US012188333B2

(12) United States Patent
Steele

(10) Patent No.: US 12,188,333 B2
(45) Date of Patent: Jan. 7, 2025

(54) SPACER WINDOW SLEEVE

(71) Applicant: Halliburton Energy Services, Inc., Houston, TX (US)

(72) Inventor: David Joe Steele, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/833,699

(22) Filed: Jun. 6, 2022

(65) Prior Publication Data

US 2022/0389802 A1 Dec. 8, 2022

Related U.S. Application Data

(60) Provisional application No. 63/197,924, filed on Jun. 7, 2021, provisional application No. 63/197,945, filed (Continued)

(51) Int. Cl.
*E21B 41/00* (2006.01)
*E21B 7/06* (2006.01)

(Continued)

(52) U.S. Cl.
CPC ..... *E21B 41/0035* (2013.01); *E21B 7/06* (2013.01); *E21B 33/12* (2013.01); *E21B 33/128* (2013.01); *E21B 34/14* (2013.01); *E21B 43/2607* (2020.05); *E21B 43/26* (2013.01); *E21B 2200/06* (2020.05)

(58) Field of Classification Search
CPC .... E21B 41/0035; E21B 33/12; E21B 33/128; E21B 34/14; E21B 43/2607; E21B 43/26; E21B 2200/06
See application file for complete search history.

(56) References Cited

U.S. PATENT DOCUMENTS 5,615,740 A * 4/1997 Comeau ..... E21B 17/00 166/380
5,730,224 A * 3/1998 Williamson ..... E21B 23/12 166/117.6

(Continued)

FOREIGN PATENT DOCUMENTS

EP 2354437 B1 2/2019
WO 2017139378 A1 8/2017

*Primary Examiner* — Steven A MacDonald

(74) *Attorney, Agent, or Firm* — Scott Richardson; Parker Justiss, P.C.

(57) ABSTRACT

Provided is a frac window system, a well system, and a method. The frac window system, in at least one aspect, includes an elongated tubular having a first end and a second end with an opening defined in a wall of the elongated tubular between the first end and the second end, the wall having an inner surface and an outer surface, wherein the opening in the wall is configured to align with a window of a first wellbore casing, and a spacer window sleeve positioned within the elongated tubular, the spacer window sleeve including a tubular having a first tubular end and a second tubular end with a second opening defined in a second wall of the tubular between the first tubular end and the second tubular end, the second wall having a second inner surface and a second outer surface, wherein the second opening in the second wall is configured to at least partially align with the opening in the wall of the elongated tubular.

25 Claims, 99 Drawing Sheets

Related U.S. Application Data on Jun. 7, 2021, provisional application No. 63/197,886, filed on Jun. 7, 2021.

(51) Int. Cl.

| | |
|---|---|
| ***E21B 33/12*** | (2006.01) |
| ***E21B 33/128*** | (2006.01) |
| ***E21B 34/14*** | (2006.01) |
| ***E21B 43/26*** | (2006.01) |

(56) References Cited

U.S. PATENT DOCUMENTS

| | | | | |
|---|---|---|---|---|
| 6,095,248 | A | 8/2000 | Freeman | |
| 6,244,340 | B1 * | 6/2001 | McGlothen | E21B 47/09 166/383 |
| 2009/0255687 | A1 * | 10/2009 | McCullough | E21B 41/0035 166/380 |
| 2009/0288817 | A1 * | 11/2009 | Parlin | E21B 41/0035 166/50 |
| 2011/0186291 | A1 * | 8/2011 | Lang | E21B 47/024 166/255.2 |
| 2018/0283140 | A1 | 10/2018 | Steele | |
| 2019/0040719 | A1 | 2/2019 | Rodriguez et al. | |

* cited by examiner

SPACER WINDOW SLEEVE

CROSS-REFERENCE TO RELATED APPLICATION

This application claims priority to U.S. Application Ser. No. 63/197,886, filed on Jun. 7, 2021, entitled "12,000-PSI MULTILATERAL FRACKING SYSTEM WITH LARGE INTERNAL DIAMETERS FOR UNCONVENTIONAL MARKET (AKA DEVICE, SYSTEM AND METHOD FOR FRACKING HIGH-PRESSURE WELLS WITHOUT A DRILLING RIG)," U.S. Application Ser. No. 63/197,945, filed on Jun. 7, 2021, entitled "MULTILATERAL WELL TOOLS THAT PASS THROUGH SMALLER RESTRICTIONS," and U.S. Application Ser. No. 63/197,924, filed on Jun. 7, 2021, entitled "SPACER WINDOW SLEEVE," all of which are commonly assigned with this application and incorporated herein by reference in their entirety.

BACKGROUND

In the production of hydrocarbons, it is common to drill one or more secondary wellbores from a first wellbore. Typically, the first and secondary wellbores, collectively referred to as a multilateral wellbore, will be drilled and/or cased using a drilling rig. Thereafter, once completed, the drilling rig will be removed, and the wellbores will produce hydrocarbons.

During any stage of the life of a wellbore, various treatment fluids may be used to stimulate the wellbore. As used herein, the term "treatment," or "treating," refers to any subterranean operation that uses a fluid in conjunction with a desired function and/or for a desired purpose. The term "treatment," or "treating," does not imply any particular action by the fluid or any particular component of the fluid.

One common stimulation operation that employs a treatment fluid is hydraulic fracturing. Hydraulic fracturing operations generally involve pumping a treatment fluid (e.g., a fracturing fluid) into a wellbore that penetrates a subterranean formation at a sufficient hydraulic pressure to create one or more cracks, or "fractures," in the subterranean formation through which hydrocarbons will flow more freely. In some cases, hydraulic fracturing can be used to enhance one or more existing fractures. "Enhancing" one or more fractures in a subterranean formation, as that term is used herein, is defined to include the extension or enlargement of one or more natural or previously created fractures in the subterranean formation. "Enhancing" may also include positioning material (e.g., proppant) in the fractures to support ("prop") them open after the hydraulic fracturing pressure has been decreased (or removed).

During the initial production life of a wellbore—often called the primary phase—primary production of hydrocarbons typically occurs either under natural pressure, or by means of pumps that are deployed within the wellbore. This may include wellbores that have undergone stimulation operations, such a hydraulic fracturing, during a completion process. Unconventional wells typically will not produce economical amounts of oil or gas unless they are stimulated via a hydraulic fracturing process to enhance and connect existing fractures. In order to reduce well costs, the hydraulic fracturing process is performed after the drilling rig has been removed from the well. Furthermore, wells may be hydraulically fractured without the aid of a workover rig if the equipment used to fracture a well is light enough to be transported in and out of the wellbore via a coiled tubing unit, wireline, electric line, or other device.

Over the life of a wellbore, the natural driving pressure may decrease to a point where the natural pressure is insufficient to drive the hydrocarbons to the surface given the natural permeability and fluid conductivity of the formation. At this point, the reservoir permeability and/or pressure must be enhanced by external means. In secondary recovery, treatment fluids are injected into the reservoir to supplement the natural permeability. Such treatment fluids may include water, natural gas, air, carbon dioxide or other gas and a proppant to hold the fractures open.

Likewise, in addition to enhancing the natural permeability of the reservoir, it is also common through tertiary recovery, to increase the mobility of the hydrocarbons themselves in order to enhance extraction, again through the use of treatment fluids. Such methods may include steam injection, surfactant injection and carbon dioxide flooding.

In both secondary and tertiary recovery, hydraulic fracturing may also be used to enhance production.

Depending on the nature of the secondary or tertiary operation, it may be necessary to redeploy a rig, often referred to as a "workover rig," to the wellbore to assist in these operations, which may require additional equipment be installed in a wellbore. For example, subjecting a producing wellbore to hydraulic fracturing pressures after it has been producing may damage certain casings, installations, or equipment already in a wellbore. Thus, it may be necessary to install additional equipment to protect the various equipment and tools already in the wellbore before proceeding with such operations. Such additional equipment is typically of sufficient size and weight that requires the use of a workover rig. As the number of secondary wellbores in a multilateral wellbore increases, the difficulty in protecting the various equipment in the first wellbore and the secondary wellbores becomes even more pronounced.

It would be desirable to provide a system that avoids the need for drilling or workover rigs in treatment fluid operations in multilateral wellbores, particularly those subject to stimulation techniques such as hydraulic fracturing.

BRIEF DESCRIPTION

Reference is now made to the following descriptions taken in conjunction with the accompanying drawings, in which.

Figure 1:
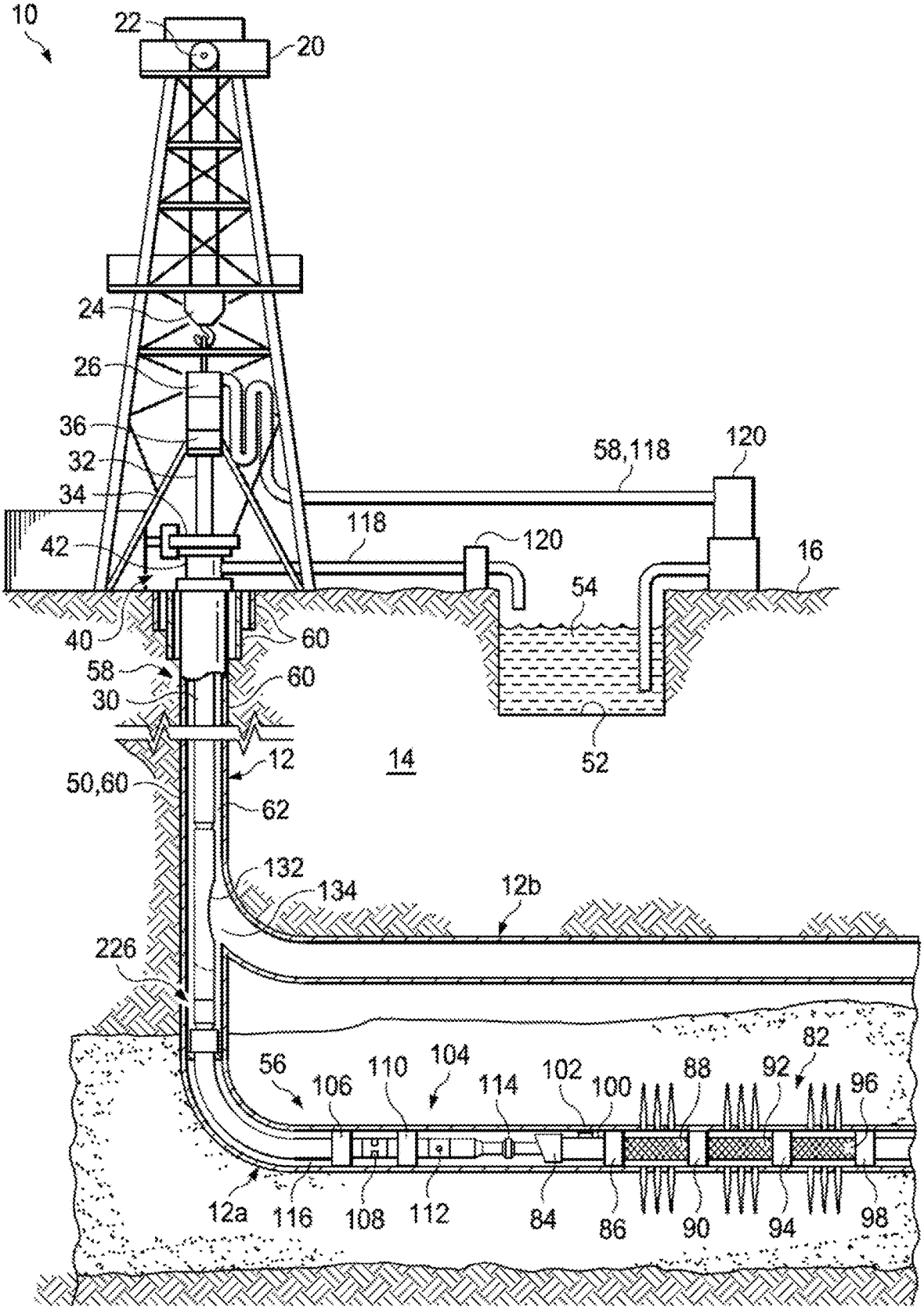
FIGS. 1 and 2 illustrate a well system designed, manufactured and/or operated according to one or more embodiments of the disclosure.

FIGS. 23 through 39 illustrate various different views of one embodiment of a well system, and use therefore, employing high-expansion seals and/or high-expansion members according to one or more aspects of the present disclosure; and FIGS. 40A through 57 illustrate various different views of one embodiment of a well system, and use therefore, employing a spacer window sleeve according to one or more aspects of the present disclosure.

DETAILED DESCRIPTION

The disclosure may repeat reference numerals and/or letters in the various examples or FIGs. This repetition is for the purpose of simplicity and clarity and does not in itself dictate a relationship between the various embodiments and/or configurations discussed. Further, spatially relative terms, such as beneath, below, lower, above, upper, uphole, downhole, upstream, downstream, and the like, may be used herein for ease of description to describe one element or feature's relationship to another element(s) or feature(s) as illustrated, the upward direction being toward the top of the corresponding FIG. and the downward direction being toward the bottom of the corresponding FIG., the uphole direction being toward the surface of the wellbore, the downhole direction being toward the toe of the wellbore. Unless otherwise stated, the spatially relative terms are intended to encompass different orientations of the apparatus in use or operation in addition to the orientation depicted in the FIGs. For example, if an apparatus in the FIGs. is turned over, elements described as being "below" or "beneath" other elements or features would then be oriented "above" the other elements or features. Thus, the exemplary term "below" can encompass both an orientation of above and below. The apparatus may be otherwise oriented (rotated 90 degrees or at other orientations) and the spatially relative descriptors used herein may likewise be interpreted accordingly.

Moreover, even though a FIG. may depict a horizontal wellbore or a vertical wellbore, unless indicated otherwise, it should be understood by those skilled in the art that the apparatus according to the present disclosure is equally well suited for use in wellbores having other orientations including vertical wellbores, deviated wellbores, multilateral wellbores, or the like. Likewise, unless otherwise noted, even though a FIG. may depict an offshore operation, it should be understood by those skilled in the art that the apparatus according to the present disclosure is equally well suited for use in onshore operations and vice-versa. Further, unless otherwise noted, even though a FIG. may depict a cased hole, it should be understood by those skilled in the art that the apparatus according to the present disclosure is equally well suited for use in open hole operations.

As used herein, "first wellbore" shall mean a wellbore from which another wellbore extends (or is desired to be drilled, as the case may be). Likewise, a "second" or "secondary" wellbore shall mean a wellbore extending from another wellbore. The first wellbore may be a primary, main or parent wellbore, in which case, the secondary wellbore is a lateral or branch wellbore. In other instances, the first wellbore may be a lateral or branch wellbore, in which case the secondary wellbore is a "twig" or a "tertiary" wellbore.

Generally, in one or more embodiments, a frac window system is provided in a multilateral wellbore with a secondary wellbore extending from a first wellbore. The frac window system includes a tubular having an opening therein that aligns with a secondary wellbore window formed in the casing string of the first wellbore. The frac window system may include annular seals along the outer surface of the tubular above and below the opening, and may further include an orientation device carried within the tubular.

In one or more embodiments, an isolation sleeve (e.g., a main bore isolation sleeve) is positioned within the frac window system to seal the opening in the frac window system and the secondary wellbore window in the first wellbore casing to isolate the secondary wellbore from high pressure fluid directed farther down the first wellbore casing.

In one or more alternative embodiments, a whipstock may seat on an orientation device so that a surface of the whipstock is aligned with the secondary wellbore window of the first wellbore casing string. In one or more embodiments, a straddle stimulation tool abuts the surface of the whipstock and extends through the frac window system opening from the first wellbore into the secondary wellbore, thereby providing the high pressure fluid to the secondary wellbore. In one or more embodiments, a plug may also be used to isolate the primary wellbore from the high pressure fluid directed to the secondary wellbore.

Figure 2:
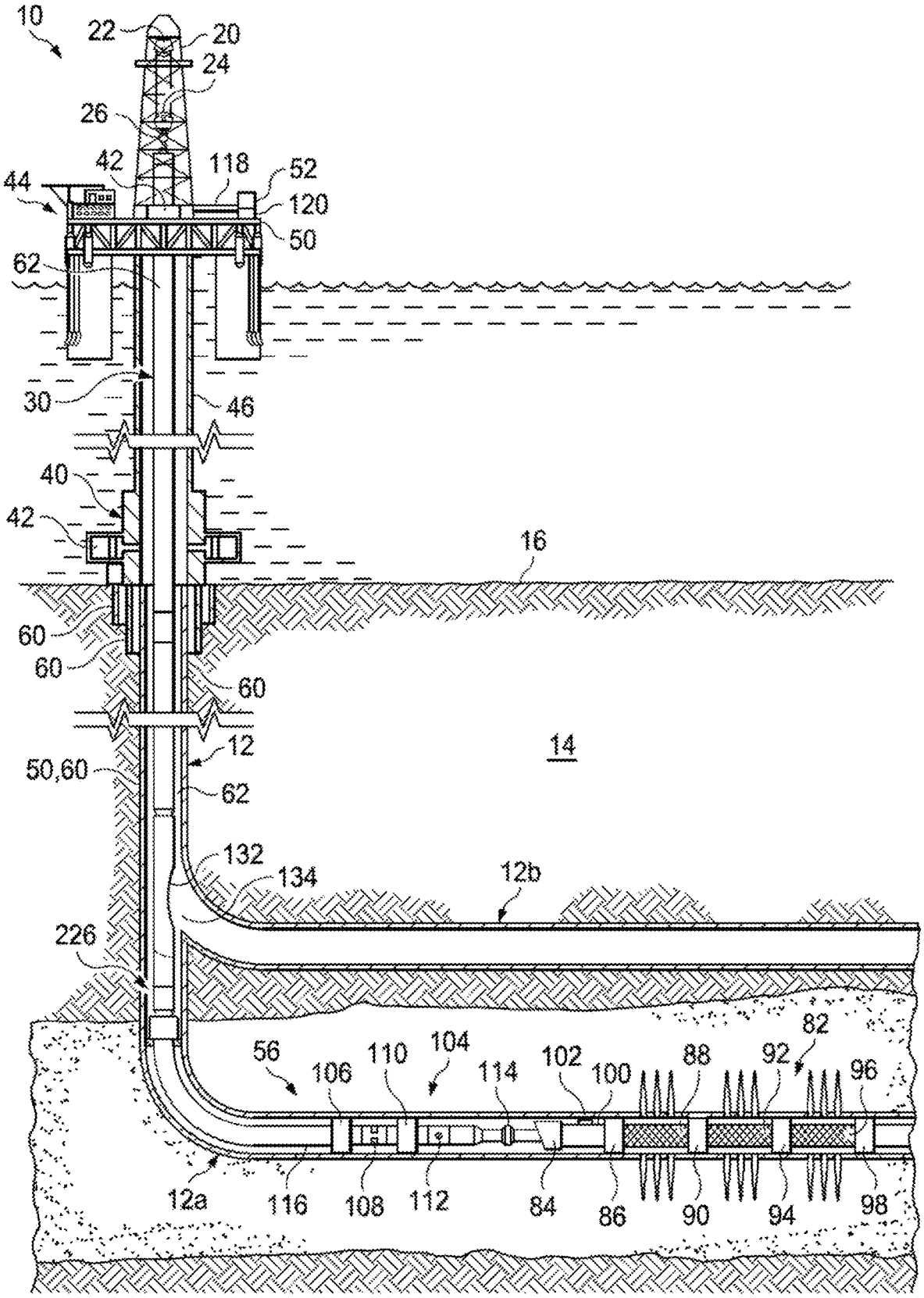

Turning to FIGS. 1 and 2, shown is an elevation view in partial cross-section of a frac window system 226 deployed in a well system 10 (land based in FIG. 1 and offshore in FIG. 2) utilized to produce hydrocarbons from wellbore 12 extending through various earth strata in a petroleum formation 14 located below the earth's surface 16. Wellbore 12 may be formed of a single first wellbore and may include one or more second or secondary wellbores 12*a*, 12*b* . . . 12*n*, extending into the formation 14, and disposed in any orientation and spacing, such as the horizontal secondary wellbores 12*a*, 12*b* illustrated.

Well system 10 includes a drilling rig or derrick 20. Drilling rig 20 may include a hoisting apparatus 22, a travel block 24, and a swivel 26 for raising and lowering a conveyance such as tubing string 30. Other types of conveyances may include tubulars such as casing, drill pipe, coiled tubing, production tubing, and other types of pipe or tubing strings. Still other types of conveyances may include wirelines, slicklines, and the like. In FIG. 1, tubing string 30 is a substantially tubular, axially extending work string formed of a plurality of drill pipe joints coupled together end-to-end, while in FIG. 2, tubing string 30 is completion tubing supporting a completion assembly as described below. Drilling rig 12 may include a kelly 32, a rotary table 34, and other equipment associated with rotation and/or translation of tubing string 30 within a wellbore 12. For some applications, drilling rig 20 may also include a top drive unit 36.

Drilling rig 20 may be located proximate to a wellhead 40 as shown in FIG. 1, or spaced apart from wellhead 40, such as in the case of an offshore arrangement as shown in FIG. 2. One or more pressure control devices 42, such as blowout preventers (BOPs) and other equipment associated with drilling or producing a wellbore may also be provided at wellhead 40 or elsewhere in the well system 10.

For offshore operations, as shown in FIG. 2, whether drilling or production, drilling rig 20 may be mounted on an oil or gas platform, such as the offshore platform 44 as illustrated, or on semi-submersibles, drill ships, and the like (not shown). Well system 10 of FIG. 2 is illustrated as being a marine-based production system. Likewise, well system 10 of FIG. 1 is illustrated as being a land-based production system. In any event, for marine-based systems, one or more subsea conduits or risers 46 extend from deck 50 of platform 44 to a subsea wellhead 40. Tubing string 30 extends down from drilling rig 20, through riser 46 and BOP 42 into wellbore 12.

A fluid source 52, such as a storage tank or vessel, may supply a working or service fluid 54 pumped to the upper end of tubing string 30 and flow through tubing string 30. Fluid source 52 may supply any fluid utilized in wellbore operations, including without limitation, drilling fluid, cementious slurry, acidizing fluid, liquid water, steam, hydraulic fracturing fluid or some other type of fluid.

Wellbore 12 may include subsurface equipment 56 disposed therein, such as, for example, the completion equipment illustrated in FIG. 1 or 2. In other embodiments, the subsurface equipment 56 may include a drill bit and bottom hole assembly (BHA), a work string with tools carried on the work string, a completion string and completion equipment or some other type of wellbore tool or equipment.

Well system 10 may generally be characterized as having a pipe system 58. For purposes of this disclosure, pipe system 58 may include casing, risers, tubing, drill strings, completion or production strings, subs, heads or any other pipes, tubes or equipment that attaches to the foregoing, such as tubing string 30 and riser 46, as well as the wellbore and laterals in which the pipes, casing and strings may be deployed. In this regard, pipe system 58 may include one or more casing strings 60 that may be cemented in wellbore 12, such as the surface, intermediate and production casing strings 60 shown in FIG. 1. An annulus 62 is formed between the walls of sets of adjacent tubular components, such as concentric casing strings 60 or the exterior of tubing string 30 and the inside wall of wellbore 12 or casing string 60, as the case may be.

As shown in FIGS. 1 and 2, where subsurface equipment 56 is illustrated as completion equipment, disposed in secondary wellbore 12*a* is a lower completion assembly 82 that includes various tools such as an orientation and alignment subassembly 84, a packer 86, a sand control screen assembly 88, a packer 90, a sand control screen assembly 92, a packer 94, a sand control screen assembly 96 and a packer 98.

Extending uphole and downhole from lower completion assembly 82 is one or more communication cables 100, such as a sensor or electric cable, that passes through packers 86, 90 and 94 and is operably associated with one or more electrical devices 102 associated with lower completion assembly 82, such as sensors positioned adjacent sand control screen assemblies 88, 92, 96 or at the sand face of formation 14, or downhole controllers or actuators used to operate downhole tools or fluid flow control devices. Cable 100 may operate as communication media, to transmit power, or data and the like between lower completion assembly 82 and an upper completion assembly 104.

In this regard, disposed in wellbore 12, the upper completion assembly 104 is coupled at the lower end of tubing string 30. The upper completion assembly 104 includes various tools such as a packer 106, an expansion joint 108, a packer 110, a fluid flow control module 112 and an anchor assembly 114.

Extending uphole from upper completion assembly 104 are one or more communication cables 116, such as a sensor cable or an electric cable, which passes through packers 106, 110 and extends to the surface 16. Cable(s) 116 may operate as communication media, to transmit power, or data and the like between a surface controller (not pictured) and the upper and lower completion assemblies 104, 82.

Fluids, cuttings, and other debris returning to surface 16 from wellbore 12 may be directed by a flow line 118 back to storage tanks, fluid source 52 and/or processing systems 120, such as shakers, centrifuges, and the like.

In each of FIGS. 1 and 2, a frac window system 226 is generally illustrated. Frac window system 226 is positioned adjacent secondary wellbore 12*b* so that an opening 132 in the frac window system 226 is aligned with the casing window 134 of casing string 60 adjacent secondary wellbore 12*b*.

Figure 3:
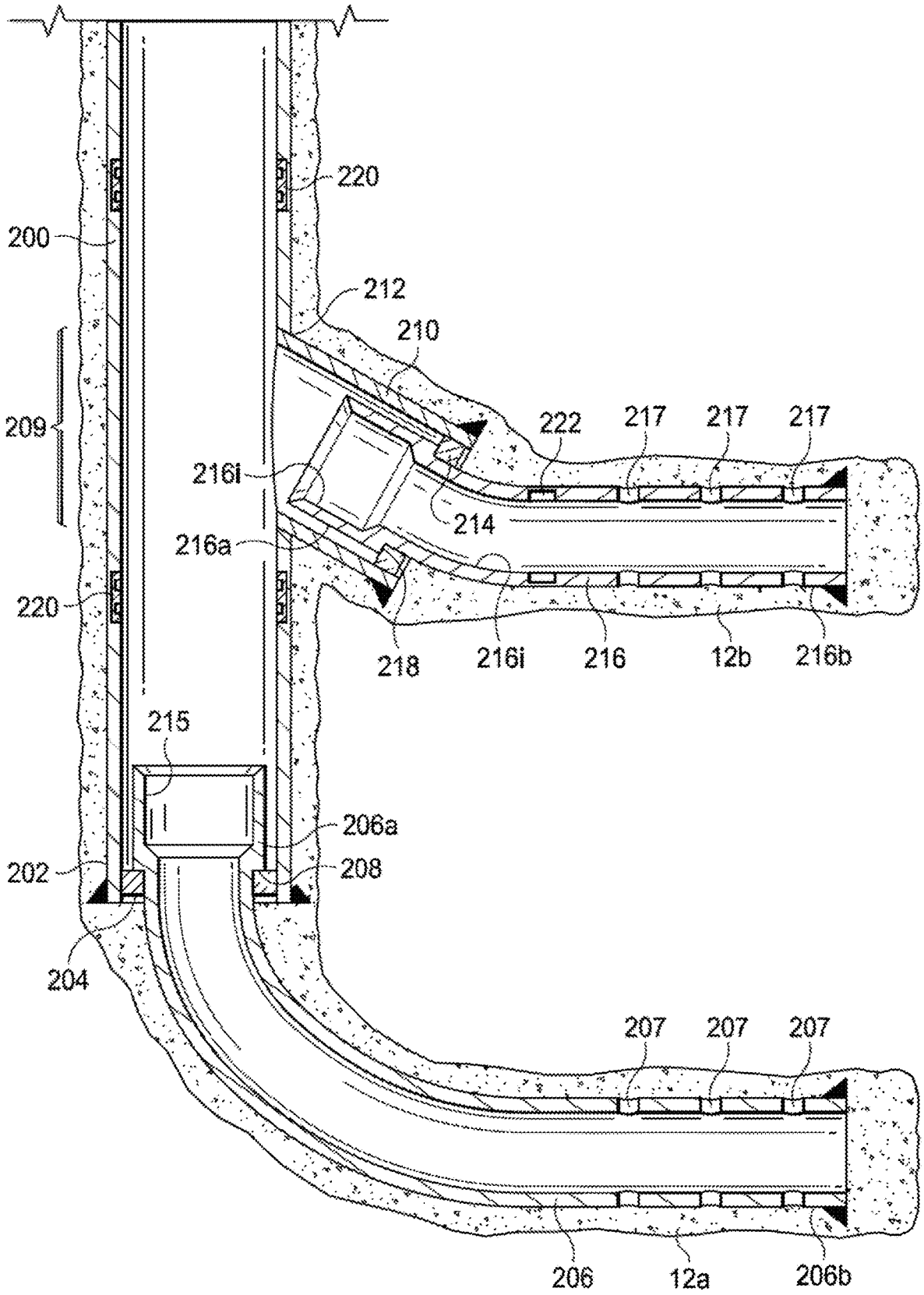
FIGS. 3 through 22 illustrate various different views of one embodiment of a well system, and use therefore, having large internal diameters according to one or more aspects of the present disclosure.

FIG. 3 is an elevation view in cross-section of the first wellbore 12 and the upper and lower secondary wellbores, 12*b* and 12*a*, respectively, illustrated as extending from first wellbore 12 in more detail. Specifically, the first wellbore 12 is illustrated as being at least partially cased with a first wellbore casing 200 cemented therein. While generally illustrated as vertical, first wellbore 12, as well as any of the wellbores described, may have any orientation. In any event, at the distal end 202 of first wellbore 12, a casing hanger 204 may be deployed from which a secondary wellbore casing 206 hangs. Secondary wellbore casing 206 has a proximal end 206*a* and a distal end 206*b*. The proximal end 206*a* may include a shoulder 208 for supporting secondary wellbore casing 206 on hanger 204. The distal end 206*b* may include perforations 207 or sliding sleeves. Secondary wellbore casing 206 is illustrated as cemented in place within wellbore 12*a*. Proximal end 206*a* may also include a polished bore receptacle (PBR) 215, which may be positioned above liner hanger 204. PBR 215 may have a larger inner diameter than the secondary wellbore casing 206. This prevents a seal 242 (see FIG. 4A) from creating a restriction smaller than the casing 206 inner diameter.

Likewise, with regard to secondary wellbore 12*b*, which is formed at a junction 209 with first wellbore 12, a transition joint 210 extends from a casing window 212 formed along the inner annulus of casing 200. Transition joint 210 may be made of steel, fiberglass, or any material capable of supporting itself under the pressure of fluids, cement, or solid objects such as rock in a downhole environment. A casing hanger 214 may be deployed from which a secondary wellbore casing 216 hangs. Secondary wellbore casing 216 has a proximal end 216*a* and a distal end 216*b* and an interior surface 216*i*. The distal end 216*b* may include perforations 217 or sliding sleeves. The proximal end 216*a* may include a shoulder 218 for supporting casing 216 on hanger 214. Secondary wellbore casing 216 is illustrated as cemented in place within wellbore 12*b*. In other embodiments (not shown) the transition joint 210 may be threaded directly to a PBR, which in turn is threaded to the secondary wellbore casing 216, and no casing hanger 214 is necessary.

Persons of ordinary skill in the art will appreciate that the illustrated first wellbore 12 and secondary wellbores 12*a*, 12*b*, and the equipment illustrated therein, are for illustrative purposes only, and are not intended to be limiting. For example, secondary wellbore casing strings 206, 216 are not limited to a particular size or manner of support, and other systems for supporting secondary wellbore casing may be utilized.

Any one or more of the casing strings or tubulars described herein may include an engagement mechanism 220 deployed along an inner surface and disposed to engage a cooperating engagement mechanism, such as engagement mechanism 246 (FIG. 4A) described below, to secure or otherwise anchor adjacent tubulars relative to one another at a desired depth and/or orientation. In one or more embodiments, engagement mechanism 220 may be latch couplings as are shown deployed along first wellbore casing 200. In one or more embodiments, an engagement mechanism 220 is positioned adjacent to window 212 at a known distance. In one or more embodiments, an engagement mechanism 220 is positioned adjacent window 212 upstream or above junction 209, while in other embodiments, the engagement mechanism is positioned adjacent window 212 downstream or below junction 209. The disclosure is not limited to a particular type of engagement mechanism 220.

Similar to engagement mechanism 220, an engagement mechanism 222 is illustrated along the interior surface 216*i* of casing 216.

Figure 4A:
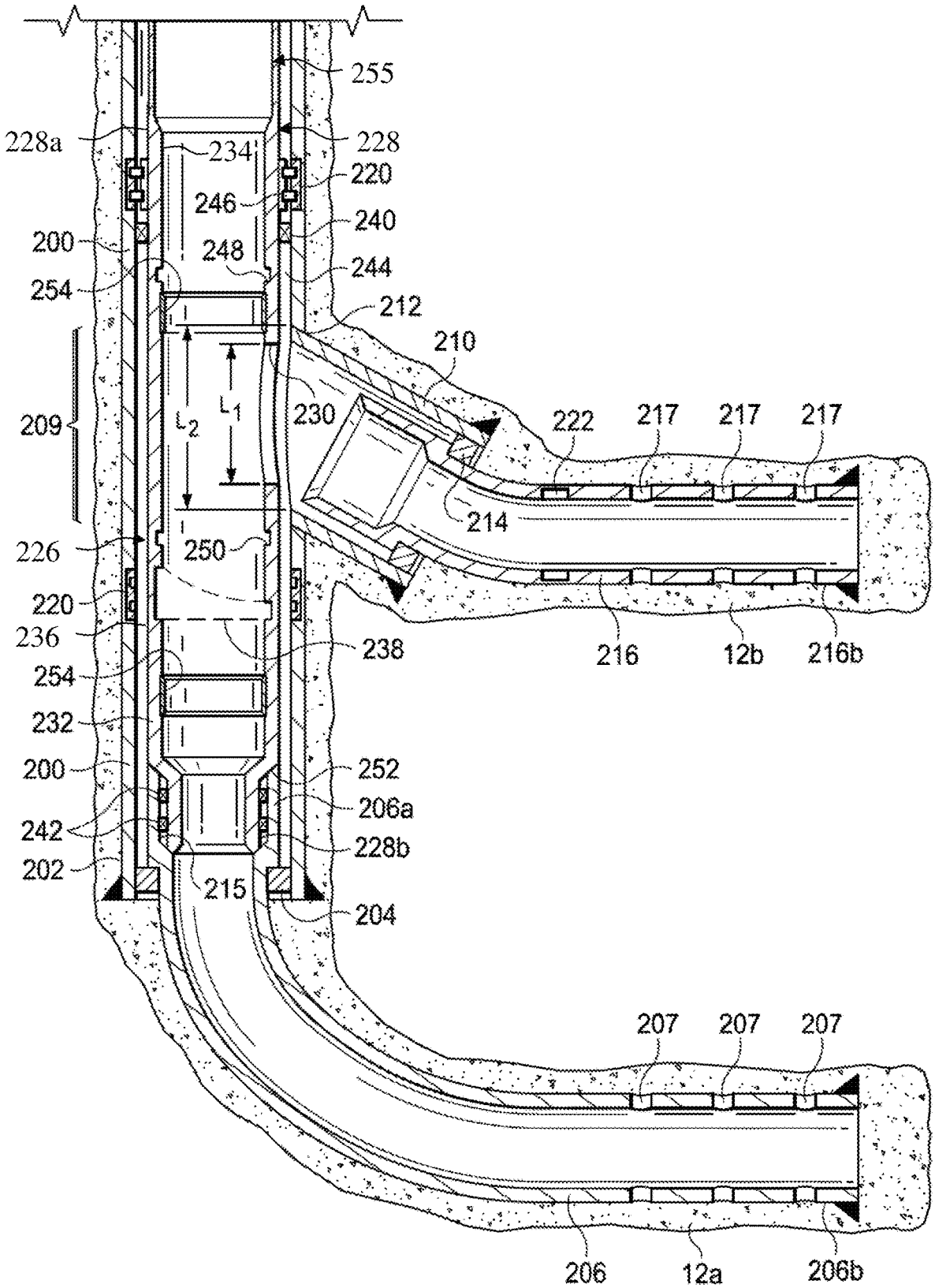

Turning to FIG. 4A, an elevation view in cross section illustrates the frac window system 226 deployed adjacent junction 209 within first wellbore casing 200. Frac window system 226 is formed of an elongated tubular 228 having a first end 228*a* and a second end 228*b* with an opening 230 defined in a wall 232 of the tubular between ends 228*a*, 228*b*. The elongated tubular 228 may extend a significant distance, and may be constructed of multiple casing, tubing, or other pipe without departing from the scope and spirit of the disclosure. Elongated tubular 228 includes an inner surface 234 and an outer surface 236.

An orientation device 238 is disposed or otherwise formed along the inner surface 234 of elongated tubular 228. In one or more embodiments, orientation device 238 is located below the opening 230, between opening the 230 and the second end 228*b* of elongated tubular 228. Although orientation device 238 may be any mechanism or device that permits rotational orientation of a tool or equipment within elongated tubular 228, in one or more embodiments, orientation device 238 may be a scoop head, a muleshoe or a ramped or angled surface. In yet another embodiment, the orientation device 238 is located above the opening 230.

Frac window system 226 further includes a first seal 240 disposed along the outer surface 236 of the elongated tubular 228. In one or more embodiments, first seal 240 is disposed along the outer surface 236 between the opening 230 and the first end 228*a* of the elongated tubular 228. Likewise, a second seal 242 is disposed along the outer surface 236 below opening 230 between opening 230 and the second end 228*b* of elongated tubular 228. First seal 240 extends between frac window 226 and casing 200 to seal the annular space 244 therebetween. Likewise, second seal 242 extends between the outer surface 236 of the elongated tubular 228 and an inner surface of the adjacent tubular, e.g., first wellbore casing 200, to seal the annular space about the second end 228*b* of elongated tubular 228. In the illustrated embodiment, second end 228*b* extends into proximal end 206*a* of secondary wellbore casing 206, and in such case, second seal 242 seals the annular space therebetween. In other embodiments, second seal 242 may be disposed along the end of 228*b* of elongated tubular 228 to seal between frac window system 226 and the first wellbore casing 200, and in particular, in some embodiments, PBR 215. In other embodiments, second seal 242 may be disposed along the inner surface 234 of the elongated tubular 228 at the second end of 228*b* to seal between frac window system 226 and a tubular (not shown) extending therein.

Seals 240, 242 as described may be any mechanism that can seal an annular space between tubulars, such as for example an expandable liner hanger system, swellable elastomer or otherwise, any type of, or combination of, elastomeric element(s) or composite elements made of man-made and/or natural materials that may be deployed to effectuate a sealing contact with both tubulars as described. A seal may include a shoulder, such as shoulder 252 formed along the outer surface 236 of elongated tubular 228. The elongated tubular 228 may include a plurality of joints of pipe spanning the distance between the shoulder 252 and smooth sealing surfaces 254 may also be provided along the inner surface 234 of the elongated tubular 228. The shoulder 252 may engage a similarly formed shoulder, such as the end of secondary wellbore casing 206, against which shoulder 252 may seat, forming a metal-to-metal seal. Although not limited to a particular configuration, the most common place shoulder 252 would engage is in the PBR 215 attached to hanger 204. This would typically be an "anchor" type of mechanism wherein shoulder 252 would have a releasable anchoring device such as a latch, a lug, a snap or similar mechanism, to attach itself to the top of the PBR 215 or to the top of hanger 204. The top of PBR 215 or the top of hanger 204 may include a receiving head, a lug-receiver, a snap locator, or other device to receive, releasably secure, and/or provide a sealing surface for shoulder 252, and/or seal 242 and/or end 228*b* of elongated tubular 228. The disclosure is not limited to a particular type of mechanism that can seal an annular space between tubulars.

In other embodiments, shoulder 252 may be disposed along the inner surface 234 of end of 228*b* of elongated tubular 228 to engage a similarly formed shoulder, such as the end of secondary wellbore casing 206.

Frac window system 226 may further include an engagement mechanism 246 along outer surface 236 and disposed for engagement with an engagement mechanism 220. In one or more embodiments, engagement mechanism 246 is a latch and engagement mechanism 220 is a latch coupling.

In one or more embodiments, engagement mechanism 246 may be an Engagement. Orientation, and Depth (EOD) device that provides depth, orientation, and an engagement into an accepting device. The engagement device of the EOD may be one that is releasable. The EOD may provide depth, orientation, and releasable engagement in concert with a device such as engagement mechanism 220 or engagement mechanism 222 or against a surface of a pipe or other device having a generally circular form and an inner and outer surface. In further embodiments, engagement mechanism 246 may be a collet. In other embodiments, engagement mechanism 246 may be a multiplicity of collets, keys, slips, latches, etc. Engagement mechanism 246 may also consist of multiple devices to provide depth, orientation and/or engagement such as collets, keys, slips, and/or latches, etc. Thus, for example, the engagement mechanism 246 in the form of an EOD may be mounted on the outer surface 236 of the elongated tubular 228 for engagement with an engagement mechanism 220, such as a latch coupling, disposed along the interior annulus of the first wellbore casing 200. In one or more embodiments, the engagement mechanism 220 of the casing 200 is above window 212, and the EOD 246 of frac window system 226 is between the opening 230 and first end 228*a* of the tubular. In one or more embodiments, the EOD 246 is between the first seal 240 and the first end 228*a* of the tubular. It will be appreciated that in one or more embodiments, engagement mechanism 246 may function to releasably engage another engagement mechanism, such as engagement mechanism 220 or 222; function as a no-go shoulder (depth lock or stop) at a desired depth; and provide an orientation lock at a desired orientation.

In any event, regardless of the particular type, in one or more embodiments, although engagement mechanism 246 may be disposed anywhere along the outer surface 236 so long as the axial position between frac window system 226 and window 212 is established, engagement mechanism 246 is disposed between the opening 230 and the first end 228*a* to engage an engagement mechanism 220 upstream of window 212, as illustrated. In one or more embodiments, the engagement mechanism 246 is between the first seal 240 and the first end 228*a* so that the engagement mechanism 246 may be isolated from pressurized fluid that may be introduced into one of the secondary wellbores 12*a*, 12*b*. In another embodiment, the latch 246 is placed below the window opening 230 (e.g., a downhole end of the window opening) and the distal end 228*b*.

As will be appreciated, when engagement mechanism 246 is a latch and engagement mechanism 220 is a latch coupling, cooperation between the two mechanism 220, 246 can be utilized to both axially and radially position frac window system 226. However, in one or more embodiments, engagement mechanism 220 need not be present. Rather, engagement mechanism 246 may be another type of device or mechanism to secure and/or position frac window system 226 in wellbore 12. In one or more embodiments, engagement mechanism 246 may be an expandable liner hanger carried on the outer surface 236 of elongated tubular 228.

Alternatively, or in addition, engagement mechanism 246 may be one or more slips that can be actuated to anchor against the first wellbore casing (or the wall of first wellbore 12 in the instance of an uncased wellbore). In one or more embodiments, engagement mechanism 246 may be one or more collets. In other embodiments, 246 may be a multiplicity of collets, keys, slips, latches, pockets, grooves, recesses, indentations, slots, splines, etc. Also, mechanism 220 may consist of multiple devices to provide depth, orientation and/or engagement such as collets, keys, slips, and/or latches, etc. The disclosure is not limited to a particular type of engagement mechanism. Alternatively, or in addition, in one or more embodiments, engagement mechanism 246 may be, or work in concert with, a mechanically, hydraulically, and/or electrically activated window finder deployed within elongated tubular 228 that will actuate and extend at least partially through opening 230 and window 212 when the opening 230 and casing window 212 are aligned. In such case, it will be appreciated, with the relative alignment achieved, another engagement mechanism, such as an expandable liner hanger or slips, may be actuated to anchor elongated tubular 228 in position.

It will be appreciated that latch 246 and latch coupling 220 permit frac window system 226 to be axially and radially oriented so that frac window system 226 is adjacent junction 209, and thus window 212, and that opening 230 is aligned with window 212 of casing 200.

Frac window system 226 may further include a first depth mechanism 248 disposed along the inner surface 234. In one or more embodiments, the first depth mechanism 248 is between the opening 230 and the first end 228*a* of elongated tubular 228. Similarly, a depth mechanism 250 may be disposed along the inner surface 234 adjacent the orientation device 238.

When deployed as described above, opening 230 of frac window system 226 is aligned with window 212 of casing 200 and the annulus about elongated tubular 228 is sealed above and below window 212. In one or more embodiments, opening 230 of frac window system 226 has a dimension L1 that is smaller than the dimension L2 of window 212.

One or more of the inner or outer surfaces of elongated tubular 228 adjacent the ends 228*a*, 228*b* may be threaded to assist in deployment of elongated tubular 228. For example, the inner surface 234 of elongated tubular 228 adjacent first end 228*a* may be threaded while the inner surface 234 adjacent second end 228*b*, as well as the outer surface 236 adjacent the two ends 228*a*, 228*b* may be smooth, the threads disposed to permit attachment of a running tool (not shown). However, in one or more embodiments, the inner and outer surfaces 234, 236 adjacent the ends 228*a*, 228*b* are all sufficiently smooth to permit an elastomeric element to seal against the surface. Thus, as used herein, "smooth" is used to refer to a surface that is not threaded. The smooth surface may have other shapes, features or contours, but is not otherwise disposed to engage the threads of another mechanism in order to join the mechanism to the surface. Other smooth sealing surfaces 254 may also be provided along the inner surface 234 of the elongated tubular 228 to ensure a desired level of sealing during operations employing frac window system 226.

The present disclosure has recognized that one of the roadblocks from fracking multilateral wells is the necessity of utilizing a drilling rig during the fracking operations. A frac window system designed, manufactured and operated according to the novel aspects of this disclosure, such as the frac window system 226, allows the drilling rig to be moved off of the well and coiled tubing to be utilized for substantially all (or all) frac operations. For example, a frac window system designed, manufactured and/or operated according to the novel aspects of this disclosure allows high rate, high-pressure through workstring/production tubing. For example, a frac window system designed, manufactured and/or operated according to the novel aspects of this disclosure may be capable of withstanding the high-pressures and stresses of stimulating at pressures of at least 5,000-psi, at least 10,000-psi, at least 12,500-psi and/or at least 15,000-psi. In some highly specialized situations, it may be desirable to be able to withstand pressures of 30,000-psi or more. For example, fracking of >80 BPM at 12,500-psi is achievable.

In some embodiments, it may be desirable to use wireline tools to perforate a portion of a wellbore (e.g., 207 in liner 206 in wellbore 12*a* and/or 217 in 216 in wellbore 12*b*). As a rule of thumb, wireline tools (electric line, slick line, braided line, cable line, sand line, etc.) cannot move downhole solely due to gravity in wellbores with an inclination of greater than 65-degrees. For that reason, devices may be attached to the wireline so the wireline can be pumped downhole—fluid pressure is applied at the surface to pump the device and wireline downhole.

Accordingly, a frac window system designed, manufactured and/or operated according to the novel aspects of this disclosure may be manufactured of certain materials, and may have certain sidewall thicknesses and inside diameters, which would allow it to withstand the foregoing high-pressures. For example, wherein traditional frac window systems might comprise lower cost low alloy steels (e.g., L-80 material, K-55 material, etc.) that are only rated up to 5,000-psi, a frac window system according to the present disclosure would comprise high-strength materials that are greater than 5,000-psi rated, if not greater than 10,000-psi rated, if not greater than 12,500-psi rated, if not greater than 15,000-psi rated, or even up to 30,000-psi rated. In at least one embodiment, a frac window system according to the disclosure includes materials having a minimum yield strength of at least 110-ksi, if not at least 125-ksi, if not at least 140-ksi, among others. For example, a Q125 steel could be used for at least a portion of the frac window system and remain within the scope of the disclosure.

Additionally, a frac window system designed, manufactured and/or operated according to the novel aspects of the disclosure could include an enlarged upper polished bore receptacle (PBR). The enlarged PBR, in at least one embodiment, would have an inside diameter ($ID_1$) sufficient to engage with a high-pressure frac string. The term "high-pressure frac string", as used herein and unless otherwise required, is defined as a frac string capable of providing frac pressures of at least 5,000-psi (e.g., 340 atm). In at least one other embodiment, the enlarged PBR would have an inside diameter ($ID_1$) sufficient to engage with a high-pressure frac string. The term "extremely high-pressure frac string", as used herein and unless otherwise required, is defined as a frac string capable of providing frac pressures of at least 10,000-psi (e.g., 680 atm). In yet at least one other embodiment, the enlarged PBR would have an inside diameter ($ID_1$) sufficient to engage with an extremely high-pressure frac string. The term "super high-pressure frac string", as used herein and unless otherwise required, is defined as a frac string capable of providing frac pressures of at least 12,500-psi (e.g., 851 atm). In yet at least one other embodiment, the enlarged PBR would have an inside diameter ($ID_1$) sufficient to engage with a super high-pressure frac string. Nevertheless, in even yet other embodiments, the enlarged PBR, in at least one embodiment, would have an inside diameter ($ID_1$)

sufficient to engage with a frac string capable of providing frac pressures of at least 15,000-psi (e.g., 1021 atm), if not at least 30,000-psi (e.g., 2041 atm). While the present disclosure is discussed mainly with regard to a high-pressure frac string, other embodiments wherein extremely high-pressure and super high-pressure frac strings are used are within the scope of the disclosure. In at least one embodiment, the enlarged PBR has an inside diameter ($ID_1$) of at least 5" (e.g., 12.7 cm), if not at least 5.5" (e.g., 13.97 cm), if not at least 6" (e.g., 15.24 cm), if not at least 6.5" (e.g., 16.51 cm), if not at least 7" (e.g., 17.78 cm), or more. In at least one embodiment, the enlarged PBR includes an outside diameter ($OD_1$) of at least 8.2" (e.g., 20.83 cm) and an inside diameter ($ID_1$) of at least 7.1" (e.g., 18.03 cm). Furthermore, such an enlarged PBR could include at least 110-ksi grade material, if not at least 125-ksi grade material capable of handling an internal yield pressure of at least 14,850-psi (e.g., 1010 atm) (1.25 S.F. at 200 deg. F.).

The enlarged PBR, accordingly, would allow a larger high-pressure frac string to engage therewith and deploy larger wellbore features within an existing multilateral wellbore. For example, the enlarged PBR has the ability to pass large frac plugs through the system during frac operations (e.g., at least 5.5" (e.g., 12.7 cm) frac plugs in 9⅝" (e.g., 25.45 cm) well), and has the ability to frac more than one lateral (wellbore) sequentially with minimal trips (and no drilling rig). The enlarged PBR also has the ability to pass plugs therethrough (e.g., plug 274 of FIG. 6A), whipstocks therethrough (e.g., whipstock 276 of FIG. 7), straddle stimulation tools therethrough (e.g., straddle stimulation tool 285 of FIG. 8), lateral bore frac plugs therethrough (e.g., frac plugs 910 of FIG. 9A), main bore isolation sleeve therethrough (e.g., main bore isolation sleeve 1560 of FIG. 15A), main bore frac plugs therethrough (e.g., frac plugs 1610 of FIG. 16), etc.

A frac window system designed, manufactured and/or operated according to the novel aspects of the disclosure could be left in the well as completion equipment or the equipment may be utilized as a service tool. In those situations wherein the novel frac window system is employed as a service tool, the novel frac window system could be re-dressed (e.g., replace seals) and used multiple times. If the novel frac window system is made of high-strength, e.g., CRA material, it will be more erosion-resistant and capable of being used on perhaps as many as 50 jobs with the only cost being to replace seals and the most highly erodible pieces (e.g., seal nipples, the tubing used in the Lateral Isolation Sleeve, etc.).

Given the foregoing, the frac window system 226 of FIG. 4A may include, in at least one embodiment, an enlarged PBR 255. Again, the enlarged PBR may have a sufficient inside diameter ($ID_1$) to engage with a high-pressure frac string. Furthermore, the enlarged PBR 255 may have a sufficient inside diameter ($ID_1$) to pass the larger wellbore features discussed in the paragraphs above. Thus, in at least one embodiment, the enlarged PBR has an inside diameter ($ID_1$) of at least 5" (e.g., 12.7 cm), if not at least 5.5" (e.g., 13.97 cm), if not at least 6" (e.g., 15.24 cm), if not at least 6.5" (e.g., 16.51 cm), if not at least 7" (e.g., 17.78 cm), or more. In at least one embodiment, the enlarged PBR includes an outside diameter ($OD_1$) of at least 8.2" (e.g., 20.83 cm) and an inside diameter ($ID_1$) of at least 7.1" (e.g., 18.03 cm).

Figure 4B:
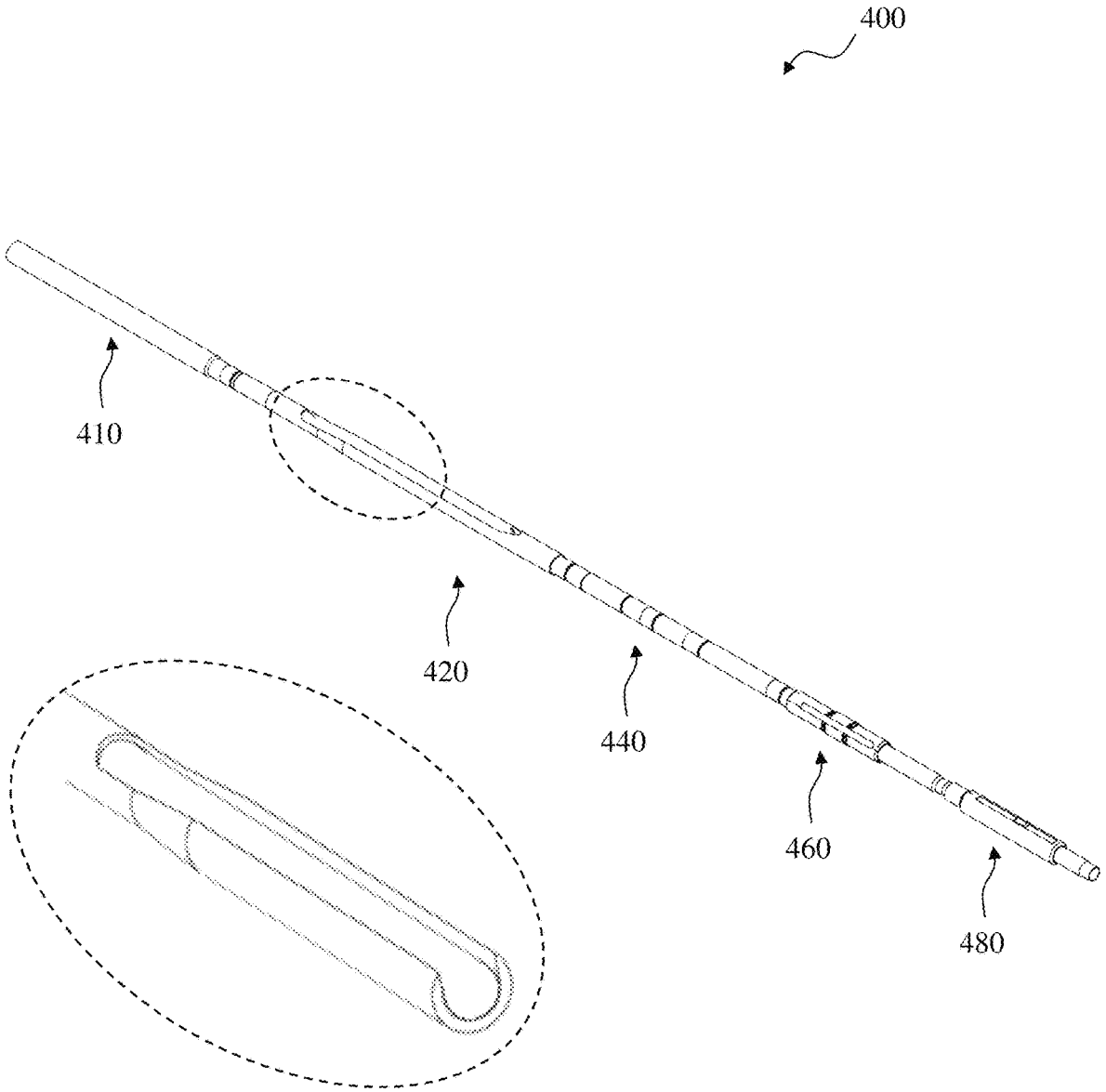
Figure 4C:
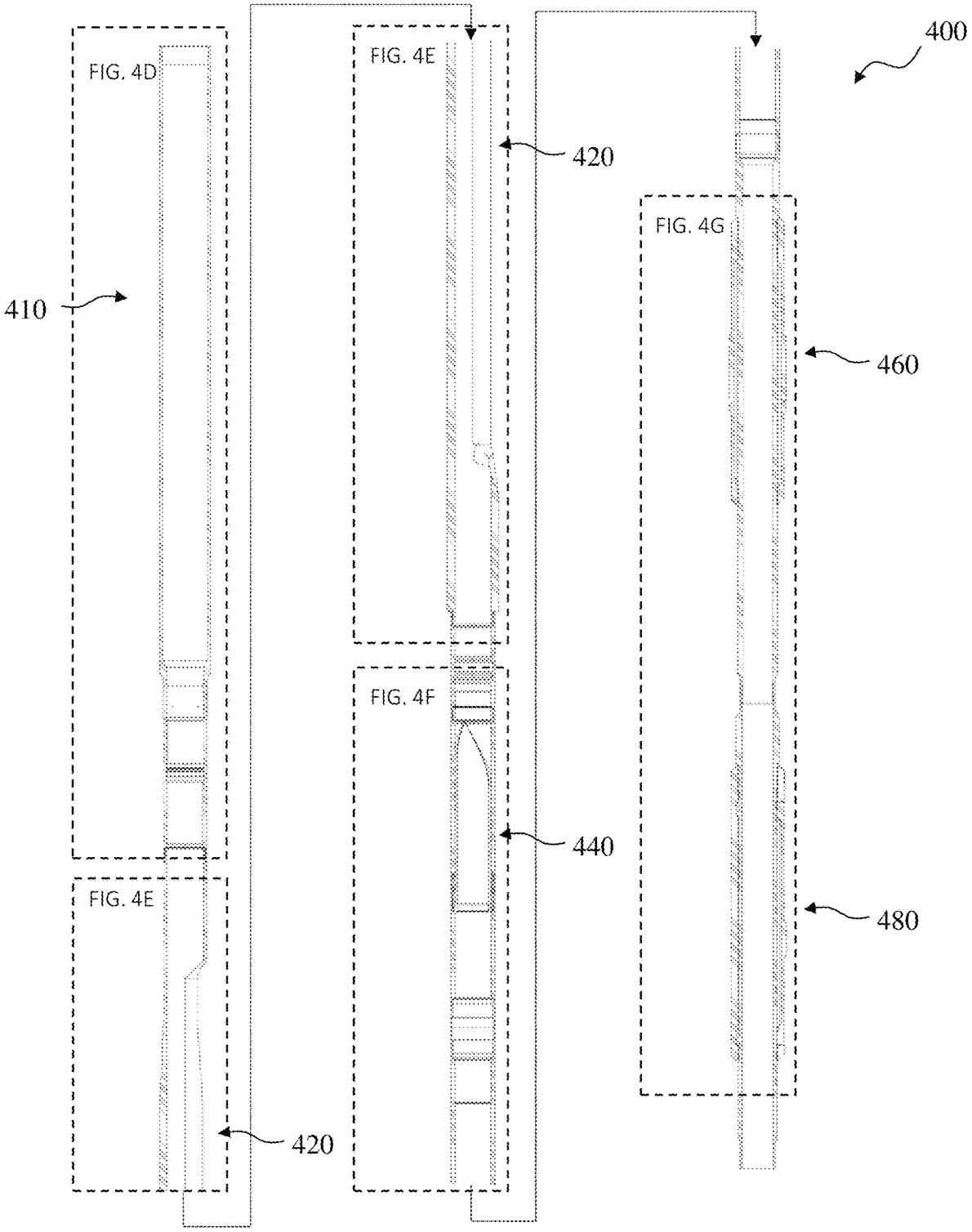

Turning to FIGS. 4B and 4C, illustrated is an isometric view and a cross-sectional view, respectively, of an alternative embodiment of a frac window system 400, as might be used within a well system, such as the well system of FIGS. 1 and 2. The frac window system 400, in at least one embodiment, is similar to the frac window system 226 illustrated in FIG. 4A. The frac window system 400, in the illustrated embodiment, includes an enlarged PBR 410 (e.g., as might be used to seal/engage a larger diameter of a high-pressure frac string), a window exit 420 (e.g., as might be used to access a lateral wellbore), an inner orientation device 440 (e.g., muleshoe), an axial orientation device 460, and a rotational orientation device 480.

Figure 4D:
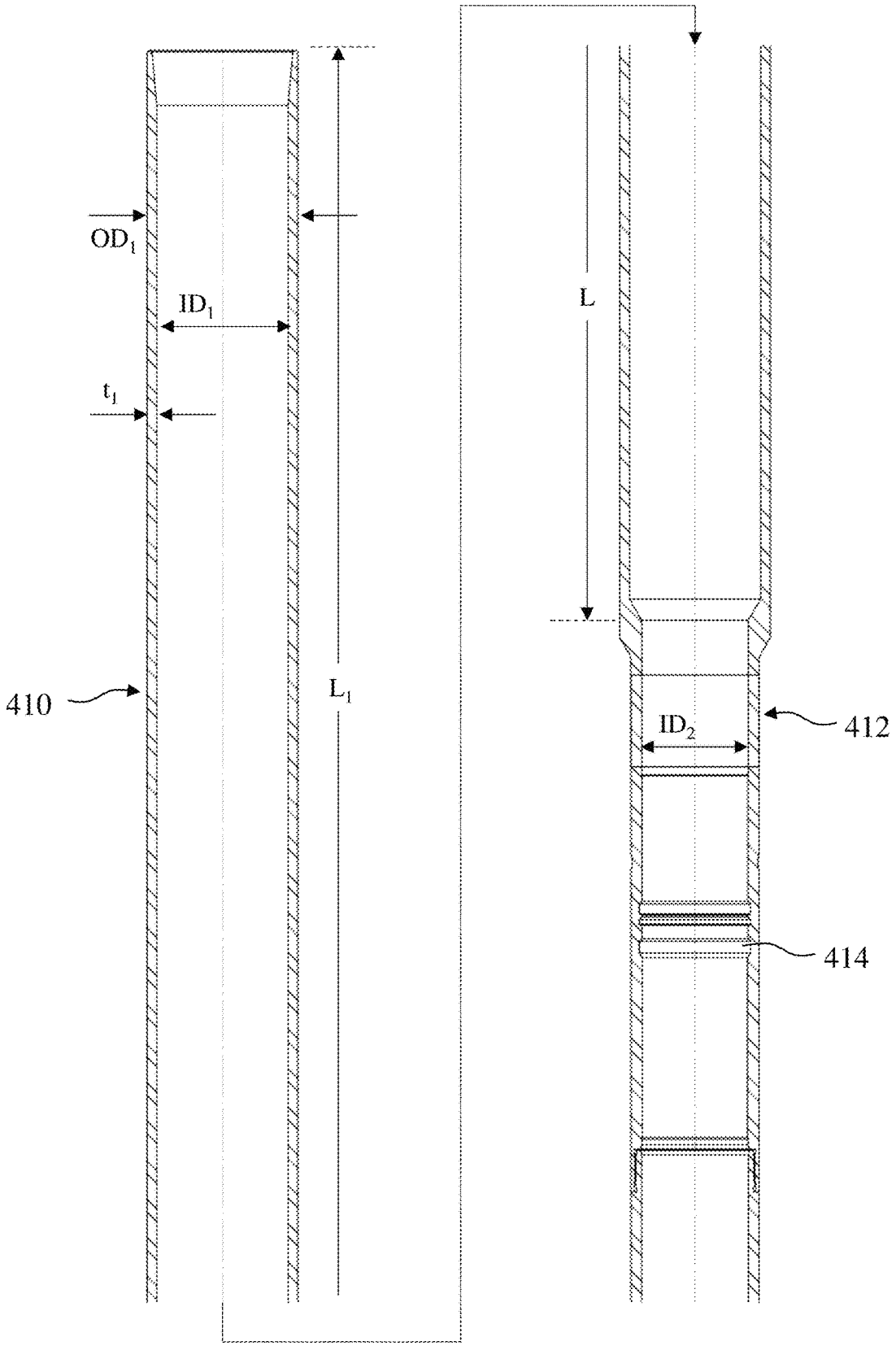

Turning to FIG. 4D, illustrated is an enlarged cross-sectional view of the PBR 410 of FIGS. 4B and 4C. In the illustrated embodiment of FIG. 4D, the PBR 410 includes an inside diameter ($ID_1$) and an outside diameter ($OD_1$). The inside diameter ($ID_1$), in at least one embodiment, is at least 5" (e.g., 12.7 cm), if not at least 5.5" (e.g., 13.97 cm), if not at least 6" (e.g., 15.24 cm), if not at least 6.5" (e.g., 16.51 cm), if not at least 7" (e.g., 17.78 cm), or more. Again, the inside diameter ($ID_1$) may be based upon the outside diameter ($OD_5$) of a high-pressure frac string that the PBR 410 is configured to engage with. In at least one embodiment, the PBR 410 includes an outside diameter ($OD_1$) of at least 8.2" (e.g., 20.83 cm) and an inside diameter ($ID_1$) of at least 7.1" (e.g., 18.03 cm), and furthermore comprises at least 125-ksi grade material that can accommodate an internal yield pressure of at least 14,850-psi (e.g., 1010 atm).

In yet another embodiment, the PBR 410 has a wall thickness ($t_1$) and a length ($L_1$). In at least one embodiment, the wall thickness ($t_1$) is at least 0.2" (e.g., 0.51 cm), if not at least 0.5" (e.g., 1.27 cm), if not at least 3" (e.g., 7.62 cm). In at least one embodiment, the wall thickness ($t_1$) ranges from 0.3" (e.g., 0.76 cm) to 0.7" (e.g., 1.78 cm). In at least one embodiment, the length ($L_1$) is at least 6" (e.g., 15.24 cm), if not at least 48" (e.g., 122 cm), if not at least 360" (e.g., 914 cm). In at least one embodiment, the length ($L_1$) ranges from 36" (e.g., 91.4 cm) to 120" (e.g., 305 cm).

Further illustrated in FIG. 4D is an upper window nipple 412, which would attach to the PBR 410. The upper window nipple 412, in at least one embodiment, might comprise at least 110-ksi CRA grade material that can accommodate an internal yield pressure of at least 12,500-psi (e.g., 851 atm). Furthermore, the upper window nipple 412 might have an inside diameter ($ID_2$) of at least 5" (e.g., 12.7 cm), if not at least 5.7" (e.g., 14.48 cm). The upper window nipple 412, in the illustrated embodiment, includes one or more profiles 414 for engaging with an isolation sleeve (not shown).

Figure 4E:
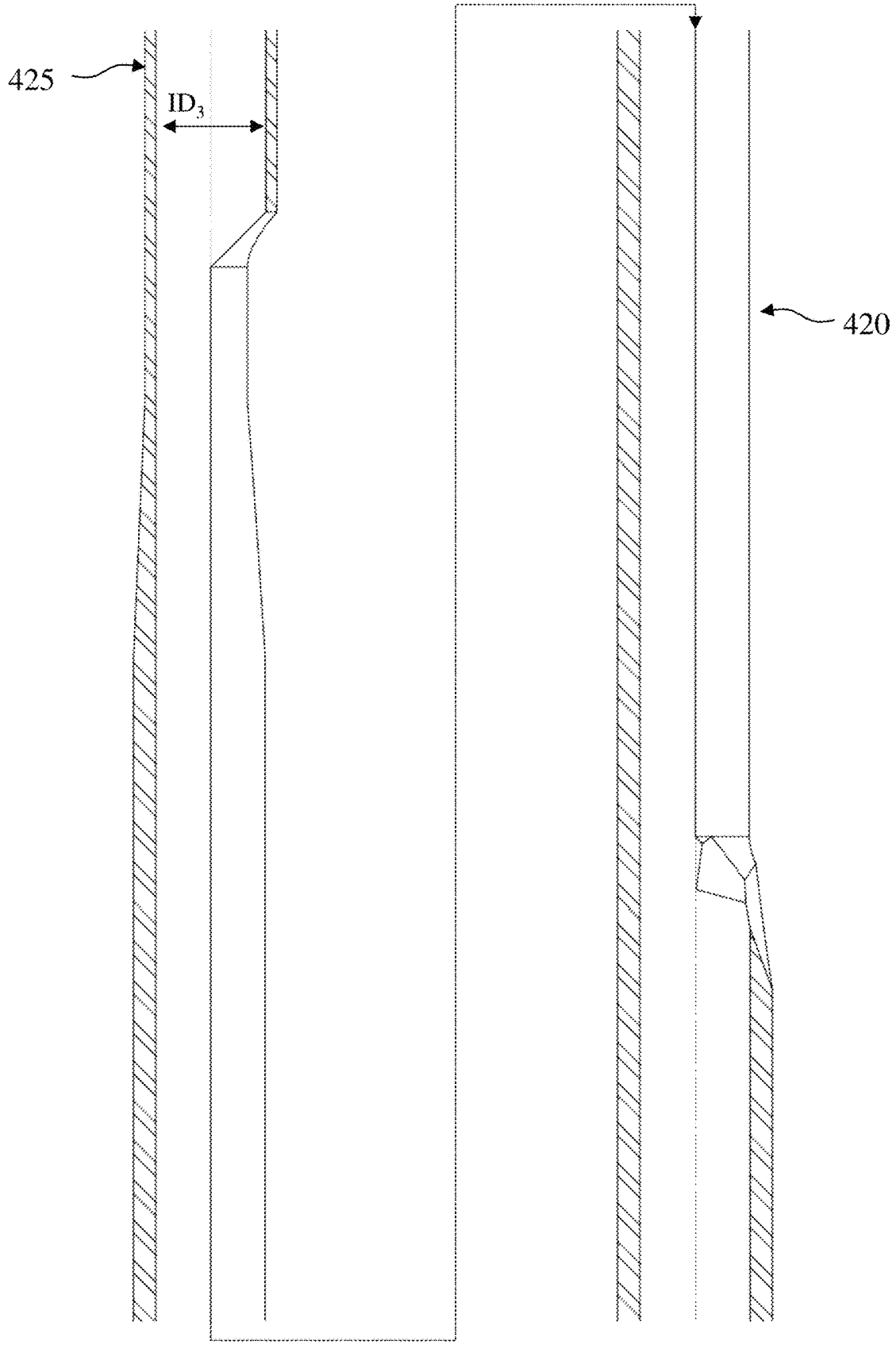

Turning to FIG. 4E, illustrated is an enlarged cross-sectional view of the window exit 420. The window exit 420, in at least one embodiment, might comprise at least 110-ksi CRA grade material that can accommodate an internal yield pressure of at least 12,500-psi (e.g., 851 atm). Furthermore, the window exit might have an inside diameter ($ID_3$) of at least 5" (e.g., 12.7 cm), if not at least 5.7" (e.g., 14.48 cm).

Figure 4F:
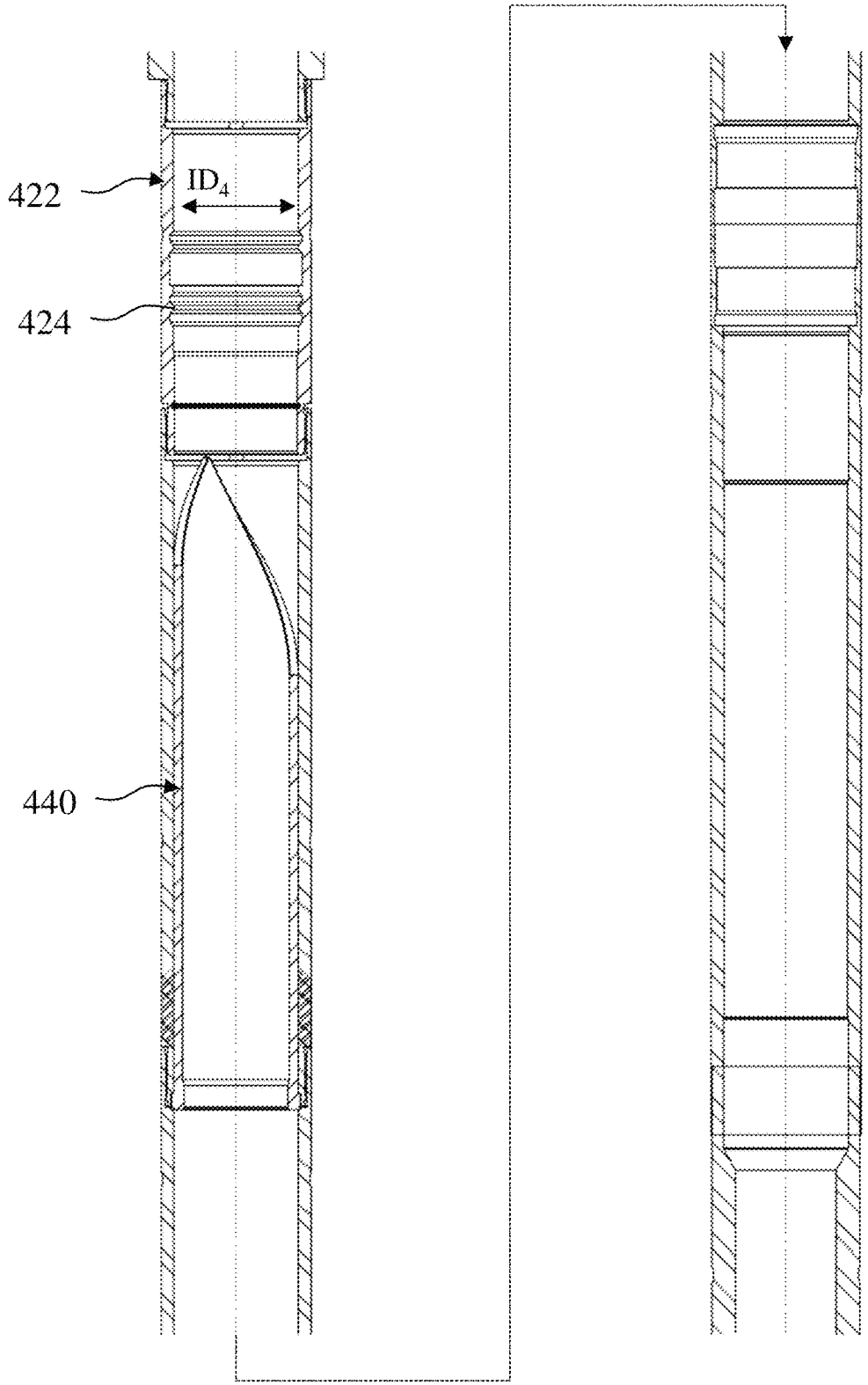

Turning to FIG. 4F, illustrated is an enlarged cross-sectional view of a lower portion of the window exit 420, including a lower window nipple 422. The lower window nipple 422, in at least one embodiment, might comprise at least 110-ksi CRA grade material that can accommodate an internal yield pressure of at least 12,500-psi (e.g., 851 atm). Furthermore, the lower window nipple 422 might have an inside diameter ($ID_4$) of at least 5" (e.g., 12.7 cm), if not at least 5.7" (e.g., 14.48 cm). The lower window nipple 422, in the illustrated embodiment, may additionally include one or more profiles 424 for engaging with an isolation sleeve (not shown). FIG. 4F additionally illustrates an inner orientation device 440 (e.g., muleshoe).

Figure 4G:
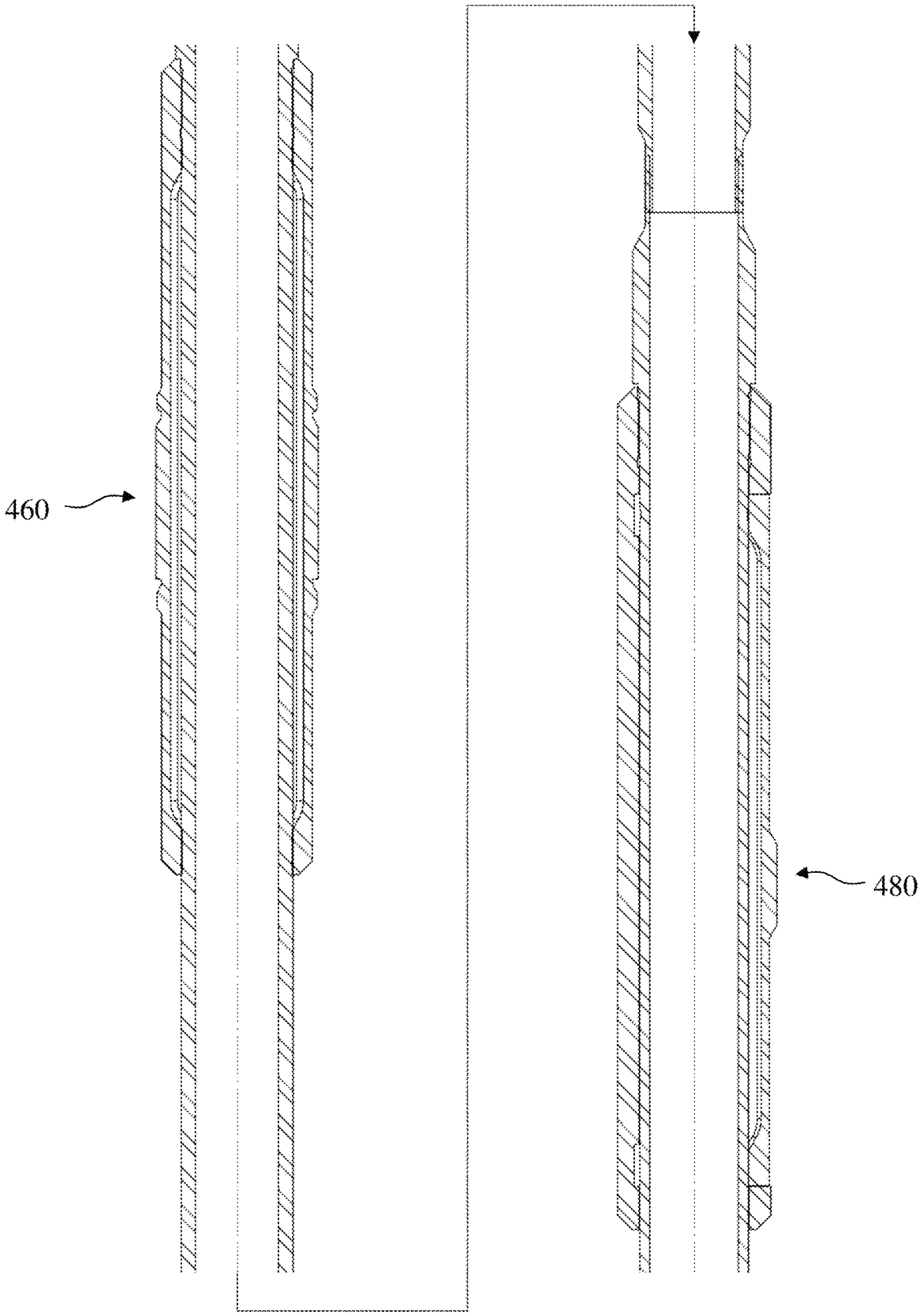

Turning to FIG. 4G, illustrated are the axial orientation device 460 and the rotational orientation device 480. As those skilled in the art appreciate, the axial orientation device 460 and the rotational orientation device 480 may engage with wellbore casing to position the frac window system 400 at the appropriate location within the wellbore.

Figure 5:
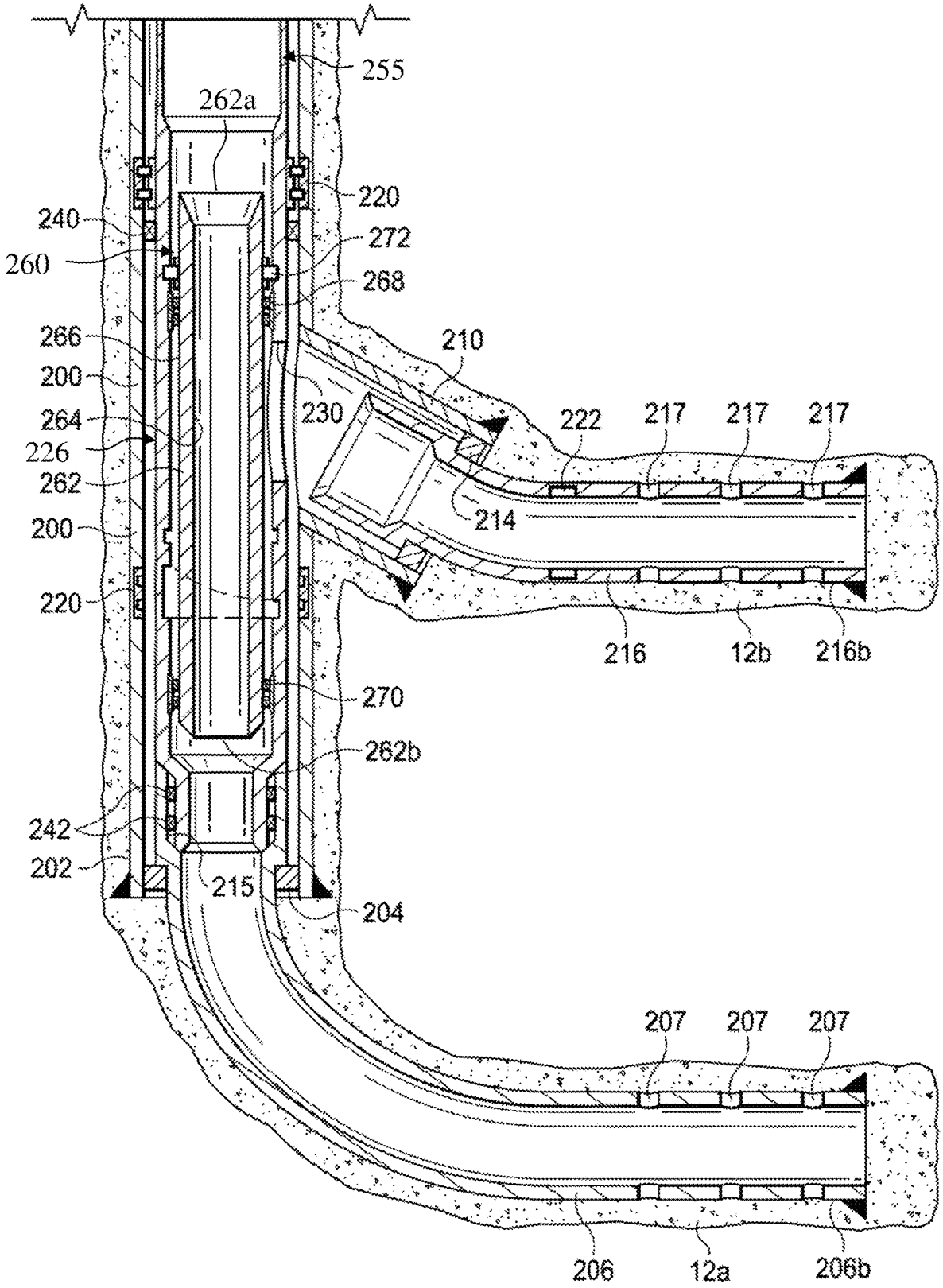

Turning to FIG. 5, the frac window system 226 is illustrated with a main bore isolation sleeve 260 deployed therein. For example, in certain embodiments the frac window system 226 is run in hole with the main bore isolation sleeve 260 disposed therein. Main bore isolation sleeve 260 is formed of a tubular sleeve 262 having a first end 262*a* and a second end 262*b*. Tubular sleeve 262 has an inner surface 264 and an outer surface 266.

Disposed along the outer surface 266 of tubular sleeve 262 are a first sleeve seal 268 and a second sleeve seal 270. First and second sleeve seals 268, 270 are spaced apart, as described below, to seal above and below opening 230 when main bore isolation sleeve 260 is deployed within frac window system 226.

Also disposed along the outer surface 266 of tubular sleeve 262 is a depth mechanism 272. In one or more embodiments, depth mechanism 272 is positioned between the first sleeve seal 268 and the first end 262*a*. Depth mechanism 272 is disposed to engage a depth mechanism disposed along the inner surface 234 of elongated tubular 228 of frac window system 226. In the illustrated embodiment, sleeve depth mechanism 272 engages first depth mechanism 248 of frac window system 226. When depth mechanism 272 is so engaged, the first end 262*a* of tubular sleeve 262 is above the opening 230 in the elongated tubular 228 and the second end 262*b* of tubular sleeve 262 is below the opening 230 in the elongated tubular 228 of frac window system 226. Moreover, when depth mechanism 272 is so engaged, the first sleeve seal 268 of tubular sleeve 262 is above the opening 230 in the elongated tubular 228 and the second sleeve seal 270 of tubular sleeve 262 is below the opening 230 in the elongated tubular 228 of frac window system 226, such that secondary wellbore 12*b* is isolated from first wellbore 12. In other words, fluid communication between secondary wellbore 12*b* and first wellbore 12 is blocked by main bore isolation sleeve 260, allowing various operations, such as high-pressure pumping, in the first wellbore 12 or secondary wellbore 12*a* to occur without impacting secondary wellbore 12*b*.

Figure 6A:
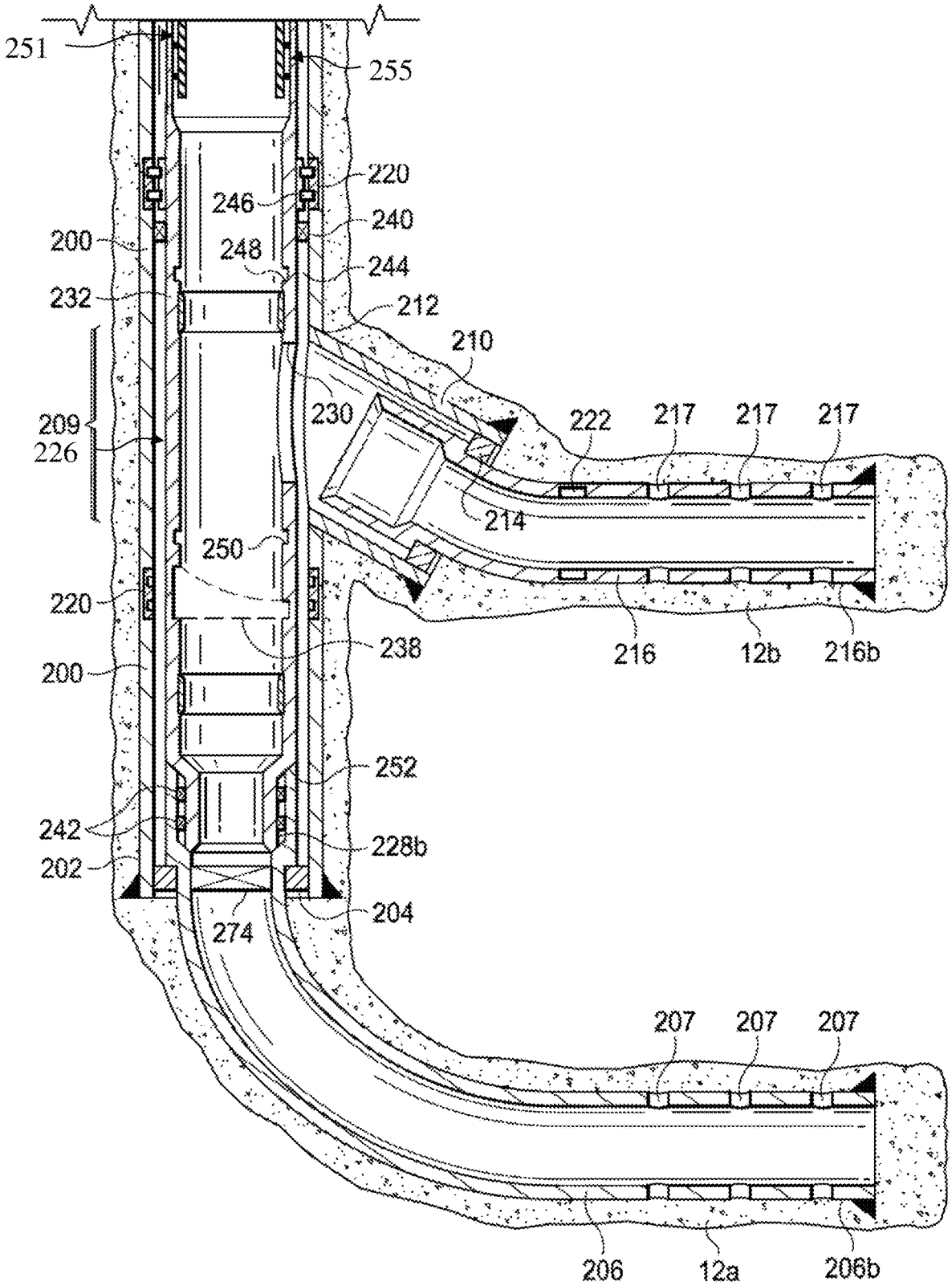

In FIG. 6A, a high-pressure frac string 251 is shown as disposed within the wellbore 12. While a high-pressure frac string is illustrated, in other embodiments an extremely high-pressure frac string or super high-pressure frac string may be used. In the illustrated embodiment, the high-pressure frac string 251 is positioned within the PBR 255. In at least one embodiment, the high-pressure frac string 251 includes an outside diameter ($OD_5$) and an inside diameter ($ID_5$). (See, FIG. 6B) The outside diameter ($OD_5$), in at least one embodiment, is at least 5" (e.g., 12.7 cm), if not at least 5.5" (e.g., 13.97 cm), if not at least 6" (e.g., 15.24 cm), if not at least 6.5" (e.g., 16.51 cm), if not at least 7" (e.g., 17.78 cm), or more. Again, the outside diameter ($OD_5$) may be based upon the inside diameter ($ID_1$) of the PRB 255 it is configured to engage with. In at least one embodiment, the high-pressure frac string 251 includes an inside diameter ($ID_5$) of at least 4.5" (e.g., 11.43 cm), if not at least 5" (e.g., 12.7 cm), if not at least 5.5" (e.g., 13.97 cm), if not at least 6" (e.g., 15.24 cm), if not at least 6.5" (e.g., 16.51 cm), or more. In yet another embodiment, the high-pressure frac string 251 has a wall thickness ($t_5$). In at least one embodiment, the wall thickness ($t_5$) of the high-pressure frac string 251 is at least 0.2" (e.g., 0.51 cm), if not at least 0.54" (e.g., 1.37 cm), if not at least 2.1" (e.g., 5.33 cm). In at least one embodiment, the wall thickness ($t_5$) of the high-pressure frac string 251 ranges from 0.5" (e.g., 1.27 cm) to 0.75" (e.g., 1.91 cm).

The frac window system 226 is illustrated with a plug 274 deployed in the lower secondary wellbore 12*a*. Much in the same way that main bore isolation sleeve 260 is utilized to isolate secondary wellbore 12*b*, the plug 274 may be deployed to isolate secondary wellbore 12*a* from pumping operations relating to secondary wellbore 12*b*. Plug 274 may be set at any time. In some embodiments, plug 274 is set before running in frac window system 226, while in other embodiments, plug 274 may be set on the same run-in trip as frac window system 226, while in other embodiments, plug 274 may be run in and set after frac window system 226 is in place, for example through the high-pressure frac string 251. Nevertheless, in at least one embodiment the plug 274 may be positioned within frac window system 226, preferably at a location adjacent end 228*b* or may be positioned in casing 206 of secondary wellbore 12*a* or within PBR 215 (FIG. 5) if present.

Figure 6B:
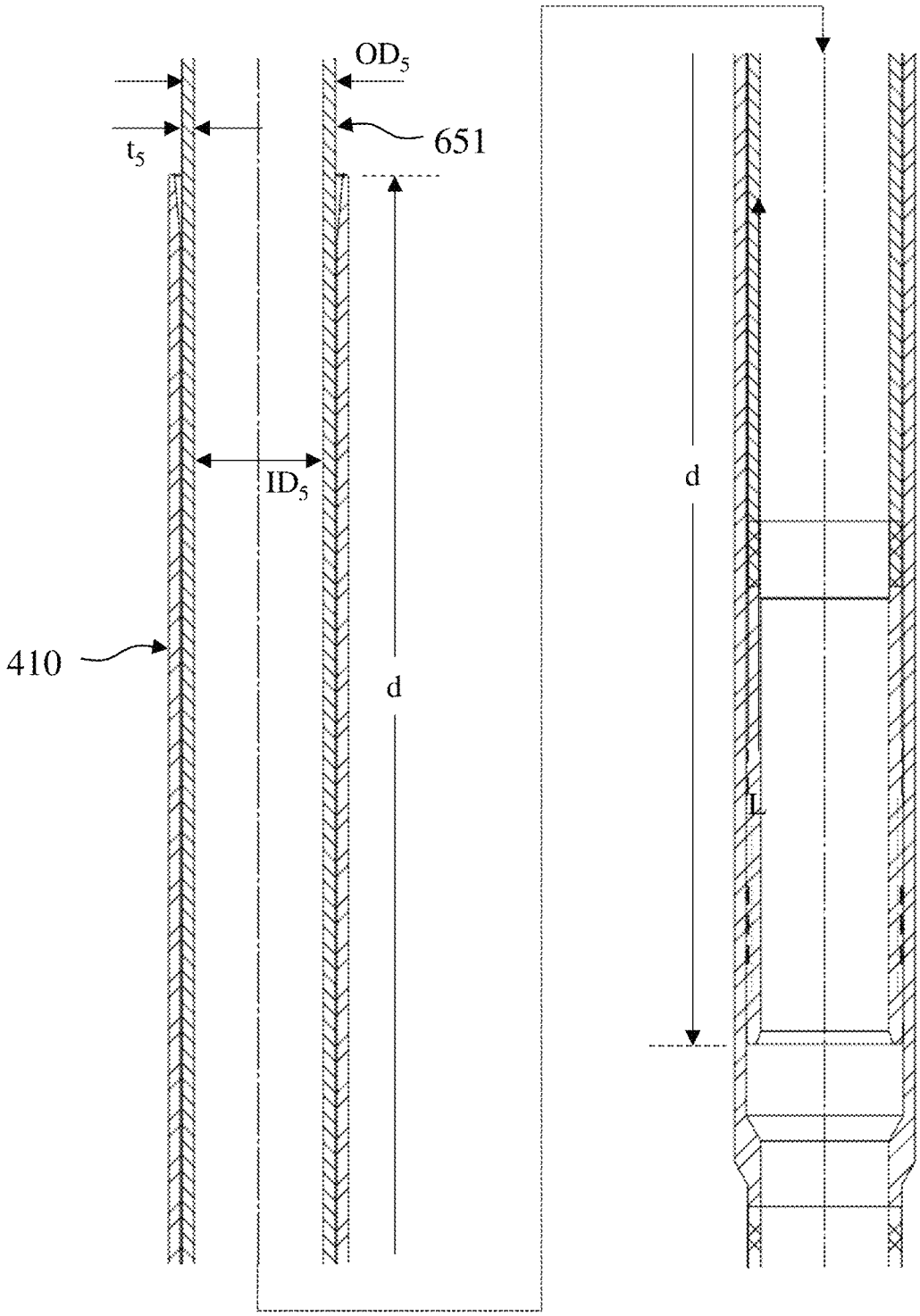

FIG. 6B illustrates a zoomed in view of the PBR 410 of FIGS. 4A through 4D, with a high-pressure frac string 651 disposed therein. In at least one embodiment, the high-pressure frac string 651 extends within the PBR 410 by a distance (d). The distance (d) may vary greatly and remain within the scope of the disclosure, but in at least one embodiment the distance (d) is at least 3" (e.g., 7.62 cm), if not at least 120" (e.g., 305 cm), if not at least 360" (e.g., 914 cm).

Figure 7:
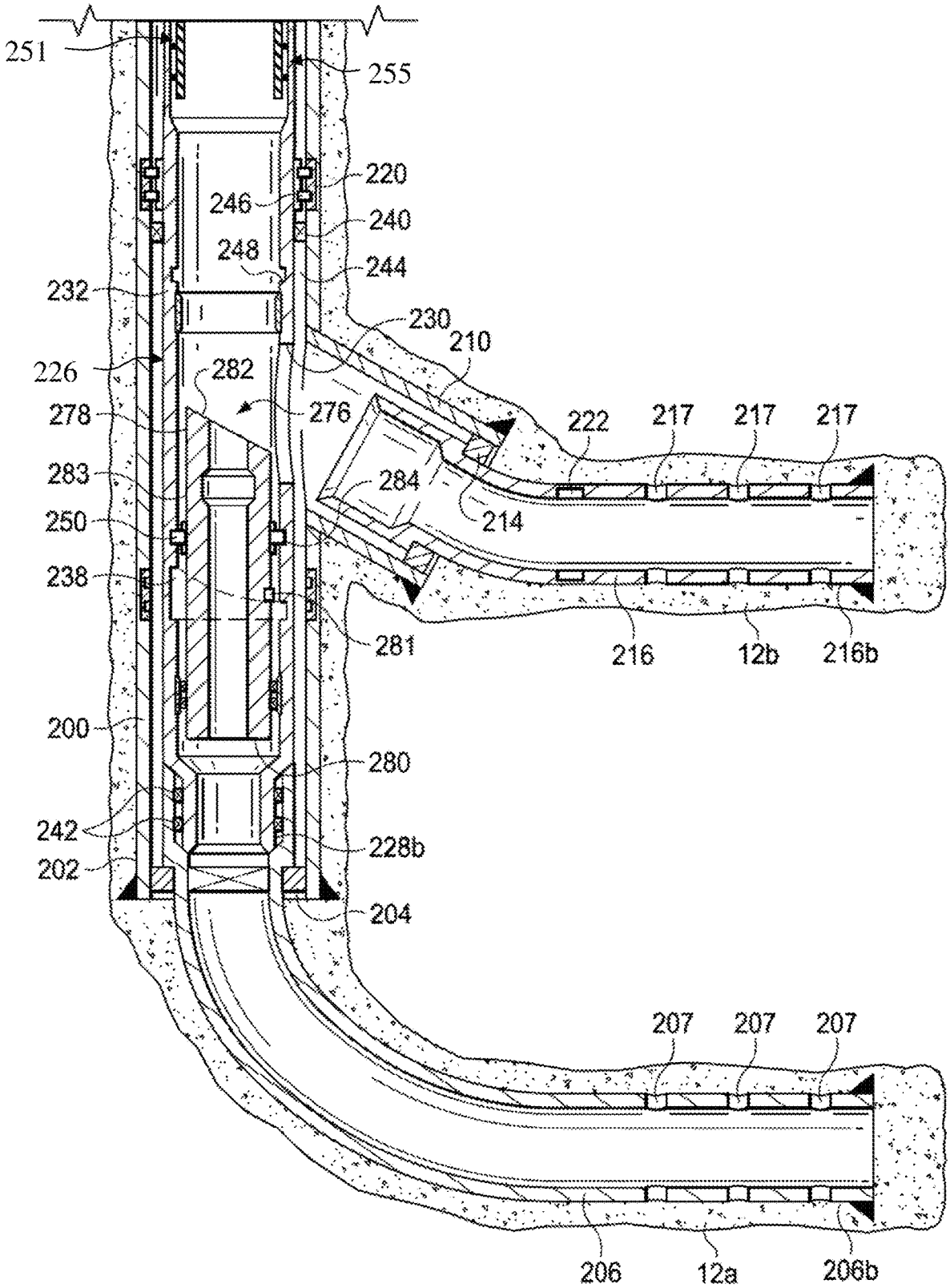

In FIG. 7, a whipstock 276 is illustrated as deployed in frac window system 226. Whipstock 276 may be of any shape or configuration, but generally has first end 278 and a second end 280 with a contoured surface 282 at first end 278. Whipstock 276 may include a follower 281, such as a lug or similar device. Follower 281 is preferably positioned along the outer surface 283 of whipstock 276 and may protrude from the surface 283 to engage orientation device 238 of frac window system 226 in order to rotate whipstock 276 to the desired angular position within first wellbore 12. Likewise, whipstock 276 may include a depth mechanism 284 disposed to engage the mechanism 250 to secure the oriented whipstock 276 to elongated tubular 228 of frac window system 226. More specifically, when whipstock 276 is deployed within frac window system 226, whipstock 276 is axially positioned so that the first end 278 of whipstock 276 is adjacent opening 230 and radially positioned so that the contoured surface 282 will direct, deflect, or otherwise guide tools and other devices passing down through first wellbore 12 through opening 230 and into secondary wellbore 12*b*.

It should be appreciated that as described herein, whipstock 276 is not limited to any particular type of whipstock, but may be any device which will deflect, direct or otherwise guide a tool or device through opening 230. In some embodiments, whipstock 276 may be a solid body, while in other embodiments, whipstock 276 may include an interior passage.

Whipstock 276 may be positioned within the frac window system 226 at various different times. In at least one embodiment, the whipstock 276 may be run-in-hole with the frac window system 226. In yet other embodiments, the whipstock 276 is run-in-hole after the frac window system 226 is run-in-hole. In yet even other embodiments, as is shown, the whipstock 276 may be run-in-hole through the high-pressure frac string 251.

Figure 8:
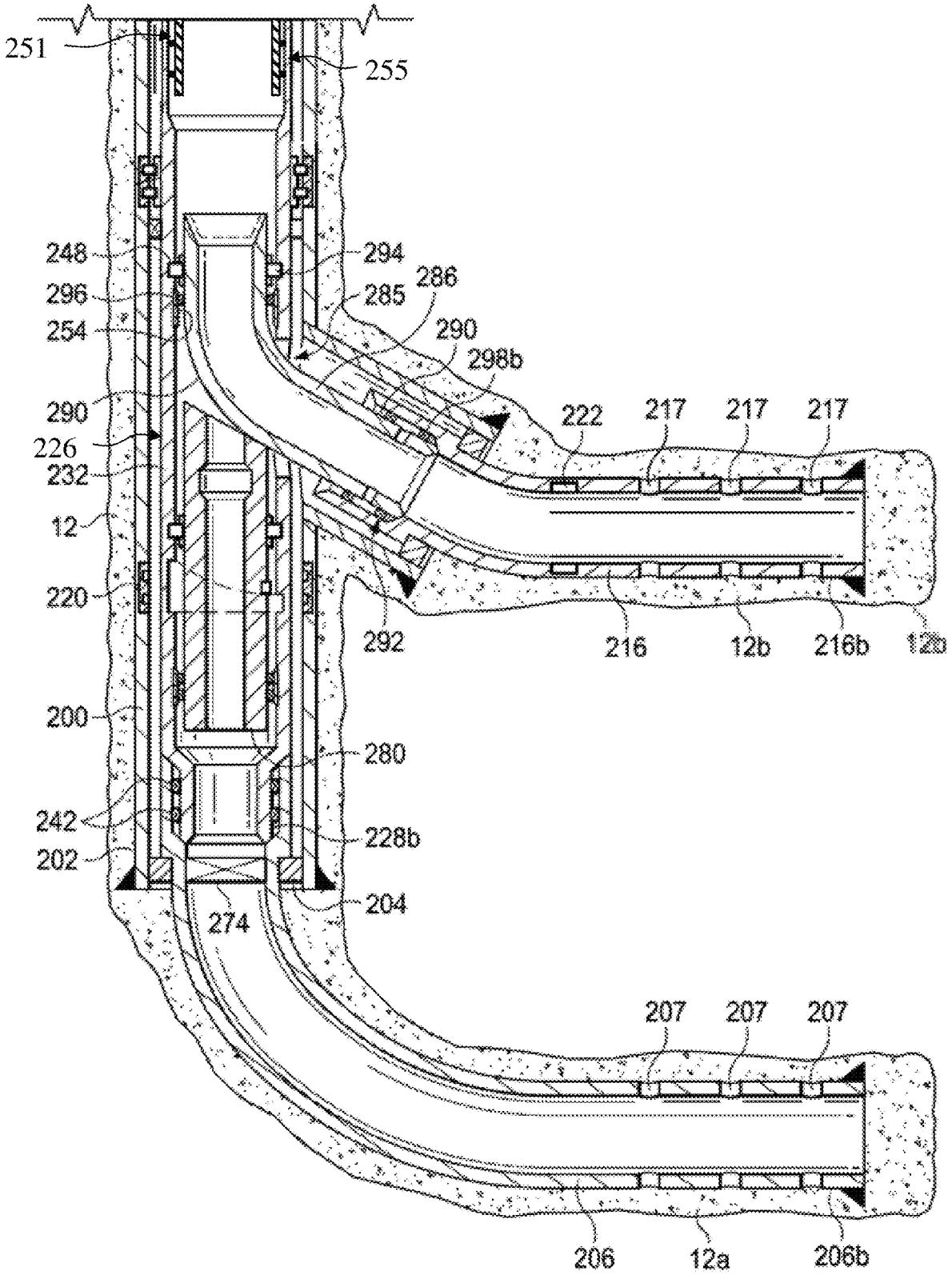

Turning to FIG. 8, a straddle stimulation tool 285 is illustrated extending from the frac window system 226 into the upper secondary wellbore 12*b*. In the illustrated embodiment, the straddle stimulation tool 285 is run-in-hole through the high-pressure frac string 251. Straddle stimulation tool 285 generally includes a straddle tubular 286 having a first end and a second end forming a flow bore therebetween. Straddle tubular 286 includes an inner surface and an outer surface. When deployed, straddle stimulation tool 285 is positioned so that first end is in first wellbore 12 and second end is in secondary wellbore 12*b*. In this regard, first end may be positioned within elongated tubular of frac window system 226 and second ends may be positioned within the first end of secondary wellbore casing 216.

More specifically, a first seal 292 may be disposed along the outer surface 290 adjacent the second end. Seal 292 is disposed to engage the inner surface of secondary wellbore casing 216 to seal the annulus formed between casing 216 and straddle stimulation tool 285. A straddle depth mechanism 294 may be disposed along the outer surface 290 of the straddle tubular 286 adjacent the first end, the straddle depth mechanism 294 engaging the first depth mechanism 248 of the frac window system 226. A second seal 296 may be provided on the outer surface 290 of the straddle tubular 286, the second seal 296 engaging the inner surface 234 of the elongated tubular 228 of the frac window system 226. Second seal 296 may engage one of the smooth the sealing surfaces 254 of elongated tubular 228 to ensure an effective or desirable seal.

In one or more embodiments, first seal 292 may be formed of multiple seal elements, such as first seal element spaced apart from a second seal element. A port may extend from inner surface 289 to outer surface 290 between seal elements.

Figure 9A:
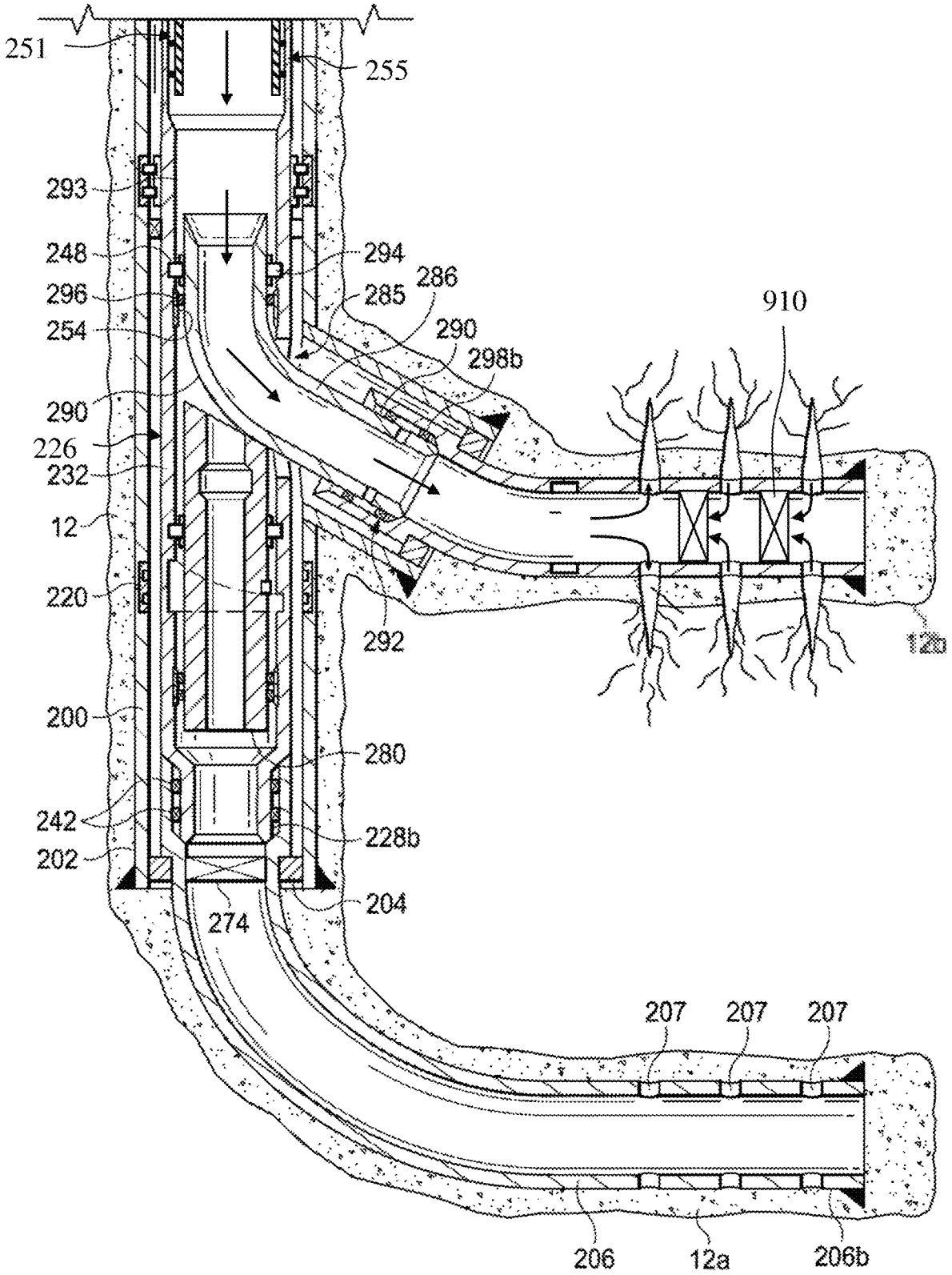

As shown in FIG. 9A, the straddle stimulation tool 285 functions to isolate the portion of first wellbore 12 below window 212, including secondary wellbore 12*a*, from secondary wellbore 12*b*. The seals as described permit delivery of a high-pressure fluid to upper secondary wellbore 12*b* without impacting lower secondary wellbore 12*a*. For example, hydraulic fracturing operations can be carried out with respect to upper secondary wellbore 12*b* without impacting lower secondary wellbore 12*a*. This might be desirable after one secondary wellbore 12*a*, 12*b* has been producing for some time and it is determined that only certain secondary wellbores within the system (such as secondary wellbore 12*b*) may need stimulation, while other secondary wellbores (such as secondary wellbore 12*a*) do not. In another example, since the vast majority of unconventional wellbores have to be stimulated before they are capable of producing hydrocarbons, the foregoing will allow each of wellbores 12*a*, 12*b* to be isolated and hydraulically fractured in order to promote production. The straddle stimulation tool 285 and the main bore isolation sleeve 260 not only isolate the wellbores 12*a* and 12*b* from one another, but also provide a path for balls, plugs, etc. to be dropped from the surface to isolate individual zones in the wellbores during the stimulation process.

As shown in FIG. 9A, the secondary wellbore 12*b* has at least partially been stimulated. For example, the secondary wellbore 12*b* has been stimulated from toe to heal, for example using one or more frac plugs 910 to isolate the different stimulated regions. In at least one embodiment, as shown, the deployment of the frac plugs 910 and the stimulation process are conducted through the high-pressure frac string 251.

Figure 9B:
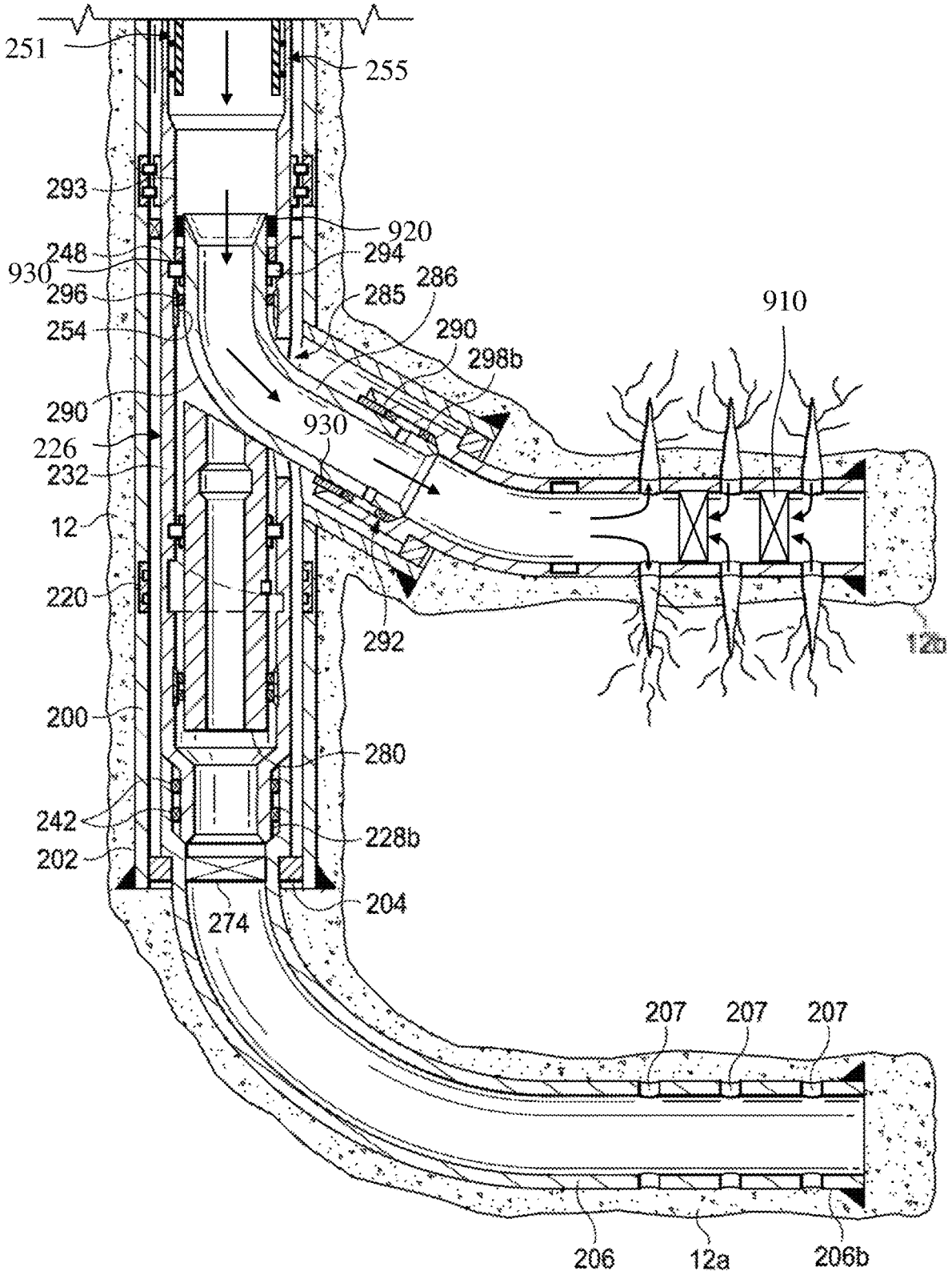

Turning to FIG. 9B, illustrated the well system of FIG. 9A with additional features therein. For example, FIG. 9B the SST 285 may additionally include a debris barrier 920. The debris barrier 920, in one embodiment, is configured to prevent proppant, fines, and/or other small items (debris) from moving (e.g., flowing into, settling into, fall into) into the area between the SST's 285 OD and the upper nipple profile of the frac window system 226. Other areas and devices may benefit from one or more barriers, one or more types of barriers, seals, wipers, energized (self and/or pressure), etc. This is only an example of where debris may be of a concern as is mentioned only as one example.

Another innovation that would play a helpful role in a high-pressure, high-flow rate, multilateral environment is sealing elements and the protection of sealing elements. In one or more embodiments, a protective sheath 930 may be utilized to protect one or more seals from sustaining damaged while being run in the well, passing from one tool/device/profile to another, etc. As for an example, a protective sheath 930 may be utilized on the lower end of the SST 285. In this embodiment, the protective sheath 930 may be round to cover a circular seal (as an example) or other shapes or configurations. In one or more embodiments, the protective sheath 930 may slidingly fit over the SST's 285 lower seals while the SST 285 is being deployed in the wellbore 12. In some embodiment, the protective sheath 930 may consist of one or more parts. For example, the protective sheath 930 may employ a releasable device that secures it in one position/location but then releases so the sheath may move to another position (such as a position away from the seals so that the seals may sealing engage a polished seal bore (smooth bore especially designed for the seals to engage against—and capable of withstanding the high-pressures and stresses of stimulating at pressure of above 5,000-psi (e.g., 340 atm), above 10,000-psi (e.g., 680 atm), at least 12,500-psi (e.g., 851 atm) and/or over 15,000-psi (e.g., 1021 atm). In some highly specialized situations, it may be desirable to be able to withstand pressures of 30,000-psi (e.g., 2041 atm) or more. The protective sheath 930 and/or related parts/pieces/devices such as the seal mandrel (the tubular shaped devices that holds the seals in place and allows fluid to flow the inside) may comprise one or more other securing features (such as a collet or snap ring) to secure the protective sheath 930 in a second position/location. The second position may be utilized as a position to secure the protective sheath 930 away from the seals after the seals have landed in the seal bore—this may be utilized in some, but not all embodiments. And as other features, devices, concepts disclosed, these examples are provided as examples.

FIG. 9B shows another alterative place for seals and a seal protection-device. The SST 285 in certain embodiments will have one or more seals at the upper end to seal in the frac window. One or more seal-protection devices may be used in most embodiments. In some similar or different embodiments, a seal-bore protection device may be utilized to protect the seal-bores before or during or after—or combination thereof—a high-pressure event requiring the use of the seal bore. A seal-bore protection device may also protect the sealing surfaces (etc.) from erosion, corrosion, or both. The protection device may comprise a mechanical barrier/device, a chemical barrier/coating, the use of a special CRA (Corrosion Resistant Alloy) or other material(s) or any combination thereof with the goal of protecting the seal bores from degradation during one or more phases of the drilling, completion, stimulating, production, workover of the well and/or the device(s). For example, if the frac window nipple profiles (including the sealing bores) are to be used as a service tool, it would be preferable for the seals bores to be usable for use in several wells, several stimulation jobs, and/or both. If the equipment is to be utilized as long-term production usage, the equipment may be preferable to have different characteristics than equipment designated as a service tool. For example, long-term production equipment may be made of lower strength materials such as L-80, N-80, J-55, or similar alloys. Lower-strength alloys are known to be more corrosion resistant than higher-strength alloys. On the other hand, higher-strength alloys are capable of withstanding higher pressures (12,500-psi (e.g., 851 atm), capable of withstand erosion better, etc. The above differences are presented not to limit the extent of the disclosure, but to illustrate the variability within the scope of the invention.

Figure 10:
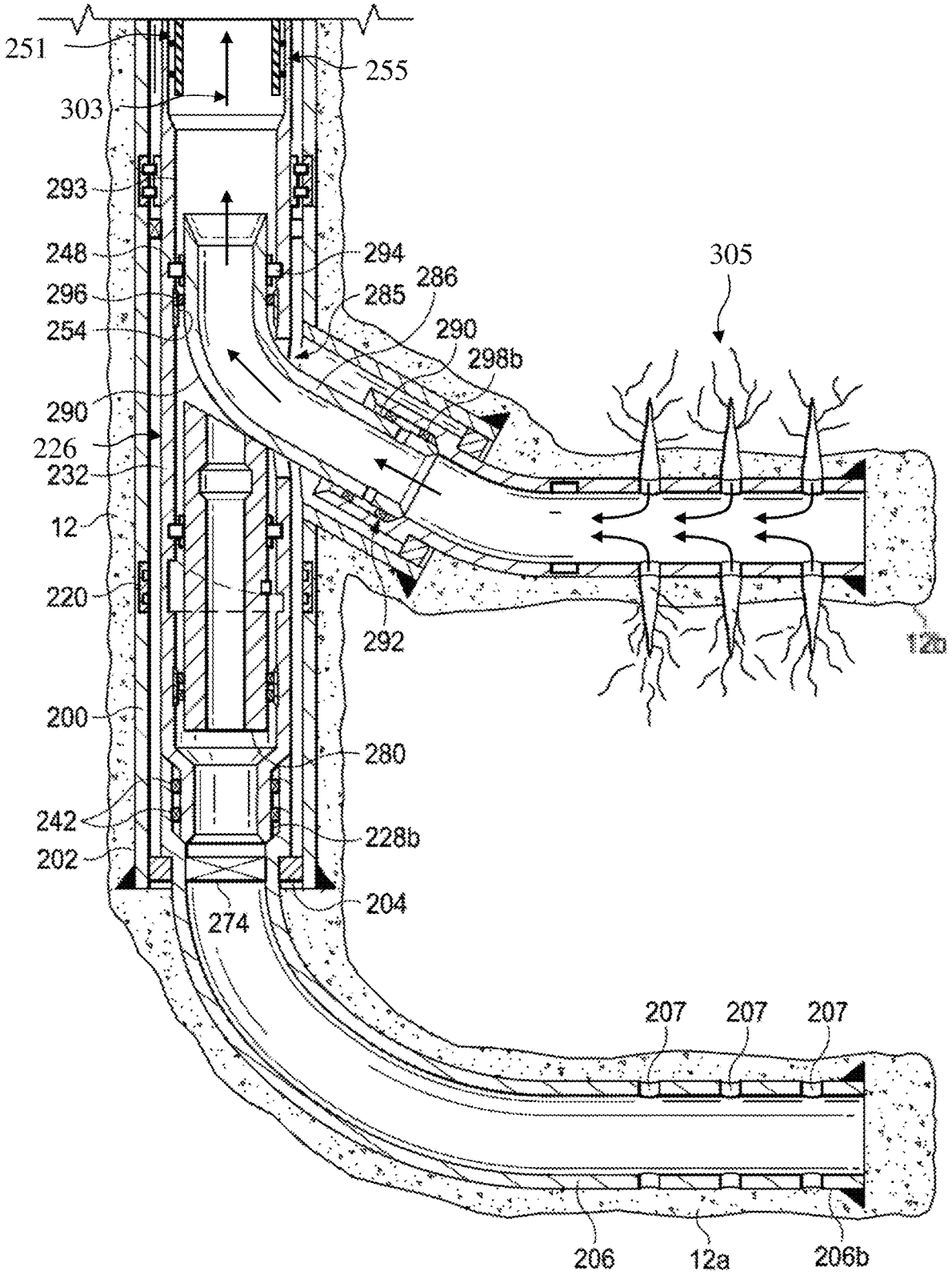

FIG. 10 illustrates production from the upper secondary wellbore 12*b* or flowback of fluids 303, such as hydraulic fracturing fluids and/or hydrocarbons, from fractures 305 resulting from such an operation, where flowback 303 from secondary wellbore 12*b* is illustrated while secondary wellbore 12*a* remains isolated.

Figure 11:
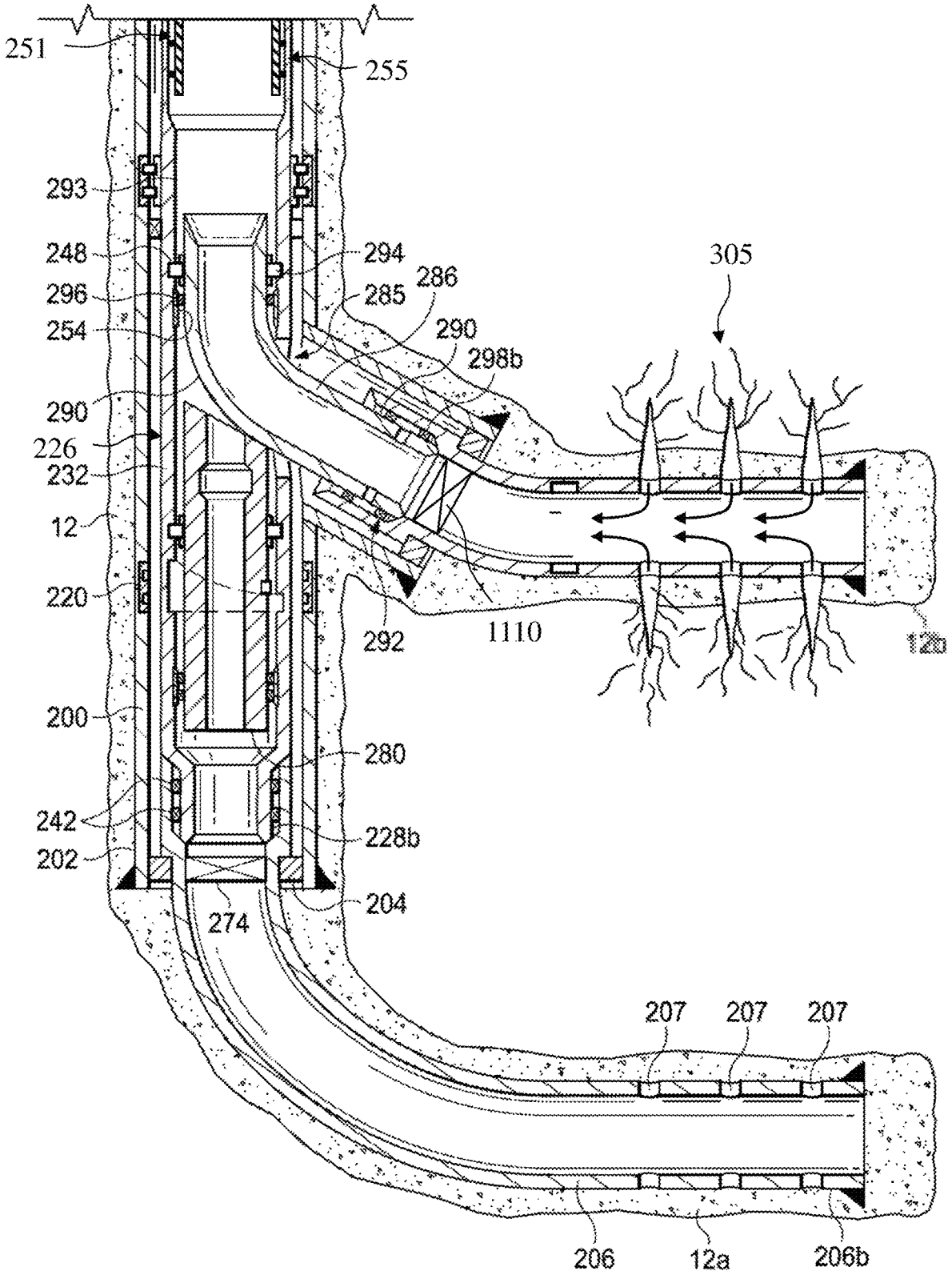

FIG. 11 illustrates the placement of an upper secondary wellbore plug 1110 within the upper secondary wellbore 12*b*. In the illustrated embodiment, the upper secondary wellbore plug 1110 is run-in-hole through the high-pressure frac string 251, for example through the straddle stimulation tool 285.

Figure 12:
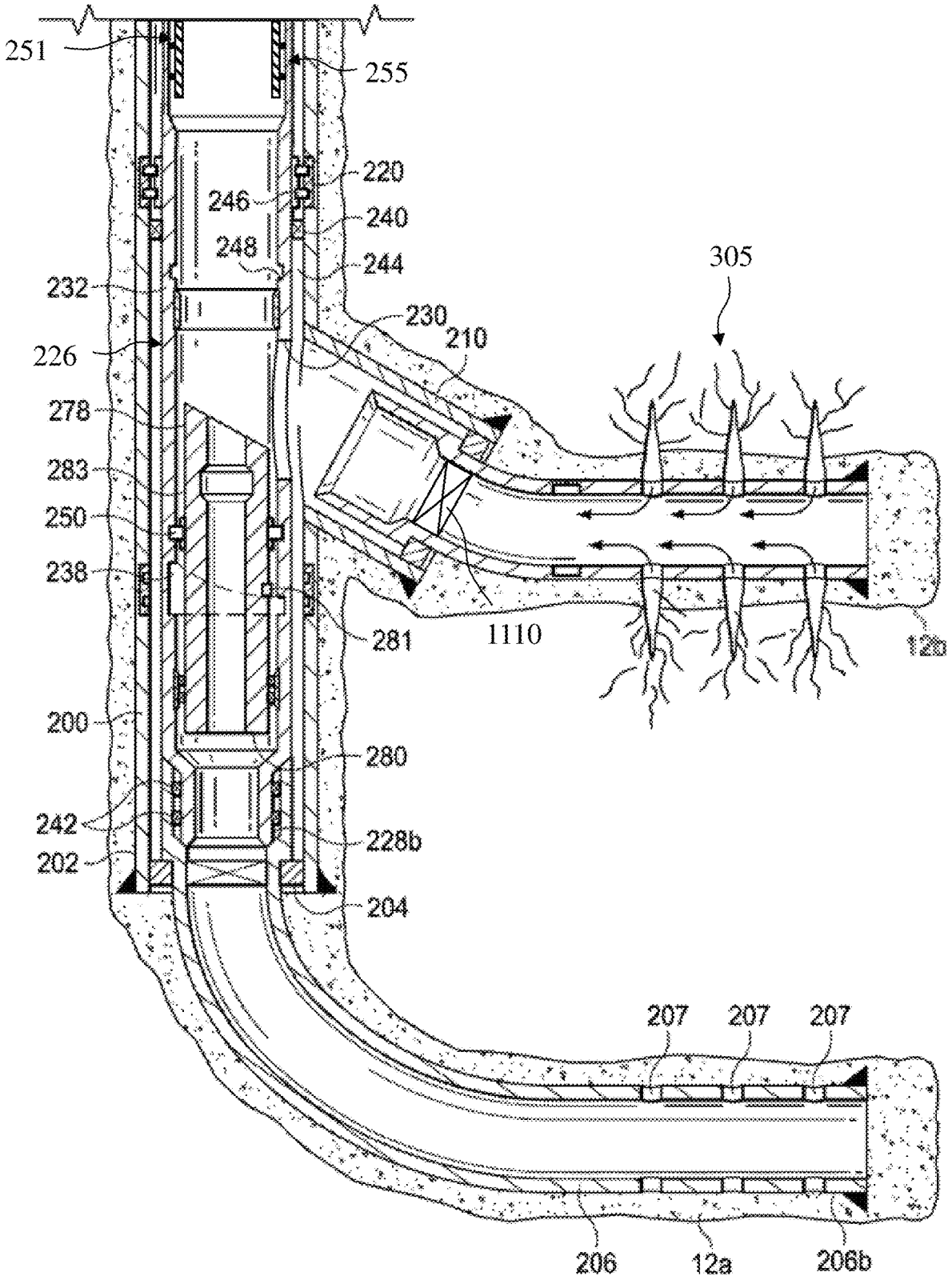

FIG. 12 illustrates the removal of the straddle stimulation tool 285. In the illustrated embodiment, the straddle stimulation tool 285 is removed through the high-pressure frac string 251.

Figure 13:
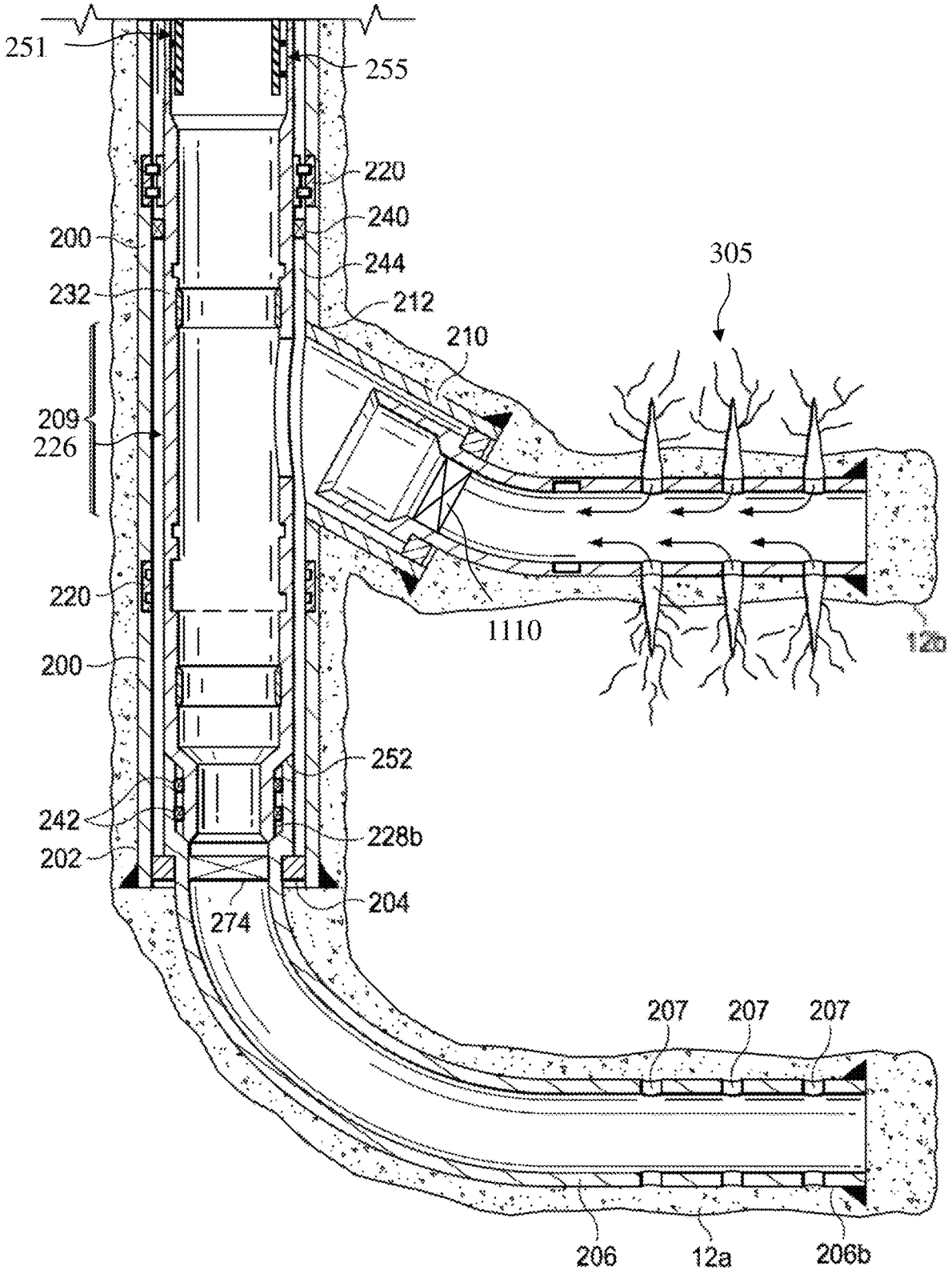

FIG. 13 illustrates the removal of the deflector 276. In the illustrated embodiment, the deflector 276 is removed through the high-pressure frac string 251.

Figure 14:
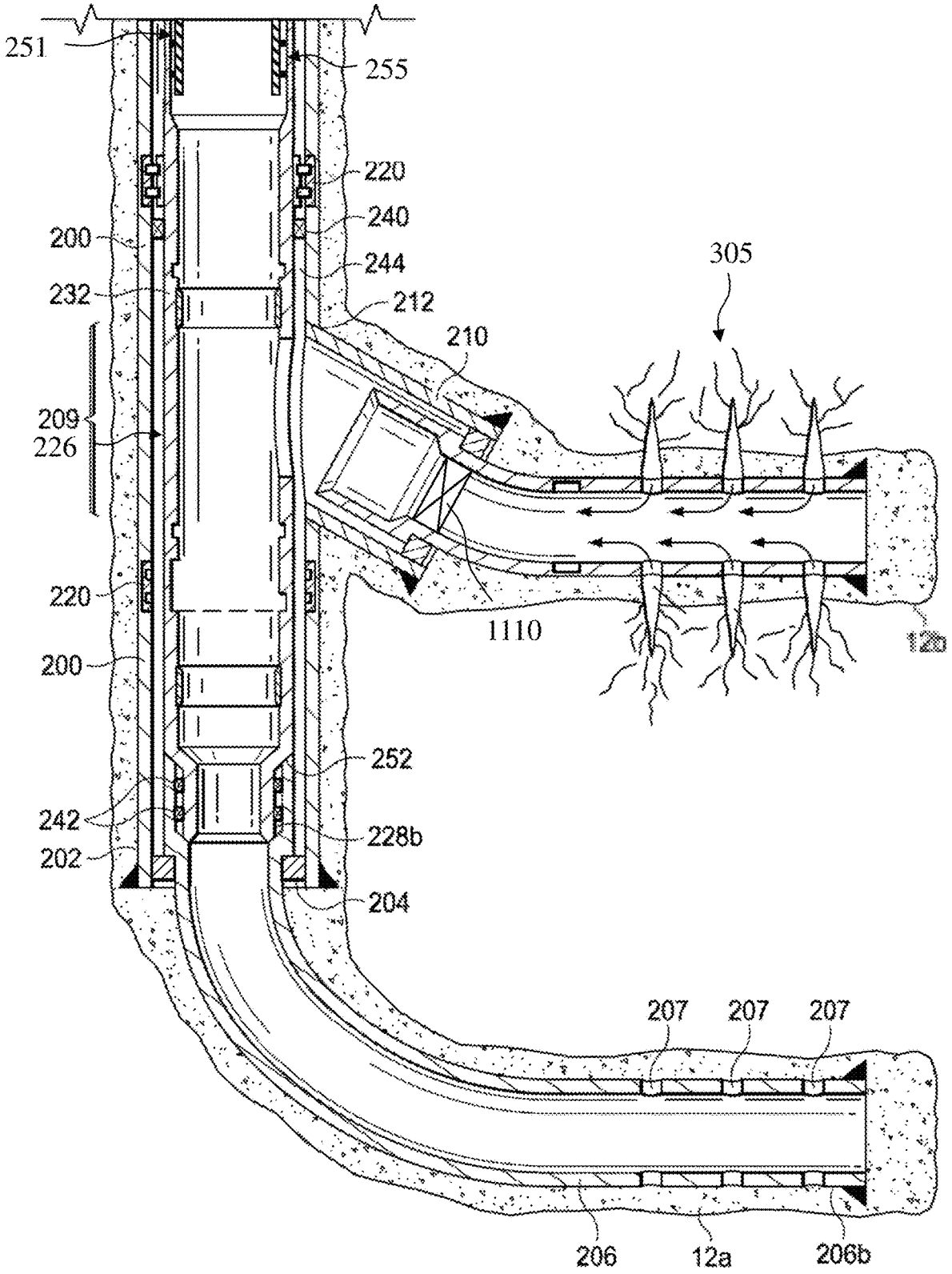

FIG. 14 illustrates the removal of the plug 274. In the illustrated embodiment, the plug 274 is removed through the high-pressure frac string 251. In yet another embodiment, the plug 274 is drilled out through the high-pressure frac string 251.

Figure 15A:
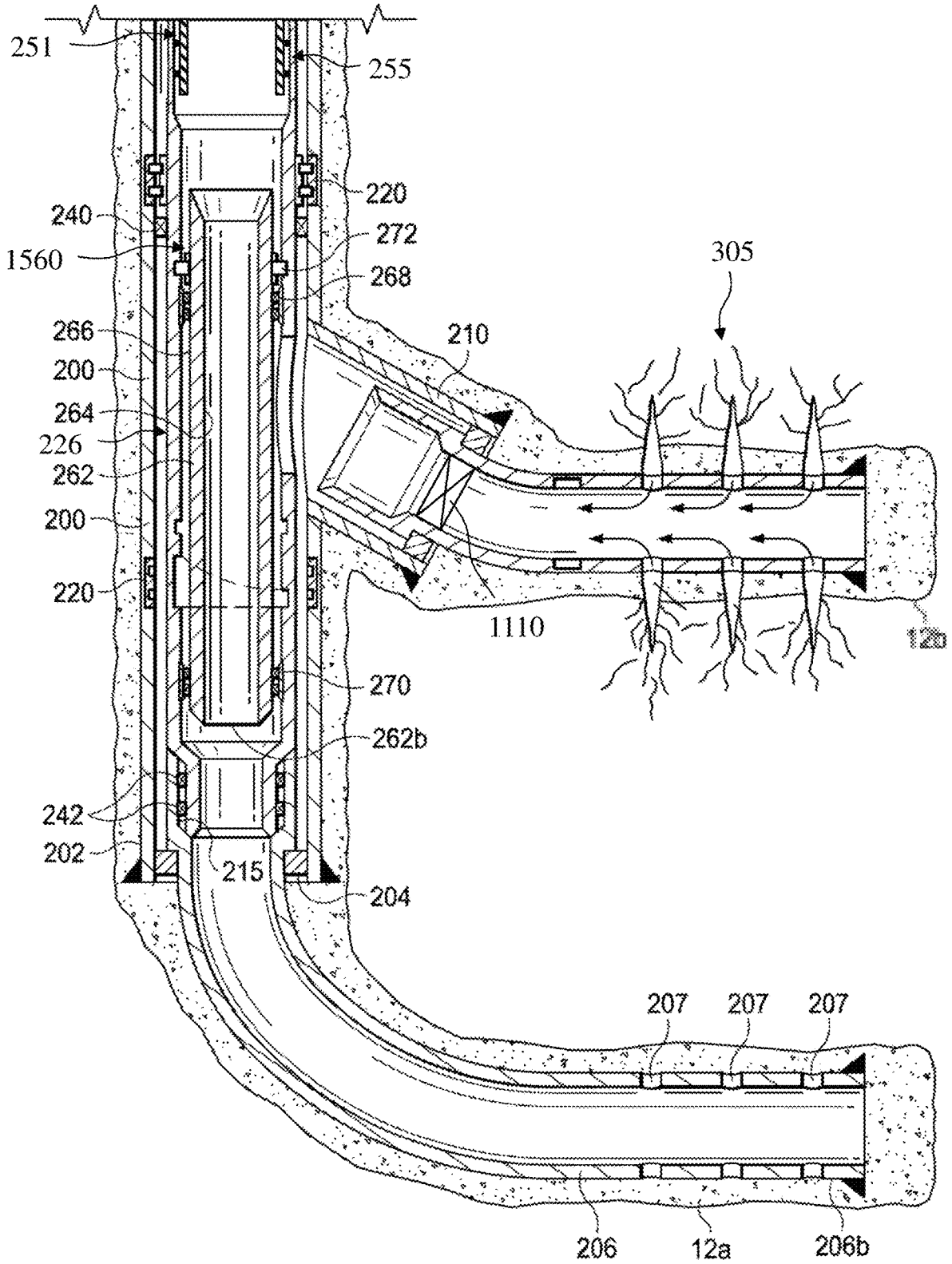
Figure 15B:
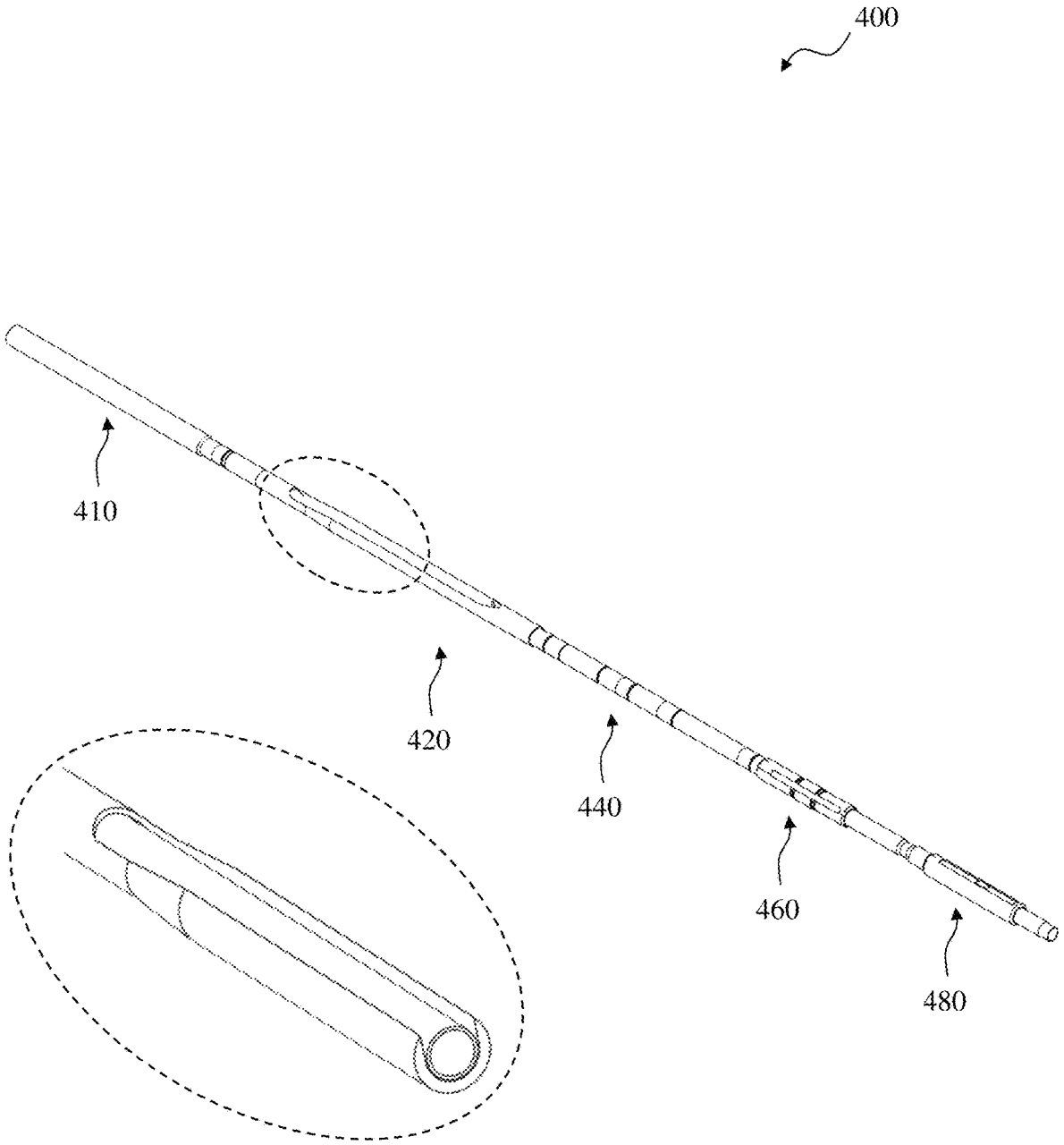
Figure 15C:
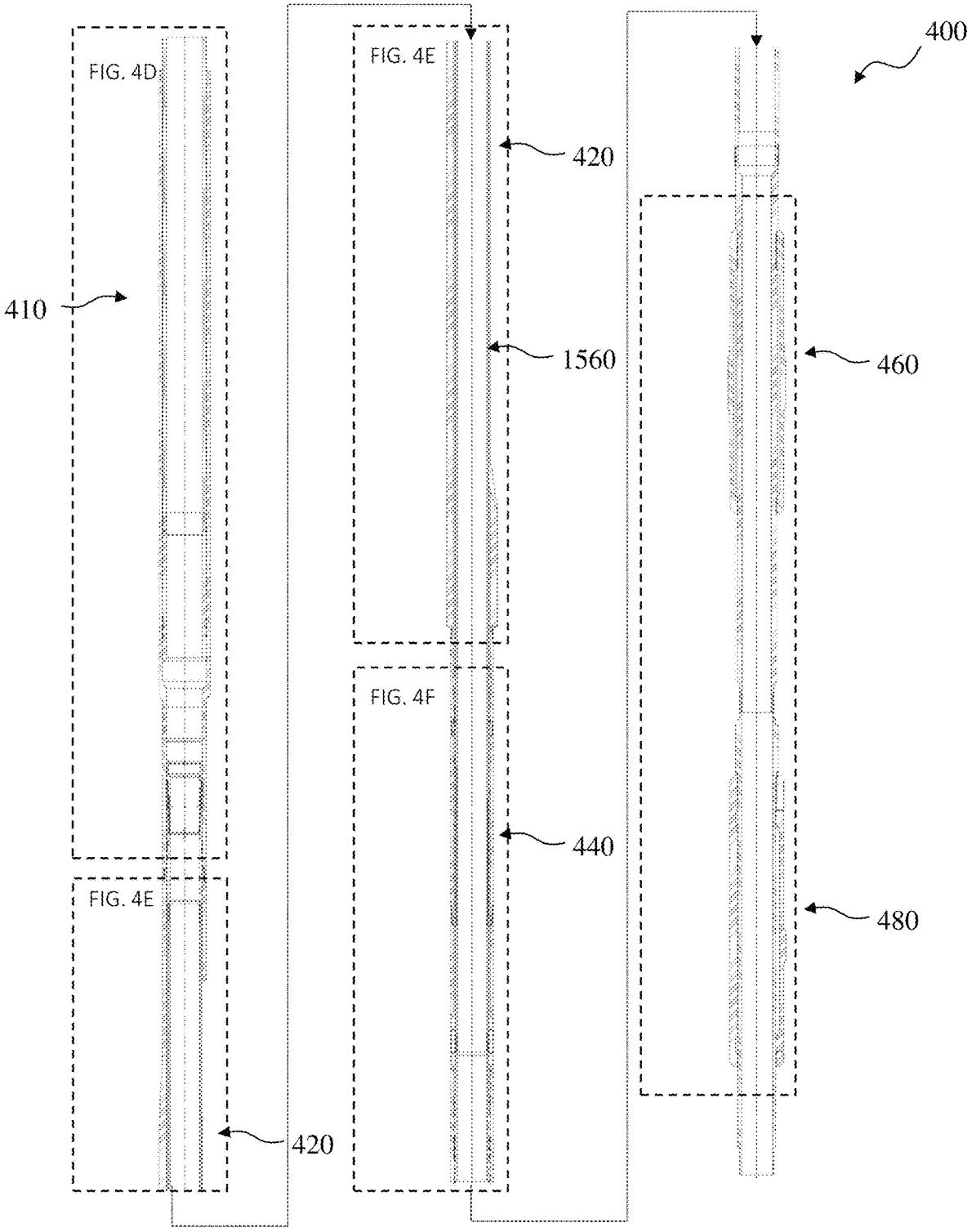
Figure 15D:
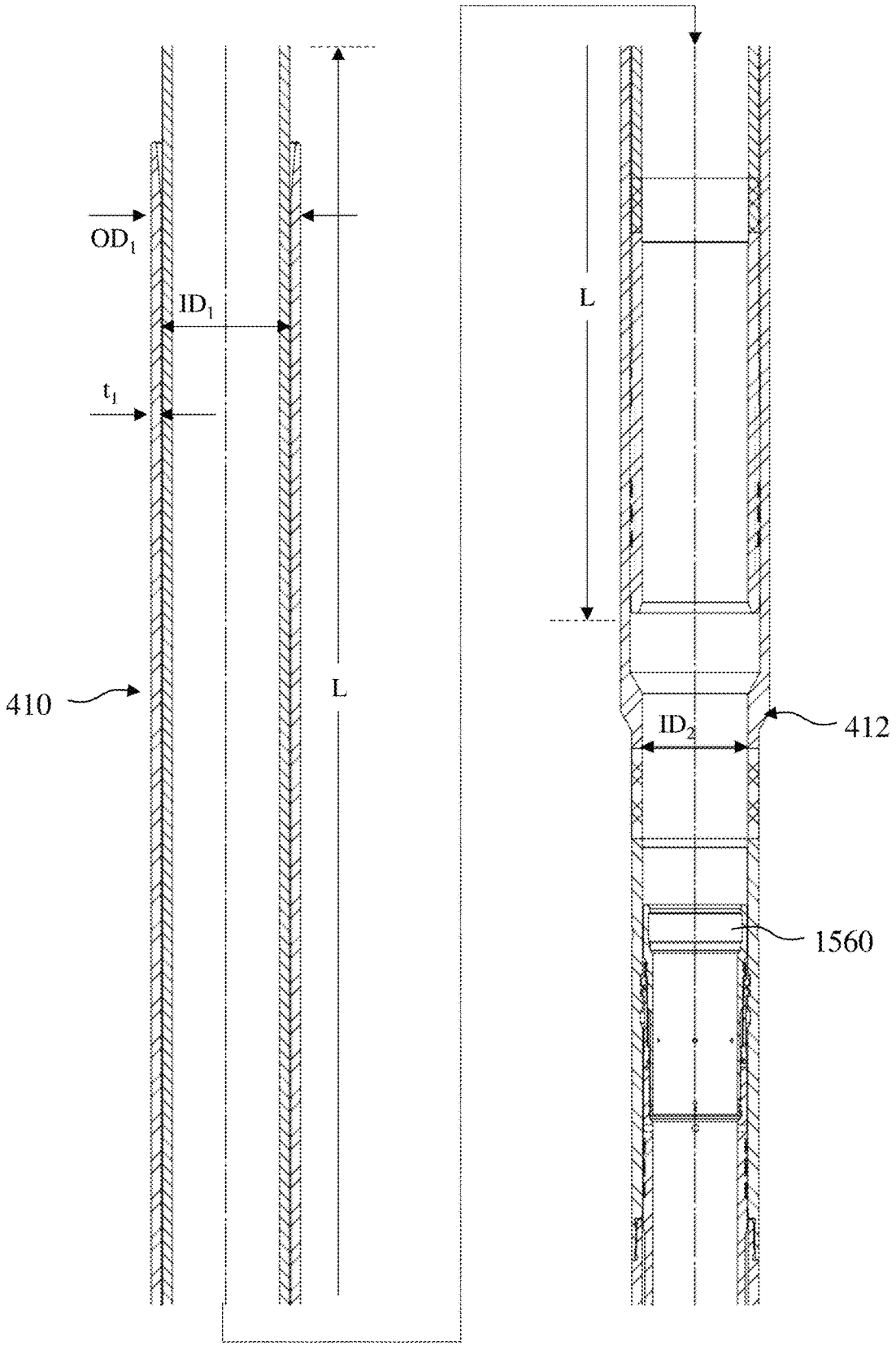
Figure 15E:
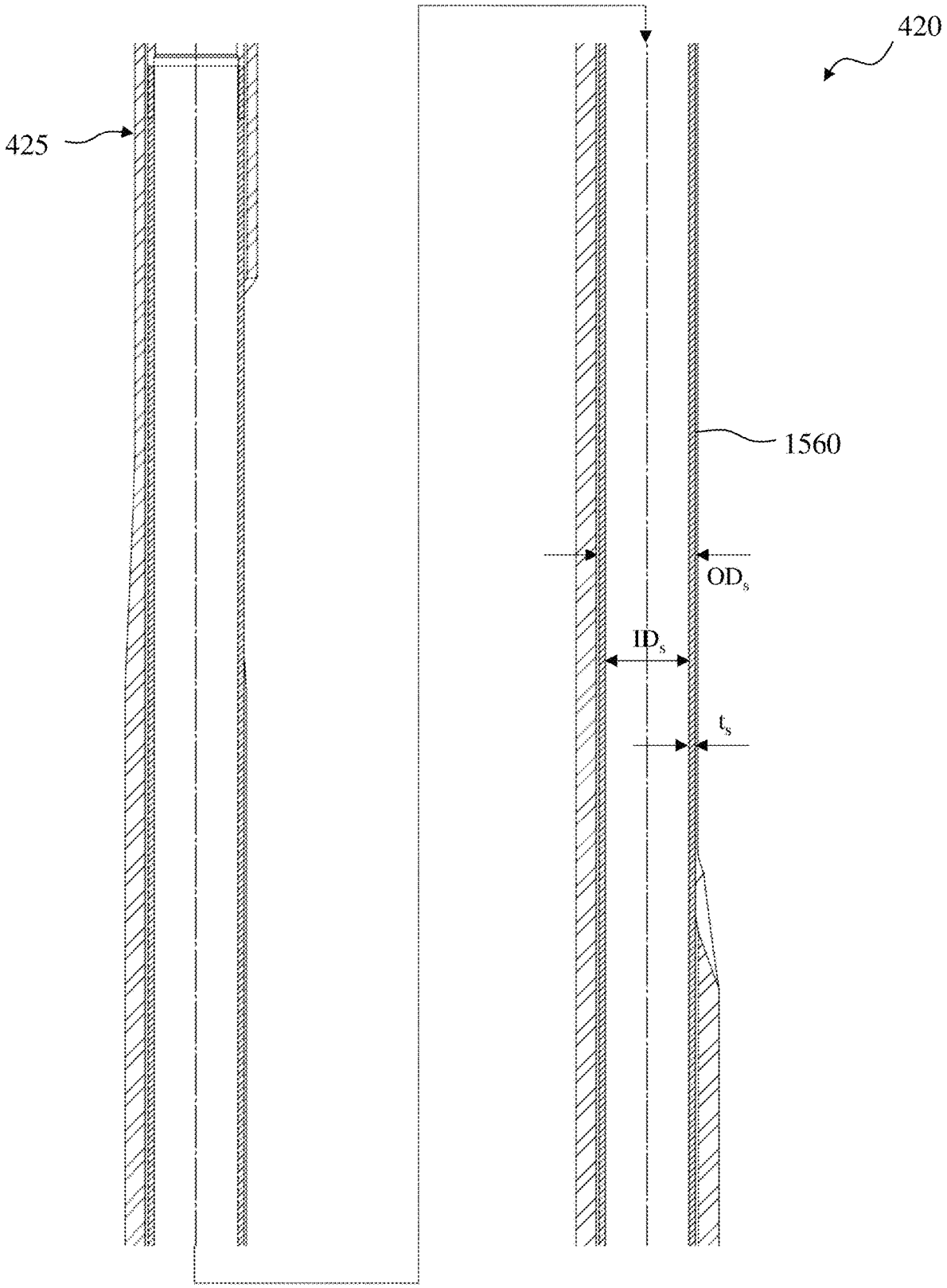
Figure 15F:
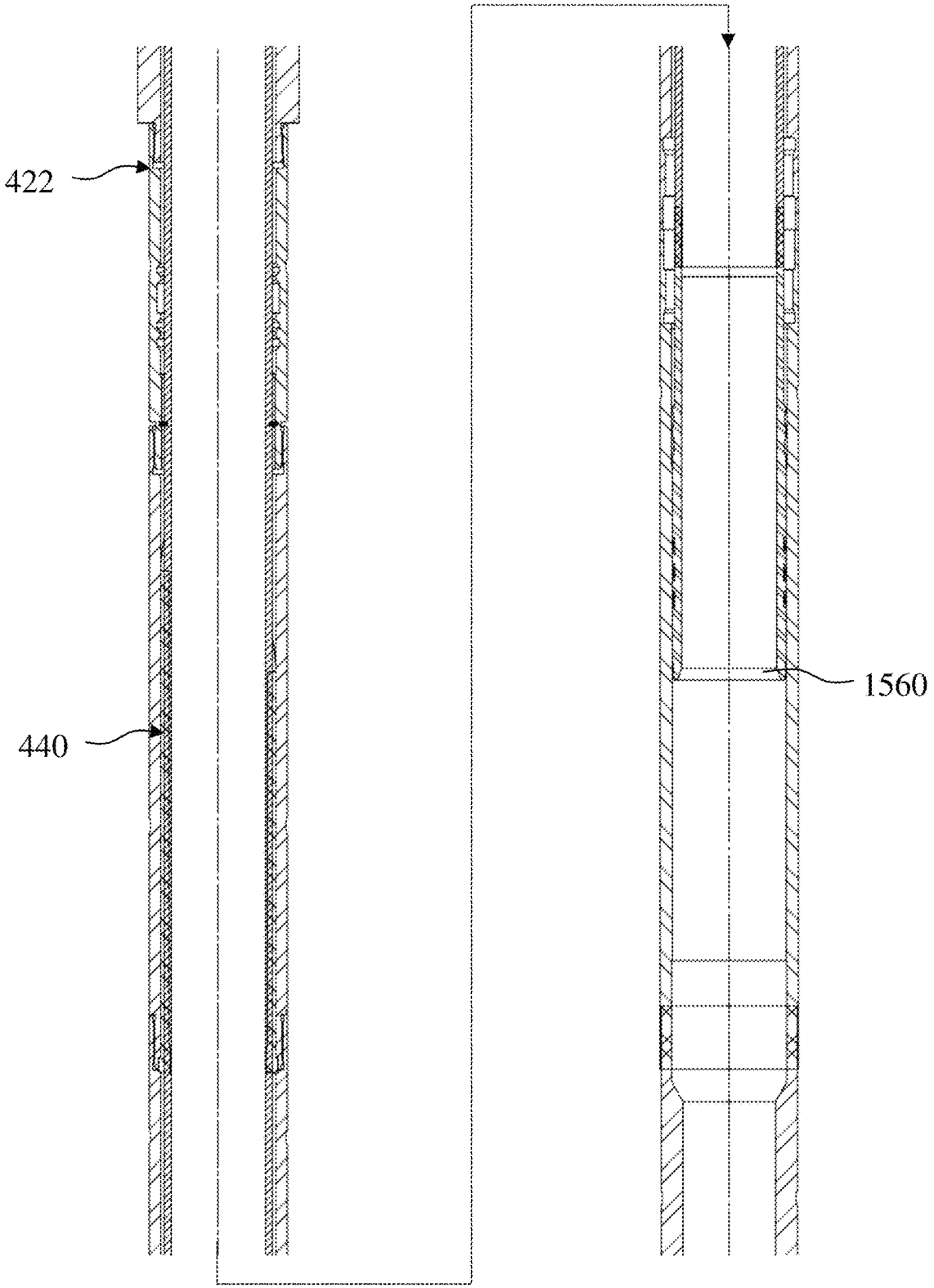
Figure 15G:
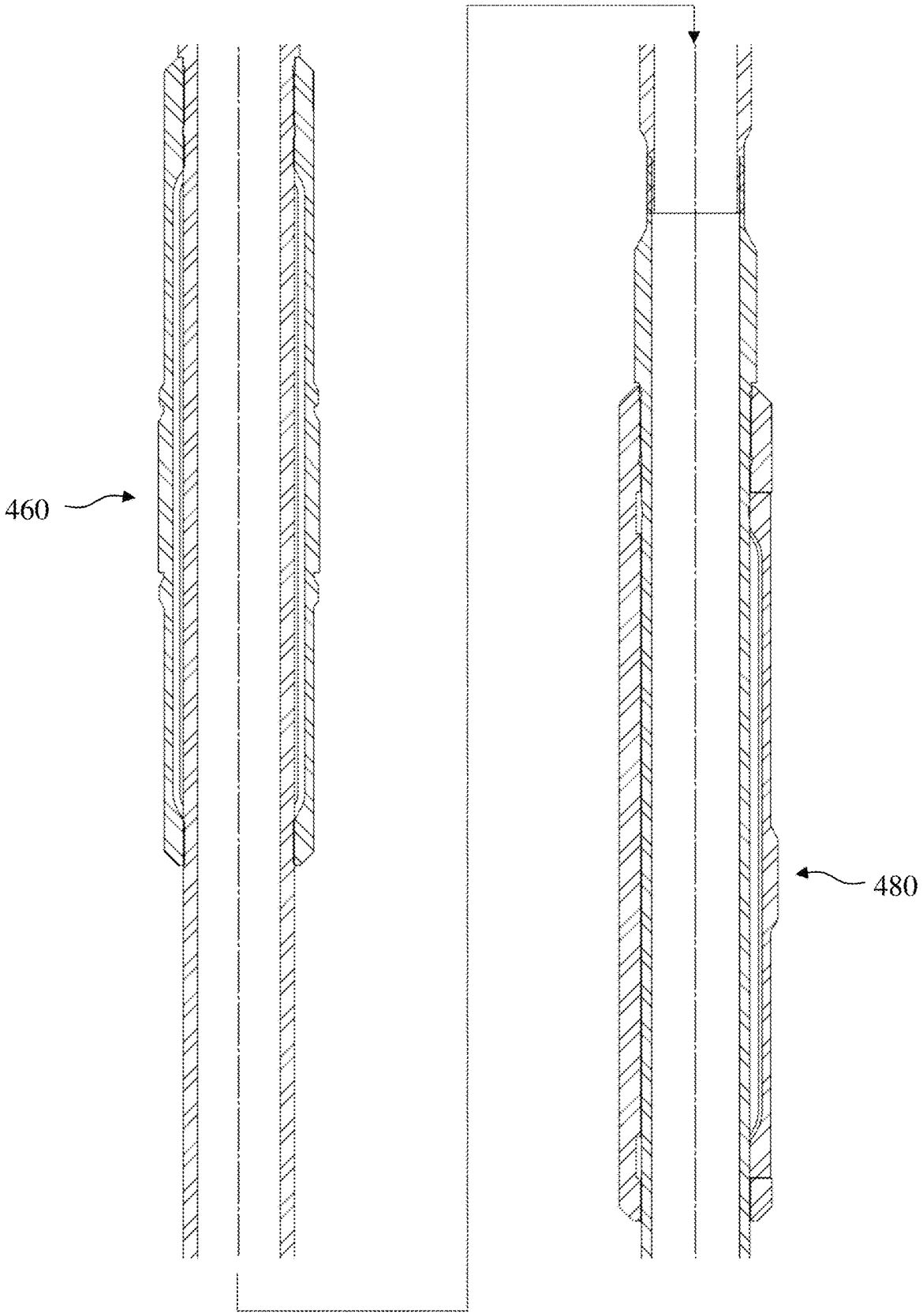

FIG. 15A illustrates the placement of an isolation sleeve 1560 within the frac window system 226. The isolation sleeve 1560, in at least one embodiment, is similar to the isolation sleeve 260 described and illustrated with respect to FIG. 5 above. In the illustrated embodiment, the isolation sleeve 1560 is run-in-hole through the high-pressure frac string 251.

In at least one embodiment, the isolation sleeve 1560 includes an outside diameter ($OD_s$) and an inside diameter ($ID_s$). The outside diameter ($OD_s$), in at least one embodiment, is at least 4.5" (e.g., 11.43 cm), if not at least 5" (e.g., 12.7 cm), if not at least 5.5" (e.g., 13.97 cm), or more. Again, the outside diameter ($OD_s$) may be based upon the inside diameter (ID) of the frac window system 226 it is configured to engage with. In at least one embodiment, the isolation sleeve 1560 includes an inside diameter ($ID_s$) of at least 4" (e.g., 10.16 cm), if not at least 4.5" (e.g., 11.43 cm), or more. In yet another embodiment, the isolation sleeve 1560 has a wall thickness ($t_s$) and a length ($L_s$).

FIGS. 15B through 15G illustrate various different embodiments and views of a frac window system 400, similar to the frac window system 400 illustrated and discussed with regard to FIGS. 4B through 4G above, having one embodiment of the isolation sleeve 1560 included therein.

Figure 16:
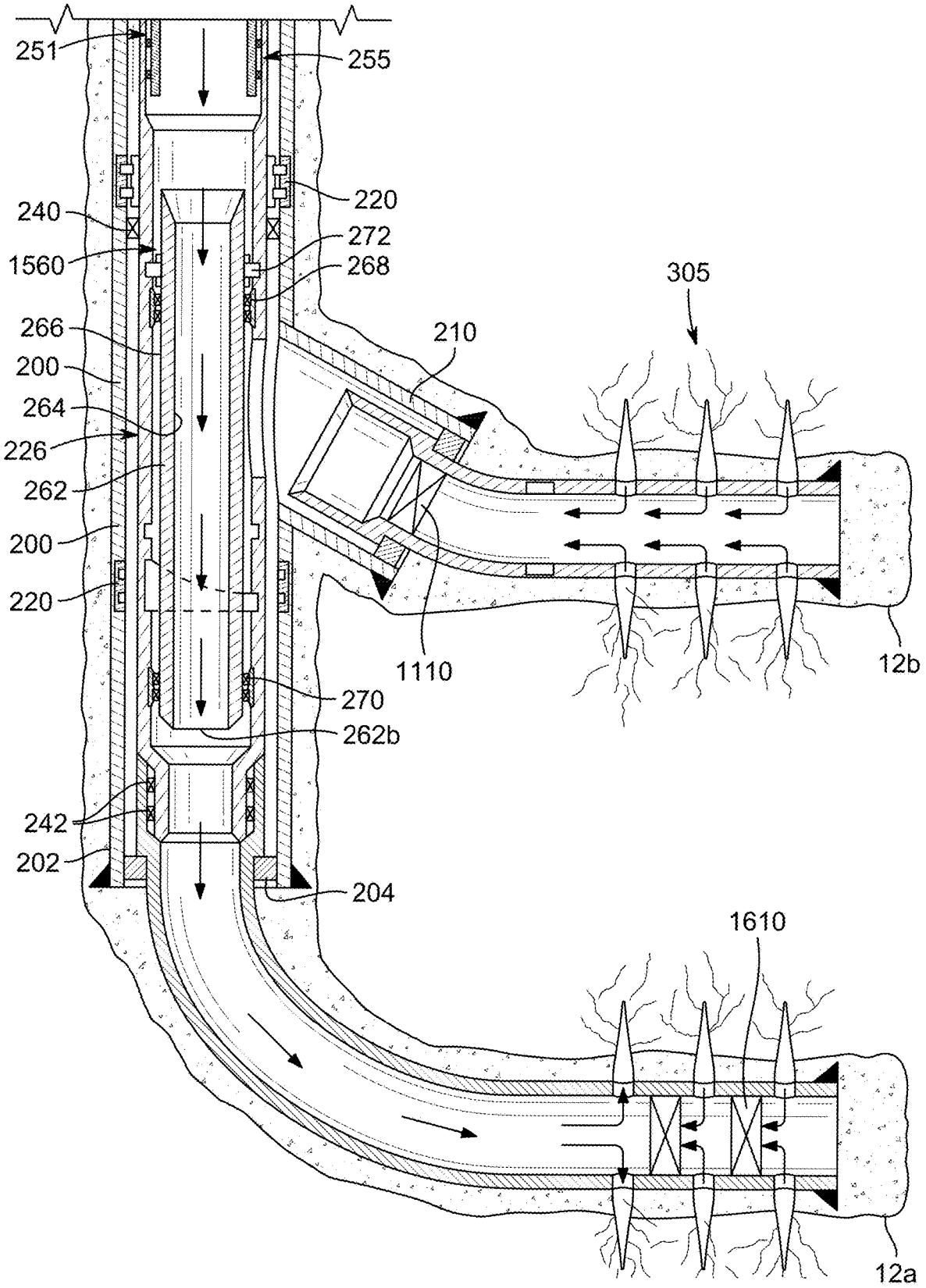

As shown in FIG. 16, the isolation sleeve 1560 functions to isolate the portion of first wellbore 12 below window 212, including secondary wellbore 12*b*, from secondary wellbore 12*a*. The seals as described permit delivery of a high-pressure fluid to lower secondary wellbore 12*a* without impacting upper secondary wellbore 12*b*. For example, hydraulic fracturing operations can be carried out with respect to lower secondary wellbore 12*a* without impacting upper secondary wellbore 12*b*. This might be desirable after one secondary wellbore 12*a*, 12*b* has been producing for some time and it is determined that only certain secondary wellbores within the system (such as secondary wellbore 12*a*) may need stimulation, while other secondary wellbores (such as secondary wellbore 12*b*) do not. In another example, since the vast majority of unconventional wellbores have to be stimulated before they are capable of producing hydrocarbons, the foregoing will allow each of wellbores 12*a*, 12*b* to be isolated and hydraulically fractured in order to promote production. The isolation sleeve 1560 not only isolates the wellbores 12*a* and 12*b* from one another, but also provide a path for balls, plugs, etc. to be dropped from the surface to isolate individual zones in the wellbores during the stimulation process.

As shown in FIG. 16, the lower secondary wellbore 12*a* has at least partially been stimulated. For example, the lower secondary wellbore 12*a* has been stimulated from toe to heal, for example using one or more frac plugs 1610 to isolate the different stimulated regions. In at least one embodiment, as shown, the deployment of the frac plugs 1610 and the stimulation process are conducted through the high-pressure frac string 251.

Figure 17:
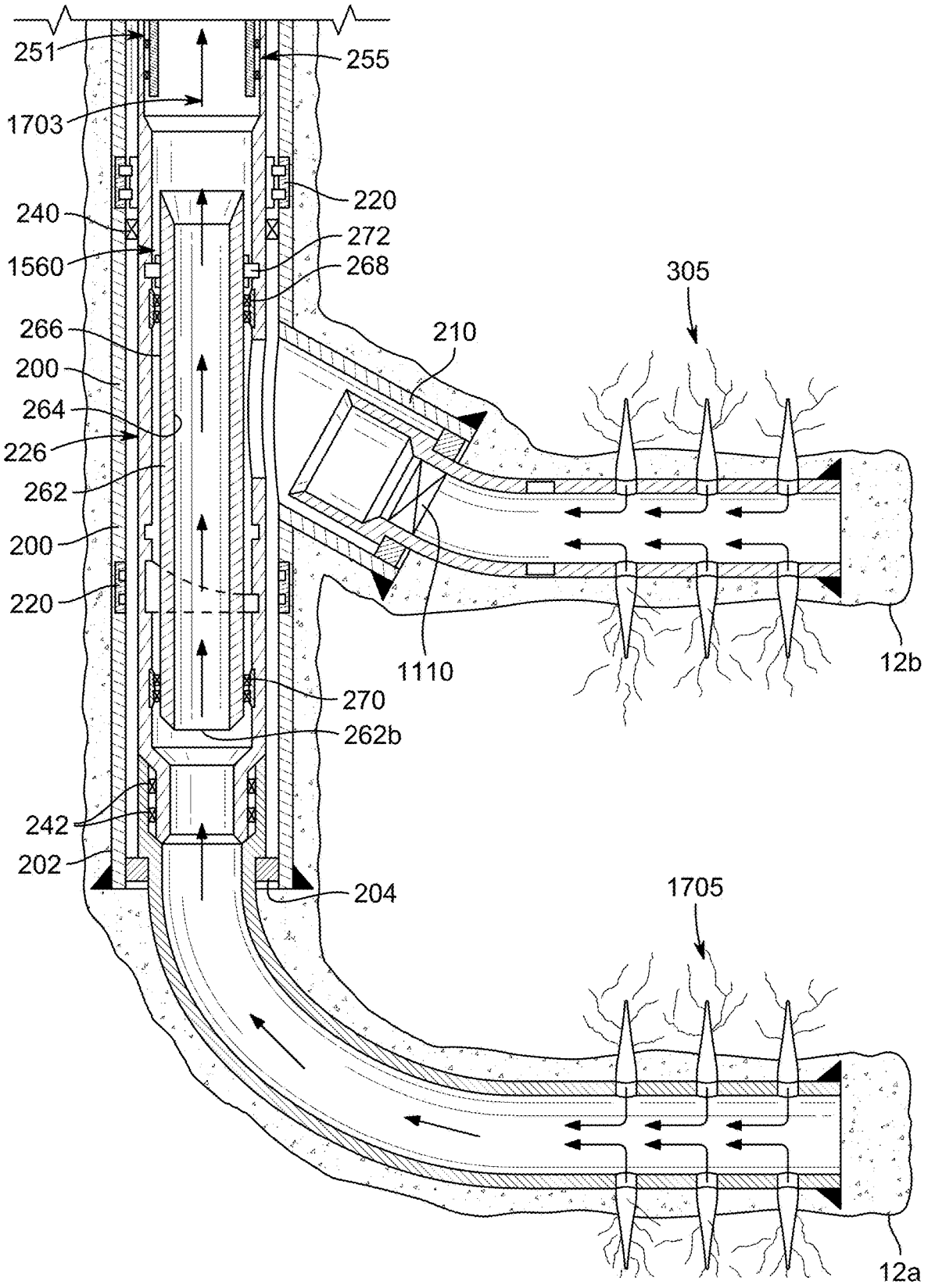

FIG. 17 illustrates production from the lower secondary wellbore 12*a* or flowback of fluids 1703, such as hydraulic fracturing fluids and/or hydrocarbons, from fractures 1705 resulting from such an operation, where flow from the lower secondary wellbore 12*a* is illustrated while the upper secondary wellbore 12*b* remains isolated.

Figure 18:
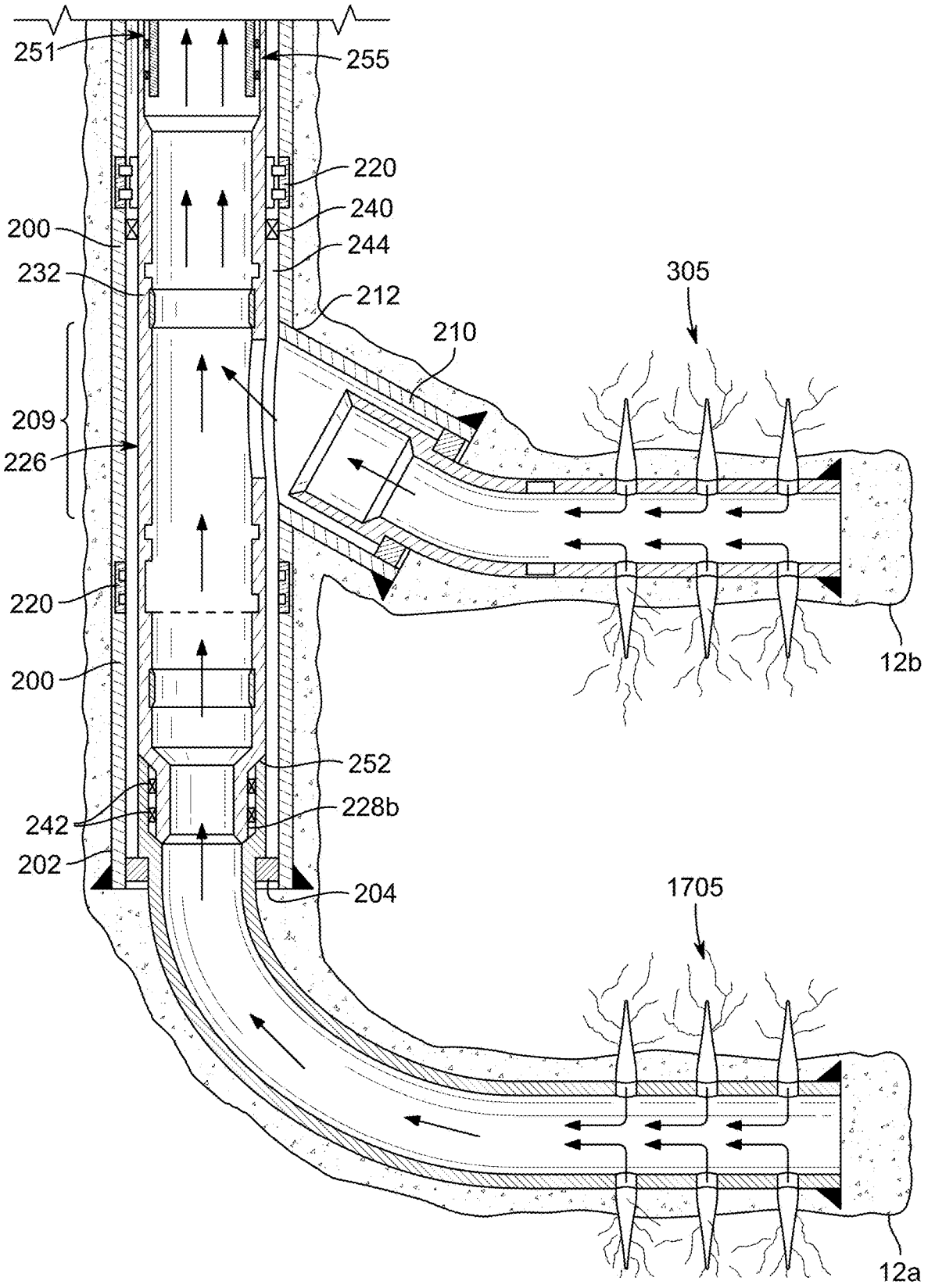

FIG. 18 illustrates the removal of the isolation sleeve 1560 and the lateral plug 1110. In the illustrated embodiment, the isolation sleeve 1560 and the lateral plug 1110 are removed through the high-pressure frac string 251. What results is commingled flow from the lower secondary wellbore 12*a* and the upper secondary wellbore 12*b*. In at least one embodiment, the commingled flow travels to the surface of the wellbore 12 through the frac window system 226 and the high-pressure frac string 251. Accordingly, the high-pressure frac string 251 may ultimately function as production tubing, for at least as long as it remains within the wellbore 12.

Figure 19A:
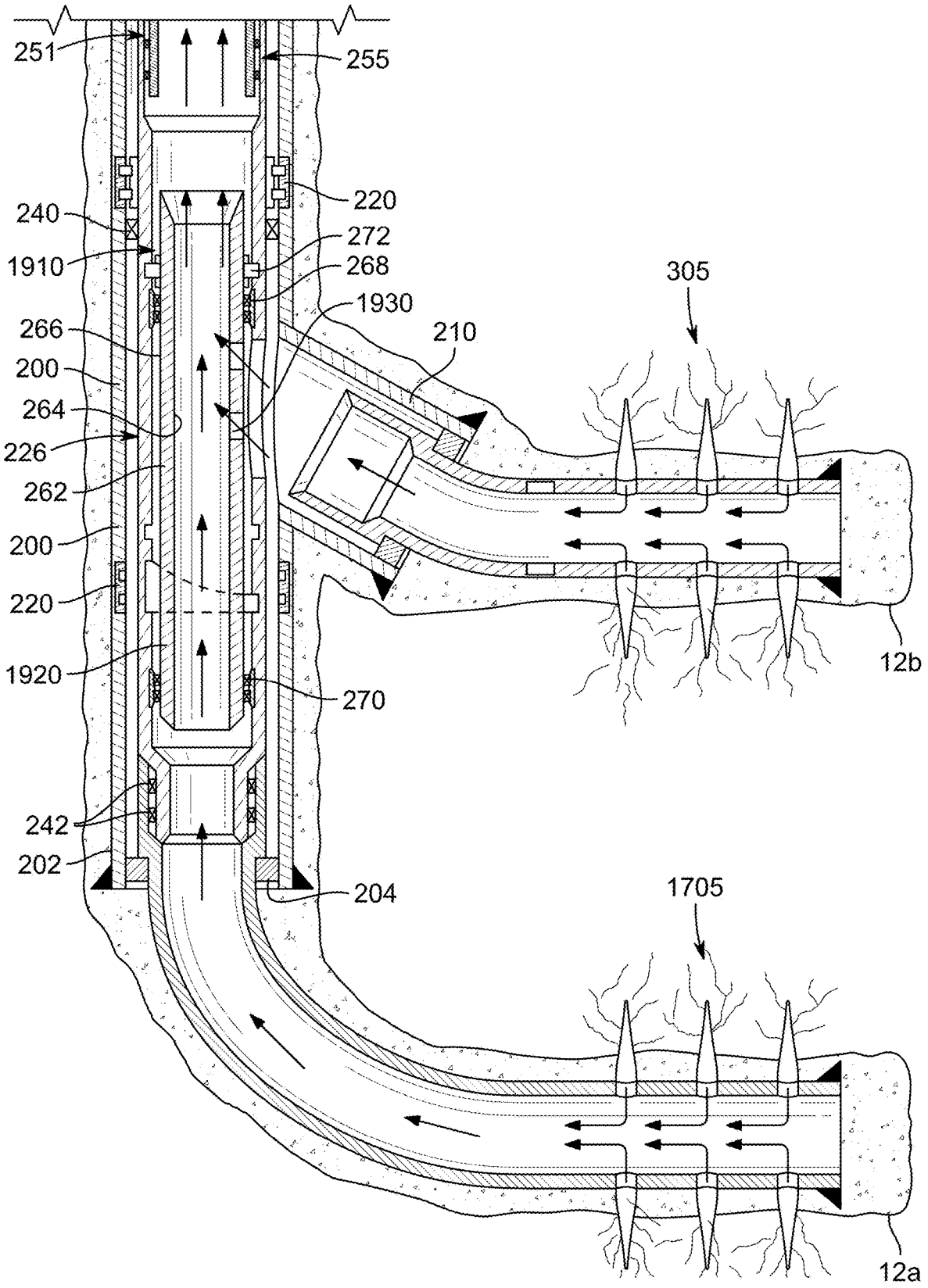

FIG. 19A illustrates an alternative embodiment of the disclosure, wherein a sleeve 1910, including a tubular 1920 having one or more flow control orifices 1930, is positioned within the frac window system 226. In at least one embodiment, the sleeve 1910 includes two or more flow control orifices that are located in a sidewall of the sleeve 1910 and restrict the flow from the upper secondary wellbore 12*b*. Depending on the amount of flow desired from the upper secondary wellbore 12*b*, the number and/or size of the one or more flow orifices 1930 may be adjusted. If the operator decides a different-size and/or number of orifices 1930 are required, they may pull the sleeve 1910 and replace it with one with different-sized and/or numbered orifices. The sleeve 1910, in at least one embodiment, may be installed and/or removed and/or replaced through the high-pressure frac string 251.

Figure 19B:
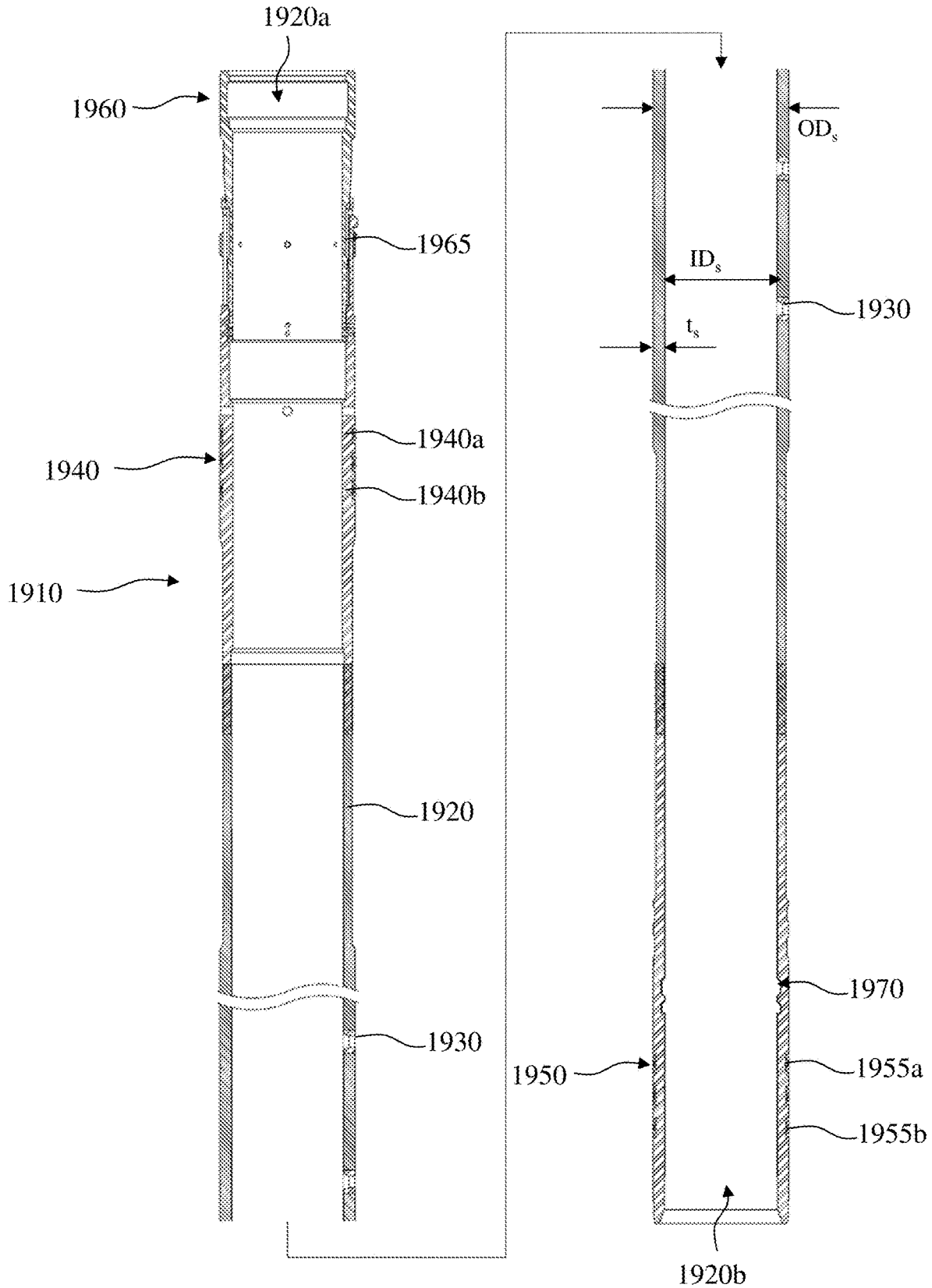

FIG. 19B illustrates a zoomed in view of the sleeve 1910. As shown, the sleeve 1910 includes a tubular 1920 having a first tubular end 1920*a* and a second tubular end 1920*b*. In at least one embodiment, the tubular 1920 has an outside diameter ($OD_s$) of at least 5.5". As shown, the isolation sleeve includes the one or more flow control orifices 1930 (e.g., two or more flow control orifices 1930) located in a sidewall of the tubular 1920 between the first tubular end 1920*a* and the second tubular end 1920*b*. Accordingly, as shown, the tubular 1920 is configured to be placed within the frac window system 226 at a junction between a first wellbore 12 and a secondary wellbore 12*b* such that the flow control orifices 1930 restrict a flow of wellbore fluid from the secondary wellbore 12*b* into the elongated tubular.

In the illustrated embodiment, the sleeve 1910 further includes an uphole seal mandrel 1940 including a first uphole seal 1940*a* and a second uphole seal 1940*b* located at least partially along an outer surface of the tubular 1920 proximate the first tubular end 1920*a*, and a downhole seal mandrel 1950 including a first downhole seal 1950*a* and second downhole seal 1950*b* located at least partially along the outer surface of the tubular 1920 proximate the second tubular end 1920*b*.

As shown, the sleeve 1910 may further include a running/retrieving mechanism 1960, as well as a depth mechanism 1965, as well as a locking profile 1970. The running/retrieving mechanism 1960 is designed so that a running and/or retrieving tool may be releasably attached to the sleeve 1910. The running tool may be coupled to sleeve 1910 so that sleeve 1910 can be deployed in the well and landed in the depth mechanism 1965 disposed along the inner surface 234 of elongated tubular 228 of frac window system 226 (FIG. 19A). The depth mechanism 1965 (e.g., 272 in 19A) may be positioned between the first uphole seal 1940*a* and the first tubular end 1920*a*.

In one or more embodiment, the one or more orifices 1930, may be disposed in one or more tubulars 1920. FIG. 19B illustrates only one tubular 1920, but multiple tubulars may be utilized. Since tubulars 1920 may see considerable erosion, it may be more cost-efficient to change out only the most-eroded tubulars 1920 in lieu of changing out one long tubular member 1920.

In one or more embodiment, orifices 1930 may comprise tungsten, a tungsten carbide, ceramic, one or more carbides, and/or one or more other erosion-resistant elements or compounds thereof. In one or more embodiment, orifices 1930 and related members may comprise straight flow paths, circular flow paths, holes, shaped inlets, shaped outlets, or combinations thereof. In one or more embodiments, orifices 1930 may be secured via an interference fit (e.g., press fit, driving fit, forced fit) with the one or more tubulars 1920. Other methods may be utilized separately, or in concert, including a chemical bond using such materials as thread-locking formulas which may be methacrylate-based and rely on the electrochemical activity of a metal substrate to cause polymerization of the fluid; Brazing, and Welding, etc. Brazing joins two metals by heating and melting a filler (alloy) that bonds to the two pieces of metal and joins them. Welding uses high temperatures to melt and join two metal parts.

In one or more embodiments, orifices 1930 may be oriented in a preferred direction so that the orifices 1930 will be aligned with opening 230 (shown if FIG. 5) which is aligned with wellbore 12*b* as shown in FIGS. 5 and 19A. When it is preferred to align orifices 1930 with opening 230, then a means to align the sleeve 1910 with opening 230 may be desirable. In one or more embodiments, sleeve 1910 may have one or more devices for the alignment. For example, an orientation device like 4052 used in 4058 (FIG. 40D) may be utilized. Another example is 4094 as shown in FIG. 40F may be implemented. In other embodiments, the orientation may happen by means of other devices related to the running tool, Frac Window 26, etc. Orifices 1930 maybe of any size or shape, mounted in a wall of the sleeve 1910 or integral to one or more tubulars 1920.

In one or more embodiments, the window exit 420 may have grooves or slots formed on the OD or the ID surface so flow may easily enter orifices 1930 even if they are not aligned with opening 230 (shown if FIG. 5). In other embodiment, the window exit 420 may have holes extending from the OD to the ID to ensure flow may enter orifices 1930 without impediment. In some embodiments, the holes extending from the OD to the ID may intersect grooves or slots formed on the OD of 420, grooves or slots formed on the ID of 420, or both grooves or slots formed on the OD and the ID surfaces of window exit 420. The grooves or slots may be of any one or more orientation (circumferential, longitudinal, angular, etc.)

In one or more embodiments, the holes extending from the OD to the ID of 420 may comprise devices to control flow, regulate flow, modify flow, impede flow, filter the flow, separate the flow into one or more constituents, measure one or more parameters of the flow (temperature, solids content, water content, pressure, change in pressure, density, velocity, radiation, conductivity, refractance, reflectance, etc.).

In one or more embodiments, frac window system 400 or one or more of its components (e.g., 420) may comprise devices, to control flow, regulate flow, modify flow, impede flow, filter the flow, separate the flow into one or more constituents, measure one or more parameters of the flow (temperature, solids content, water content, pressure, change in pressure, density, velocity, radiation, conductivity, wave reflectance, reflectance, etc.).

Figure 19C:
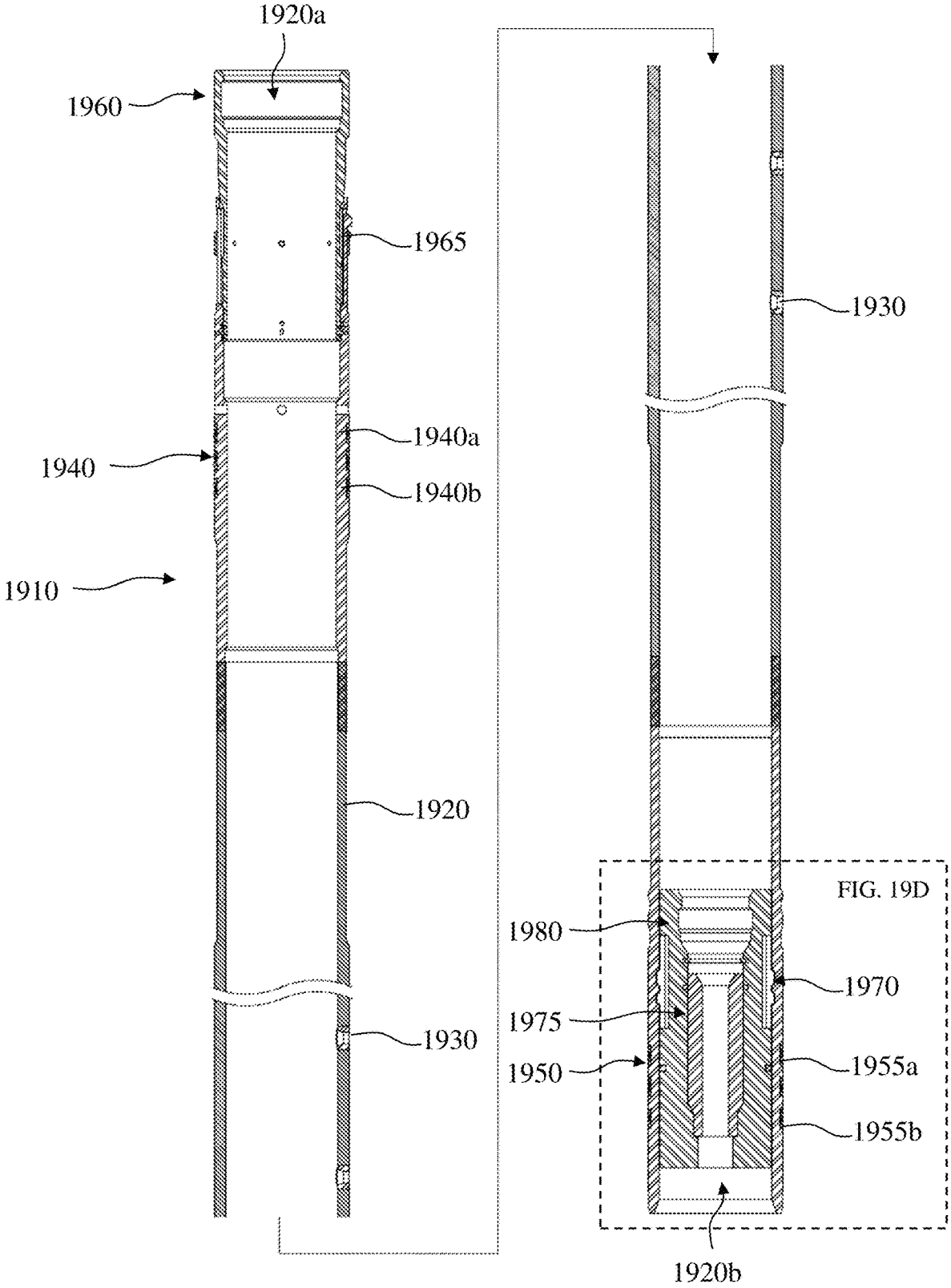
Figure 19D:
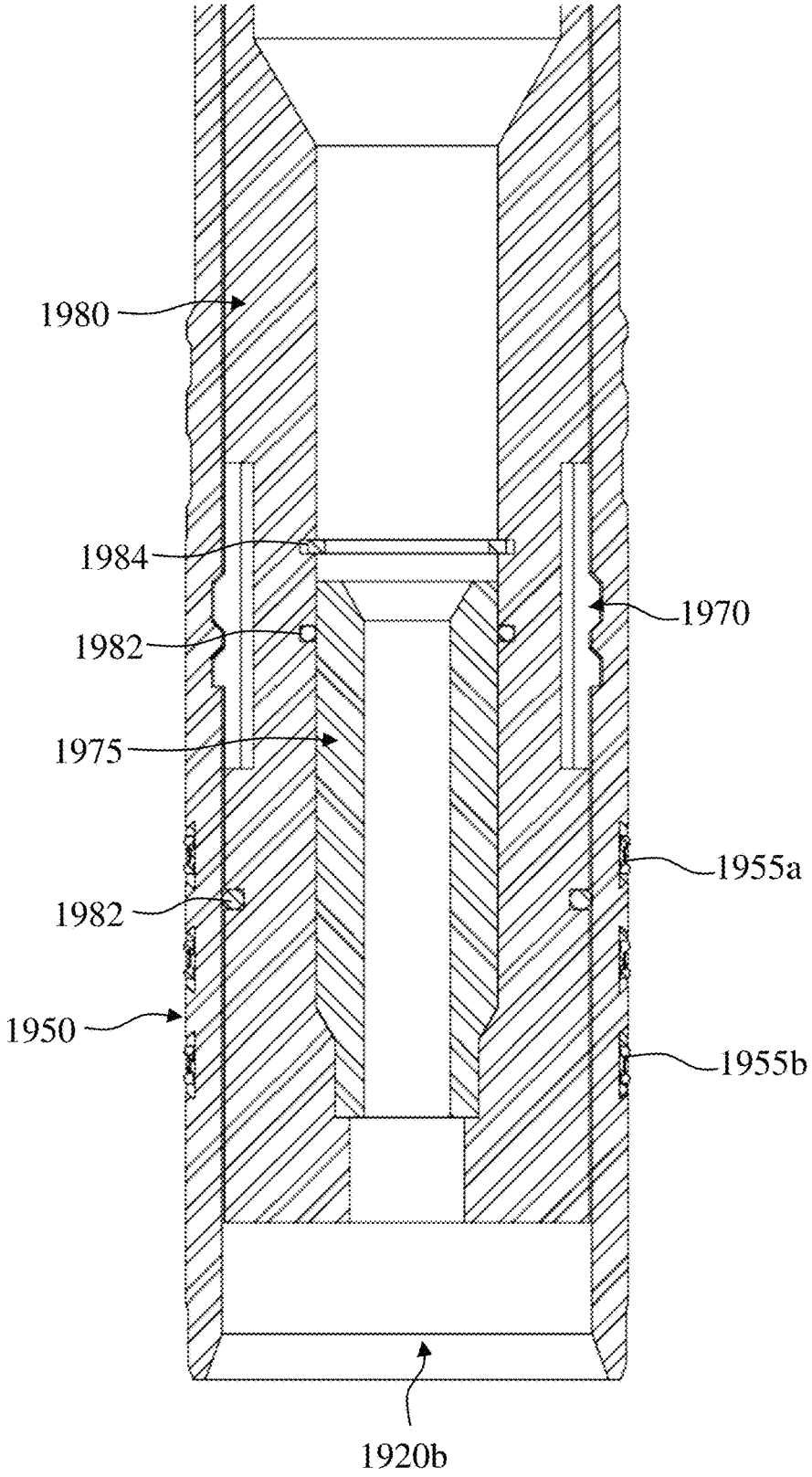

It may be desirable to control the production from lateral 12*b* and lateral 12*a* (and/or other wellbores located below 12*b*). In FIGS. 19C and 19D, an orifice insert 1975 is deployed inside of sleeve 1910. In some embodiments, orifice insert 1975 may be located proximate the second tubular end 1920*b* (lower end) of sleeve 1910 so that the flow from a lower wellbore (e.g., 12*a*) may be restricted and/or controlled (independently from 12*b*).

In some embodiments, the orifice insert 1975 may be fixedly-releasable from sleeve 1910. In some embodiments, the orifice insert 1975 may be mounted to a holder 1980 that can provide a means to retrieve and replace the orifice insert 1975 without pulling the sleeve 1910. In some embodiments, the holder 1980 may be releasably-fixed to sleeve 1910 by locking profile 1970 shown in FIG. 19C.

As shown in 19D, one or more seals 1982 may be used with the orifice insert 1975 and holder 1980. Furthermore, a retaining device 1984 maybe used to retain the orifice insert 1975 within the holder 1980.

Figure 19E:
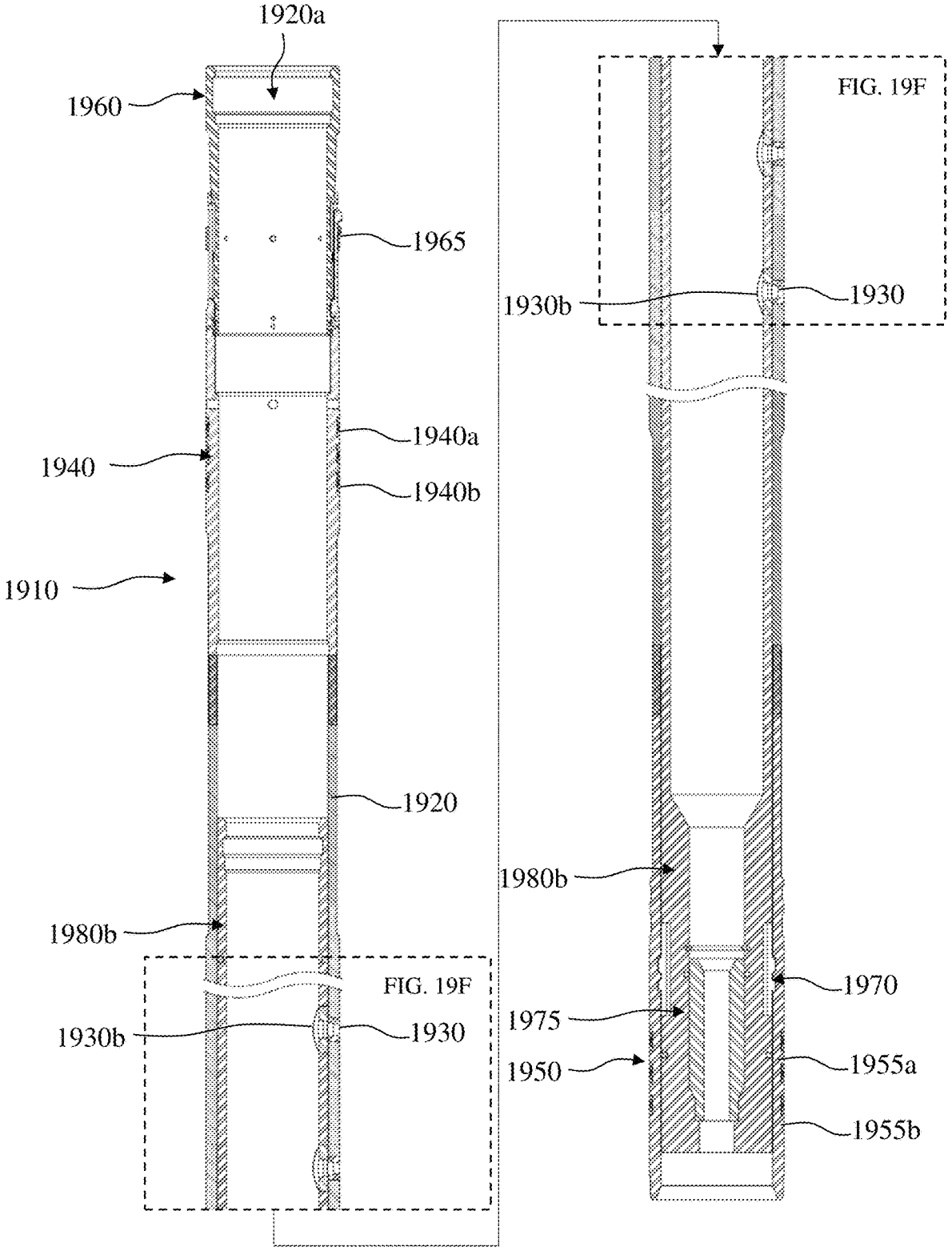
Figure 19F:
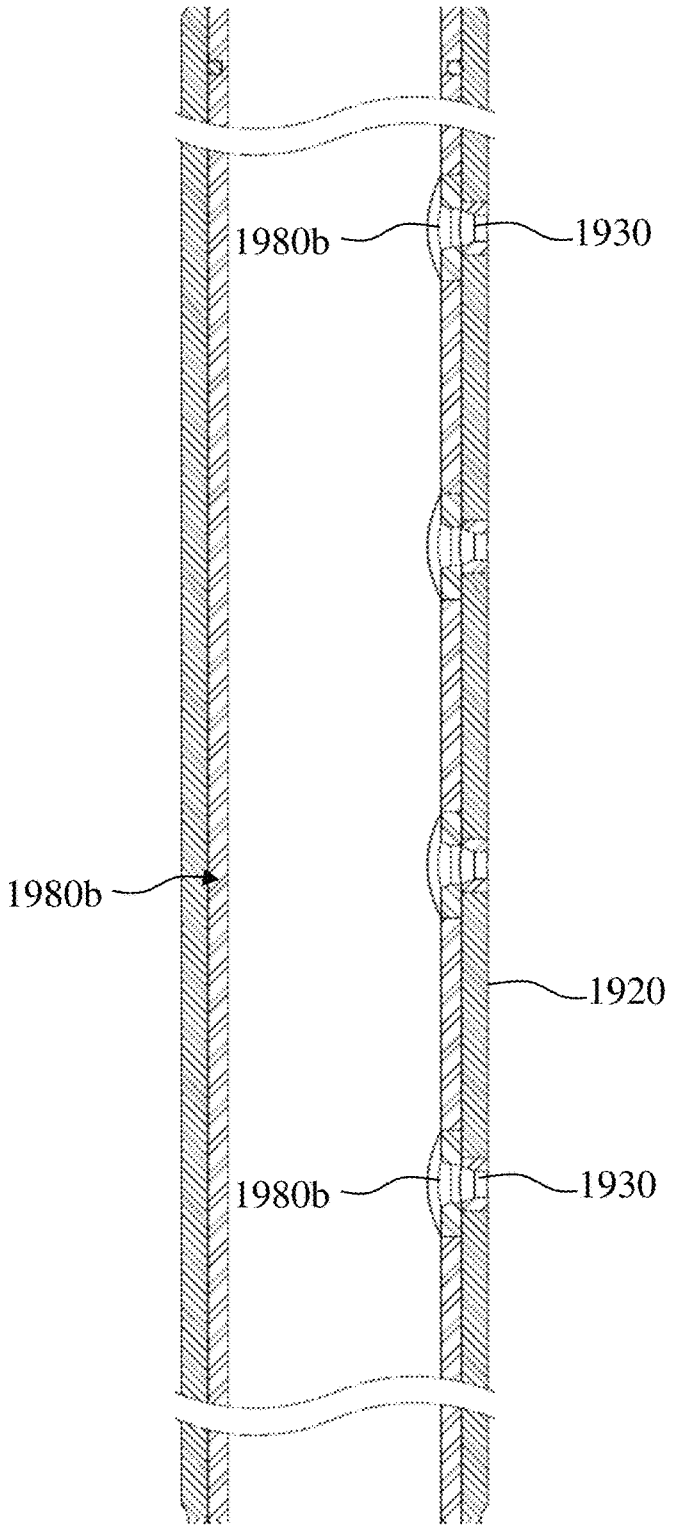
Figure 19G:
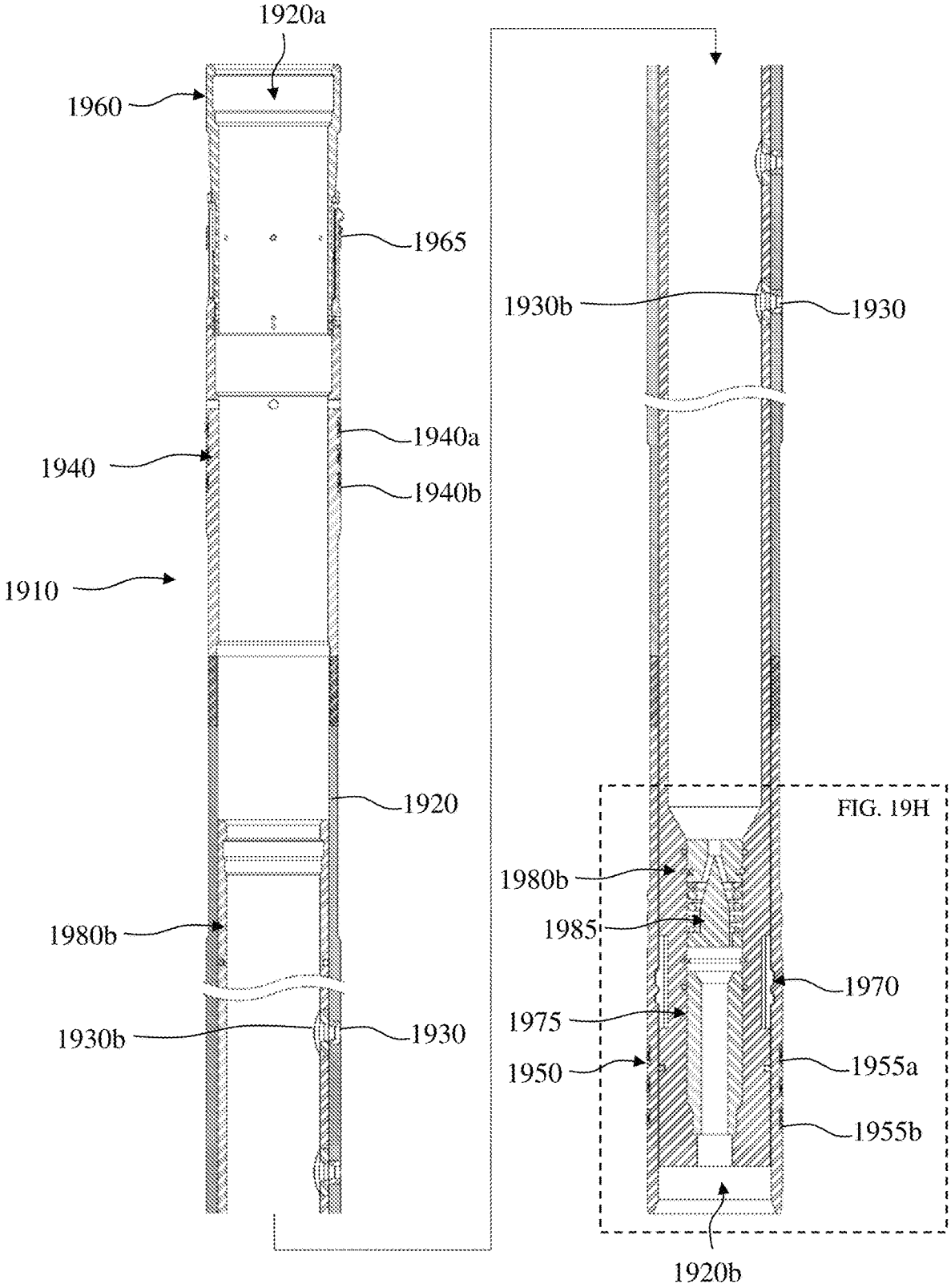
Figure 19H:
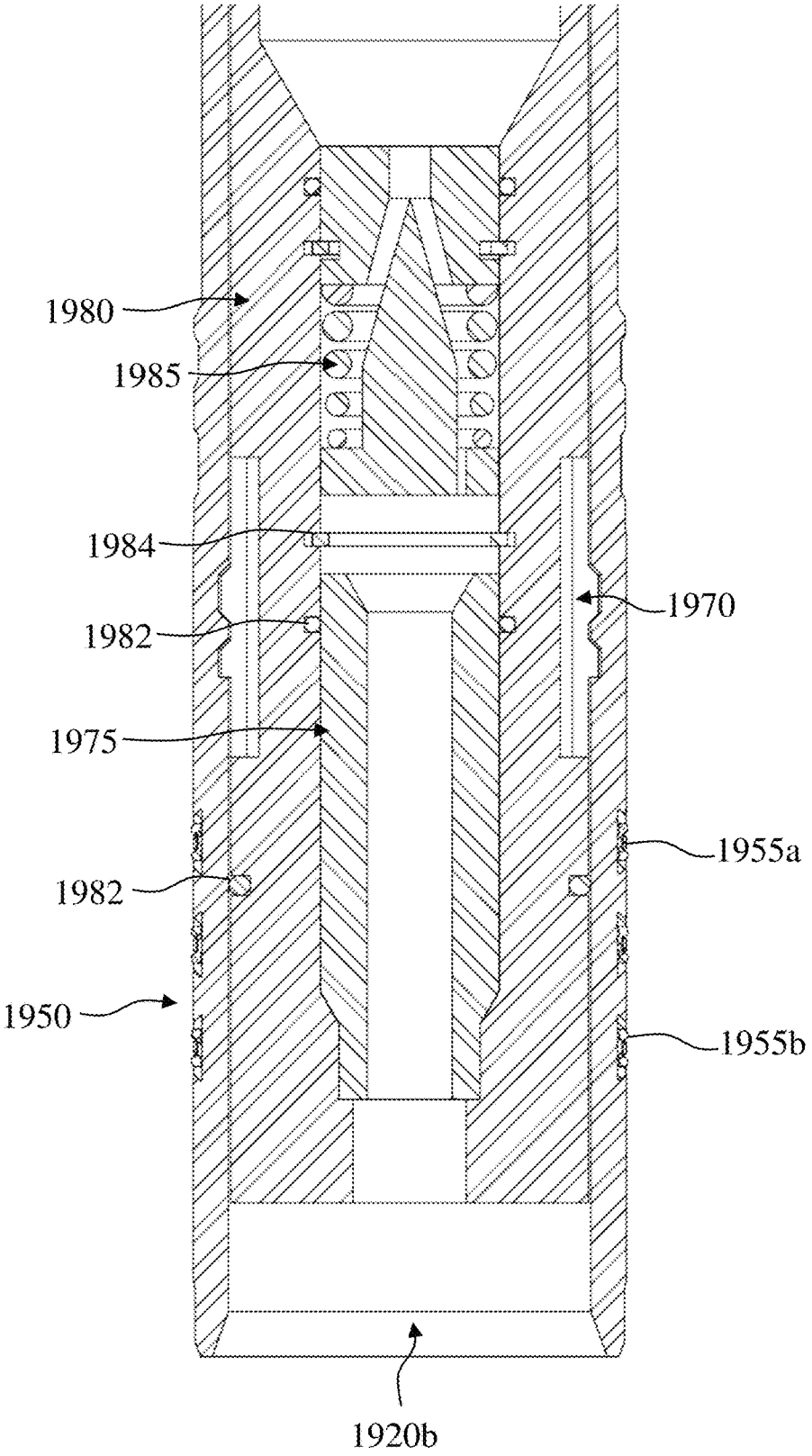

In some embodiments it may be desirable to change all orifices—including the orifice insert 1975 and the orifices 1930 controlling flow from lateral 12*b*—without pulling the entire sleeve 1910. In FIGS. 19E and 19F, the holder 1980 has been exchanged for a long holder 1980*b*. In this embodiment, the long holder 1980*b* may include the orifice insert 1975 as well as replacement orifices 1930*b* placed adjacent to secondary wellbore 12*b* (and opening 230 of 26).

FIGS. 19E and 19F illustrate the replacement orifices 1930*b* aligned with orifices 1930 of the sleeve 1910. The replacement orifices 1930*b* may be aligned by one or methods or devices, such as for example a lug or similar device (e.g., which may be similar follower 281 illustrated in FIG. 7). The lug or similar device (not shown) may be positioned along the outer surface of the tool used to deploy it into the well. The lug or similar device may protrude from an outer surface to engage orientation device in order to rotate the replacement orifices 1930*b* to the desired angular position within sleeve 1910.

Other ways may be utilized to orient the replacement orifices 1930*b*. In some embodiments the use of a running tool encompassing an electronic orientation device (e.g. gyroscope, 6-axis or 9-axis Inertial Measurement Unit (IMU), Measurement While Drilling (MWD) directional instruments, Halliburton's Work String Orientation Tool (WOT), etc.) may be used. Likewise, the running tool may also encompass a rotational device to physically rotate the replacement orifices 1930*b* to the desired orientation. The rotational device may be used with or without the aid of an electronic, mechanical, or other orientation devices.

In some embodiments, the orifices 1930, 1930*b* and 1975 are passive components. These orifices 1930, 1930*b* and 1975 may employ a specific setting to partially choke flow. The resulting arrangement can be used to delay water or gas breakthrough by reducing production from a selected wellbore (e.g., 12*a*, 12*b*, etc.).

In some embodiments, the sleeve 1910 comprises an actuatable component 1985 (e.g., valve) installed as part of a well completion to help optimize production, for example, by actively equalizing reservoir inflow from one or more wellbores (e.g., 12*a*, 12*b*, etc.). An actuatable component 1985 may be a spring-type component that adjusts the orifice sized as a function of the pressure differential.

Other actuatable components may comprise remotely-actuated devices (e.g., to change the size/area of the flow area and/or orifice) (e.g., remote flow control valve, interval control valve, etc.) or other parameter/mechanism. The active components may be actuated via pressure pulses, time intervals, temperature changes, fluid changes, etc. (or combination thereof) from the surface or other location.

In some other embodiments, the orifices 1930, 1930*b* and 1975 may comprise embodiments of an autonomous control device similar to Halliburton's EquiFlow® Autonomous In Flow Control Device (AICD). The orifices 1930, 1930*b* and 1975 may comprise an entry shape and/or internal design to create a rotational flow. Oil may exit the orifices with a pressure drop very similar to that of a passive (e.g., fixed flow area) orifice while gas and water rotate at a higher velocity because of their lower viscosities, creating low pressure in the core region that causes flow breakdown. As a result, the flow rates of gas and water are reduced. Another benefit of the higher velocity of gas and water is that the effect increases as the amount of gas and water in the flow stream increases.

Figure 19I:
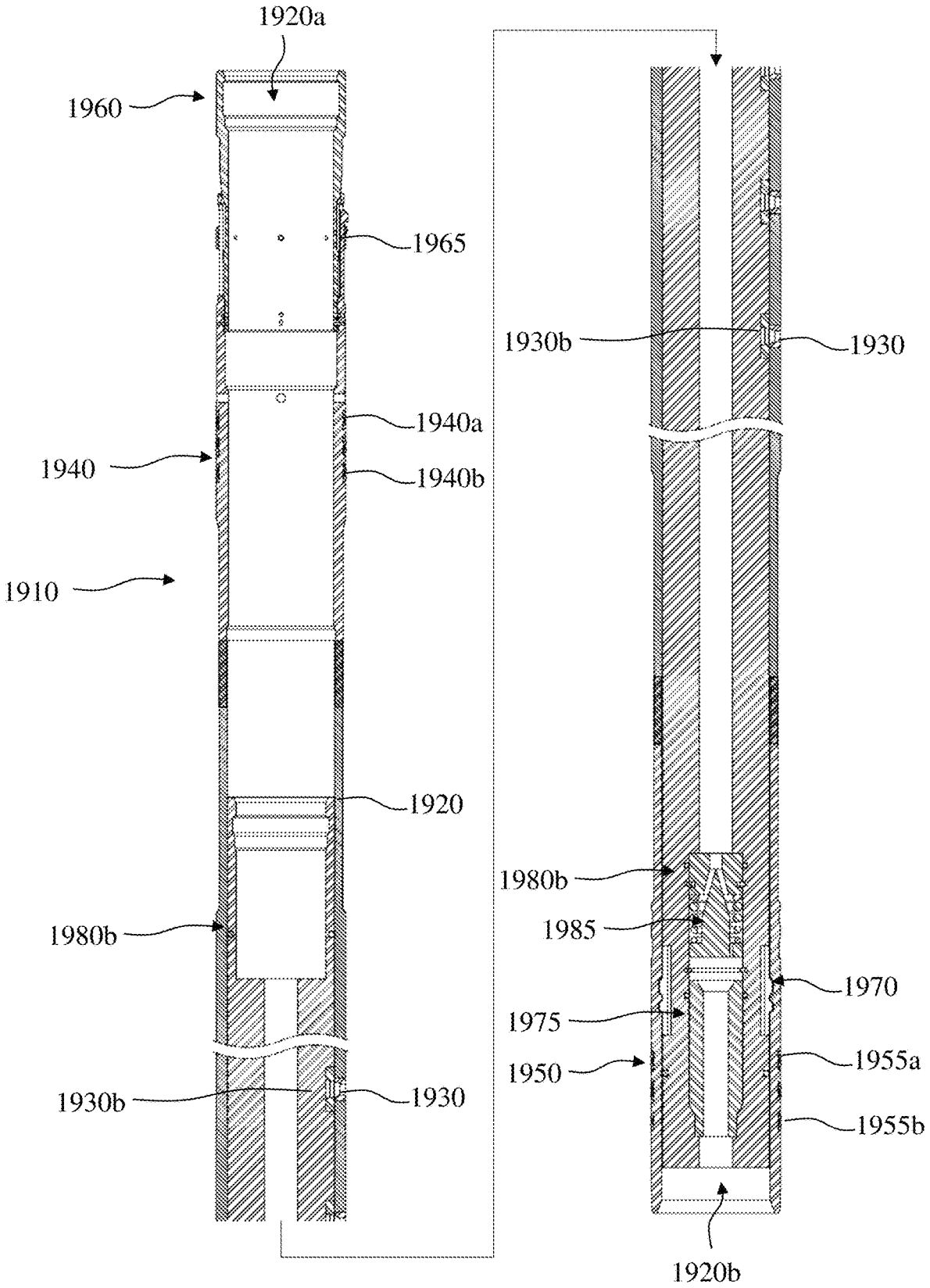

FIG. 19I illustrates the area (or volume) that is available for implementing an autonomous feature. In some embodiments, the area/volume may be used to implement actuatable components. By utilizing one or more control devices in wellbore 12*a*, 12*b*, and other connected wellbores the flow of oil, gas, water and combinations thereof may be regulated and controlled. When used in concert with sleeve 1910, and 226, the production of oil, gas and water can be optimized to maximize hydrocarbon recovery and increase economic returns during various stages of the multilateral well's life (e.g., natural flow, during secondary recovery operations (e.g., using ESP's, Rod Pumps, Gas Lift, etc.) and during tertiary recovery and/or disposal operations (e.g., water flood, CO2 flood, chemical flood, water disposal, etc.).

At some point in time, the pressures within the lower secondary wellbore 12*a* and/or upper secondary wellbore 12*b* may reduce to a value wherein the high-pressure frac string 251 and/or frac window system 226 may be removed from the wellbore 12, and optionally, a less expensive conventional frac window system and/or low-pressure frac string and/or production tubing may be insert within the wellbore 12 for collecting the commingled flow from the lower secondary wellbore 12*a* and the upper secondary wellbore 12*b*. For example, the frac window system 226 may be left in the wellbore 12 until a later time, such as when the bottom hole pressure (BHP) is low enough that 5,000-psi (e.g., 340 atm) completion equipment may be installed. At that time, the operator would purchase 5,000-psi (e.g., 340 atm) rated equipment that is made of low-alloy steel, which has a low enough yield strength that corrosion is not a concern (e.g., L-80 material, K-55 material, etc.), and install it within the wellbore 12.

Figure 20:
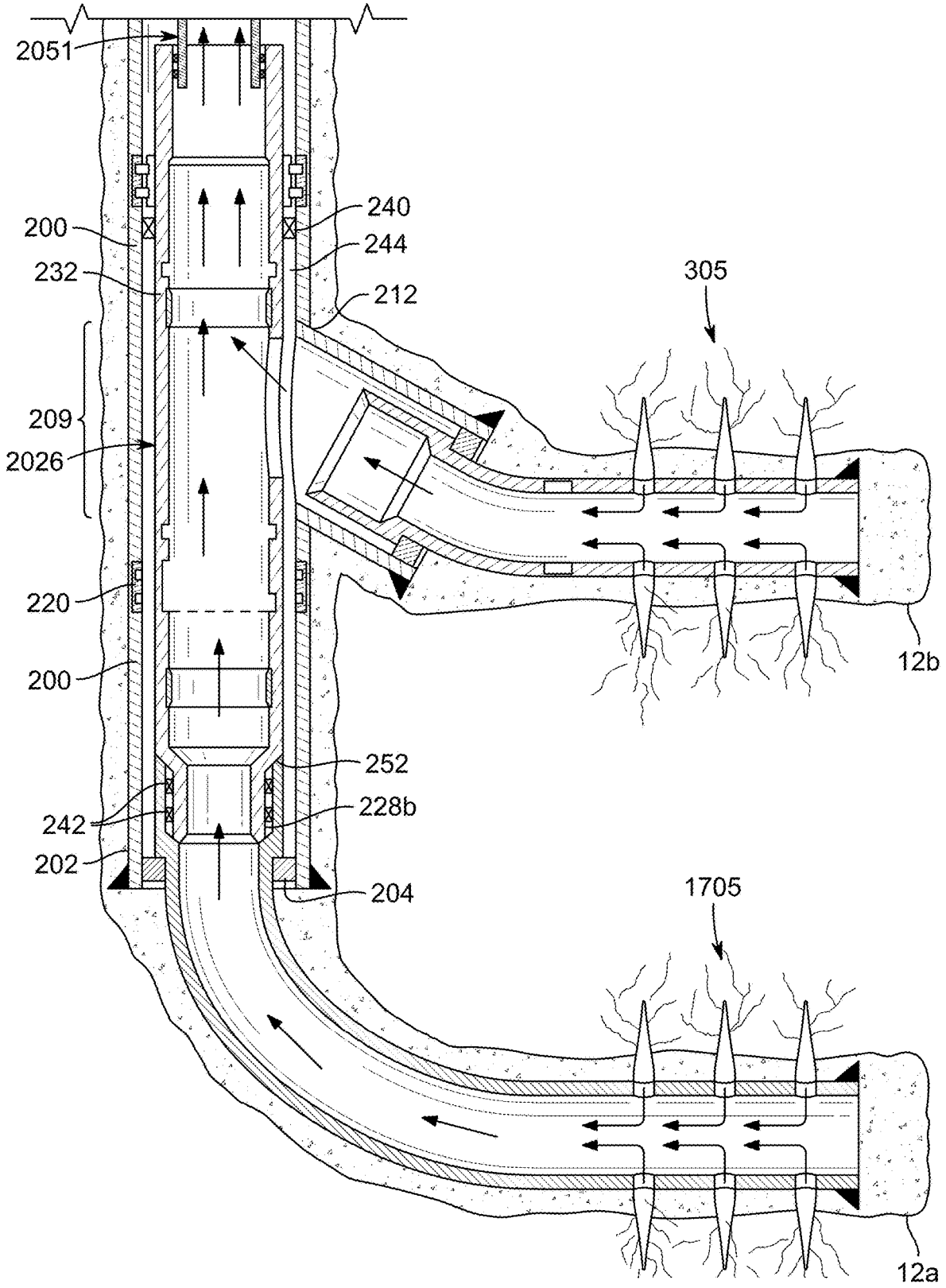

FIG. 20 illustrates the removal of the frac window system 226 and the installation of a conventional frac window system 2026 (e.g., 5,000-psi rated equipment). FIG. 20 additionally illustrates a low-pressure frac string 2051 engaging with the conventional frac window system 2026. In an alternative embodiment, conventional production tubing, as opposed to the low-pressure frac string 2051, may engage with the conventional frac window system 2026.

In other embodiments, a dual-string completion system, such as Halliburton's FloRite® System, which allows separate production from lower secondary wellbore 12*a* and the upper secondary wellbore 12*b*, may also be utilized. One advantage of the FloRite® System with Vector Block is that it allows re-entry into either lateral wellbore 12*a*, 12*b*. It also provides a high-pressure Level 5 hydraulic seal between the lateral wellbore 12*b* and the mainbore 12, which ensures a less drawdown at the heal of lateral wellbore 12*b*.

Figure 21:
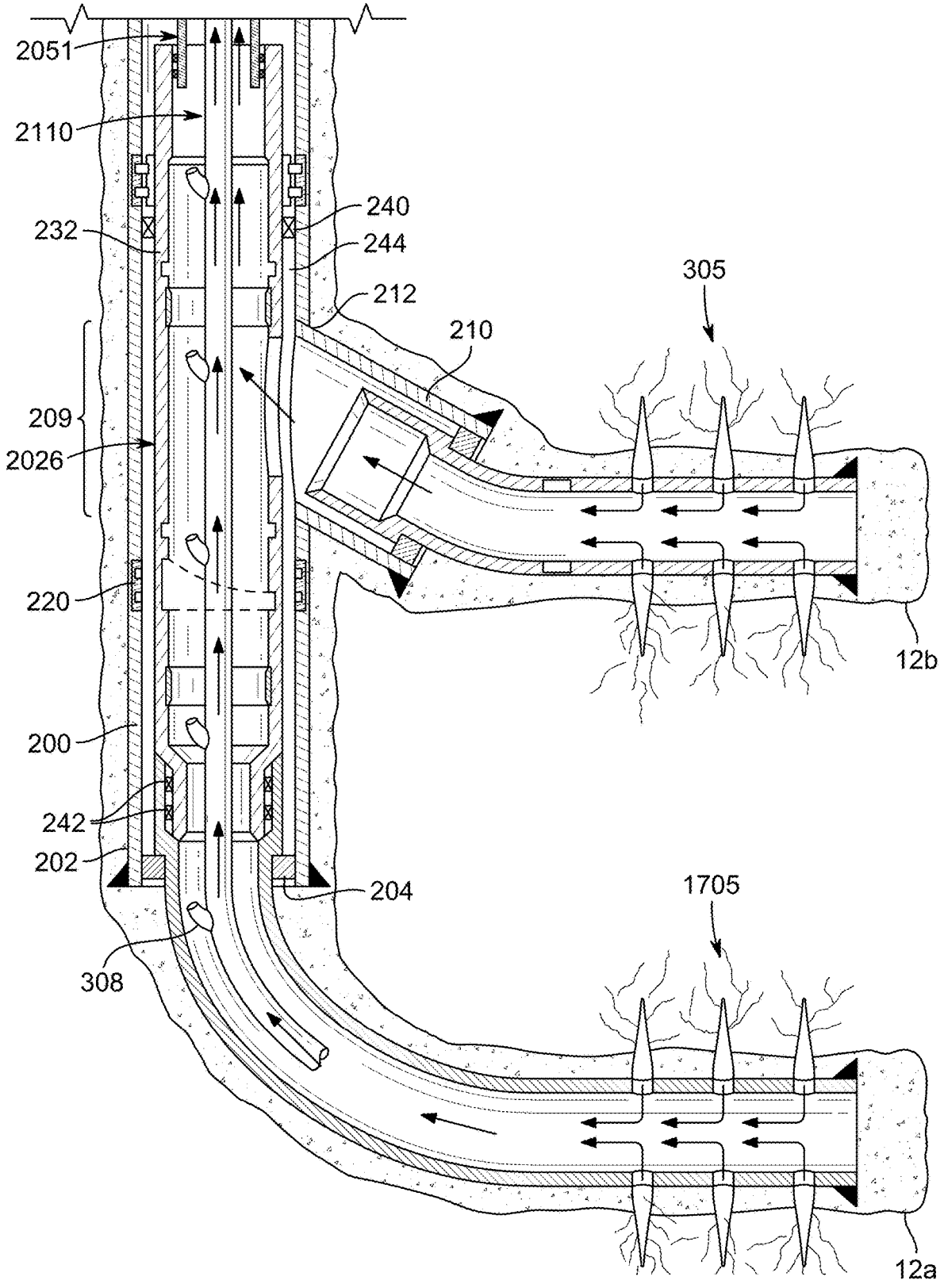
Figure 22:
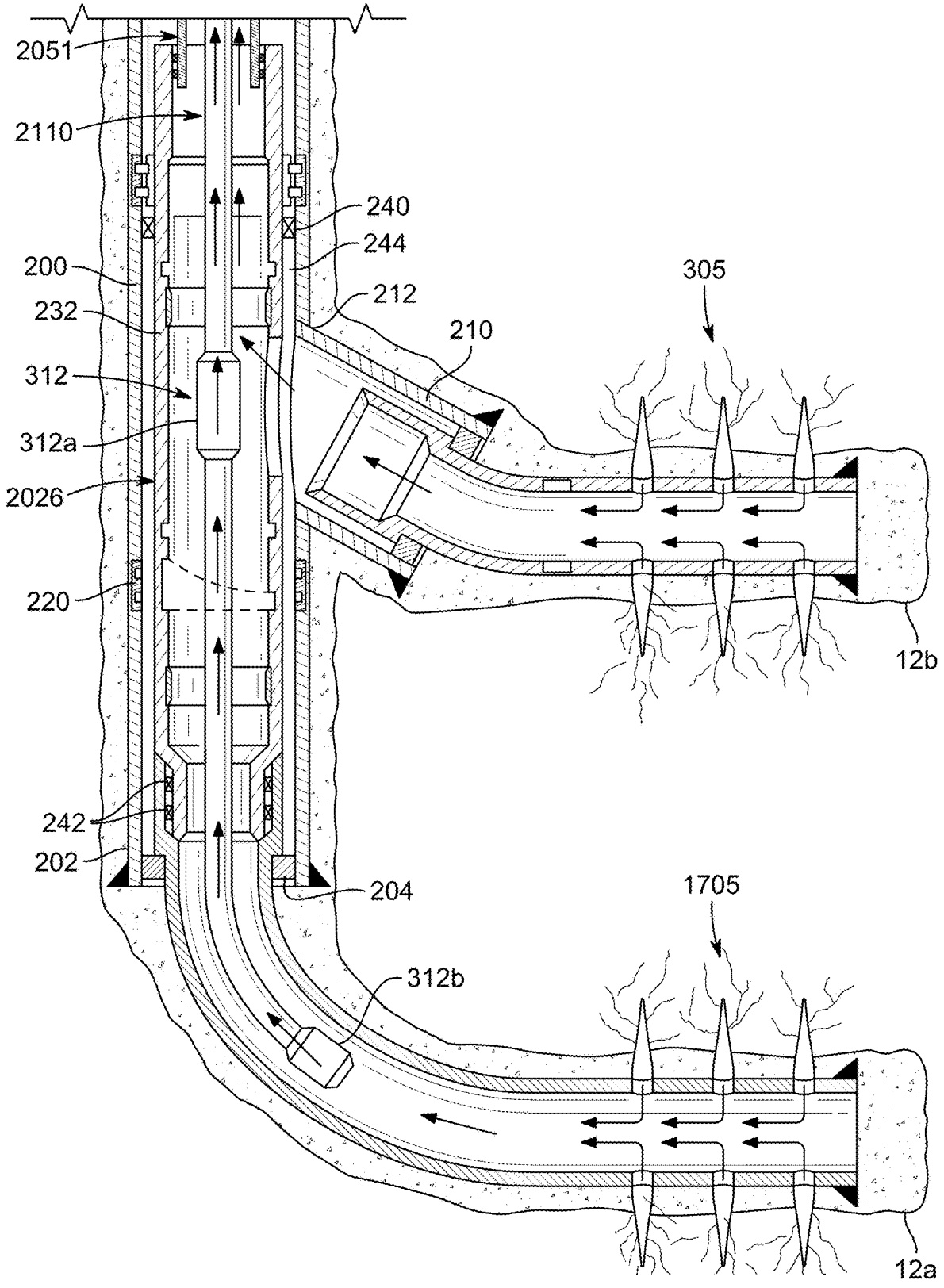

FIGS. 21 and 22 illustrate the well system of FIG. 20 after different types of artificial lift equipment 2110, 2210, respectively, have been installed within the wellbore 12. In at least one embodiment, the artificial lift equipment 2110, 2210 is installed at the same time as the conventional frac window system 2026 and/or low-pressure frac string 2051, thereby saving time and money.

Figure 23:
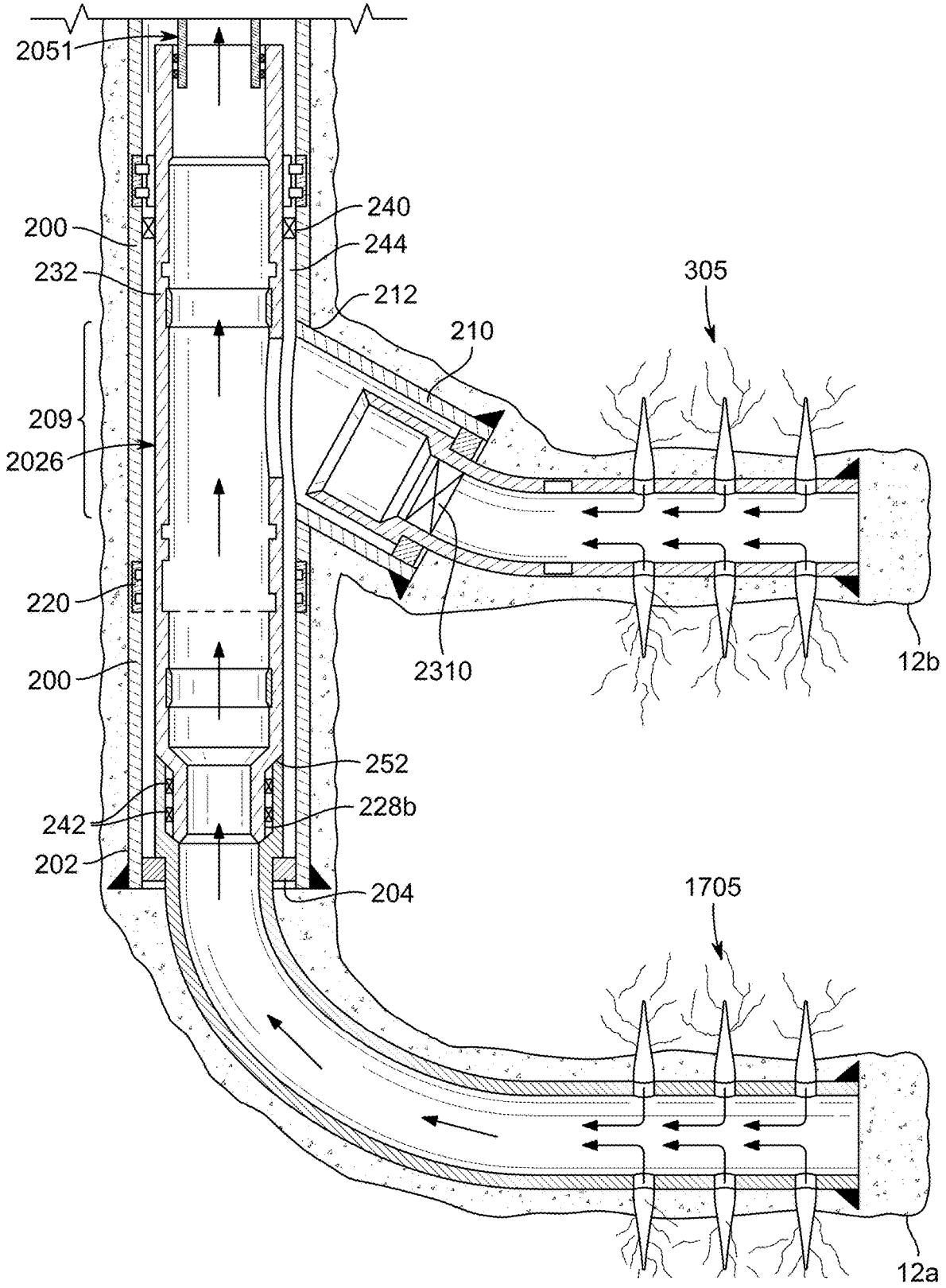

FIG. 23 illustrates the well system of FIG. 20 after the placement of an upper secondary wellbore plug 2310 within the upper secondary wellbore 12*b*. In the illustrated embodiment, the upper secondary wellbore plug 2310 is run-in-hole through the low-pressure frac string 2051. In at least one embodiment, the upper secondary wellbore plug 2310 is a high-expansion plug, as might be required to traverse the low-pressure frac string 2051 while still having the ability to seal the upper secondary wellbore 12*b*.

Figure 24A:
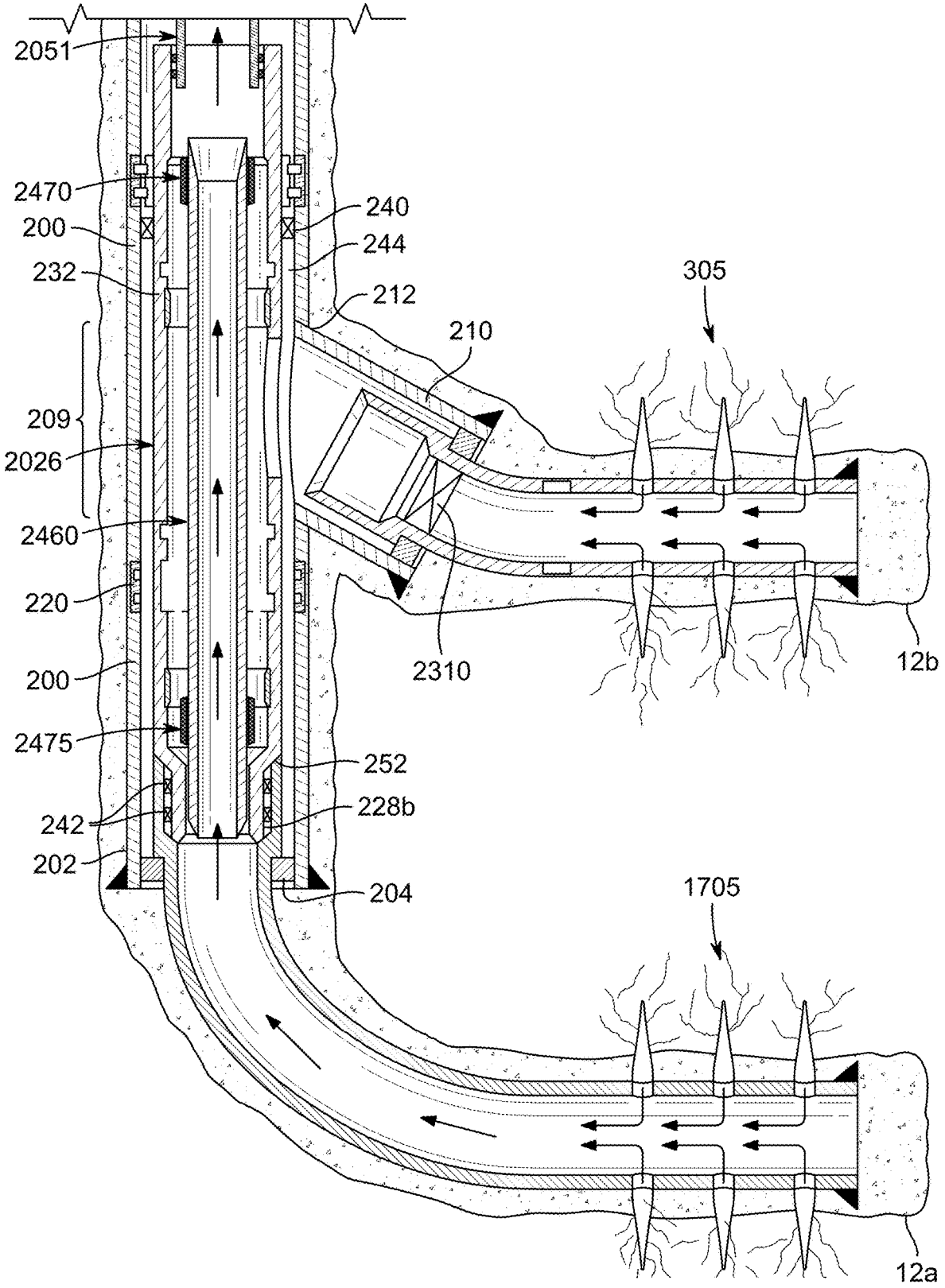

FIG. 24A (e.g., with reference to FIG. 24B) illustrates the placement of an isolation sleeve 2460 within the convention frac window system 2026. The isolation sleeve 2460, in at least one embodiment, is similar in many respects to the isolation sleeve 260 described and illustrated with respect to FIG. 5 above. For example, the isolation sleeve 2460 includes a tubular 2465 having a first tubular end 2465*a* and a second tubular end 2465*b*. However, the isolation sleeve 2460 additionally includes a first high-expansion seal 2470 located at least partially along an outer surface of the tubular 2465 proximate the first tubular end 2465*a* and a second high-expansion seal 2475 located at least partially along the outer surface of the tubular 2465 proximate the second tubular end 2465*b*. The first and second high-expansion seals 2470, 2475, in the illustrated embodiment, are configured to move between a radially retracted state (FIGS. 24A-24C) for running the isolation sleeve 2460 in hole and a radially expanded state (FIGS. 25A-25C) for engaging an inner surface of the frac window system 2026. Accordingly, the isolation sleeve 2460 may be similar to the isolation sleeve 260, but for the inclusion of the high-expansion seals 2470, 2475 and the smaller outside diameter necessary to traverse the low-pres sure frac string 2051. In the illustrated embodiment, the first high-expansion seal 2470 and the second high-expansion seal 2475 are spaced such that they isolate (e.g., span) a junction between the first wellbore 12 and the secondary wellbore 12*b*. In the illustrated embodiment, the isolation sleeve 2460 is run-in-hole through the low-pressure frac string 2051. In the embodiment of FIG. 24A, the high-expansion seals 2470, 2475 are in their radially retracted state.

Figure 24B:
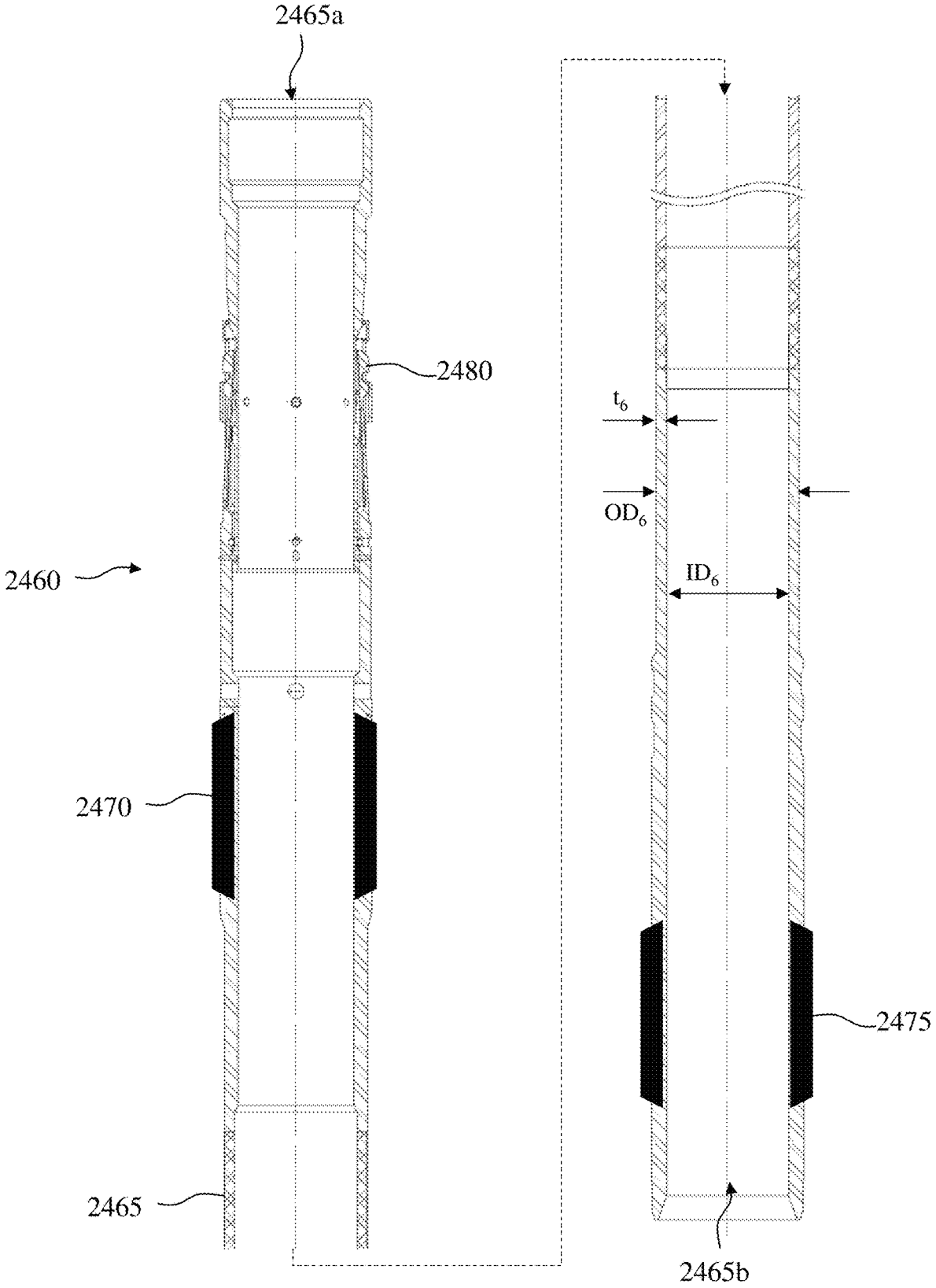

FIG. 24B illustrates an enlarged cross-sectional view of the isolation sleeve 2460 of FIG. 24A having the high-expansion seals 2470, 2475. In the illustrated embodiment, the isolation sleeve 2460 further includes a depth mechanism 2480 disposed at least partially along the outer surface of the tubular 2465, the depth mechanism 2480 configured to engage a related depth mechanism disposed along an inner surface of the frac window system 2026. In at least one embodiment, the depth mechanism 2480 is positioned between the first high-expansion seal 2470 and the first tubular end 2465*a*.

In the illustrated embodiment of FIG. 24B, the isolation sleeve 2460 includes an inside diameter ($ID_6$) and an outside diameter ($OD_6$). The outside diameter ($OD_6$), in at least one embodiment, is at least 0.95" (e.g., 2.413 cm), if not at least 2.867" (e.g., 7.28 cm), if not at least 4.545" (e.g., 11.54 cm), if not at least 6.151" (e.g., 15.62 cm), if not at least 12.313" (e.g., 31.28 cm), or more. Again, the outside diameter ($OD_6$) may be based at least in part upon the inside diameter of the low-pressure frac string 2051 that the isolation sleeve 2460 must traverse. The inside diameter ($ID_6$), in at least one embodiment, is at least 0.47" (e.g., 1.19 cm), if not at least 2.398" (e.g., 6.09 cm), if not at least 3.96" (e.g., 10.06 cm), if not at least 5.36" (e.g., 13.61 cm), if not at least 11.081" (e.g., 28.15 cm), or more. In at least one embodiment, the isolation sleeve 2460 comprises at least 55-ksi grade material that can accommodate an internal yield pressure of at least 5,000-psi (e.g., 340 atm).

In yet another embodiment, the isolation sleeve 2460 has a wall thickness ($t_6$). In at least one embodiment, the wall thickness ($t_6$) is at least 0.2" (e.g., 0.51 cm), if not at least 0.7" (e.g., 1.78 cm), if not at least 2.0" (e.g., 5.08 cm). In at least one embodiment, the wall thickness ($t_6$) ranges from 0.22" (e.g., 0.56 cm) to 0.634" (e.g., 1.61 cm).

The term high-expansion, as used herein, means that the feature expands by at least 3% when moving from its radially reduced state to its radially expanded state. In yet another embodiment, the term extremely high-expansion, as used herein, means that the feature expands by at least 10% when moving from its radially reduced state to its radially expanded state. In yet another embodiment, the term super high-expansion, as used herein, means that the feature expands by at least 15%, if not at least 20%, or not at least 25%, when moving from its radially reduced state to its radially expanded state. Unless otherwise stated, any reference to high-expansion in this document may encompass all of the above percentages.

Figure 24C:
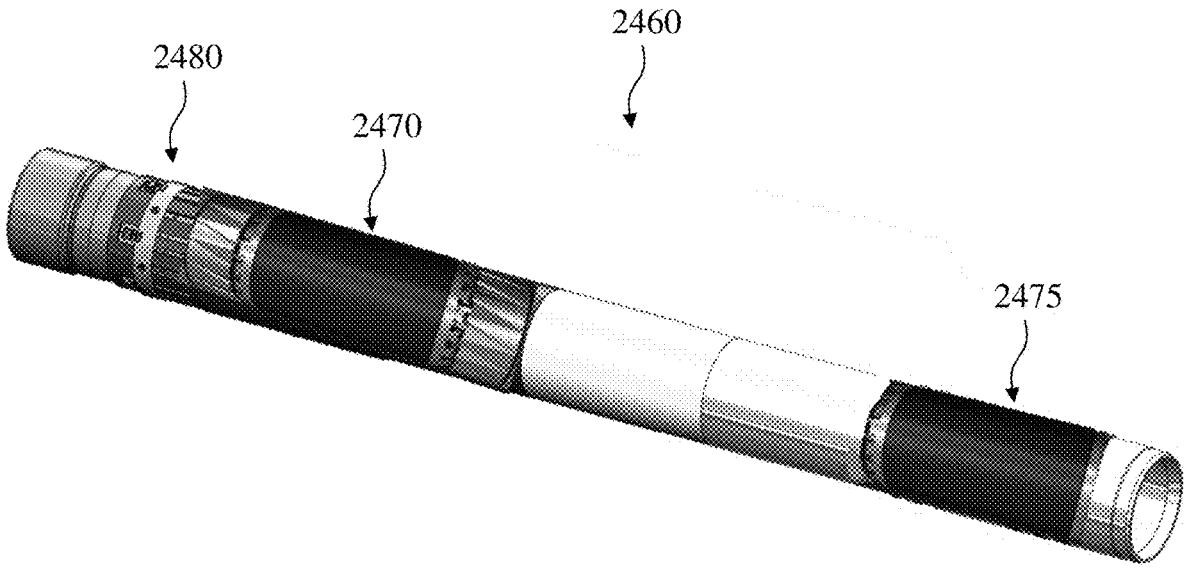

FIG. 24C illustrates an isometric view of an alternative embodiment of the isolation sleeve 2460 of FIG. 24A having the high-expansion seals 2470, 2475 in their radially retracted state.

Figure 25A:
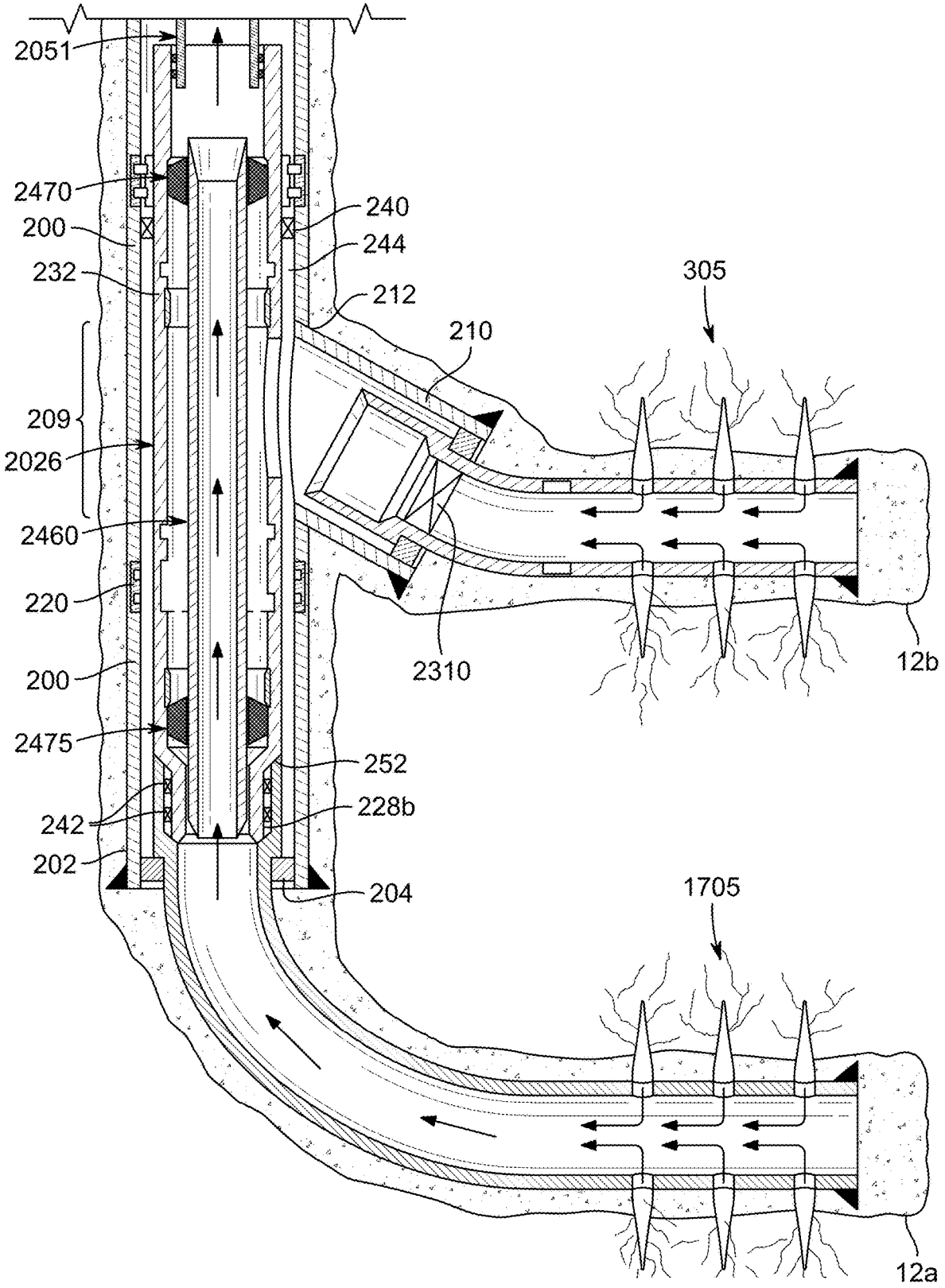

FIG. 25A illustrates the expansion of the high-expansion seals 2470, 2475 of the isolation sleeve 2460 within the convention frac window system 2026. Accordingly, as shown, the high-expansion seals 2470, 2475 are in their radially expanded state.

Figure 25B:
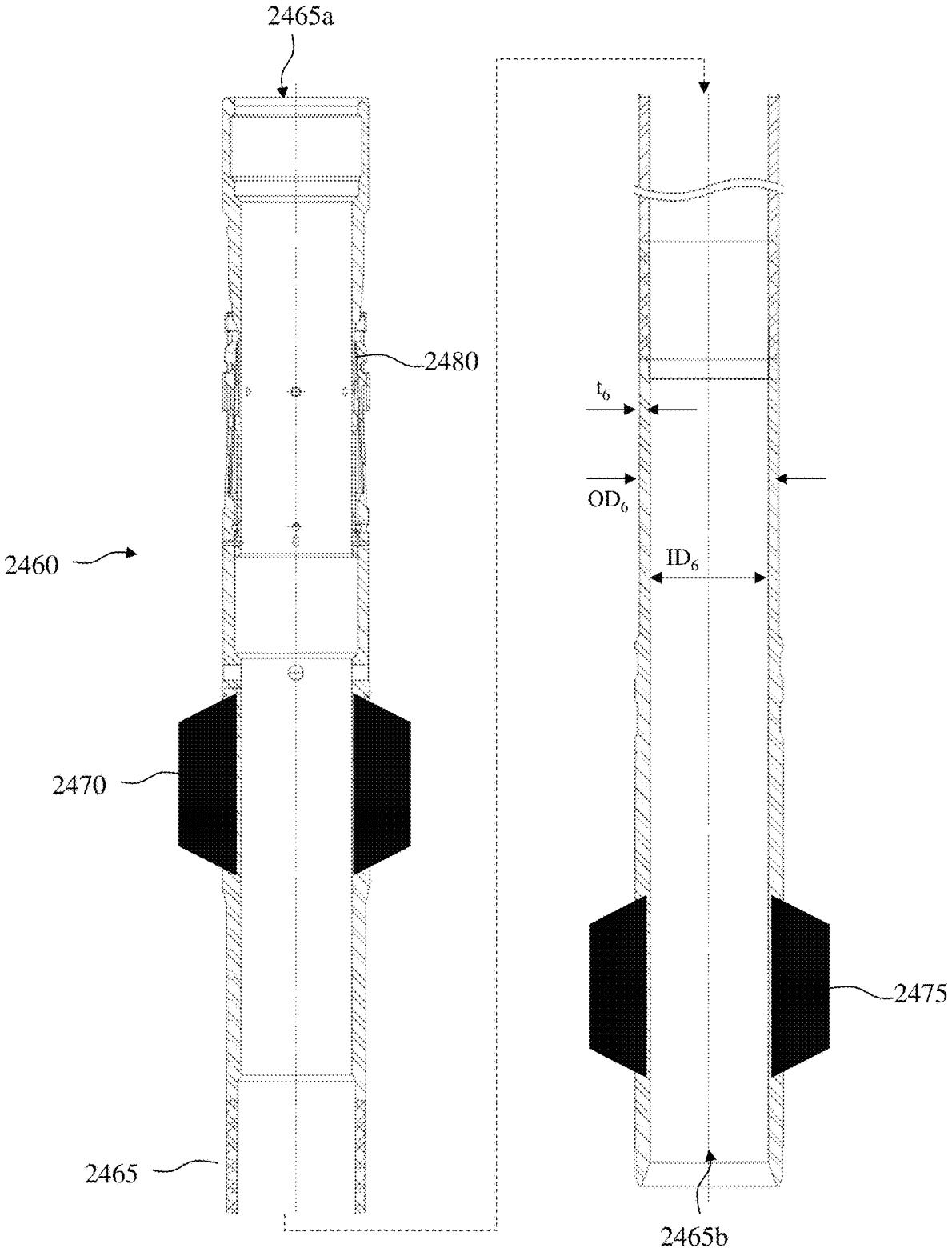

FIG. 25B illustrates an enlarged cross-sectional view of the isolation sleeve 2460 of FIG. 25A having the high-expansion seals 2470, 2475 in their radially expanded state.

Figure 25C:
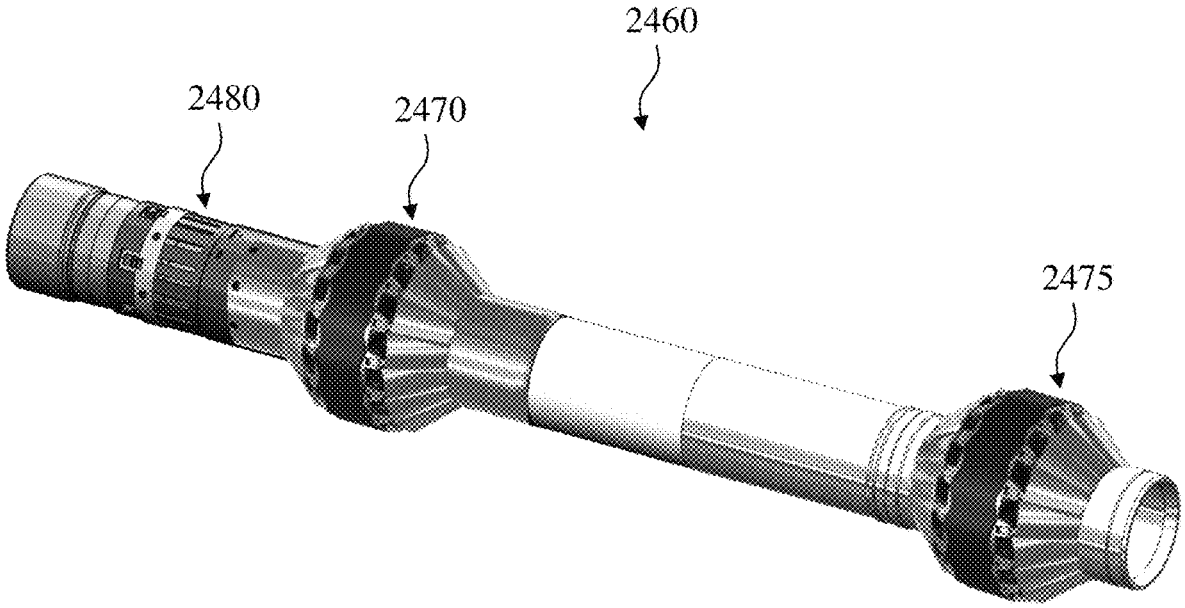

FIG. 25C illustrates an isometric view of an alternative embodiment of the isolation sleeve 2460 of FIG. 25A having the high-expansion seals 2470, 2475 in their radially expanded state.

Figure 24D:
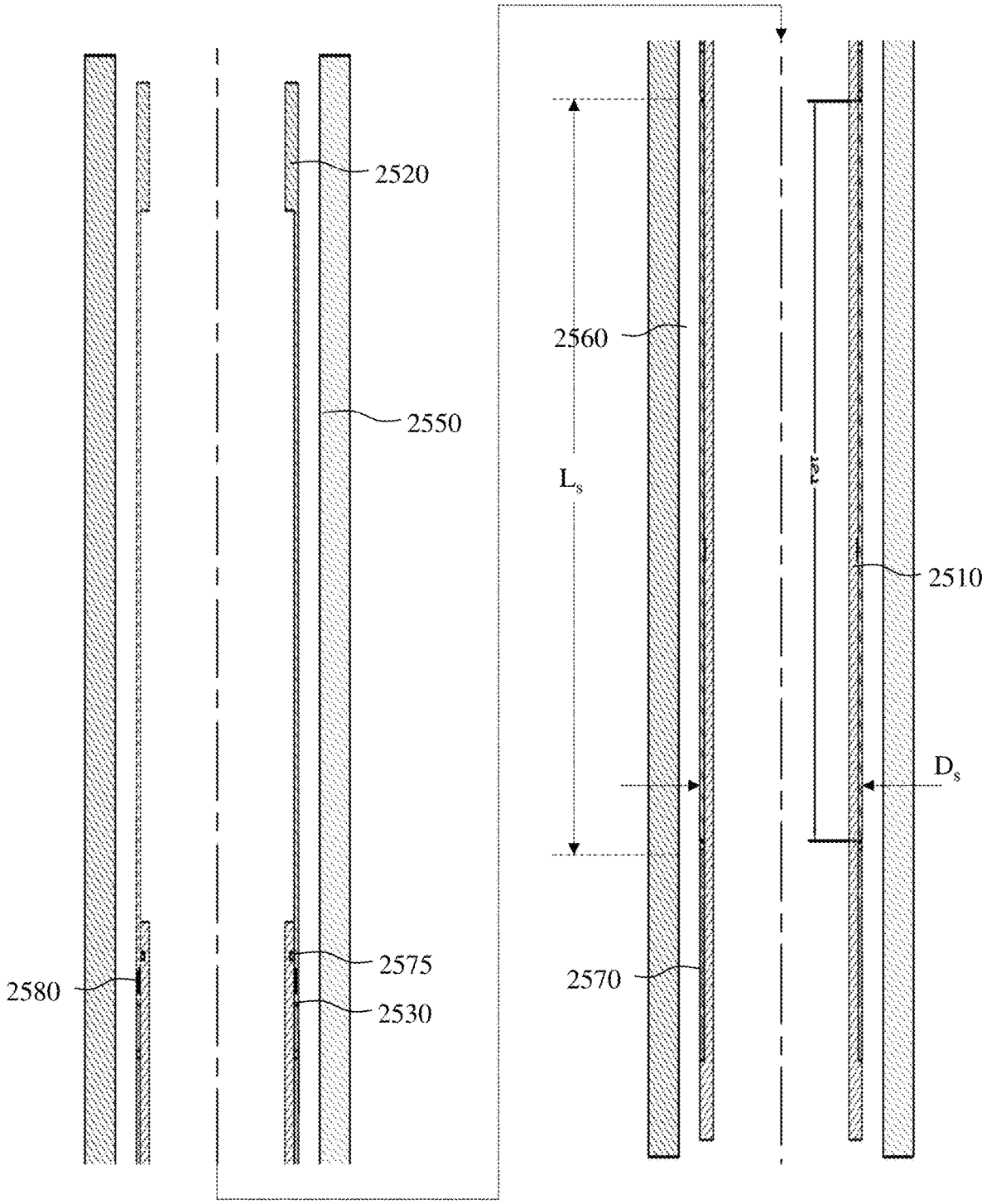
Figure 25D:
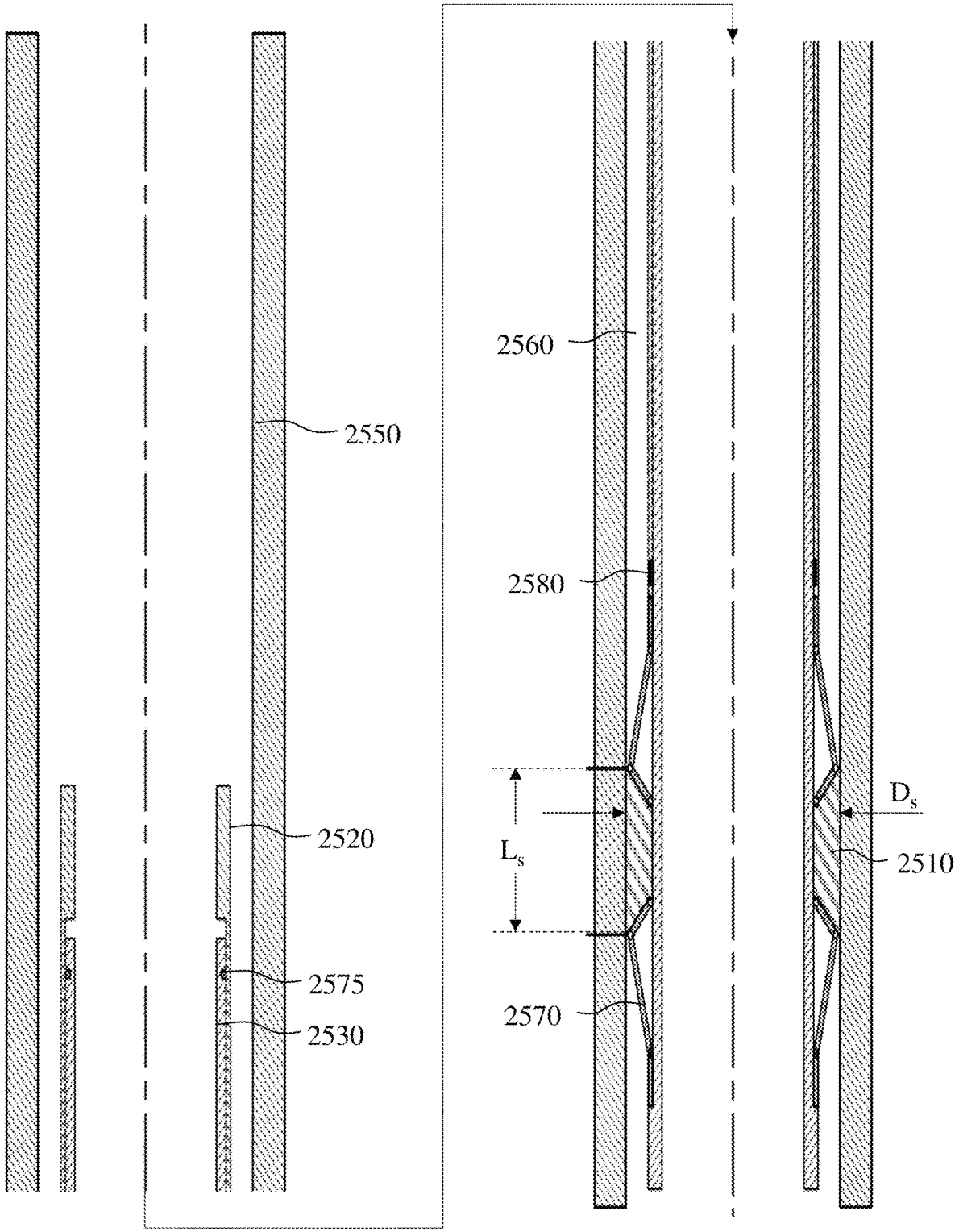

FIG. 25D, with reference to 24D, illustrates a cross-sectional view of an alternative embodiment of the isolation sleeve of FIG. 24D having the high-expansion seals in their radially expanded state (FIG. 25D) and radially retracted state (FIG. 24D). In at least one embodiment, the high-expansion seals 2510 may require the compression of the elastomer seals so that the outside diameter ($D_s$) will increase as the length ($L_s$) of the elastomer seals decrease. In one or more embodiment this may require a 2-part mandrel so one end of the elastomer seals remains fixed while the other end is compressed by the movement of a 2-part mandrel. The dynamic portion 2520 of the 2-part mandrel is in the extended position when the assemble is being run into the well. When a specific load is applied to the dynamic portion, it is released via one or more shear devices (not shown) As the dynamic portion 2520 travels downwards, the high-expansion seals 2510 are compressed axially; and the length ($L_s$) of the elastomer decreases. In most embodiments, the high-expansion seals 2510 are nearly incompressible meaning that the volume of the high-expansion seals does not change under load. Consequently, as length ($L_s$) of the elastomer decreases, the outside diameter ($D_s$) increases. In some embodiments, the gap 2560 between the OD of the isolation sleeve and the ID of the item which the elastomer will seal against requires a bridging device at each end of the elastomer seals. Without a bridging device, the elastomer seals may extrude (flow) away from the ID which it is intended to seal against. This extruding of the elastomer may result in inadequate pressure between the ID it is to seal against and the elastomer itself. This pressure is often referred to as the sealing pressure. If the sealing pressure is less than the pressure of the fluid that is trying to pass by the elastomer seal, the seal is inclined to fail. Therefore, in a bridging device is typically needed for the elastomer seals to affect enough sealing pressure. In one or more embodiments, the bridging device may be an articulating bridging device like 2570 that increases in OD as it is compressed axially.

Once the high-expansion seals 2510 are forced outwards and pressed against the seal surface 2550, a locking mechanism may be activated to lock dynamic portion 2520 and static portion 2530 of the 2-part mandrel together. In one or more embodiments, the locking mechanism may comprise an internal slip 2580 which has a toothed-profile which will lock into a mating toothed profile 2582. In some embodiments, the locking mechanism may comprise a releasing feature to unlock the 2-part mandrel so the high-expansion seals 2510 may relax and the assembly retrieved from the well. As shown, one or more seals 2575 may be utilized to provide a pressure barrier between the dynamic portion 2520 and static portion 2530 of the 2-part mandrel. The things shown and discussed here are only examples of things that can be utilized to compress, lock a force/load into the high-expansion seals 2510 (referred to as energizing the seals), seal the path between the 2-part mandrel, etc. In other embodiments, the articulating bridging device may be replaced with "petal plates". Petal plates are a set of more than one set of plates that have the shape of petals of a flower. Just like the petals of a flower can expand outwards rather easily, the petal plates expand outwardly while the high-expansion seals 2510 are being compressed. The petal plates, in some embodiments, expand outwardly enough to contact the seal surface 2550. In some embodiments, the edges of the petal plate that contact the seal surface 2550 maybe supported by portions of the high-expansion seals 2510 creating a high-pressure seal with the petal plate edges trapped between the portions of the high-expansion seals 2510 and the seal surface 2550. Since the petal plate is trapped, the extrusion gap is zero, which means the seal material cannot extrude between the petal plate and seal surface 2550. In one or more embodiments, the tool, or running tool, may have centralizing device that will force the tool into a centralized location within the body it is to seal against. One of the reasons for a centralizing device is to ensure the seals are not laying lowside in the well. Laying lowside would require unequal radial load to the seals since one side of the seals would be required to lift the tool and simultaneously effect a seal. By centralizing the tool prior to "setting" the seals, the seals are loading evenly around the circumference and a uniform seal pressure is created.

Figure 26:
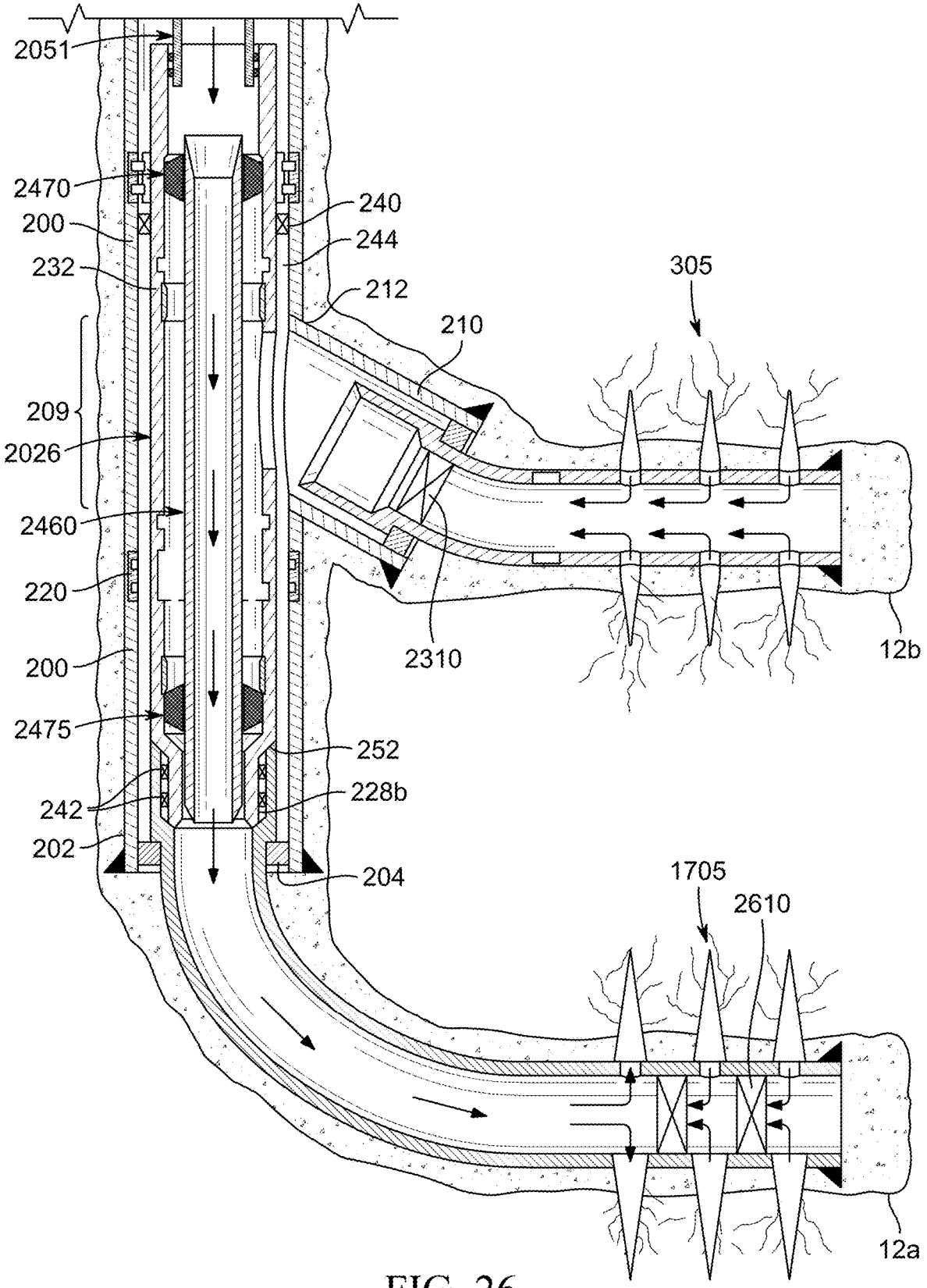

As shown in FIG. 26, the isolation sleeve 2460 functions to isolate the portion of first wellbore 12 below window 212, including secondary wellbore 12*b*, from secondary wellbore 12*a*. The seals, as described above, permit delivery of a high-pressure fluid to lower secondary wellbore 12*a* without impacting upper secondary wellbore 12*b*. For example, hydraulic fracturing operations can be carried out with respect to lower secondary wellbore 12*a* without impacting upper secondary wellbore 12*b*. This might be desirable after one secondary wellbore 12*a*, 12*b* has been producing for some time and it is determined that only certain secondary wellbores within the system (such as secondary wellbore 12*a*) may need stimulation, while other secondary wellbores (such as secondary wellbore 12*b*) do not. The isolation sleeve 2460 not only isolates the wellbores 12*a* and 12*b* from one another, but also provide a path for balls, plugs, etc. to be dropped from the surface to isolate individual zones in the wellbores during the stimulation process.

As shown in FIG. 26, the lower secondary wellbore 12*a* has at least partially been re-stimulated. For example, the lower secondary wellbore 12*a* has been re-stimulated from toe to heal, for example using one or more frac plugs 2610 to isolate the different stimulated regions. In at least one embodiment, as shown, the deployment of the frac plugs 2610 and the re-stimulation process are conducted through the low-pressure frac string 2051.

Figure 27:
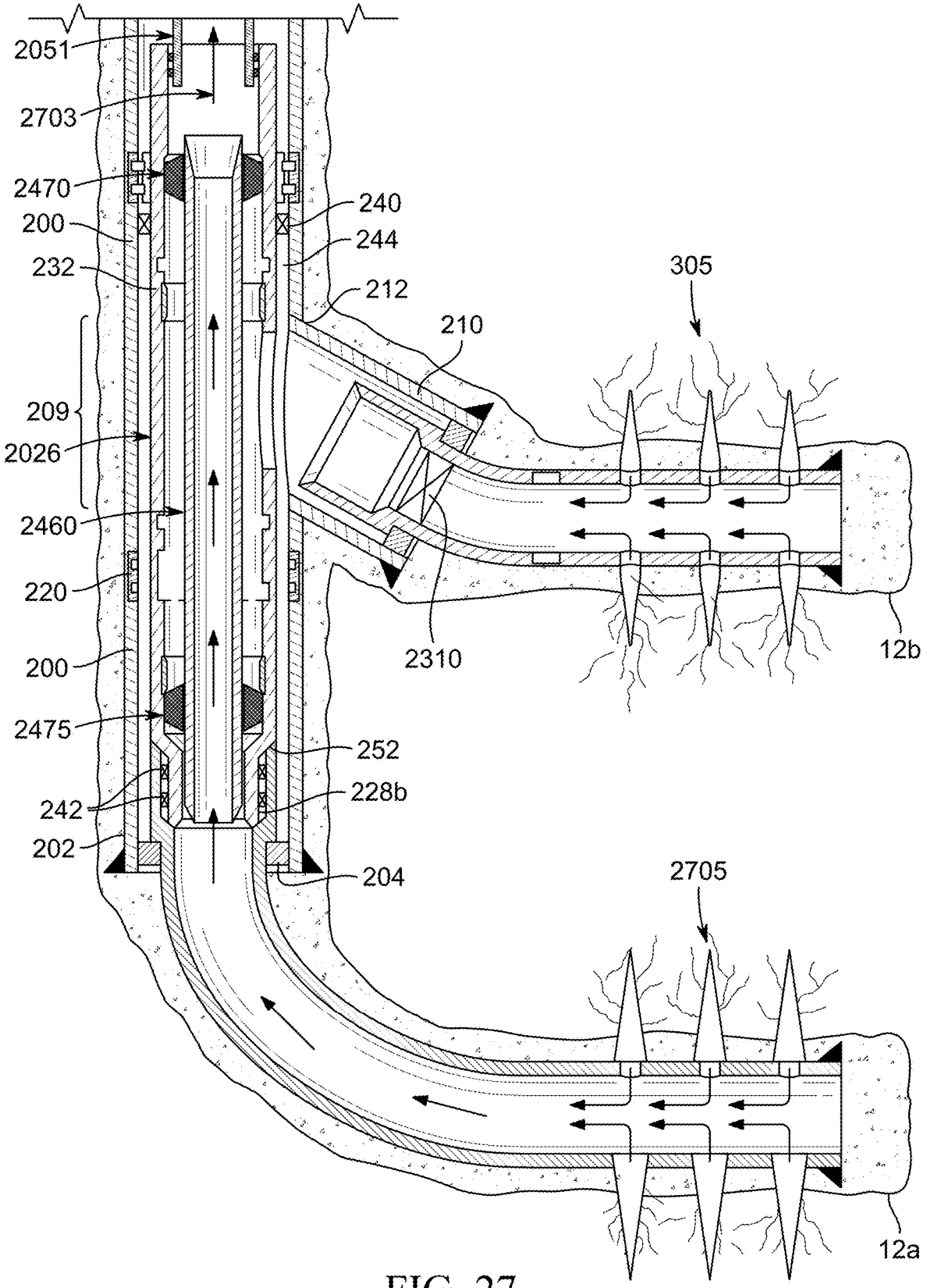

FIG. 27 illustrates production from the lower secondary wellbore 12*a* or flowback of fluids 2703, such as hydraulic fracturing fluids and/or hydrocarbons, from fractures 2705 resulting from such an operation, where flowback 2703 from the lower secondary wellbore 12*a* is illustrated while the upper secondary wellbore 12*b* remains isolated.

Figure 28:
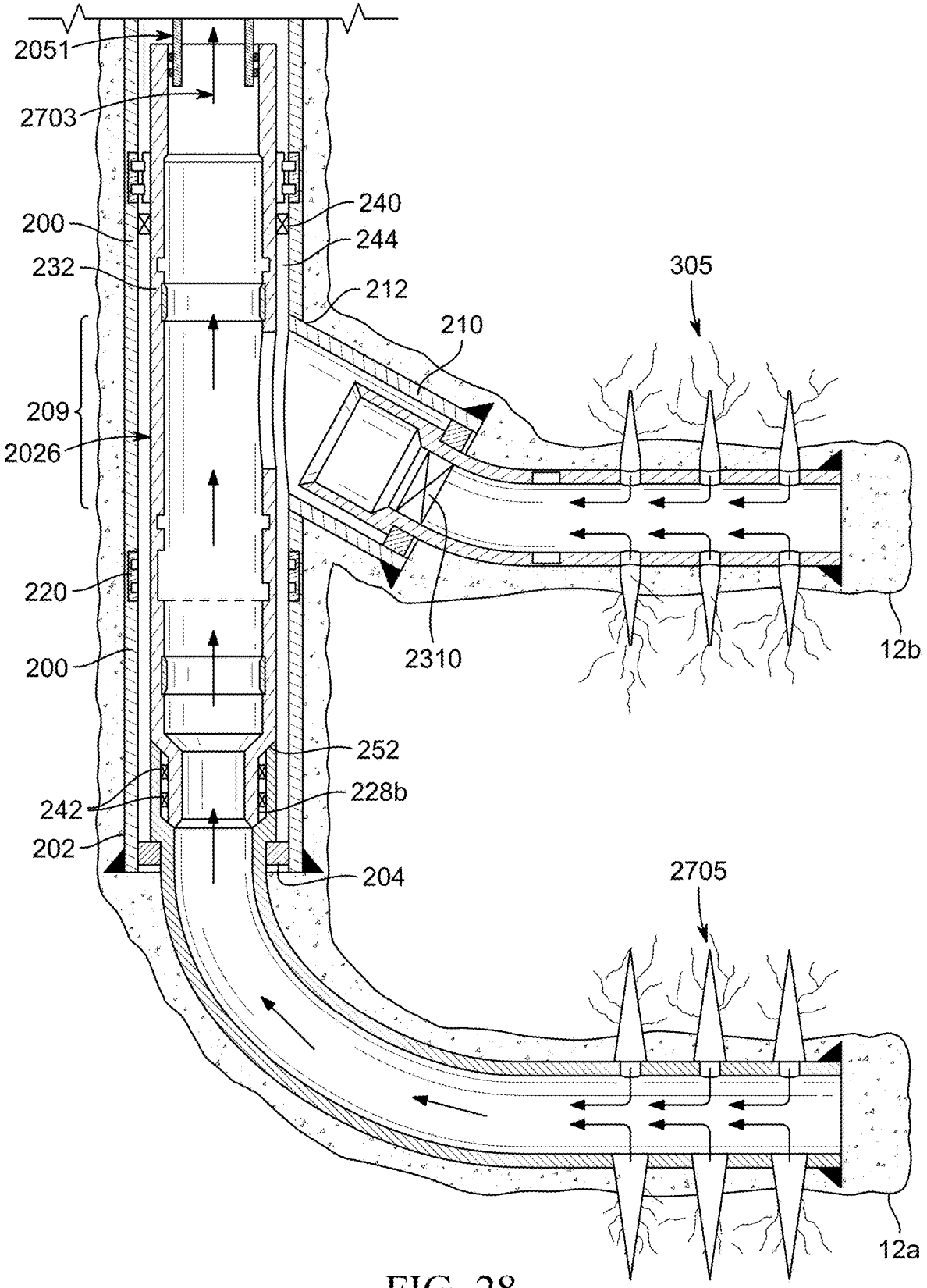

FIG. 28 illustrates the removal of the isolation sleeve 2460. In the illustrated embodiment, the isolation sleeve 2460 is removed through the low-pressure frac string 2051. For example, the high-expansion seals 2470, 2475 may be returned from their radially expanded state to their radially retracted state, such that they have an outside diameter (OD) small enough that the isolation sleeve 2460 may be removed through the low-pressure frac string 2051.

Figure 29:
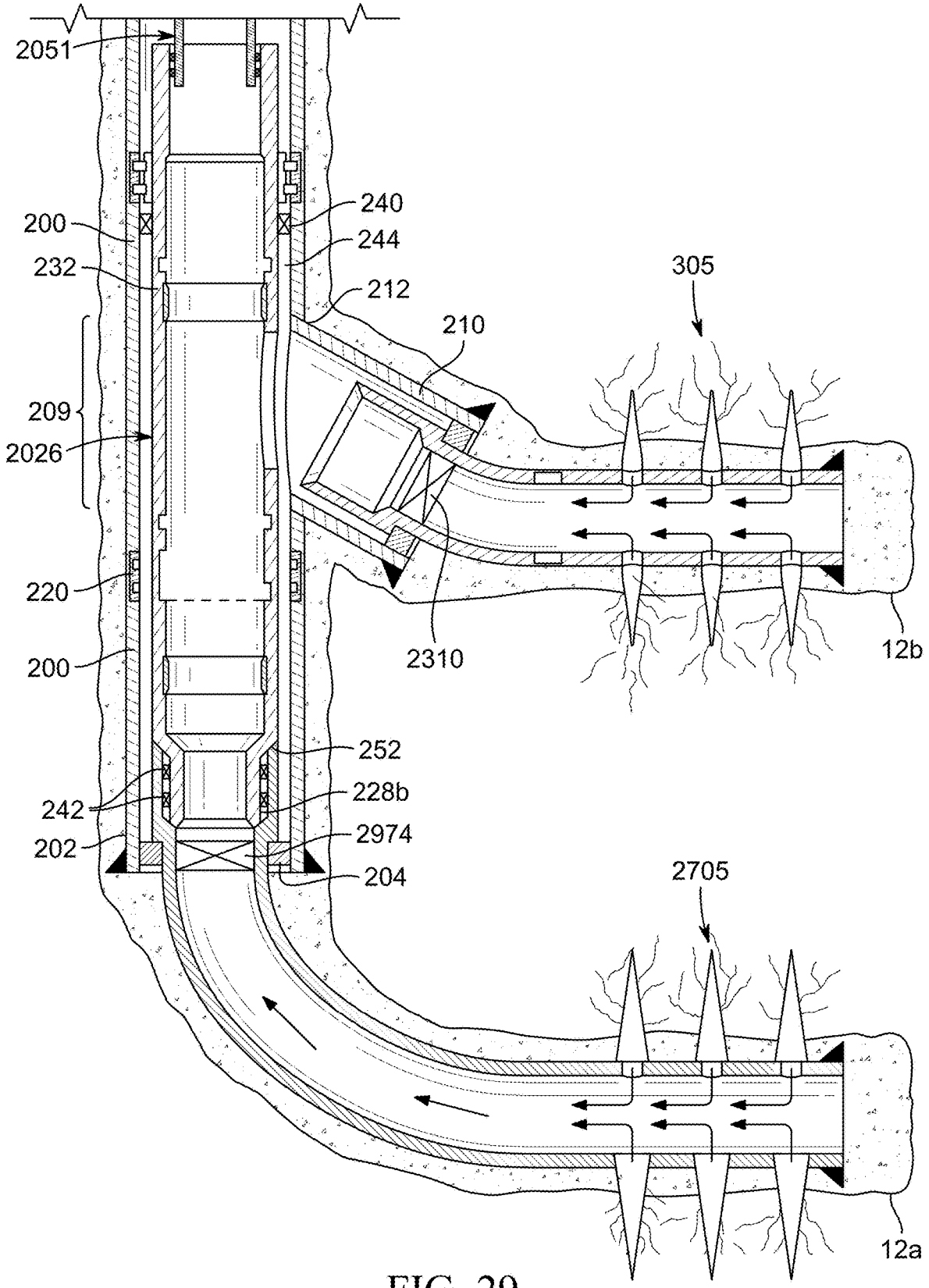

FIG. 29 illustrates the placement of a plug 2974 in the lower secondary wellbore 12*a*. Much in the same way that isolation sleeve 2460 is utilized to isolate secondary wellbore 12*b*, the plug 2974 may be deployed to isolate secondary wellbore 12*a* from pumping operations relating to secondary wellbore 12*b*. In at least one embodiment the plug 2974 may be positioned within frac window system 2026, preferably at a location adjacent end 228*b* or may be positioned in casing 206 of secondary wellbore 12*a* or within PBR 215 (FIG. 5) if present.

Figure 30A:
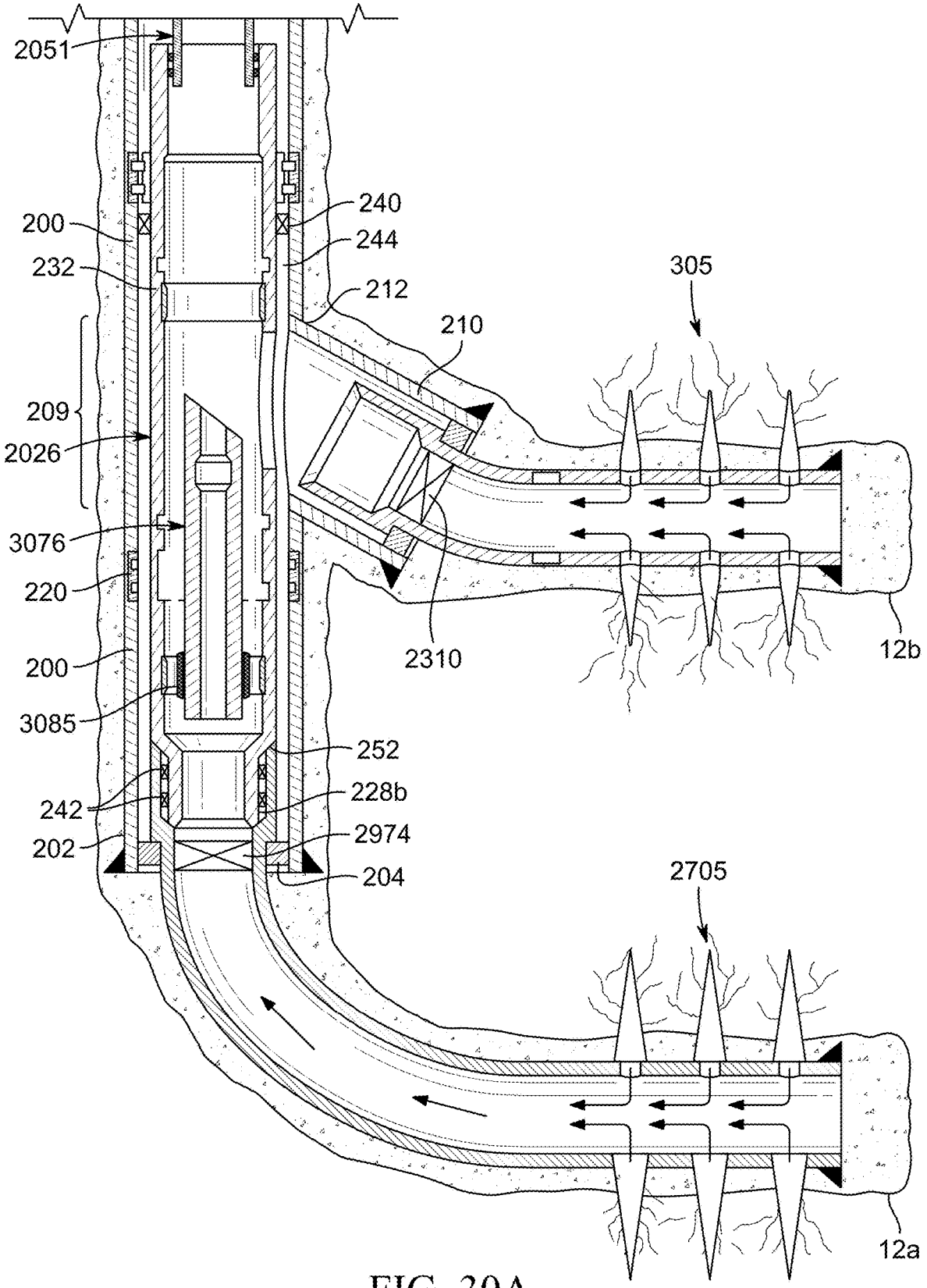

FIG. 30A illustrates the placement of a whipstock 3076 having one or more high-expansion members 3085 in the frac window system 2026. The whipstock 2076 may be similar in many respects to the whipstock 276 of FIG. 7 above, but for the whipstock 2076 having the one or more high-expansion members 3085 and the smaller outside diameter ($OD_6$) necessary to traverse the low-pressure frac string 2051. The whipstock 3076, in the illustrated embodiment, is run-in-hole through the low-pressure frac string 2051. In the embodiment of FIG. 30A, the one or more high-expansion members 3085 are in their radially retracted state.

Figure 30B:
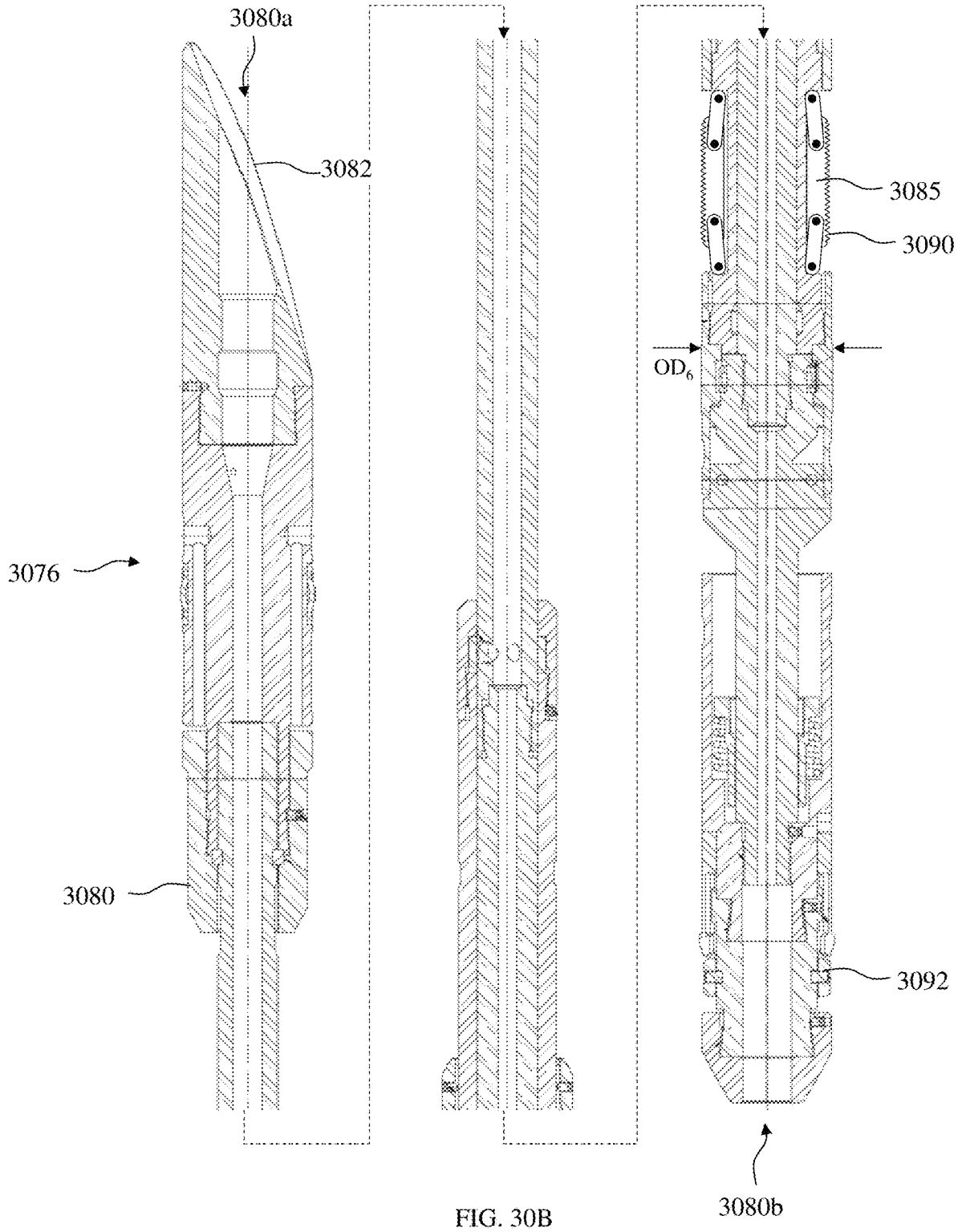

FIG. 30B illustrates an enlarged cross-sectional view of the whipstock 3076 of FIG. 30A having high-expansion members 3085. As shown, the whipstock 3076 may include a housing 3080 having a first whipstock end 3080*a* with a contoured surface 3082 and a second whipstock end 3080*b*. As further shown, the whipstock 3076 may include the one or more high-expansion members 3085 located at least partially along an outer surface of the housing 3080. As discussed, the one or more high-expansion members 3085 are configured to move between a radially retracted state (FIGS. 30A and 30B) for running the whipstock 3076 in hole and a radially expanded state (FIGS. 31A and 31B) for engaging an inner surface of a frac window system 2026.

In the illustrated embodiment, the one or more high-expansion members 3085 are one or more scissor type high-expansion members. Nevertheless, other types of high-expansion members are within the scope of the disclosure. As show, the one or more high-expansion members 3076 may each have a plurality of teeth 3090 for engaging the inner surface of the frac window system 2026.

The whipstock 3076 is illustrated as a neckless whipstock. However, the whipstock 3076 could be configured as a necked whipstock or extended necked whipstock and remain within the scope of the present disclosure. As further shown, the whipstock 3076 may further include a depth mechanism 3092 disposed at least partially along the outer surface of the housing 3080, the depth mechanism 3092 configured to engage a related depth mechanism disposed along an inner surface of the frac window system 2026. In at least one embodiment, the depth mechanism 3092 is positioned between the one or more high-expansion members 3076 and the second whipstock end 3080*b*.

Figure 31A:
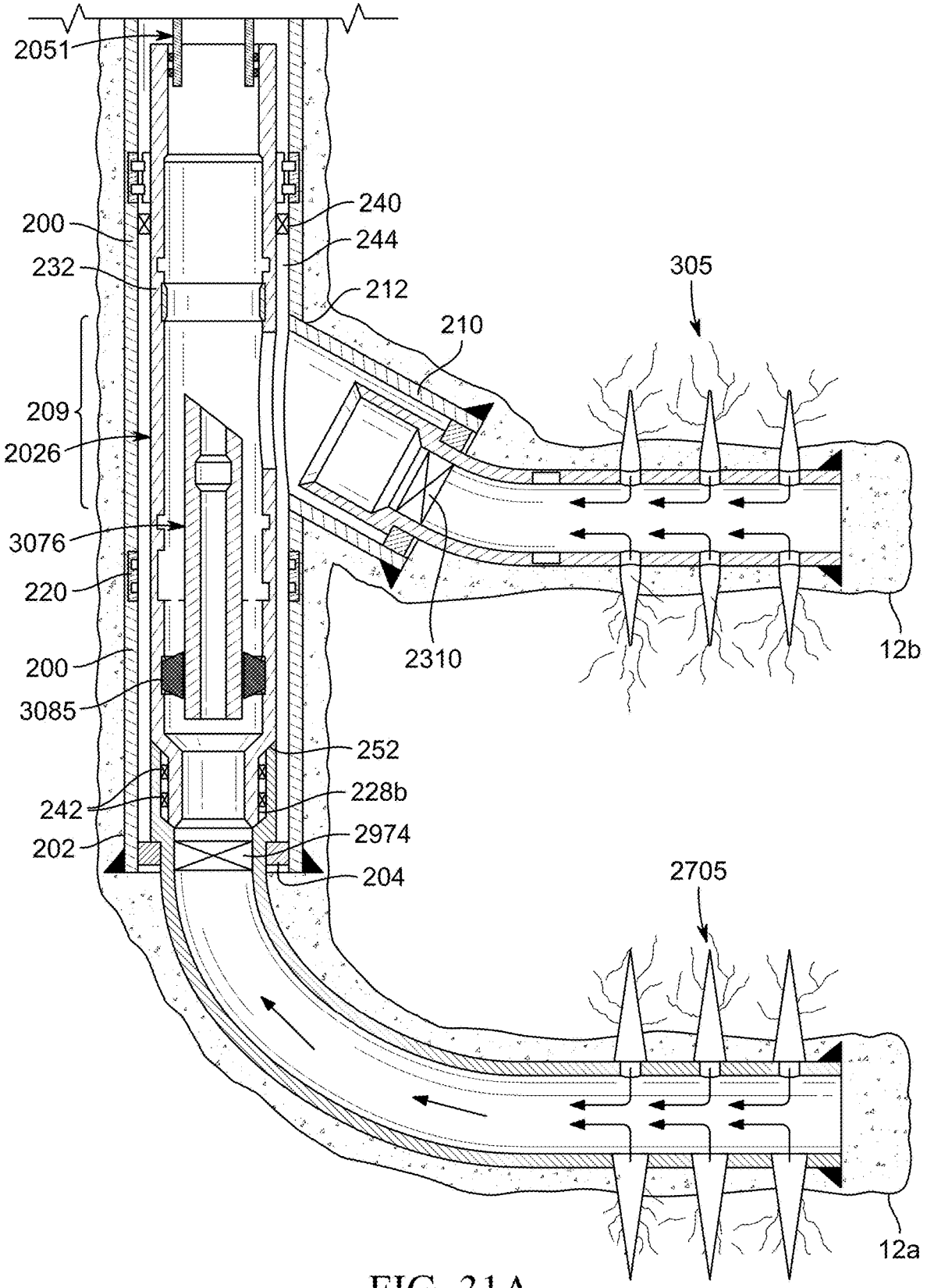
Figure 31B:
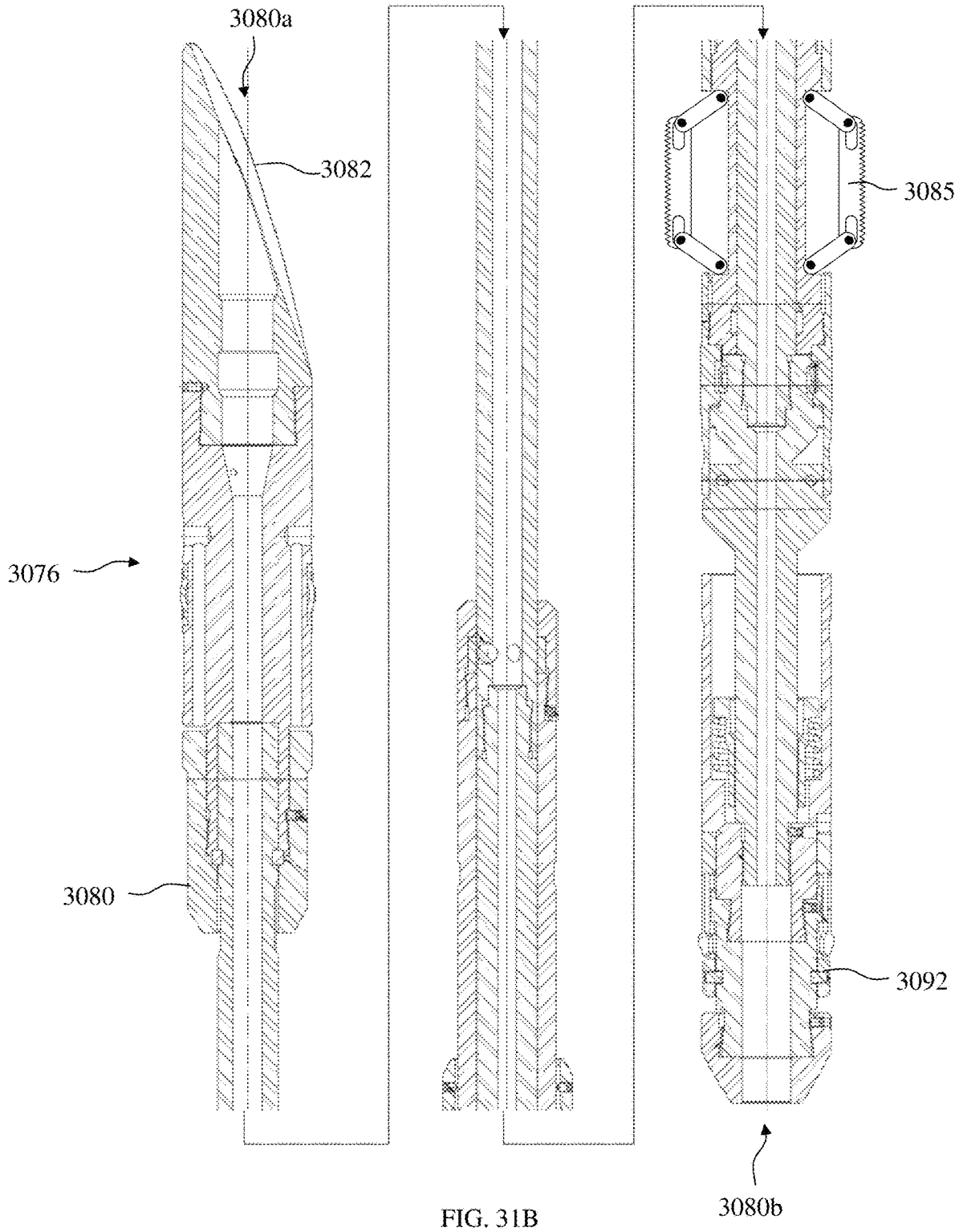

In the illustrated embodiment of FIG. 31B, the whipstock 3076 includes outside diameter ($OD_6$). The outside diameter ($OD_6$), in at least one embodiment, is at least 0.95" (e.g., 2.413 cm), if not at least 2.992" (e.g., 7.60 cm), if not at least 4.583" (e.g., 11.64 cm), if not at least 8.379" (e.g., 21.28 cm), if not at least 12.313" (e.g., 31.28 cm), or more. Again, the outside diameter ($OD_6$) may be based upon the inside diameter of the low-pressure frac string 2051 that the isolation sleeve 2460 must traverse.

FIG. 31A illustrates the expansion of the high-expansion members 3085 of the whipstock 2076 within the convention frac window system 2026. Accordingly, as shown, the high-expansion members 3085 are in their radially expanded state.

FIG. 31B illustrates an enlarged cross-sectional view of the whipstock 2076 of FIG. 32A having the high-expansion members 3085 in their radially expanded state.

Figure 32:
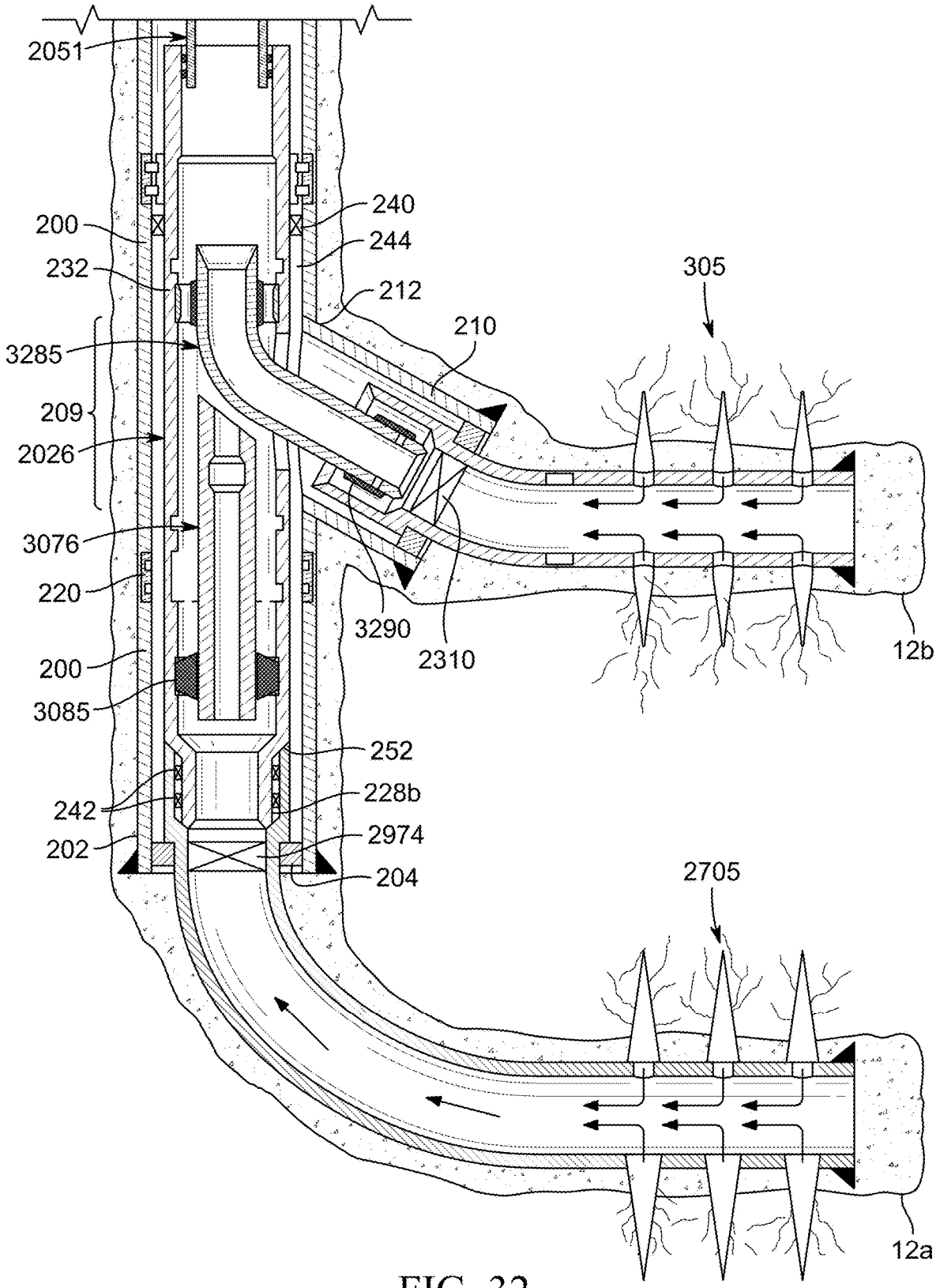

Turning to FIG. 32, a straddle stimulation tool 3285 is illustrated extending from the frac window system 2026 into the upper secondary wellbore 12*b*. In the illustrated embodiment, the straddle stimulation tool 3285 is run-in-hole through the low-pressure frac string 2051. Straddle stimulation tool 3285 is similar in many respects to the straddle stimulation tool 285, but for the straddle stimulation tool 3285 may include high-expansion seals 3290. The high-expansion seals 3290, in the illustrated embodiment, are in their radially retracted state, and may be similar in one fashion or another to the high-expansion seals 2465 of the isolation sleeve 2460.

Figure 33:
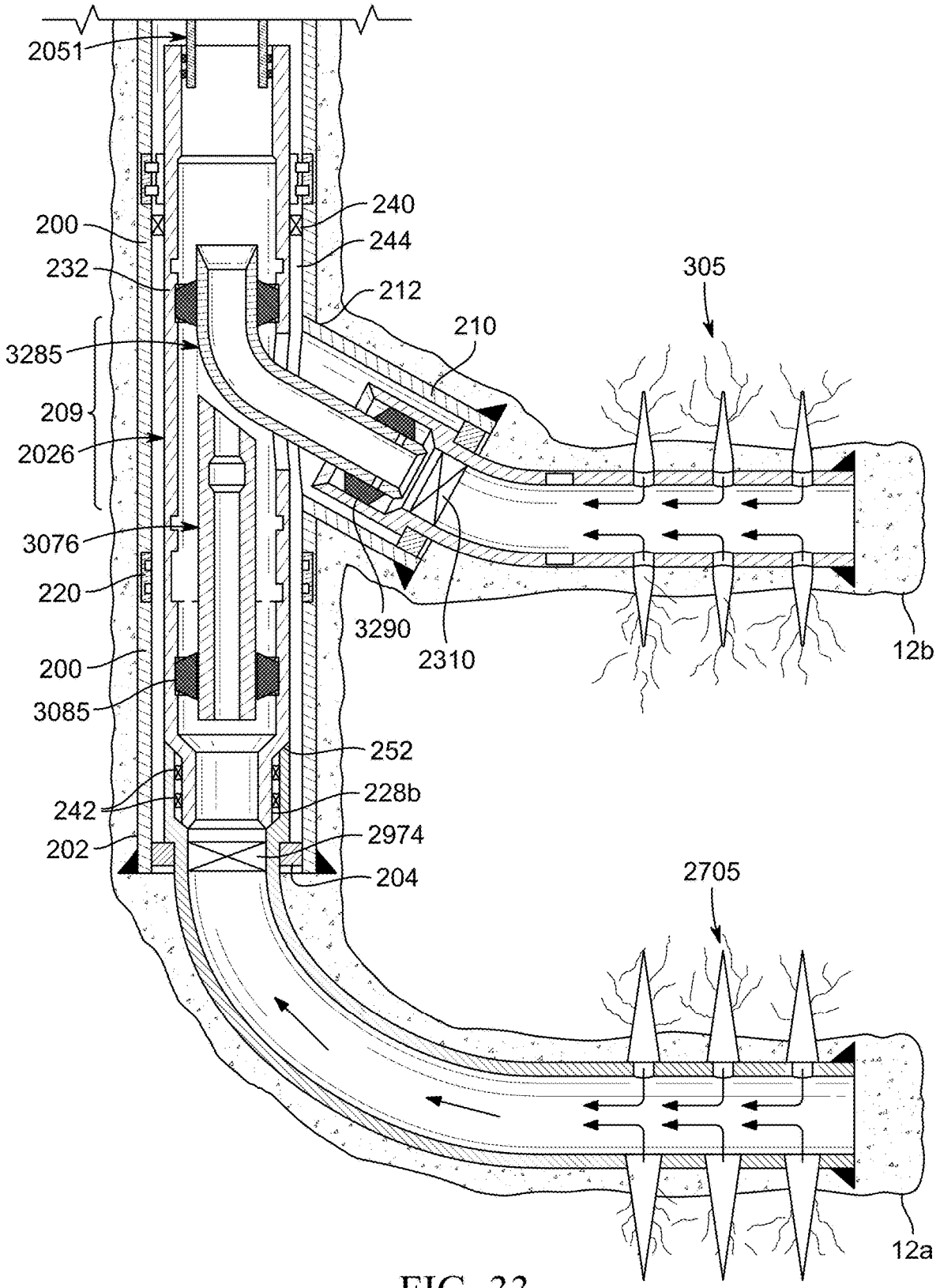

FIG. 33 illustrates the expansion of the high-expansion seals 3290 of the straddle stimulation tool 3285. Accordingly, as shown, the high-expansion seals 3290 are in their radially expanded state.

Figure 34:
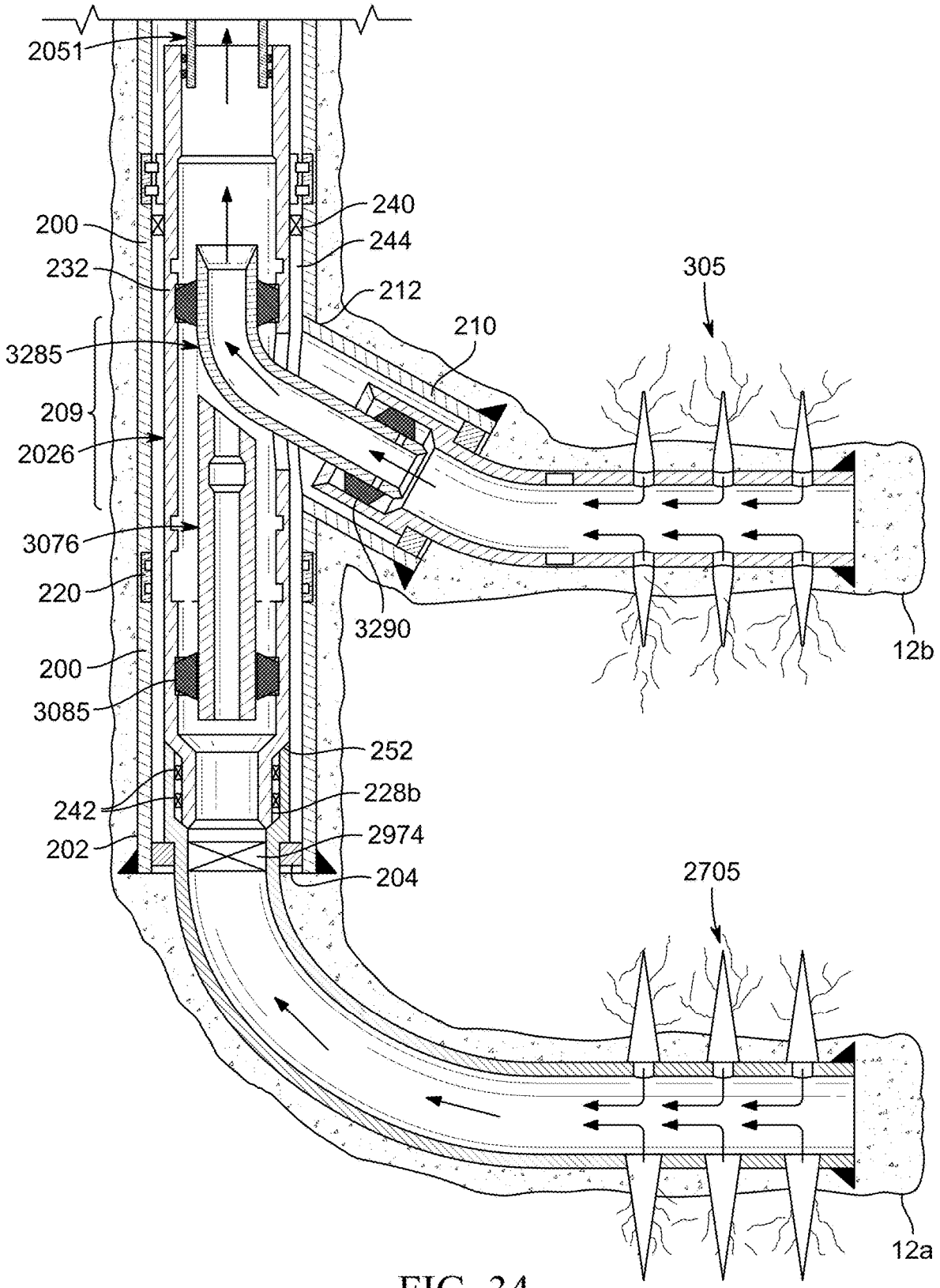

FIG. 34 illustrates the removal of the plug 2310. Those skilled in the art understand the processes that might be used to remove the plug 2310.

Figure 35:
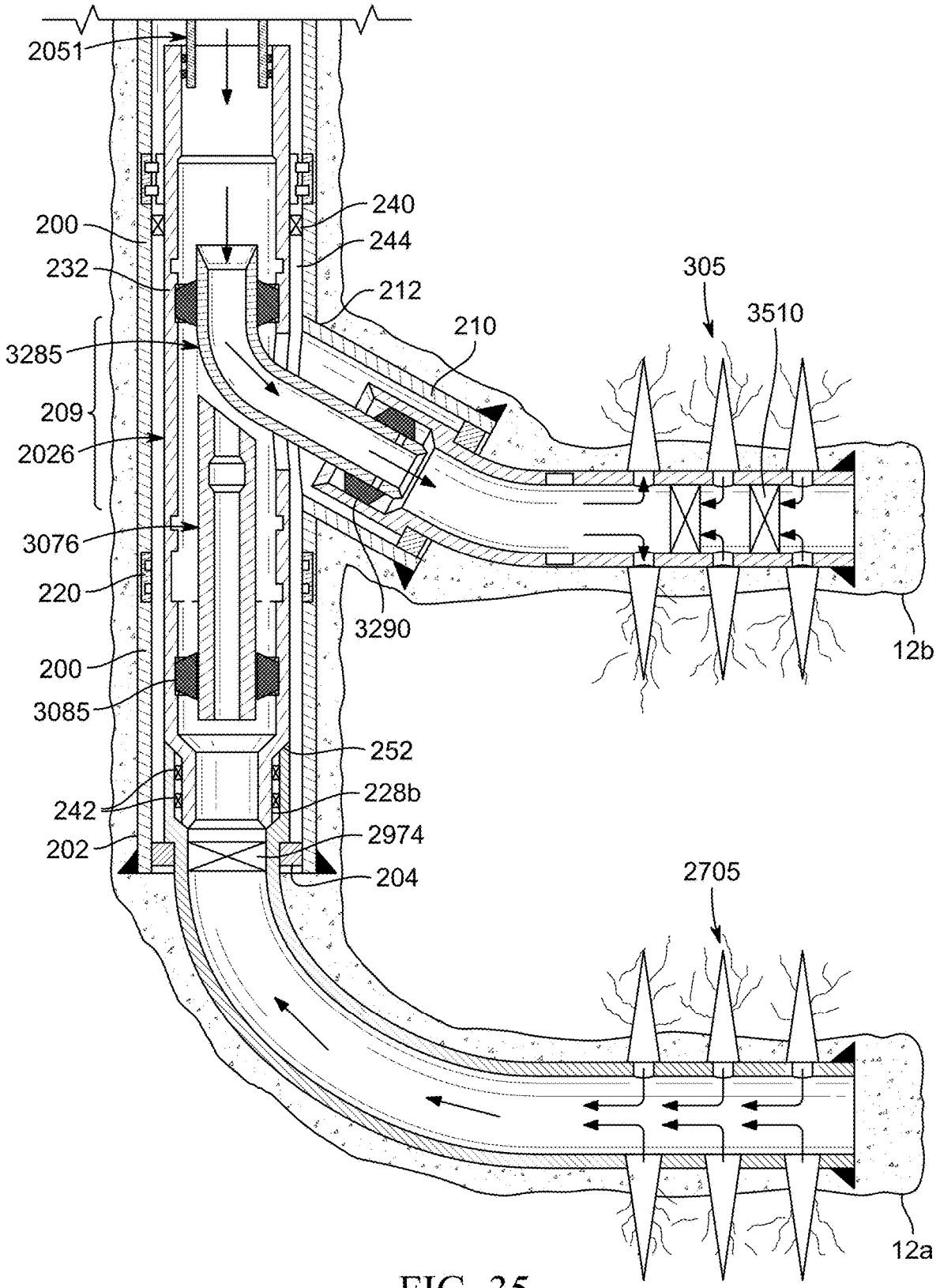

As shown in FIG. 35, the secondary wellbore 12*b* has at least partially been re-stimulated. For example, the secondary wellbore 12*b* has been re-stimulated from toe to heal, for example using one or more frac plugs 3510 to isolate the different stimulated regions. In at least one embodiment, as shown, the deployment of the frac plugs 3510 and the re-stimulation process are conducted through the low-pressure frac string 2051.

Figure 36:
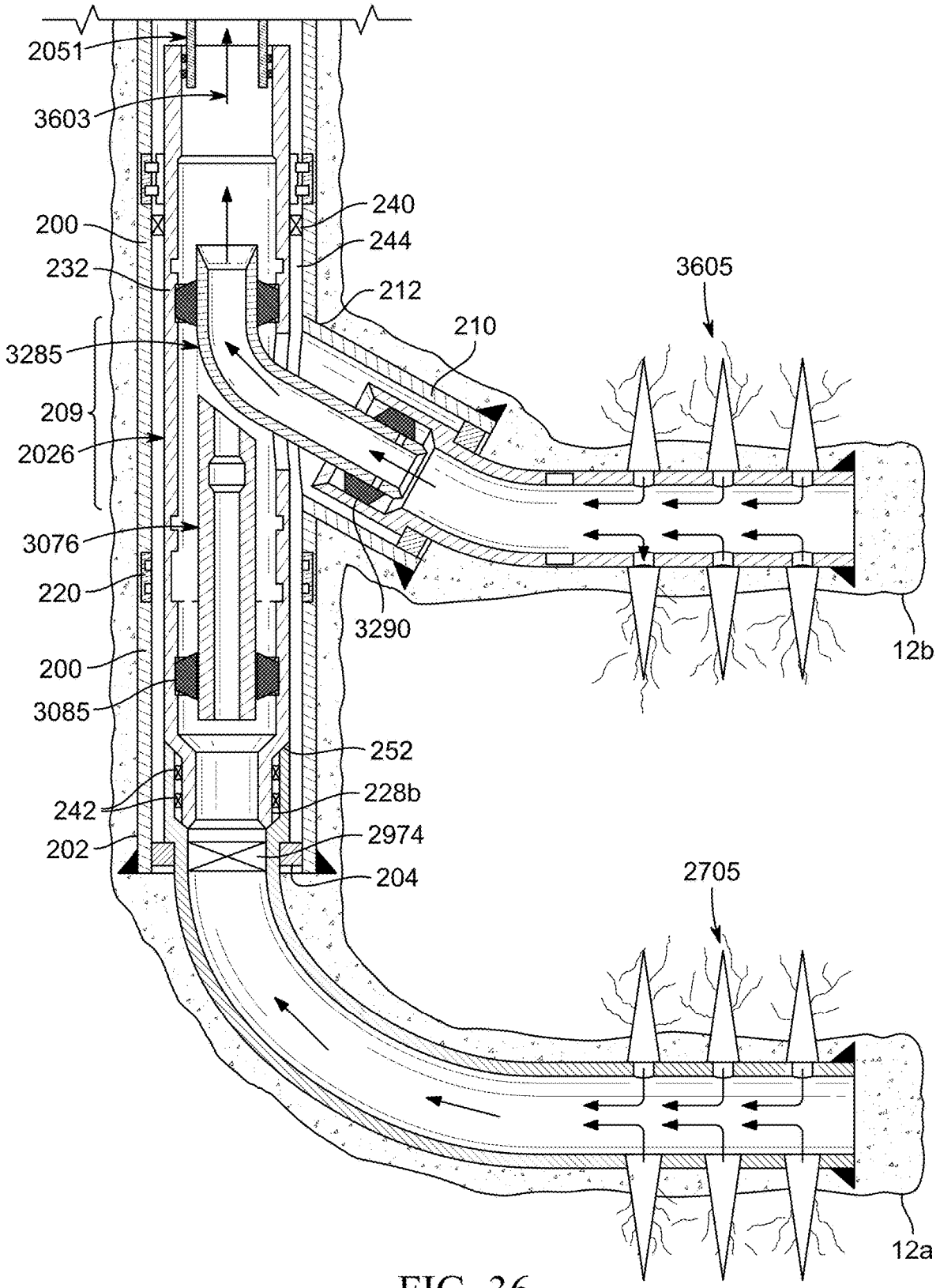

FIG. 36 illustrates production from the upper secondary wellbore 12*b* or flowback of fluids 3603, such as hydraulic fracturing fluids and/or hydrocarbons, from fractures 3605 resulting from such an operation, where flowback 3603 from secondary wellbore 12*b* is illustrated while secondary wellbore 12*a* remains isolated.

Figure 37:
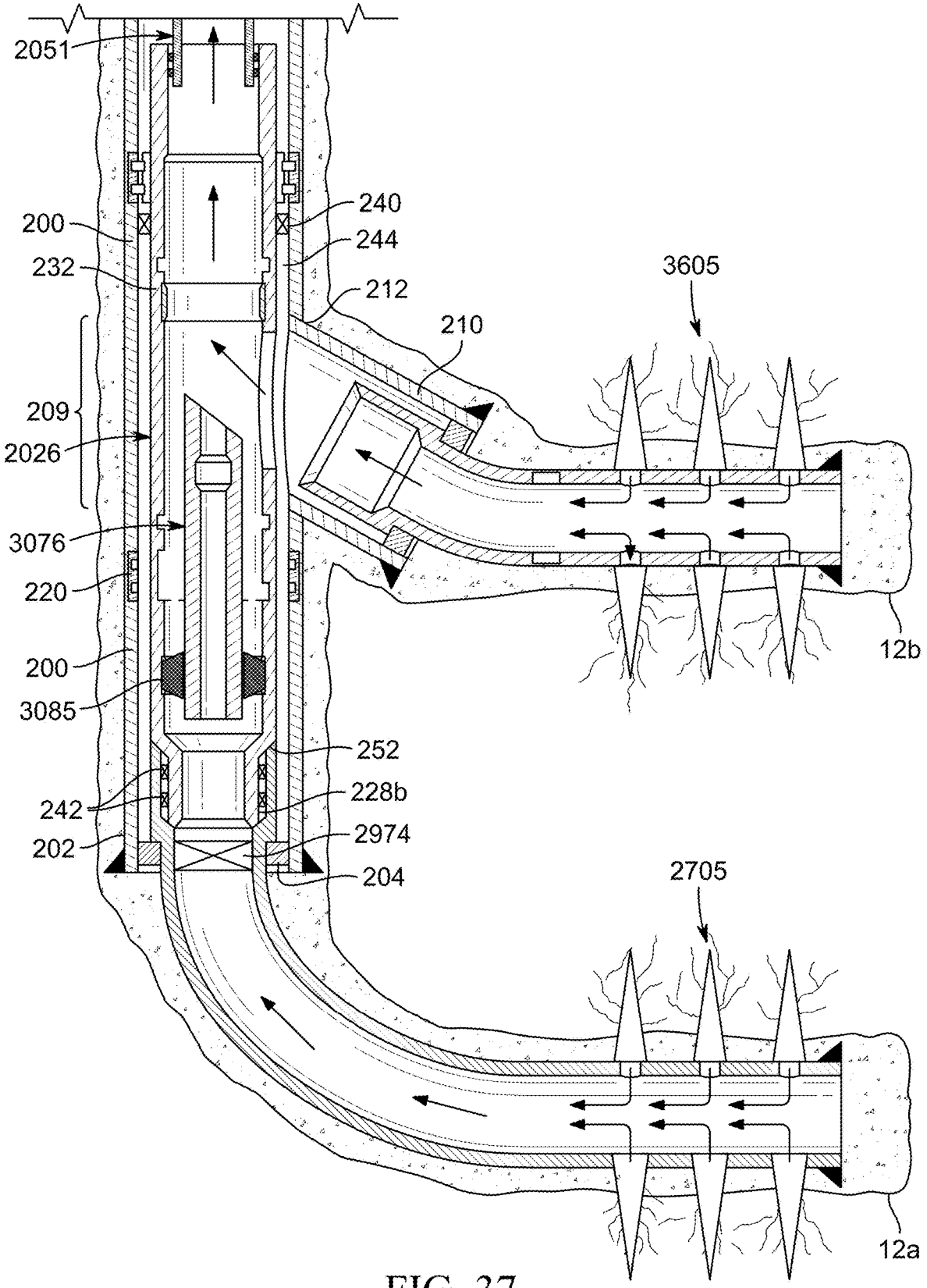

FIG. 37 illustrates the removal of the straddle stimulation tool 3285. In the illustrated embodiment, the straddle stimulation tool 3285 is removed through the low-pressure frac string 2051. For example, the high-expansion seals of the straddle stimulation tool 3285 may be returned from their radially expanded state to their radially retracted state, such that they have an outside diameter (OD) small enough that the straddle stimulation tool 3285 may be removed through the low-pressure frac string 2051.

Figure 38:
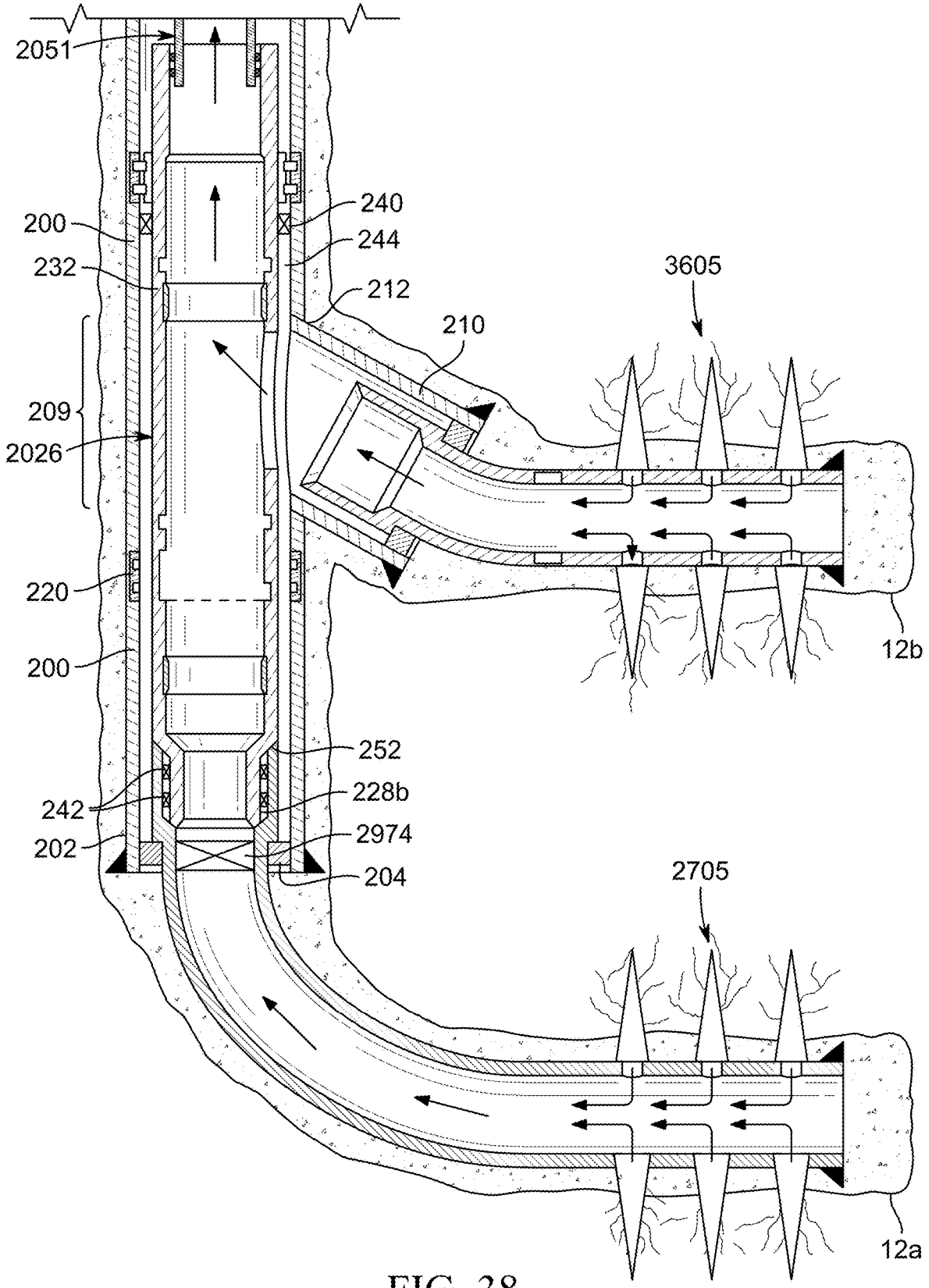

FIG. 38 illustrates the removal of the deflector 3076. In the illustrated embodiment, the deflector 3076 is removed through the low-pressure frac string 2051. For example, the high-expansion members 3085 may be returned from their radially expanded state to their radially retracted state, such that they have an outside diameter (OD) small enough that the deflector 3076 may be removed through the low-pressure frac string 2051.

Figure 39:
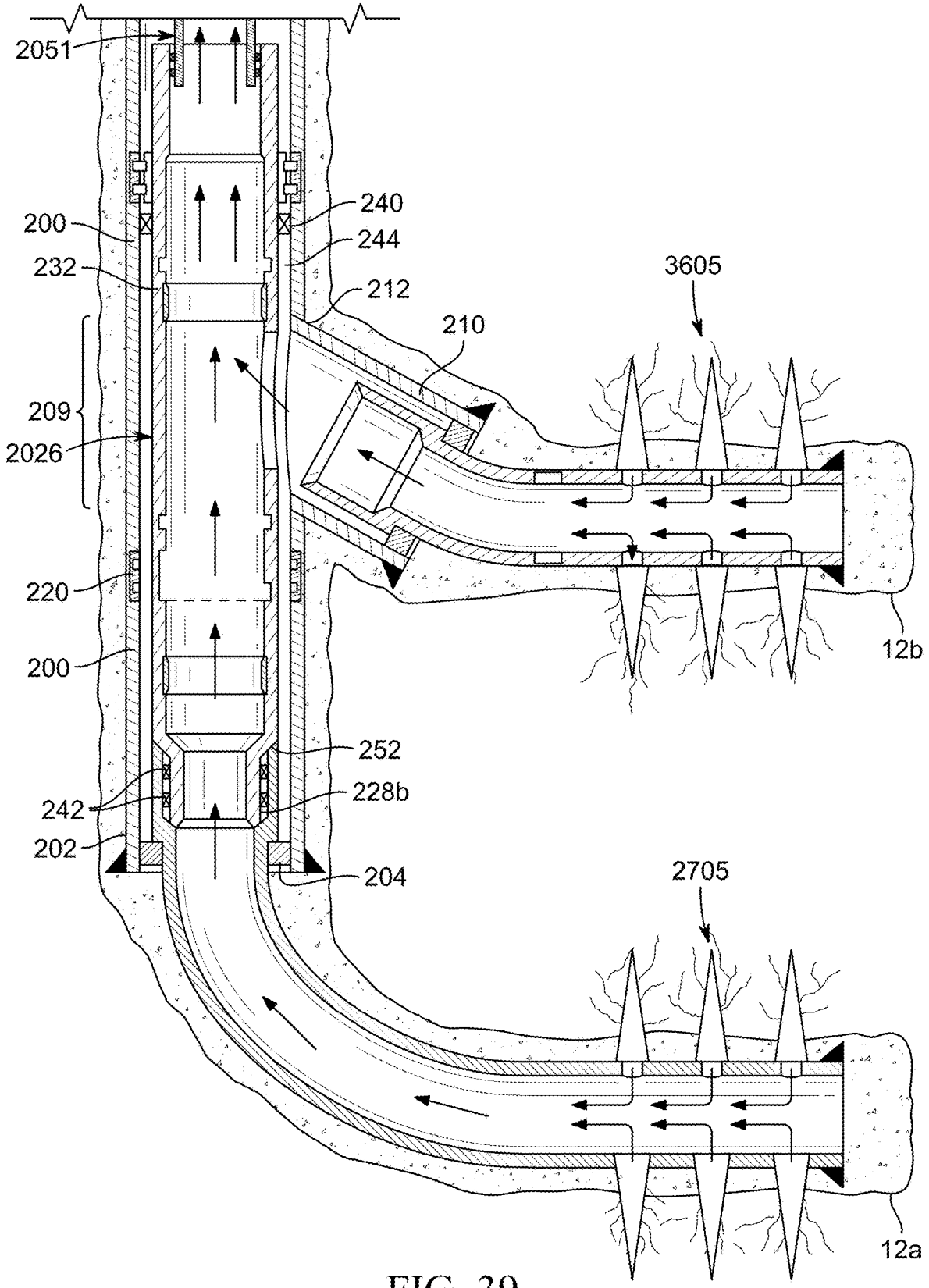

FIG. 39 illustrates the removal of the plug 2974. In the illustrated embodiment, the plug 2974 is removed through the low-pressure frac string 2051. In yet another embodiment, the plug 2974 is drilled out through the low-pressure frac string 2051. What results is commingled flow from the lower secondary wellbore 12*a* and the upper secondary wellbore 12*b*. In at least one embodiment, the commingled flow travels to the surface of the wellbore 12 through the frac window system 2026 and the low-pressure frac string 2051. Accordingly, the low-pressure frac string 2051 may ultimately function as production tubing, for at least as long as it remains within the wellbore 12.

In certain situations, the pressures within the lower secondary wellbore 12*a* and/or upper secondary wellbore 12*b* may reduce to a value wherein the high-pressure frac string 251 may be removed from the wellbore 12, and optionally, a less expensive low-pressure frac string is deployed, for example while continuing to use the frac window system 226. As the frac window system 226 has a larger inside diameter (ID), it may become desirable and/or necessary to insert a spacer window sleeve within the frac window system 226 (e.g., prior to pulling the high-pressure frac string 251), such that smaller outside diameter (OD) wellbore tools may traverse through the smaller inside diameter (ID) low-pressure frac string but still engage the larger inside diameter (ID) of the frac window system. The spacer window sleeve may also maintain the full function of an IsoRite® System with the use of standard (e.g., already developed) IsoRite® Tools, even though the larger frac window system 226 of the present disclosure is being used.

Figure 40A:
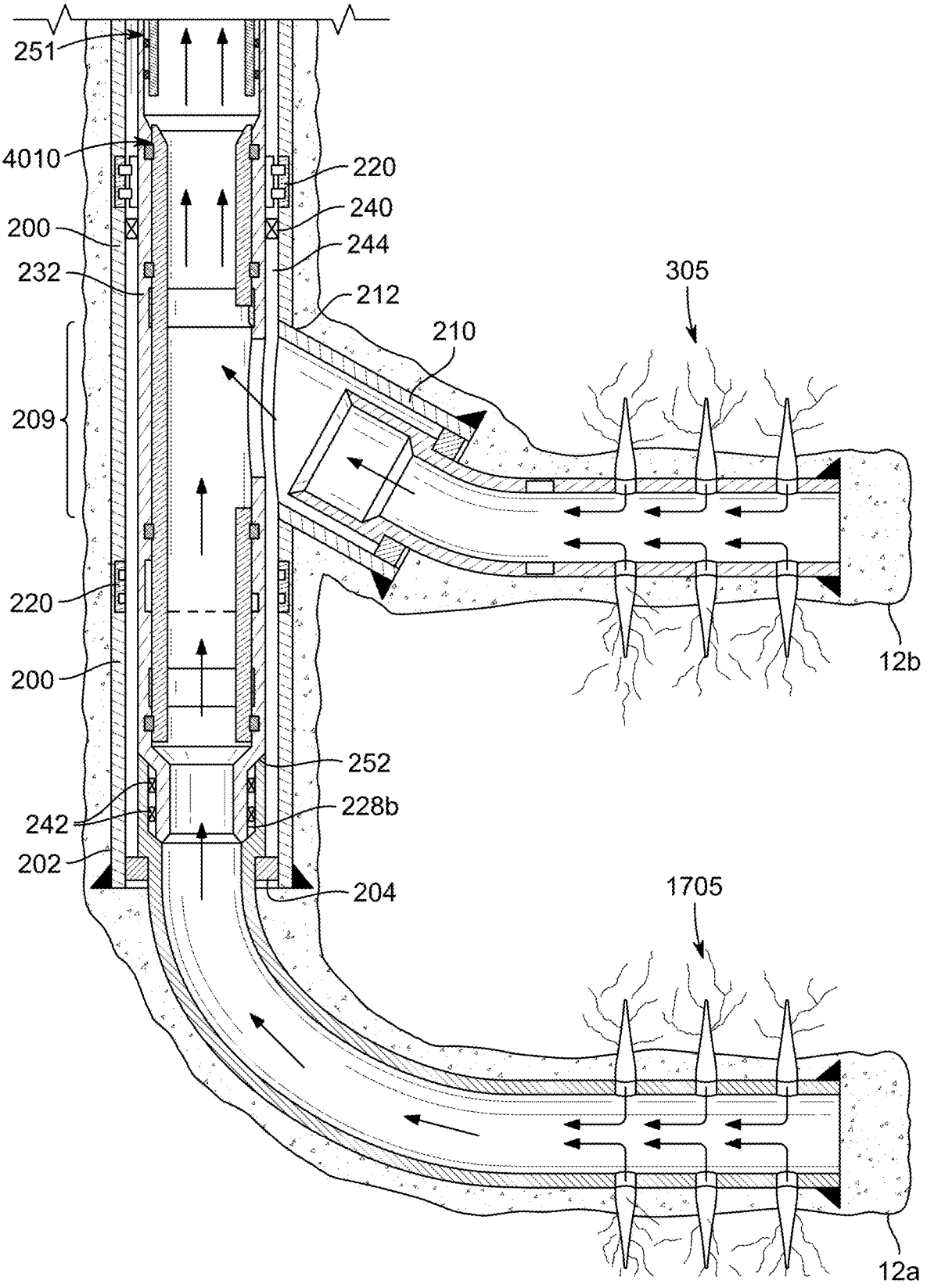

FIG. 40A illustrates the well system of FIG. 18 after having installed a spacer window sleeve 4010 within the frac window system 226. In the illustrated embodiment, the spacer window sleeve 4010 has been installed through the high-pressure frac string 251.

Figure 40B:
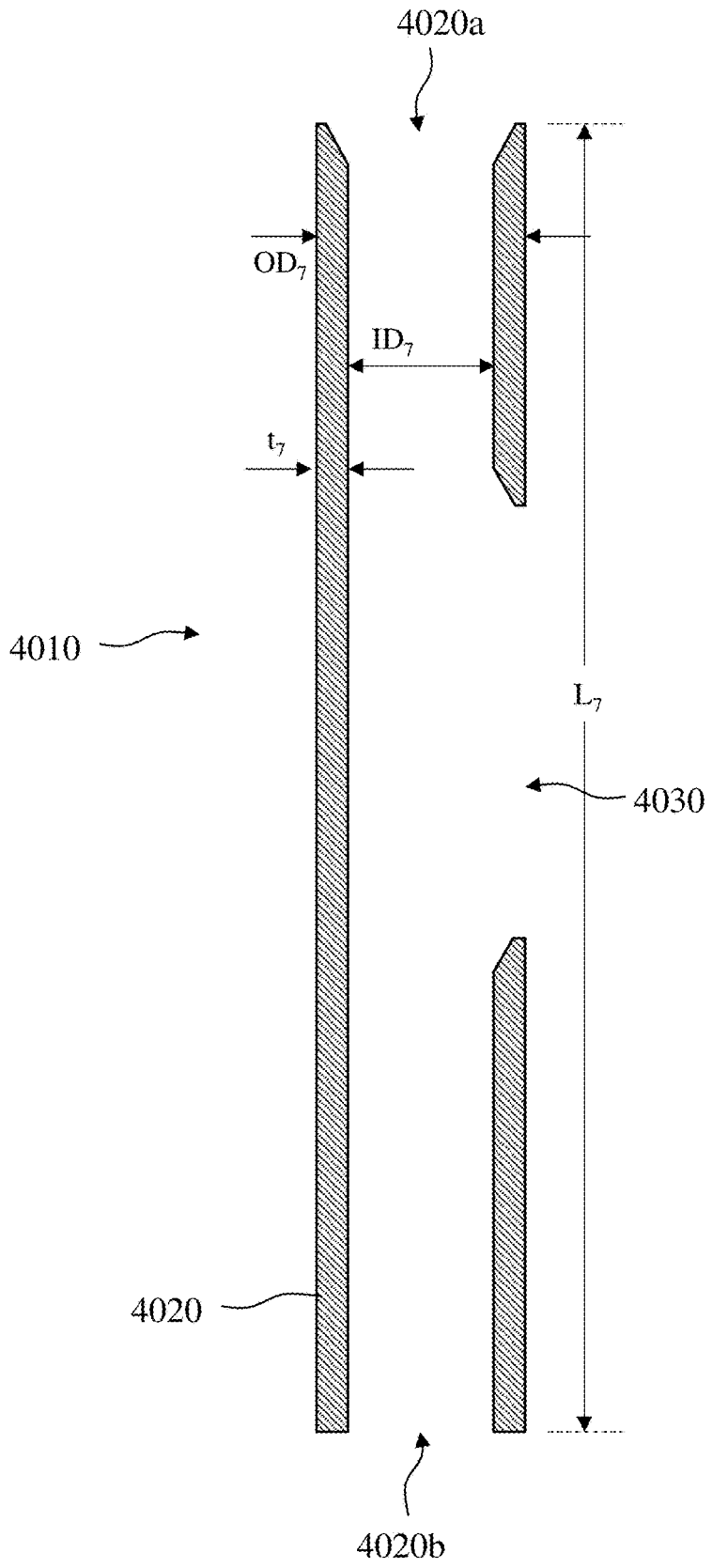

Turning to FIG. 40B, illustrated is an enlarged cross-sectional view of the spacer window sleeve 4010 of FIG. 40A. The spacer window sleeve 4010, in at least one embodiment, includes a tubular 4020 having a first tubular end 4020*a* and a second tubular end 4020*b*. In accordance with one embodiment of the disclosure, the spacer window sleeve 4010 additionally includes a second opening 4030 defined in a second wall of the tubular 4020 between the first tubular end 4020*a* and the second tubular end 4020*b*. The second wall, in the illustrated embodiment, has a second inner surface and a second outer surface. The second opening 4030, in at least one embodiment, aligns with the window exit 420 in the frac window system 226.

In at least one embodiment, the spacer window sleeve 4010 includes an outside diameter ($OD_7$) and an inside diameter ($ID_7$). The outside diameter ($OD_7$), in at least one embodiment, is at least 0.73" (e.g., 1.85 cm), if not at least 0.95" (e.g., 2.41 cm), if not at least 4.25" (e.g., 10.8 cm), if not at least 5.76" (e.g., 14.63 cm), if not at least 12.19" (e.g., 30.96 cm), or more. Again, the outside diameter ($OD_7$) may be based upon the inside diameter ($ID_3$) of the frac window system 226 it is configured to engage with. In at least one embodiment, the spacer window sleeve 4010 includes an inside diameter ($ID_7$) of at least 0.5" (e.g., 1.27 cm), if not at least 1.9" (e.g., 4.83 cm), if not at least 2.867" (e.g., 7.28 cm), if not at least 4.5" (e.g., 11.43 cm), if not at least 10.93" (e.g., 27.76 cm), or more. In yet another embodiment, the spacer window sleeve 4010 has a wall thickness ($t_7$) and a length ($L_7$).

Figure 40C:
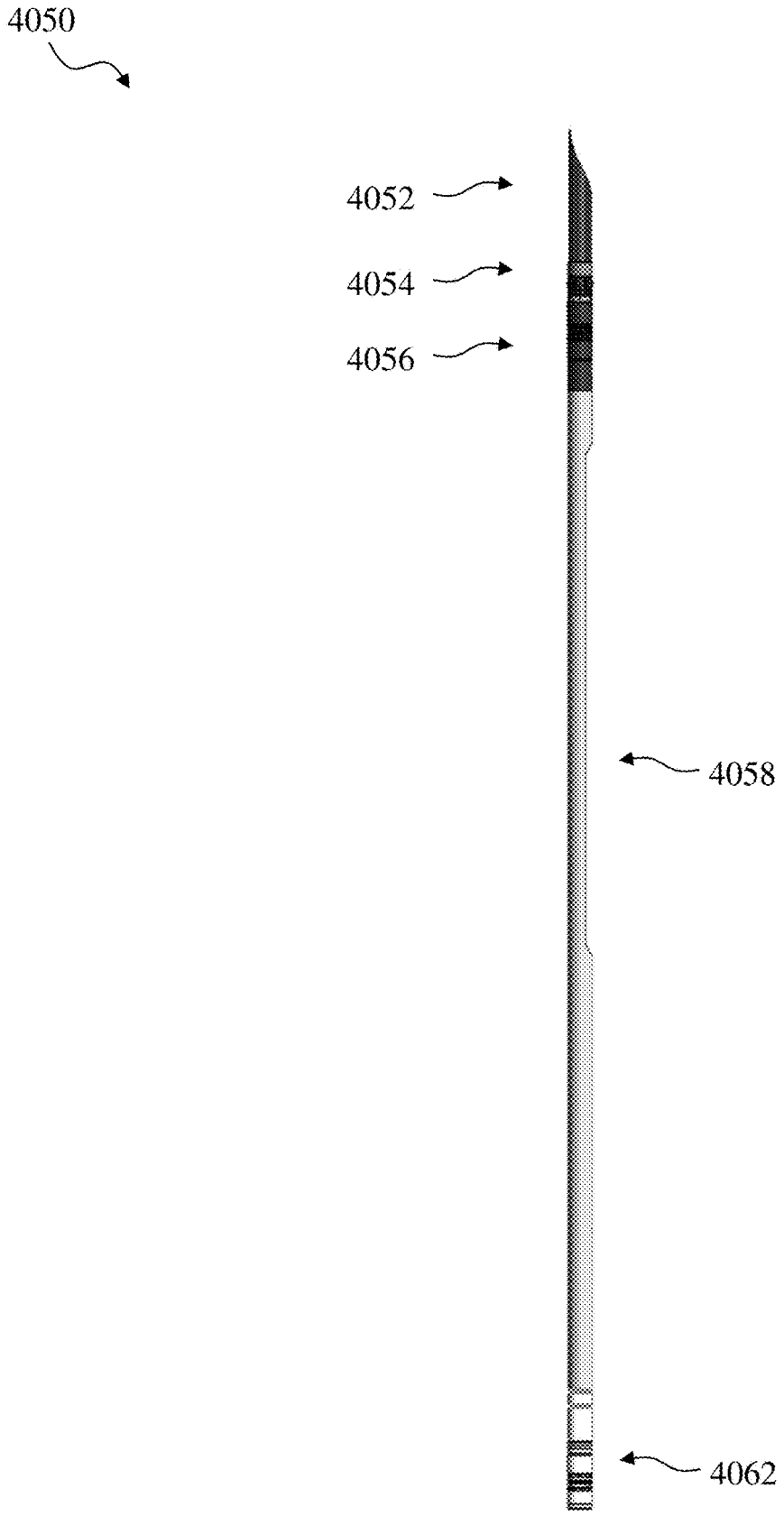
Figure 40D:
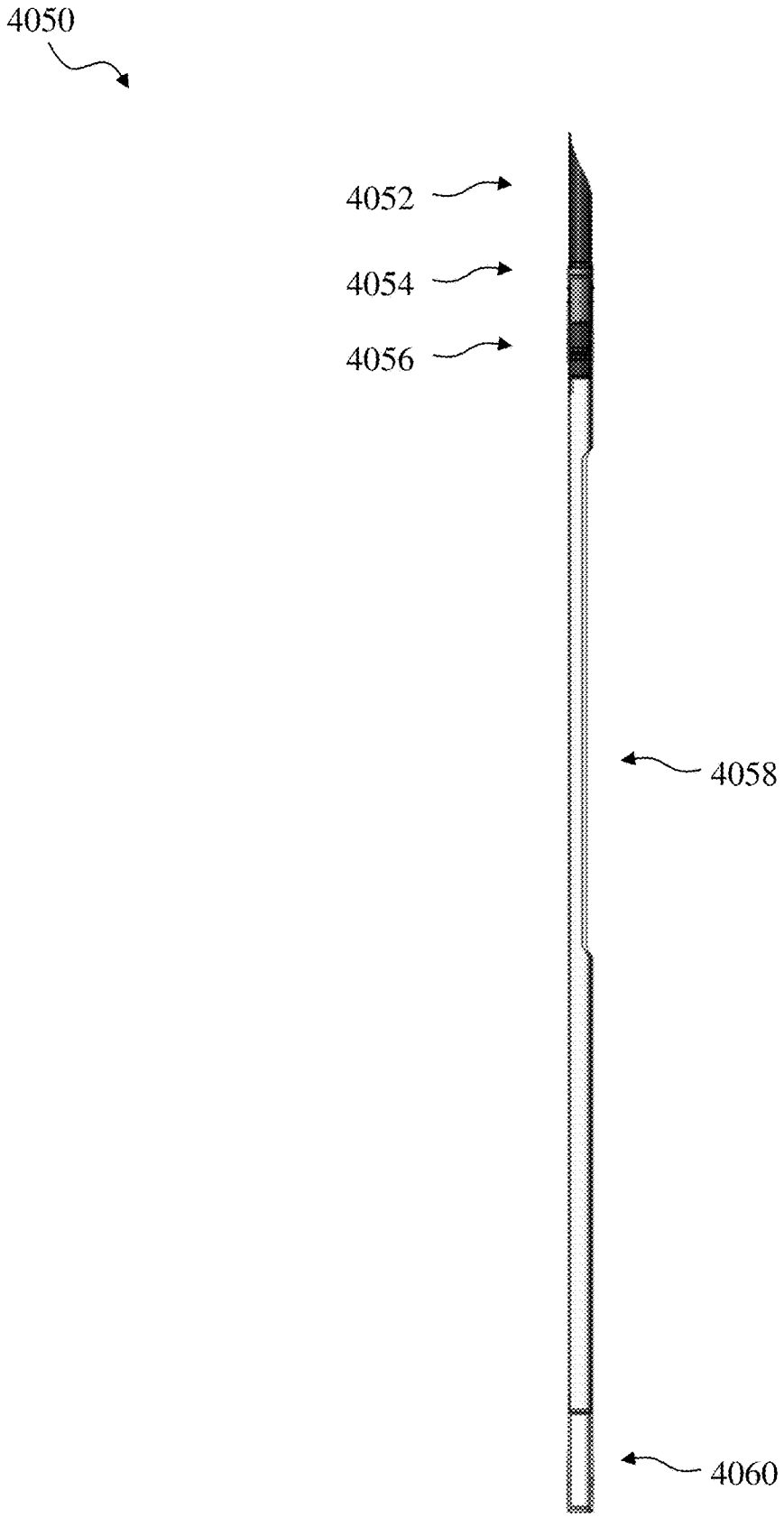

Turning to FIGS. 40C and 40D, illustrated are an external view and cross-sectional view, respectively, of one embodiment of a spacer window sleeve 4050 with top orientation device. The spacer window sleeve 4050 includes, without limitation: an orientation device 4052—e.g., muleshoe; anchoring device 4054—collet; seal mandrel with external seals 4056—5.763" (e.g., 14.64 cm); internal R-nipple profile w/4.525" (e.g., 11.49 cm) polish bore (may be integral with seal mandrel 4056 as shown); tubing window 4058—window opening to pass tools out into the lateral; internal profile for landing whipstock—4.525" (e.g., 11.49 cm) (not shown, but may be integral with lower seal mandrel as shown); internal polish bore 4060—4.525" (e.g. 11.49 cm); and seal mandrel with external seals 4062—5.763" (e.g., 14.64 cm). In the illustrated embodiment, the orientation device 4052 is located proximate the first tubular end 4020*a*.

Figure 40E:
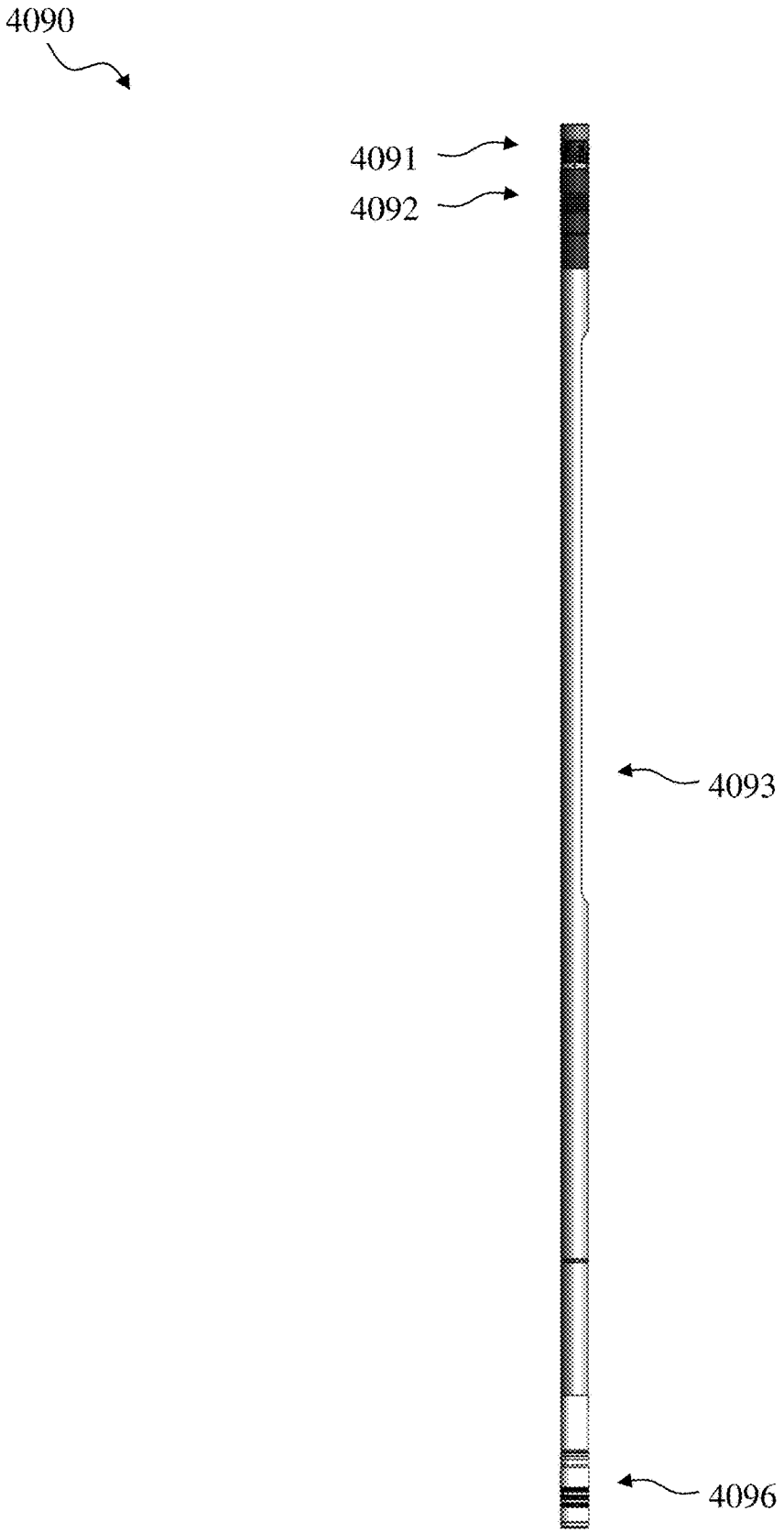
Figure 40F:
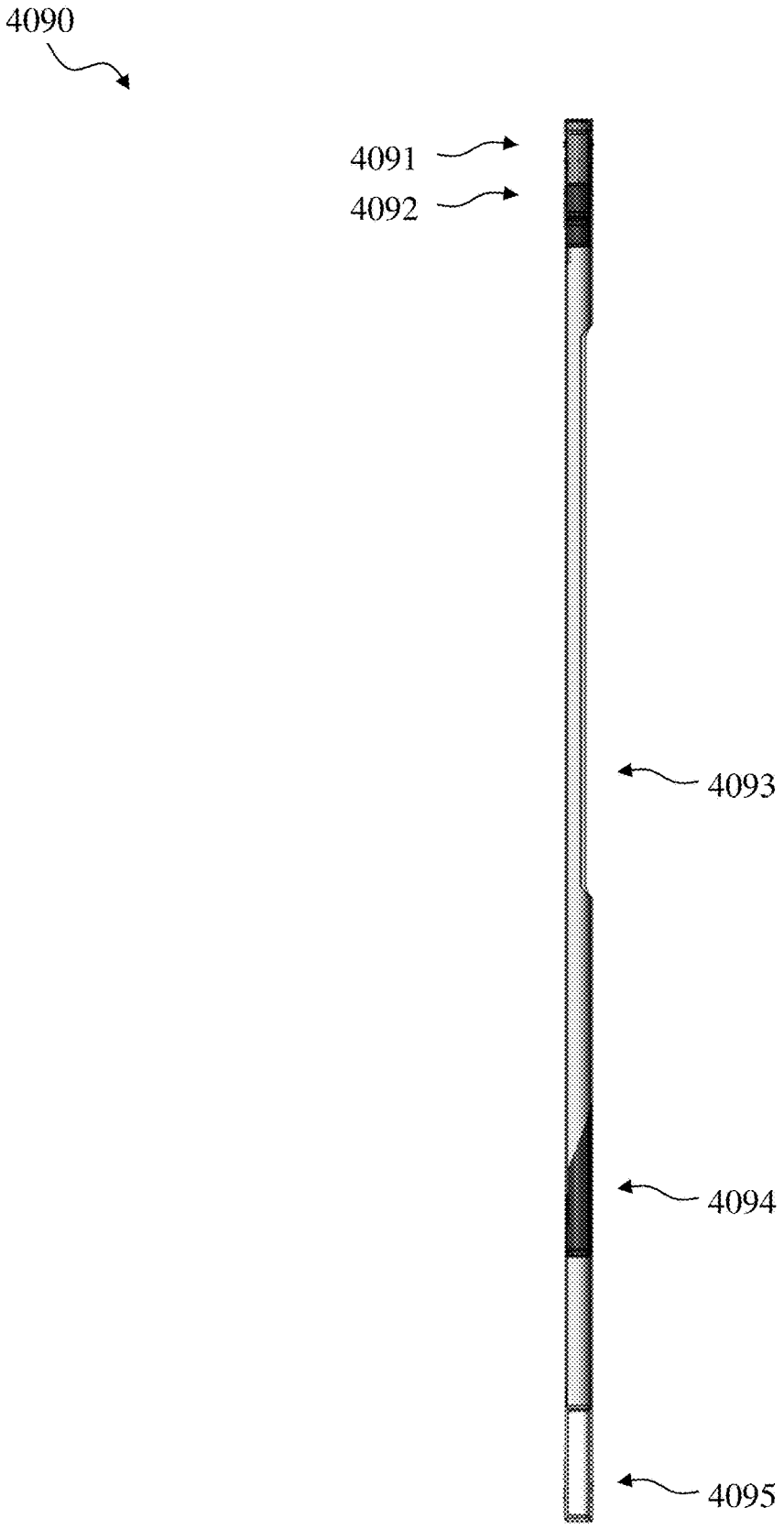
Figure 40G:
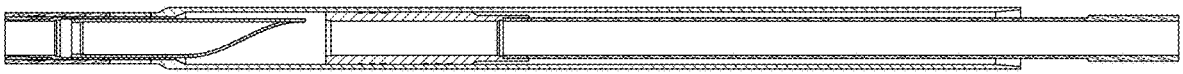
Figure 40H:
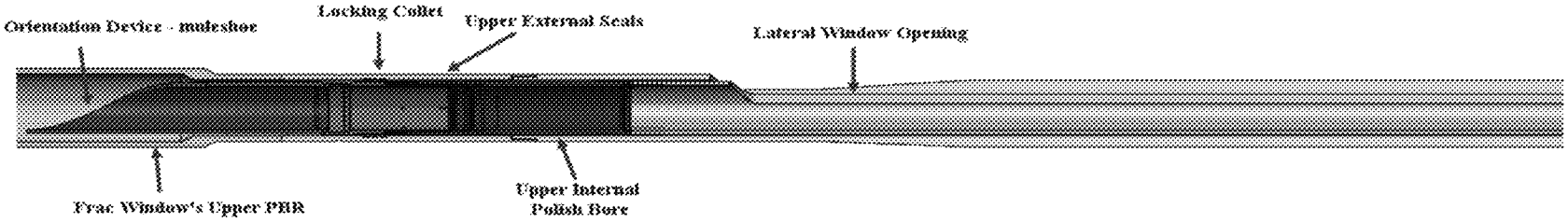
Figure 40I:
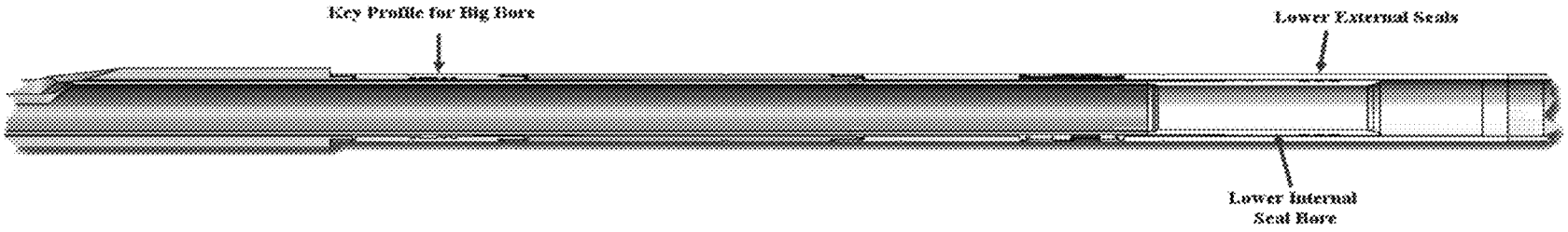
Figure 40J:
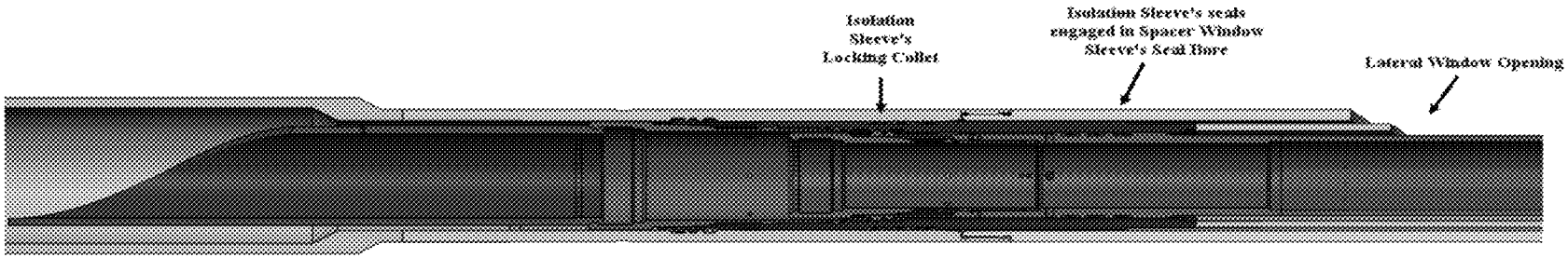
Figure 40K:
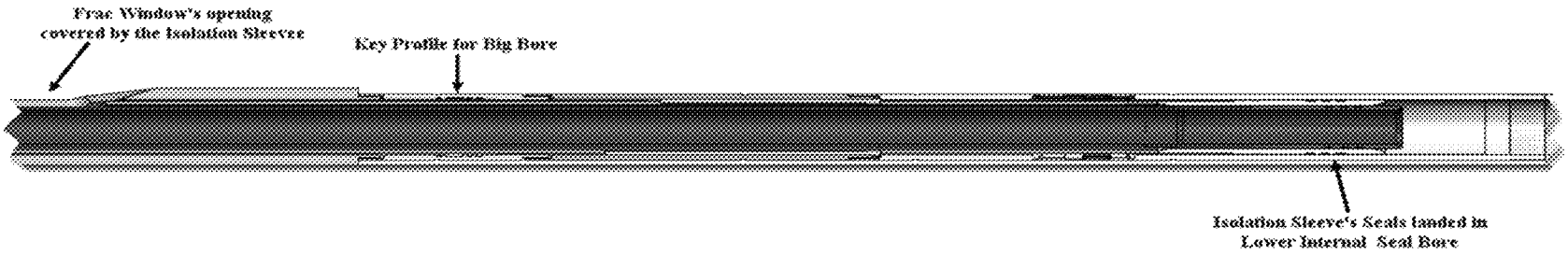
Figure 40L:
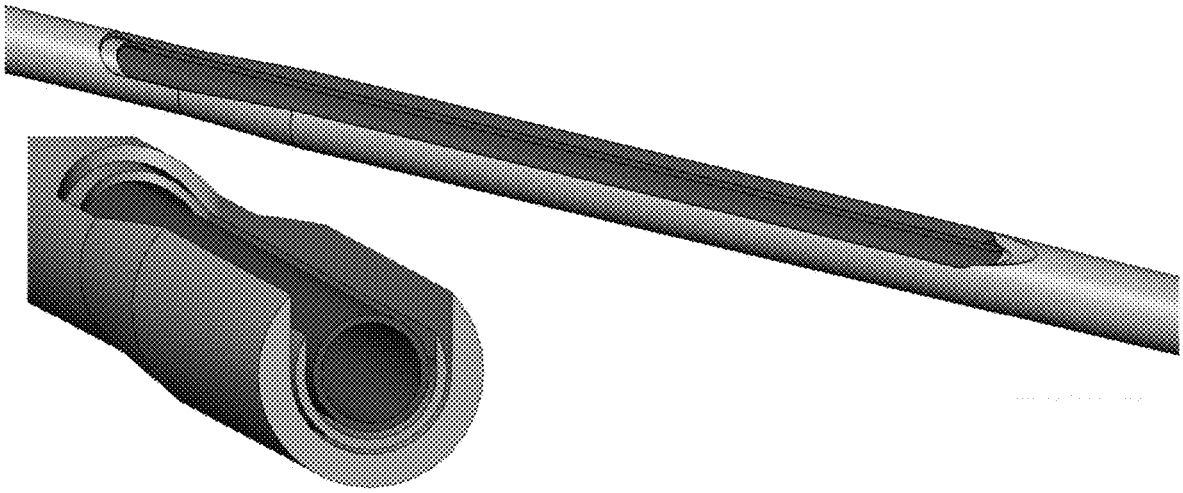
Figure 40M:
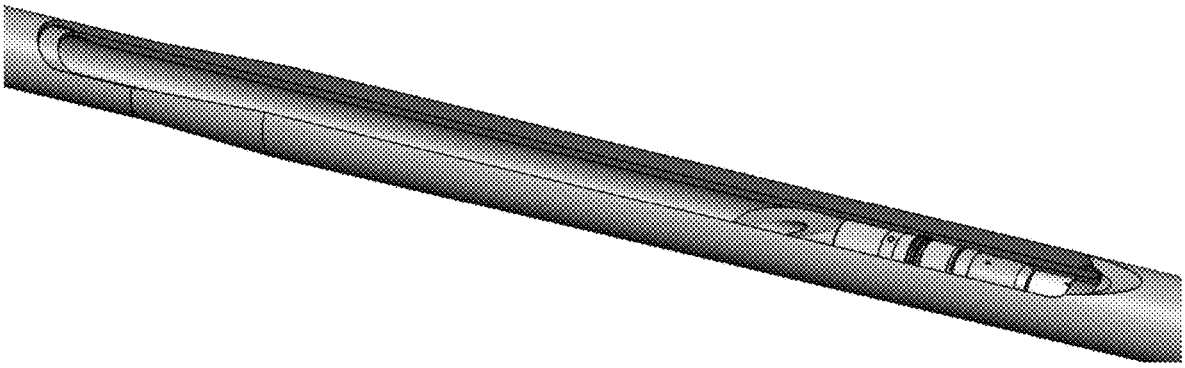

Turning to FIGS. 40E and 40F, illustrated are an external view and cross-sectional view, respectively, of an alternative embodiment of a spacer window sleeve 4090 with lower orientation device. The spacer window sleeve 4090 includes, without limitation: anchoring device 4091—collet; seal mandrel with external seals 4092—5.763" (e.g., 14.64 cm); 3) internal R-nipple profile w/4.525" (e.g., 11.49 cm) polish bore (may be integral with seal mandrel 4091 as shown;

tubing window 4093—window opening to pass tools out into the lateral; internal profile for landing whipstock—4.525" (e.g., 11.49 cm) (not shown); orientation device 4094—e.g., muleshoe; internal polish bore 4095—4.525" (e.g., 11.49 cm); and 8) seal mandrel with external seals 4096—5.763" (e.g., 14.64 cm). In the illustrated embodiment, the orientation device 4094 is located between the second opening 4093 and the second tubular end 4020*b*.

Turning to FIGS. 40G through 40M, illustrated are various different views of the installed spacer window sleeve 4050.

Figure 41:
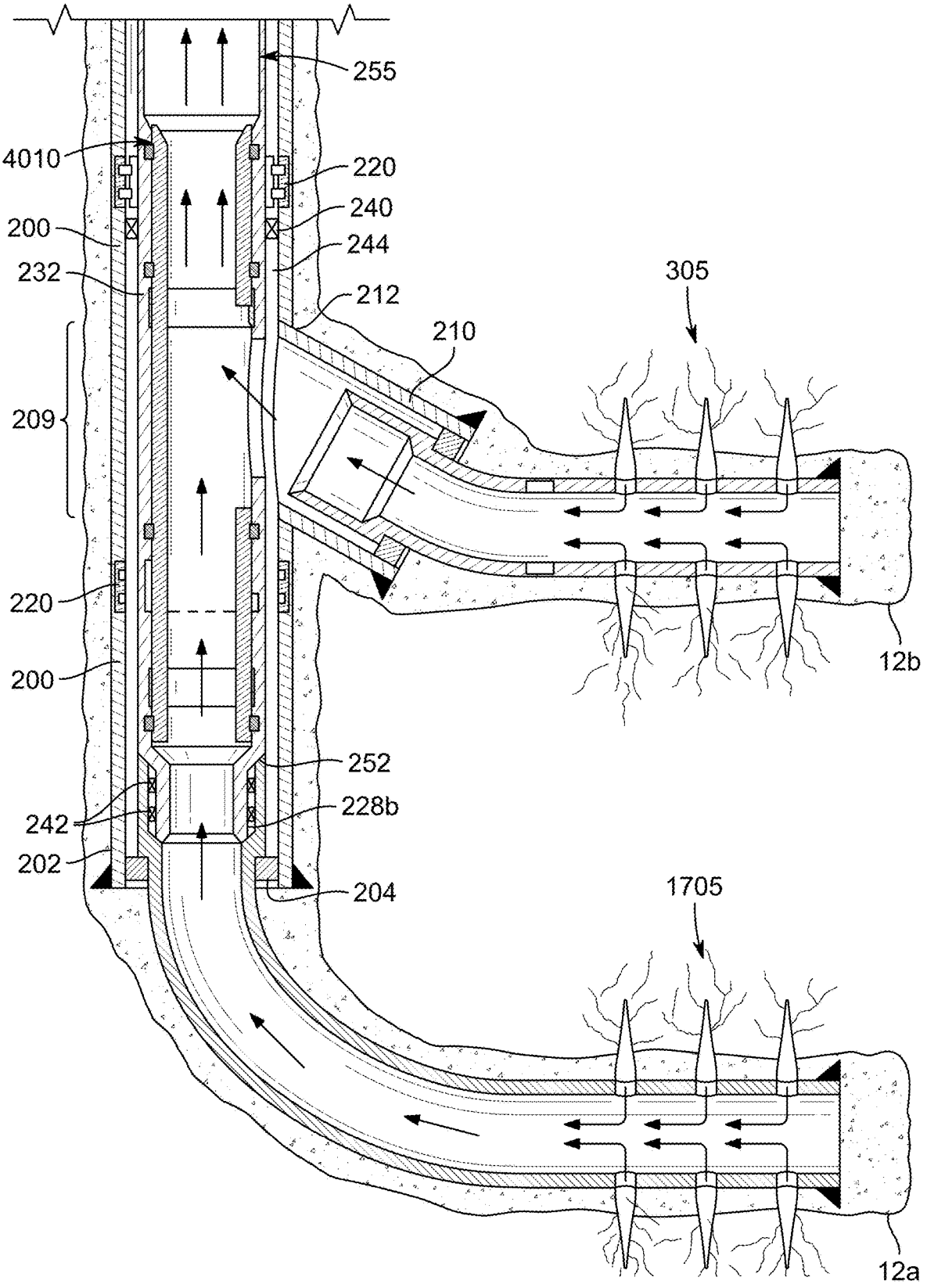

FIG. 41 illustrates the removal of the high-pressure frac string 251.

Figure 42:
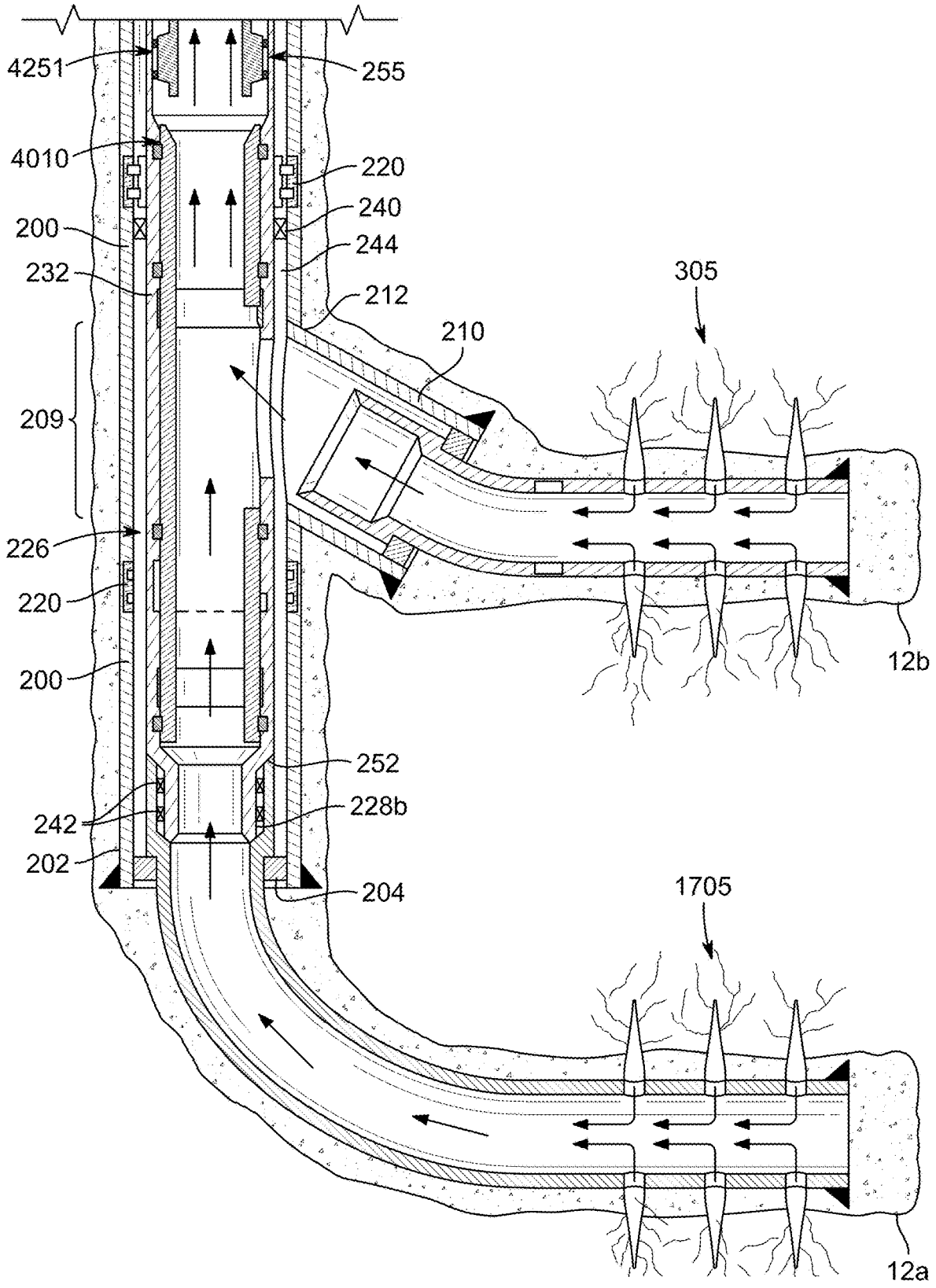

FIG. 42 illustrates the installation of a low-pressure frac string 4251, or in certain embodiments, production tubing. The low-pressure frac string 4251, in the illustrated embodiment, engages with the PBR 255 of the frac window system 226.

Figure 43:
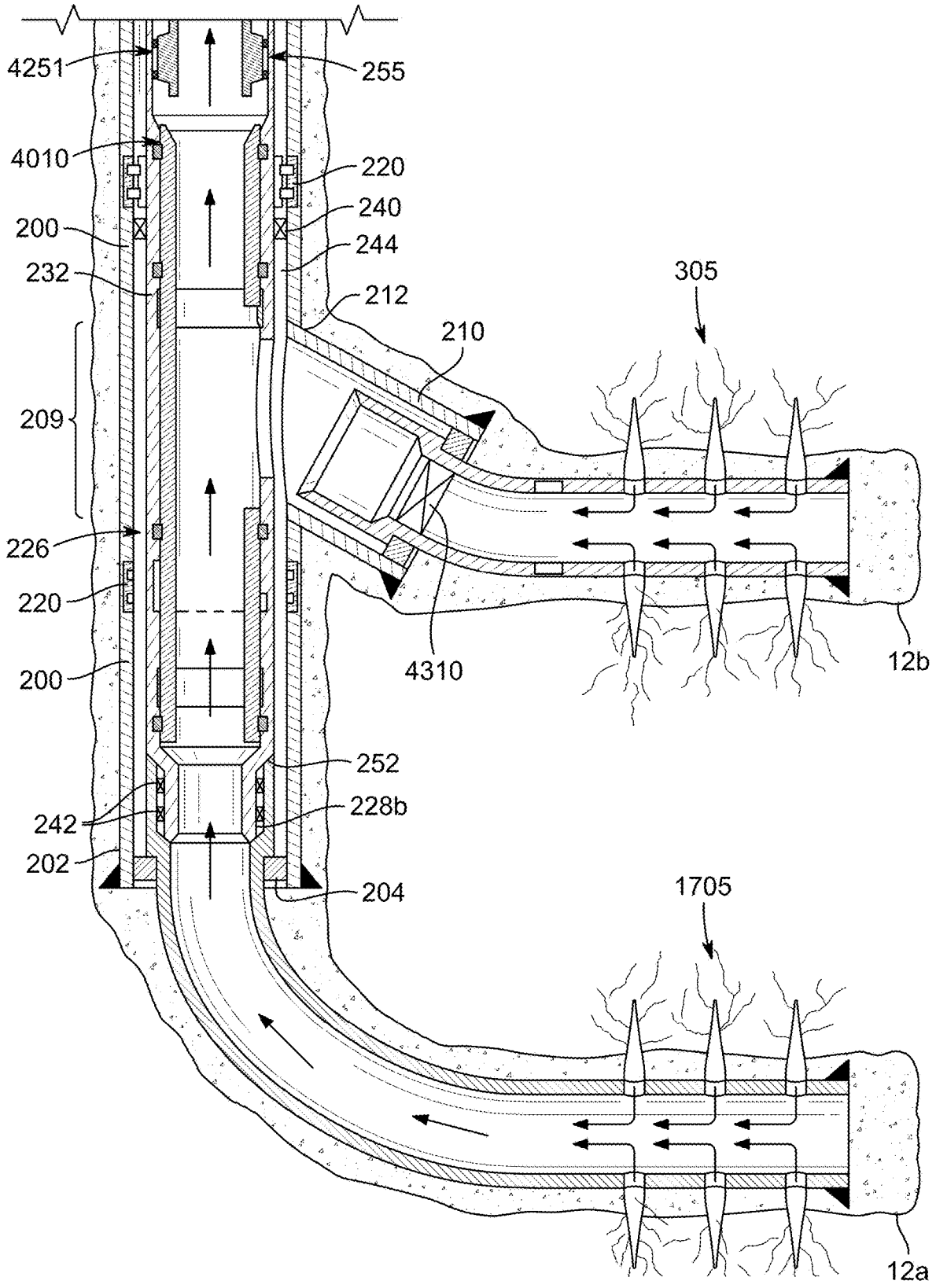

FIG. 43 illustrates the well system of FIG. 42 after the placement of an upper secondary wellbore plug 4310 within the upper secondary wellbore 12*b*. In the illustrated embodiment, the upper secondary wellbore plug 4310 is run-in-hole through the low-pressure frac string 4251. In at least one embodiment, the upper secondary wellbore plug 4310 is a high-expansion plug, as might be required to traverse the low-pressure frac string 4251 while still having the ability to seal the upper secondary wellbore 12*b*.

Figure 44:
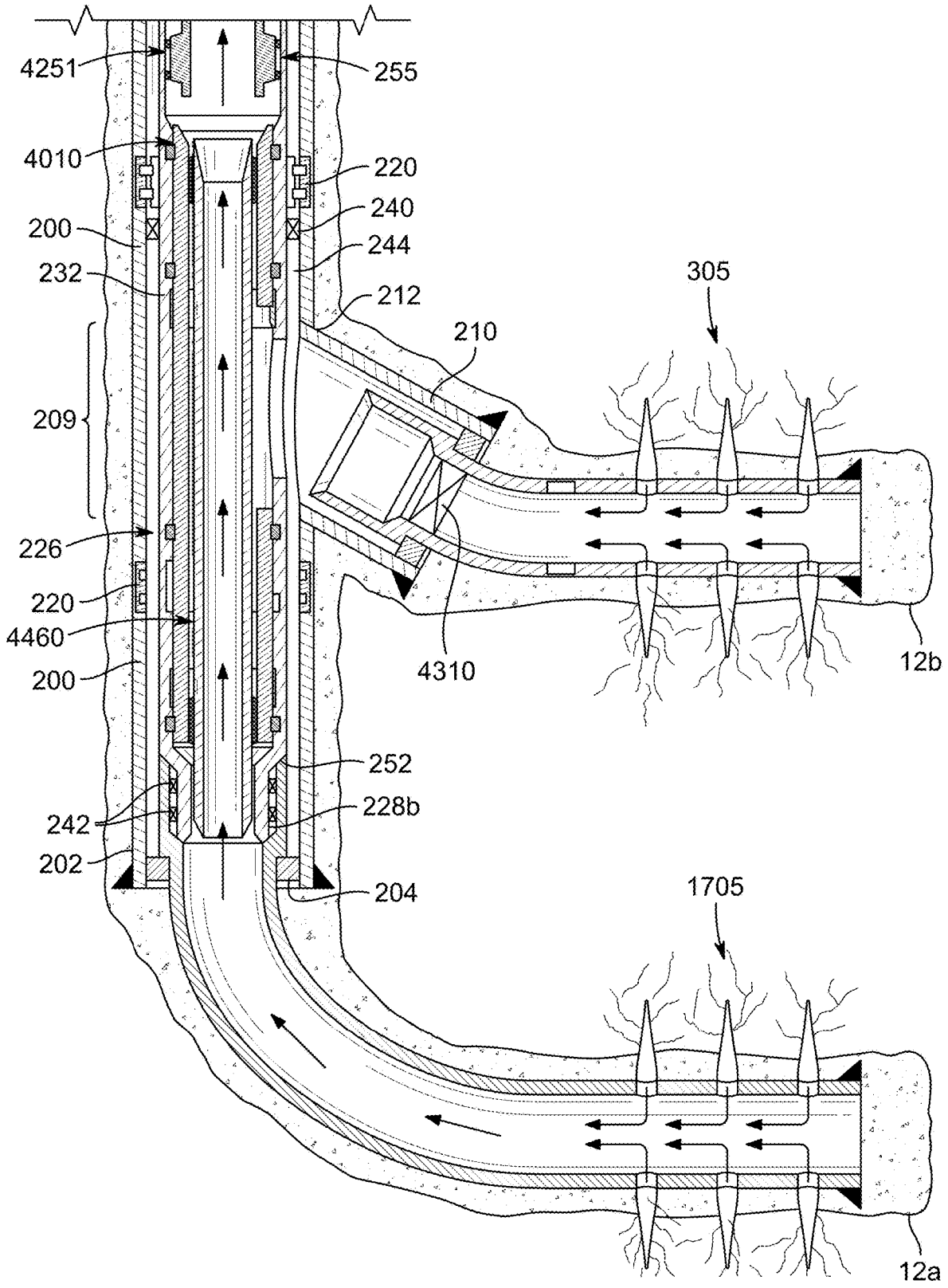

FIG. 44 illustrates the placement of an isolation sleeve 4460 within the frac window system 226. The isolation sleeve 4460, in at least one embodiment, is similar in many respects to the isolation sleeve 2460 described and illustrated with respect to FIG. 24A above, but for the exclusion of the high-expansion seals 2465 (e.g., the high-expansion seals are not necessary because of the spacer window sleeve 4010). In the illustrated embodiment, the isolation sleeve 4460 is run-in-hole through the low-pressure frac string 4251.

Figure 45:
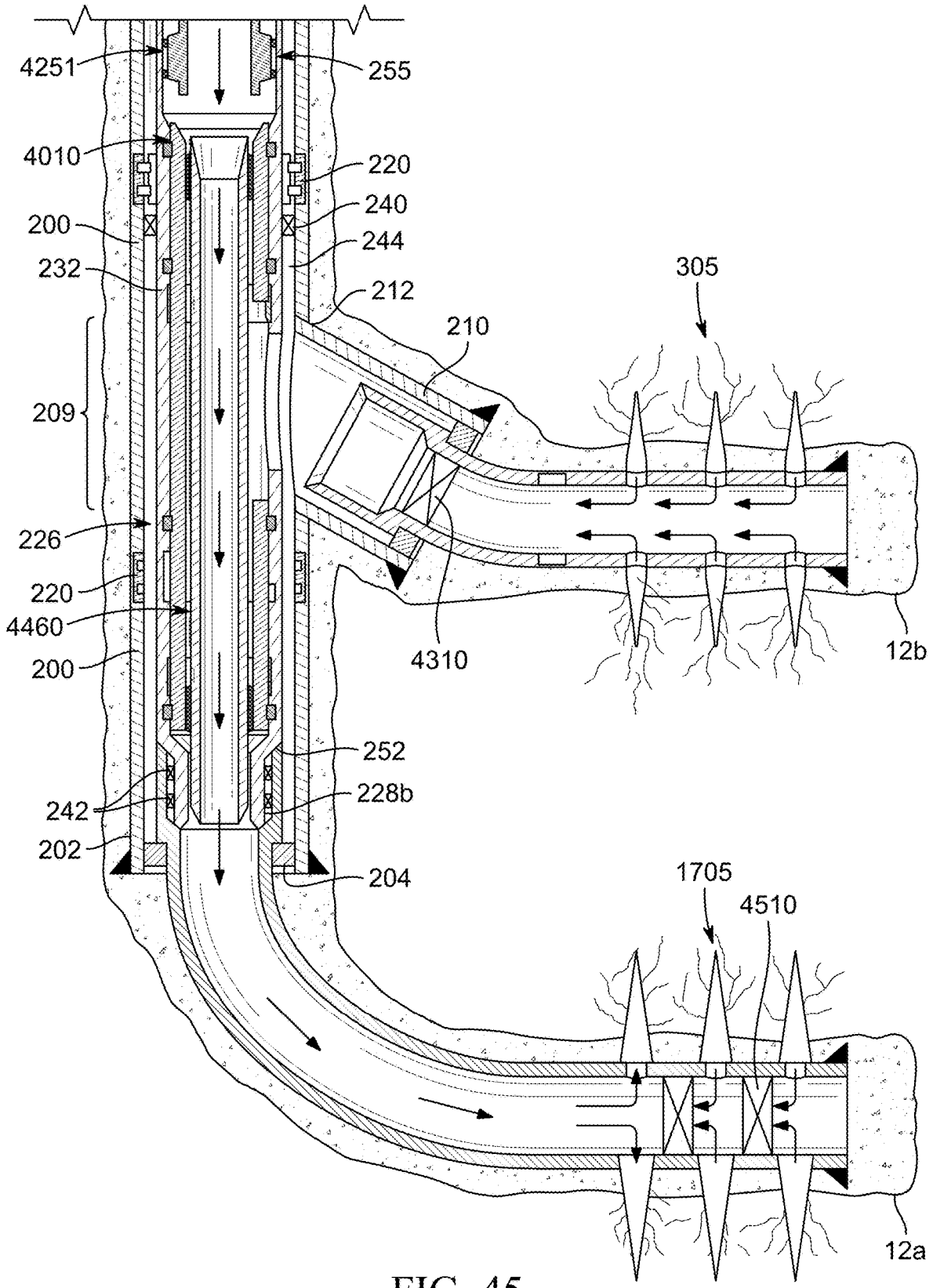

As shown in FIG. 45, the isolation sleeve 4460 functions to isolate the portion of first wellbore 12 below window 212, including secondary wellbore 12*b*, from secondary wellbore 12*a*. The seals, as described above, permit delivery of a high-pressure fluid to lower secondary wellbore 12*a* without impacting upper secondary wellbore 12*b*. For example, hydraulic fracturing operations can be carried out with respect to lower secondary wellbore 12*a* without impacting upper secondary wellbore 12*b*. This might be desirable after one secondary wellbore 12*a*, 12*b* has been producing for some time and it is determined that only certain secondary wellbores within the system (such as secondary wellbore 12*a*) may need stimulation, while other secondary wellbores (such as secondary wellbore 12*b*) do not. The isolation sleeve 4460 not only isolates the wellbores 12*a* and 12*b* from one another, but also provide a path for balls, plugs, etc. to be dropped from the surface to isolate individual zones in the wellbores during the stimulation process.

As shown in FIG. 45, the lower secondary wellbore 12*a* has at least partially been re-stimulated. For example, the lower secondary wellbore 12*a* has been re-stimulated from toe to heal, for example using one or more frac plugs 4510 to isolate the different stimulated regions. In at least one embodiment, as shown, the deployment of the frac plugs 4510 and the re-stimulation process are conducted through the low-pressure frac string 4251.

Figure 46:
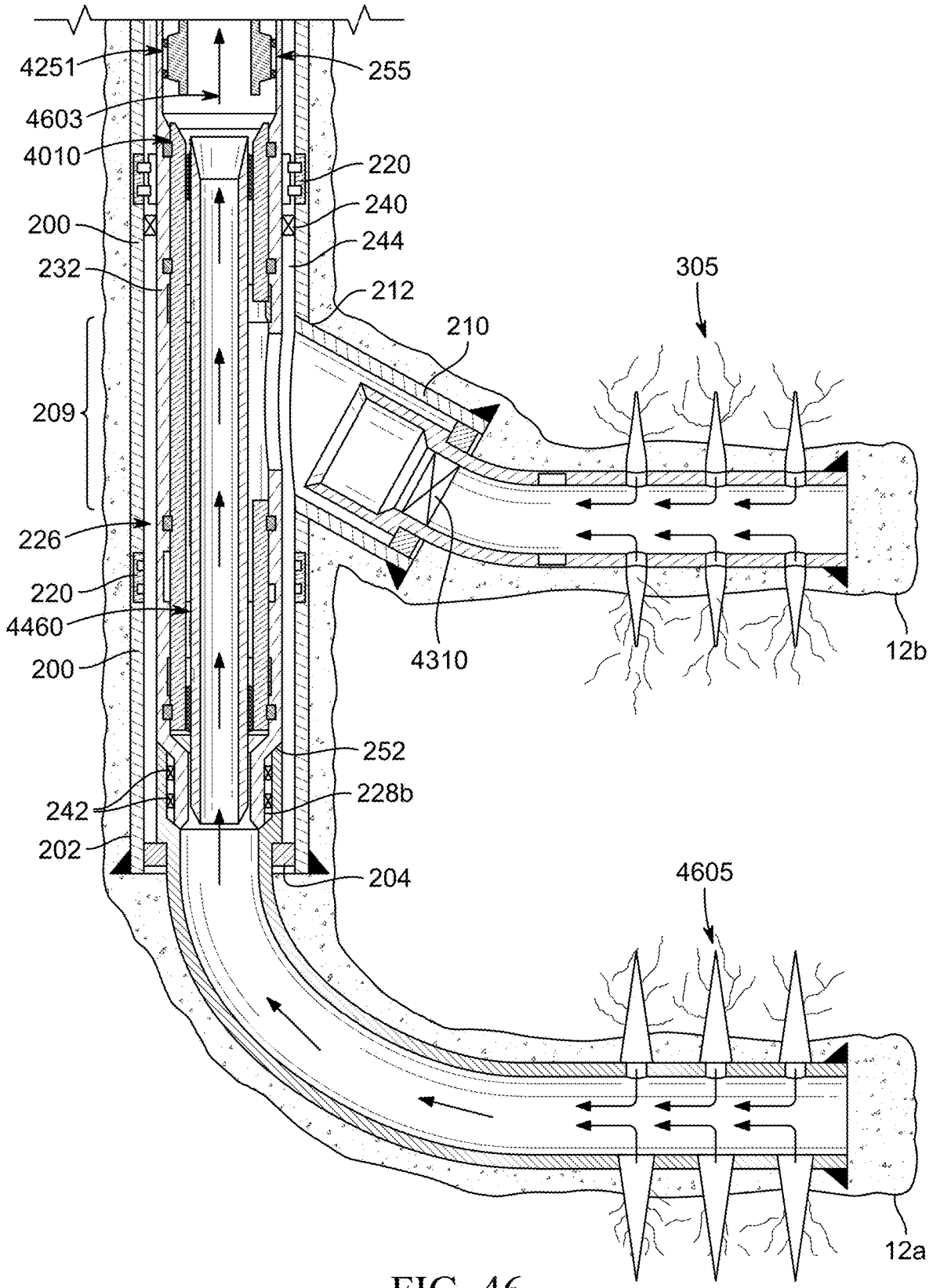

FIG. 46 illustrates production from the lower secondary wellbore 12*a* or flowback of fluids 4603, such as hydraulic fracturing fluids and/or hydrocarbons, from fractures 4605 resulting from such an operation, where flowback 4603 from the lower secondary wellbore 12*a* is illustrated while the upper secondary wellbore 12*b* remains isolated.

Figure 47:
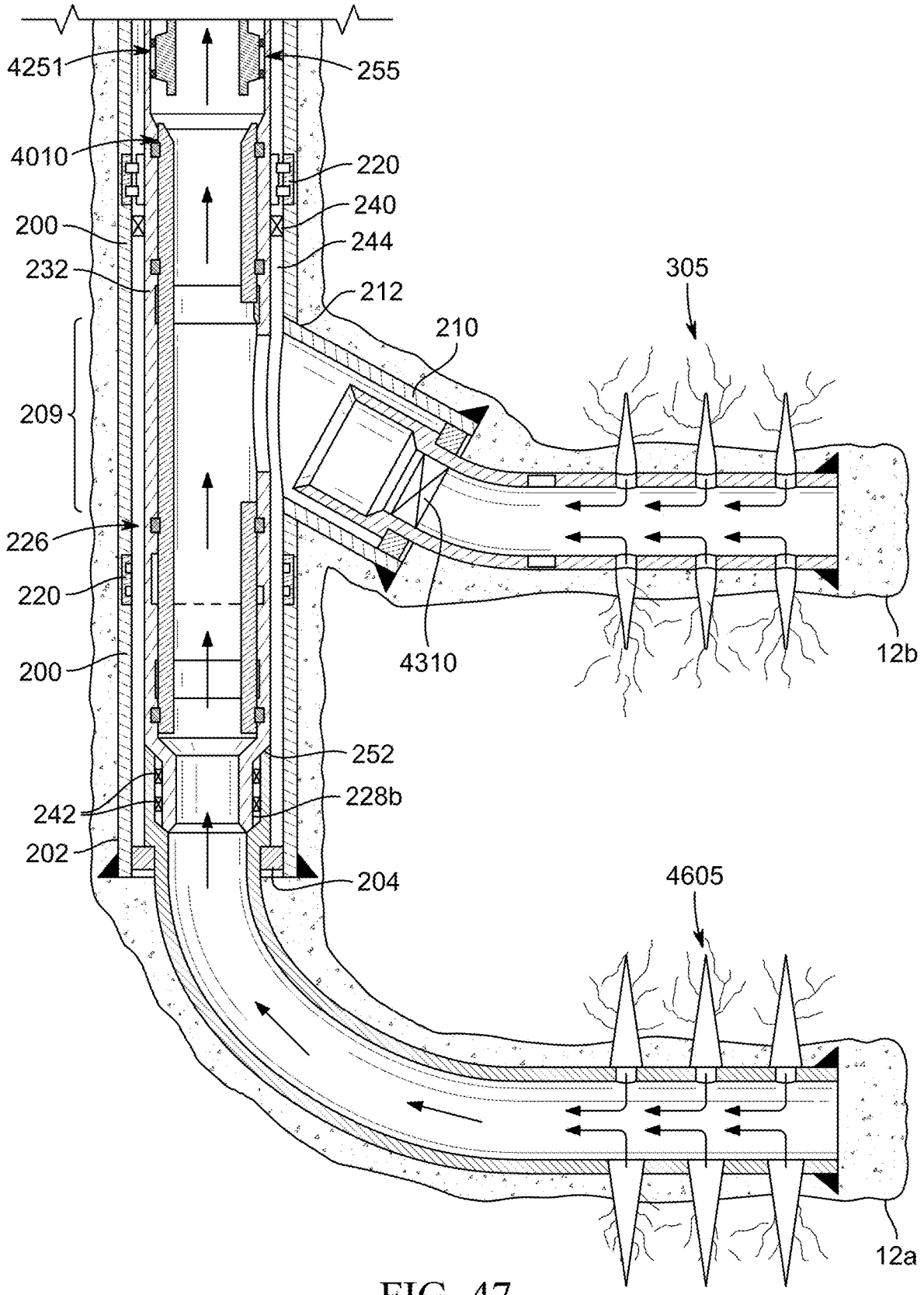

FIG. 47 illustrates the removal of the isolation sleeve 4460. In the illustrated embodiment, the isolation sleeve 4460 is removed through the low-pressure frac string 4251.

Figure 48:
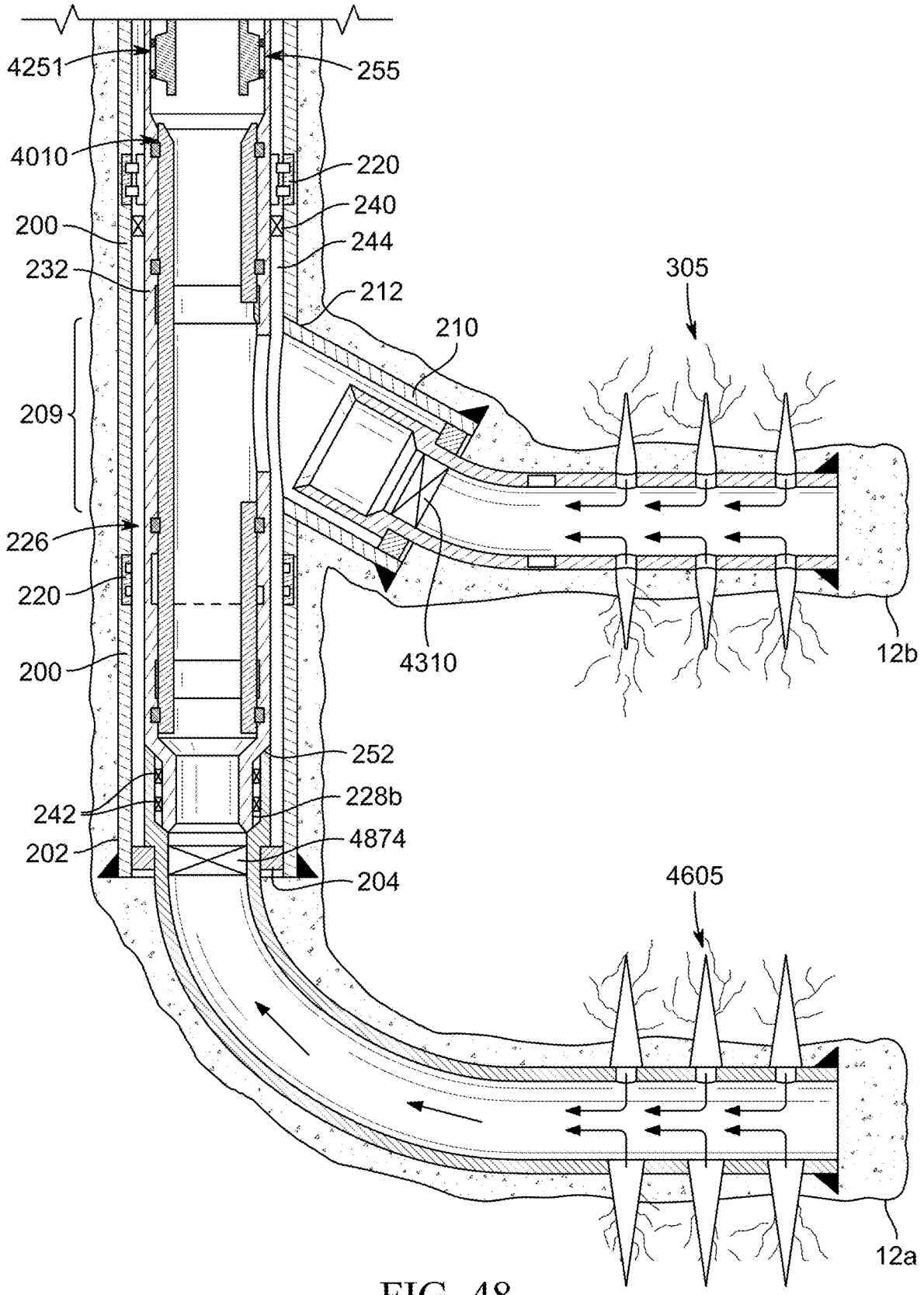

FIG. 48 illustrates the placement of a plug 4874 in the lower secondary wellbore 12*a*. Much in the same way that isolation sleeve 4460 is utilized to isolate secondary wellbore 12*b*, the plug 4874 may be deployed to isolate secondary wellbore 12*a* from pumping operations relating to secondary wellbore 12*b*. In at least one embodiment the plug 4874 may be positioned within frac window system 226, preferably at a location adjacent end 228*b* or may be positioned in casing 206 of secondary wellbore 12*a* or within PBR 215 (FIG. 5) if present.

Figure 49:
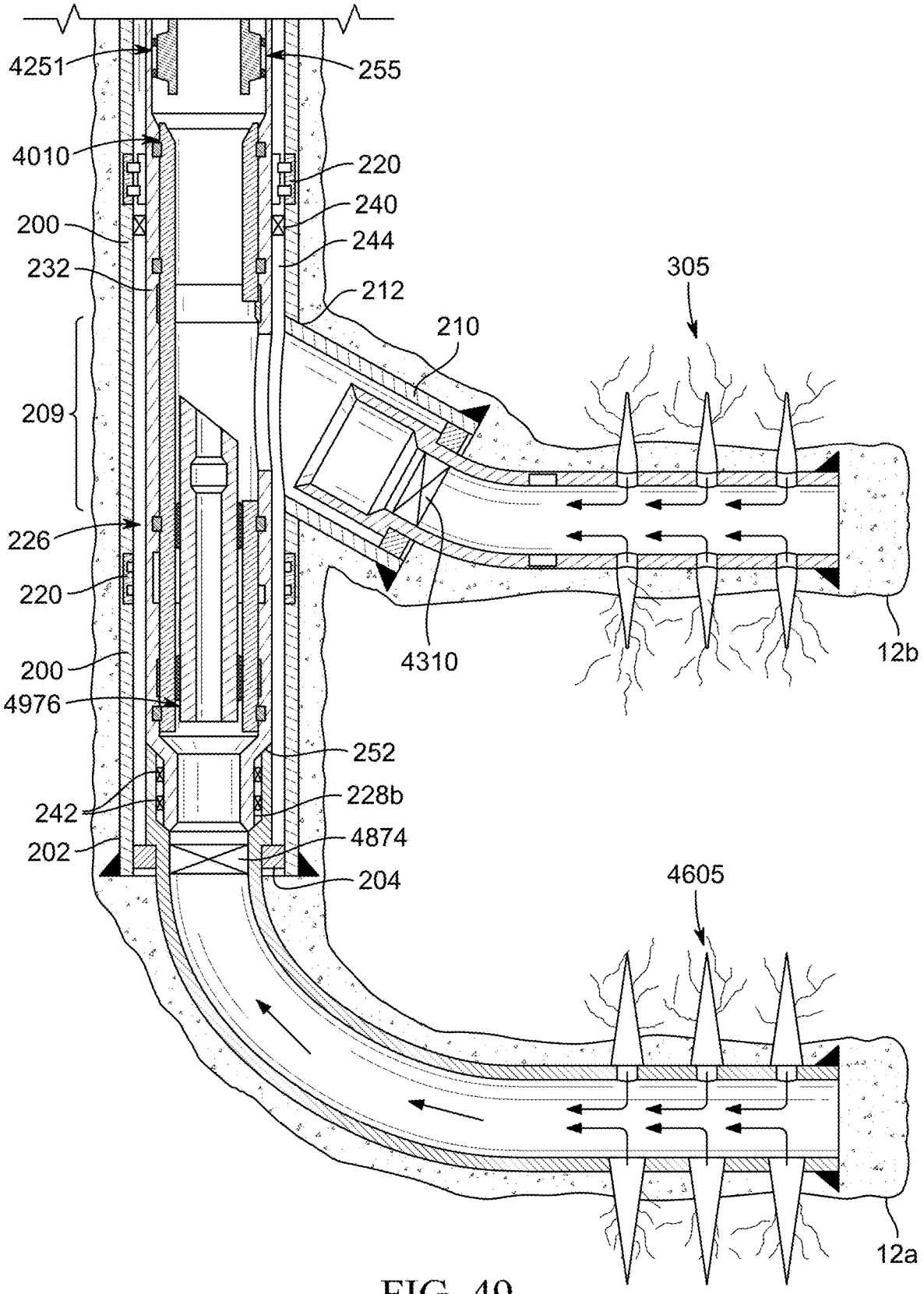

FIG. 49 illustrates the placement of a whipstock 4976 in the frac window system 226. The whipstock 4976 may be similar in many respects to the whipstock 3076 of FIG. 30A above, but for the exclusion of the high-expansion member 3080 (e.g., the high-expansion members are not necessary because of the spacer window sleeve 4010). The whipstock 4976, in the illustrated embodiment, is run-in-hole through the low-pressure frac string 4251.

Figure 50:
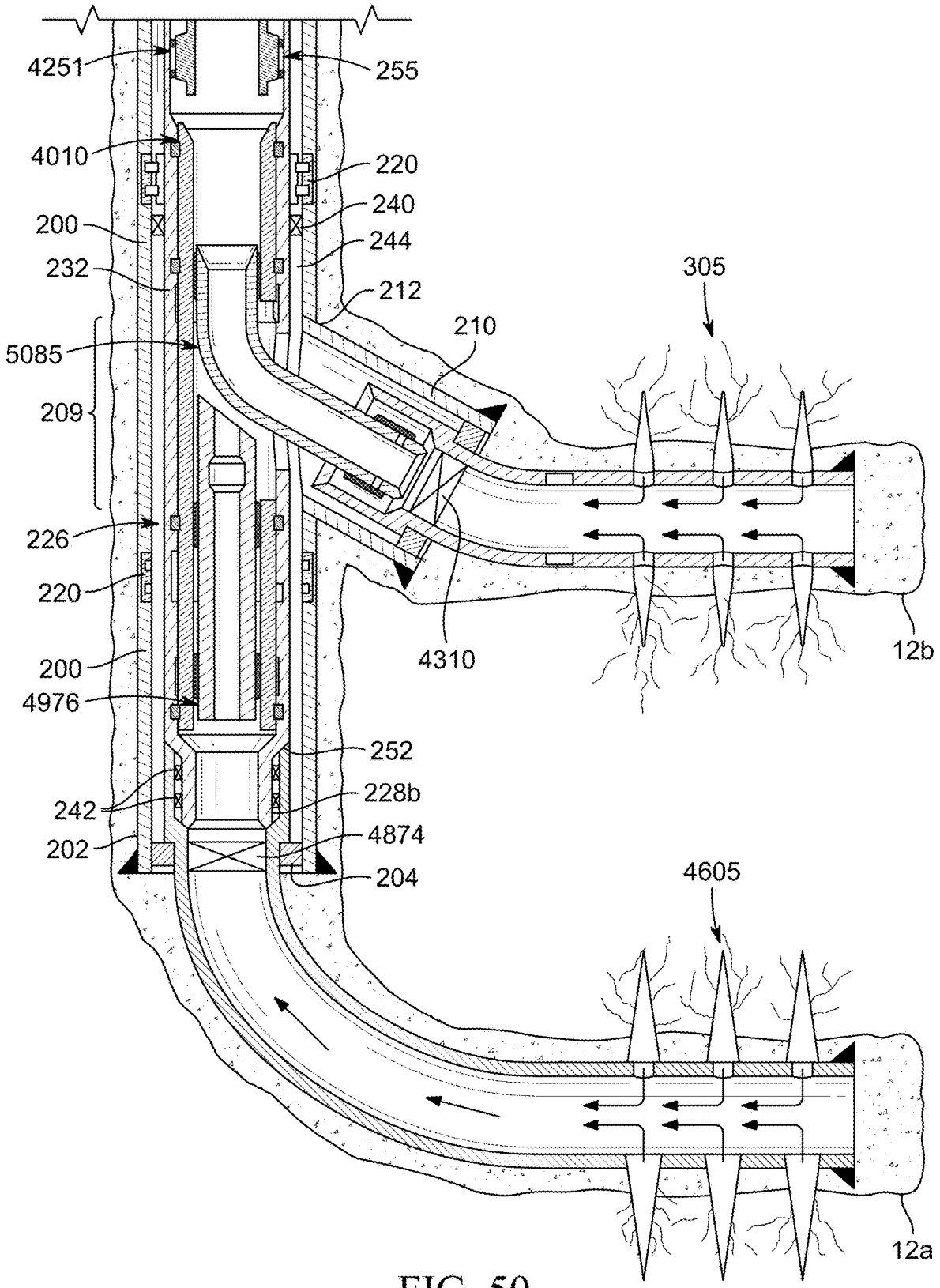

Turning to FIG. 50, a straddle stimulation tool 5085 is illustrated extending from the frac window system 226 into the upper secondary wellbore 12*b*. In the illustrated embodiment, the straddle stimulation tool 5085 is run-in-hole through the low-pressure frac string 4251. Straddle stimulation tool 5085 is similar in many respects to the straddle stimulation tool 3285, but for the exclusion of the high-expansion seals.

Figure 51:
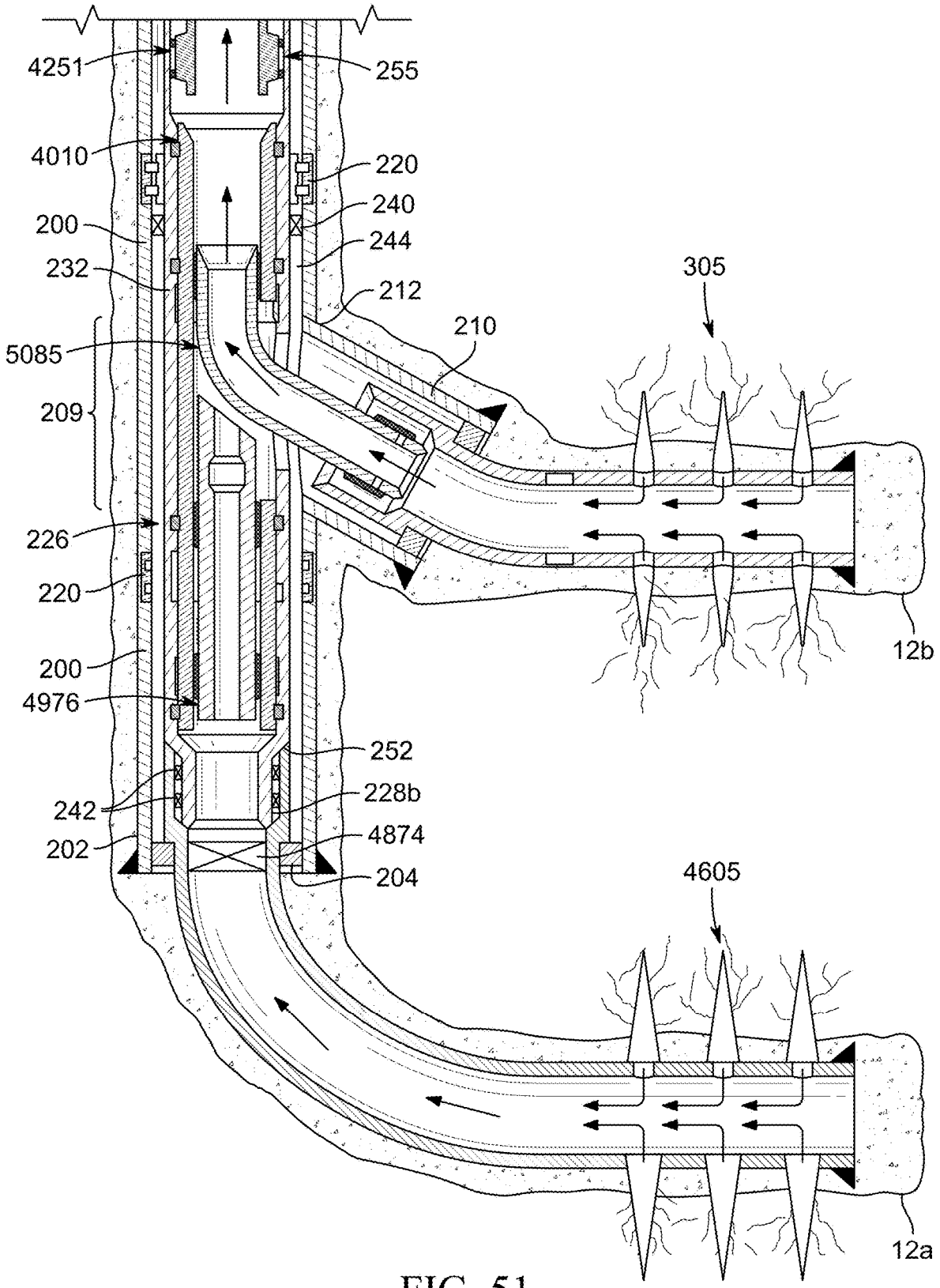

FIG. 51 illustrates the removal of the plug 4310. Those skilled in the art understand the processes that might be used to remove the plug 4310.

Figure 52:
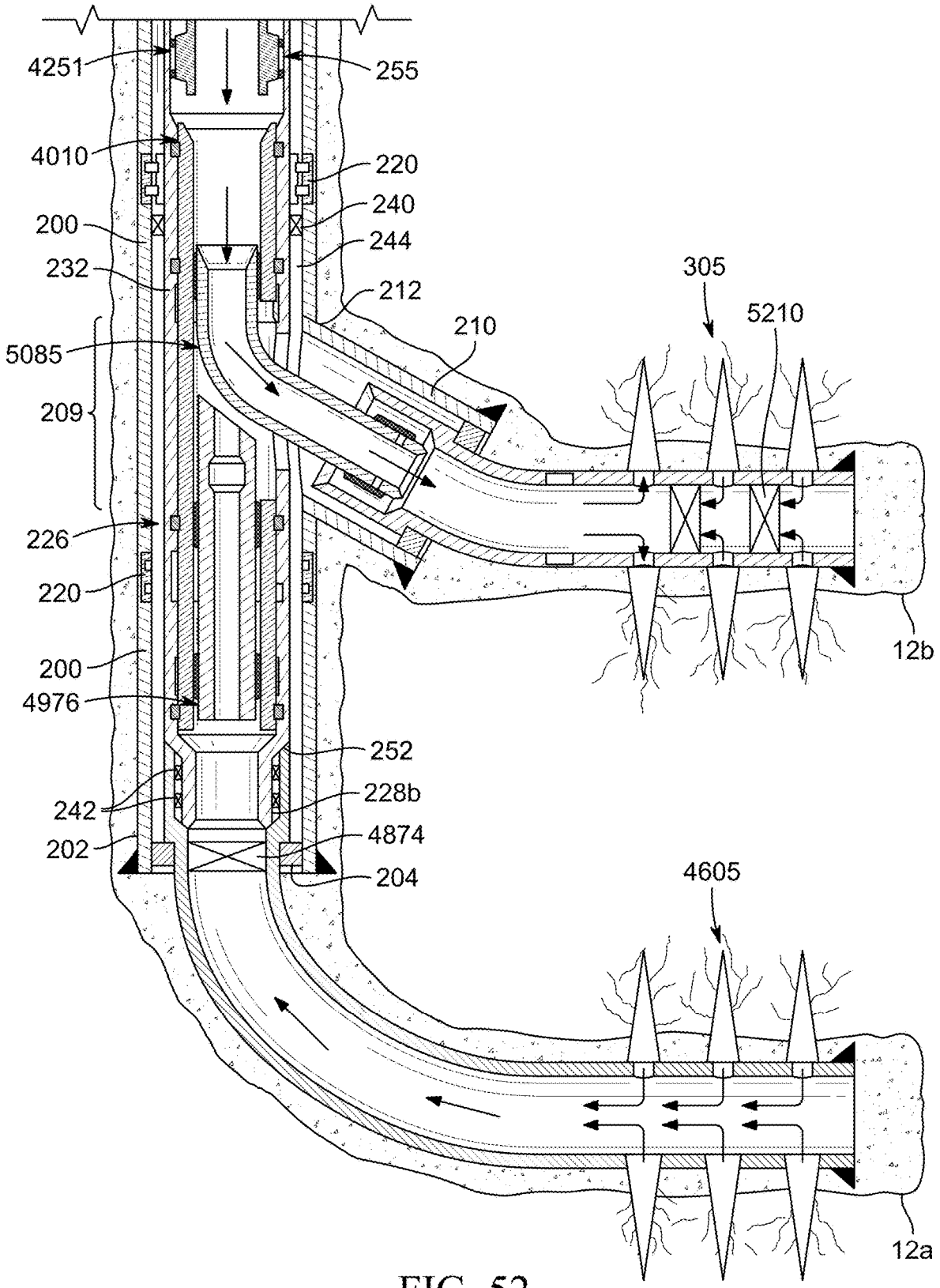

As shown in FIG. 52, the secondary wellbore 12*b* has at least partially been re-stimulated. For example, the secondary wellbore 12*b* has been re-stimulated from toe to heal, for example using one or more frac plugs 5210 to isolate the different stimulated regions. In at least one embodiment, as shown, the deployment of the frac plugs 5210 and the re-stimulation process are conducted through the low-pressure frac string 4251.

Figure 53:
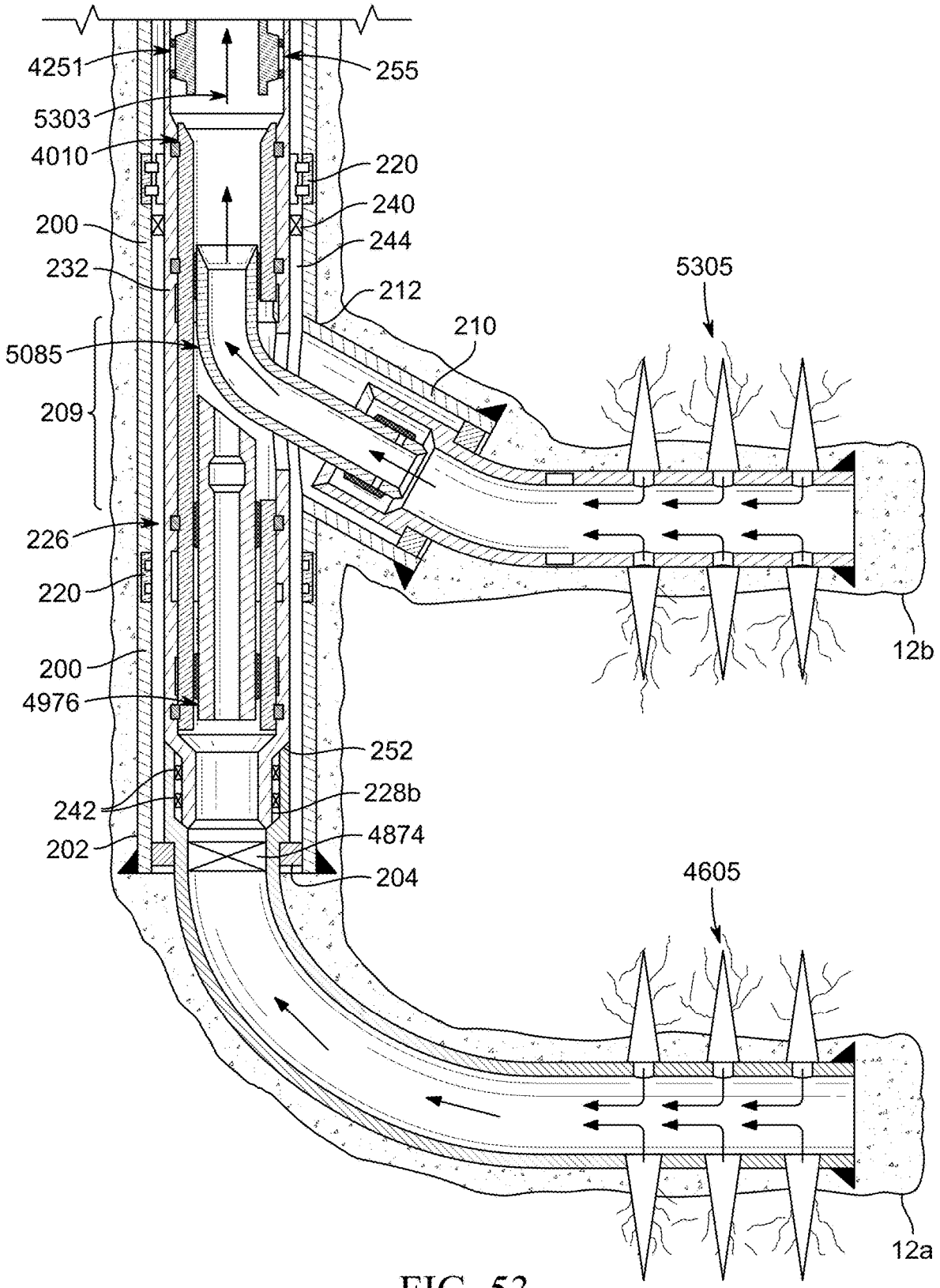

FIG. 53 illustrates production from the upper secondary wellbore 12*b* or flowback of fluids 5303, such as hydraulic fracturing fluids and/or hydrocarbons, from fractures 5305 resulting from such an operation, where flowback 5303 from secondary wellbore 12*b* is illustrated while secondary wellbore 12*a* remains isolated.

Figure 54:
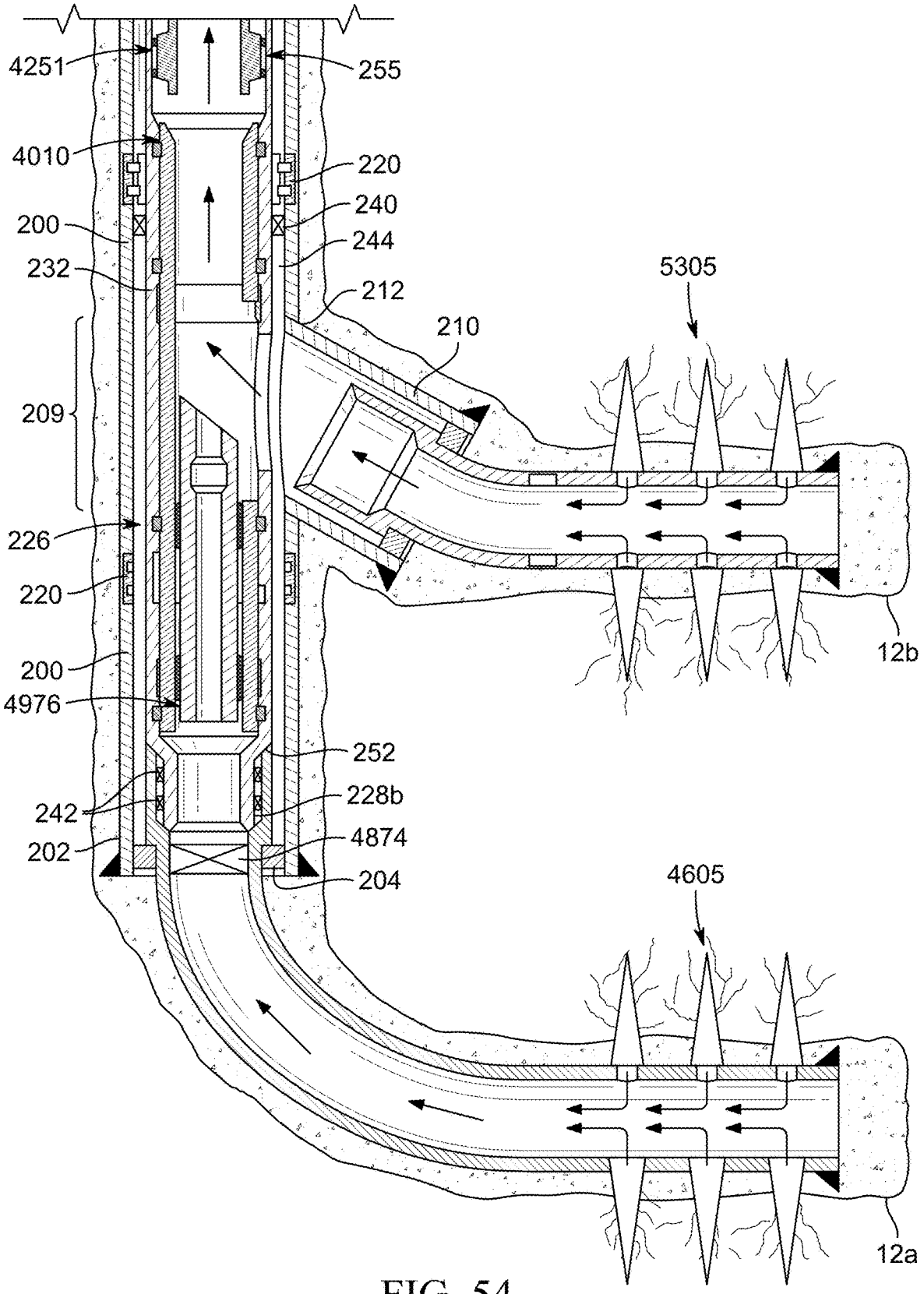

FIG. 54 illustrates the removal of the straddle stimulation tool 5085. In the illustrated embodiment, the straddle stimulation tool 5085 is removed through the low-pressure frac string 4251.

Figure 55:
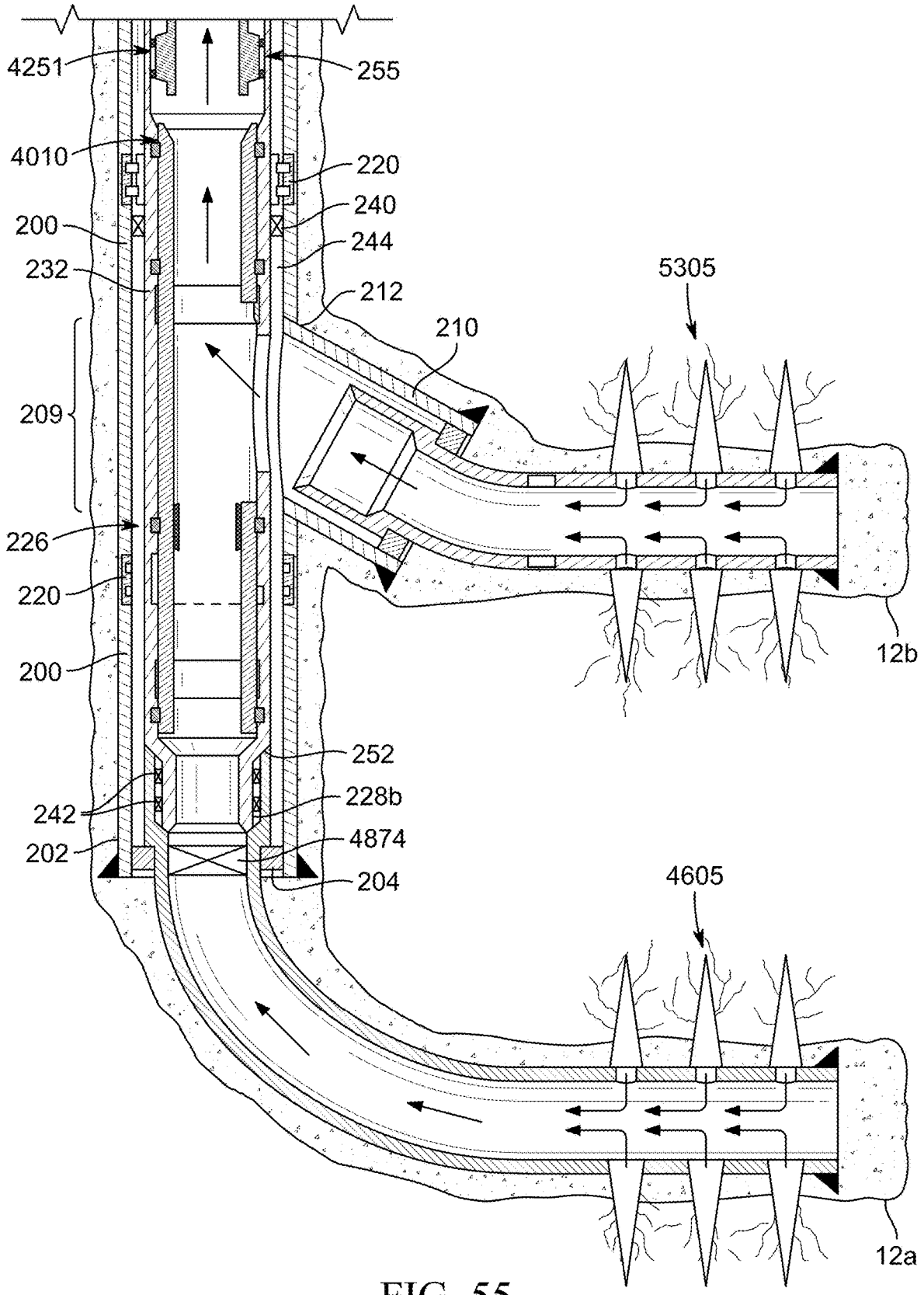

FIG. 55 illustrates the removal of the deflector 4976. In the illustrated embodiment, the deflector 4976 is removed through the low-pressure frac string 4251.

Figure 56:
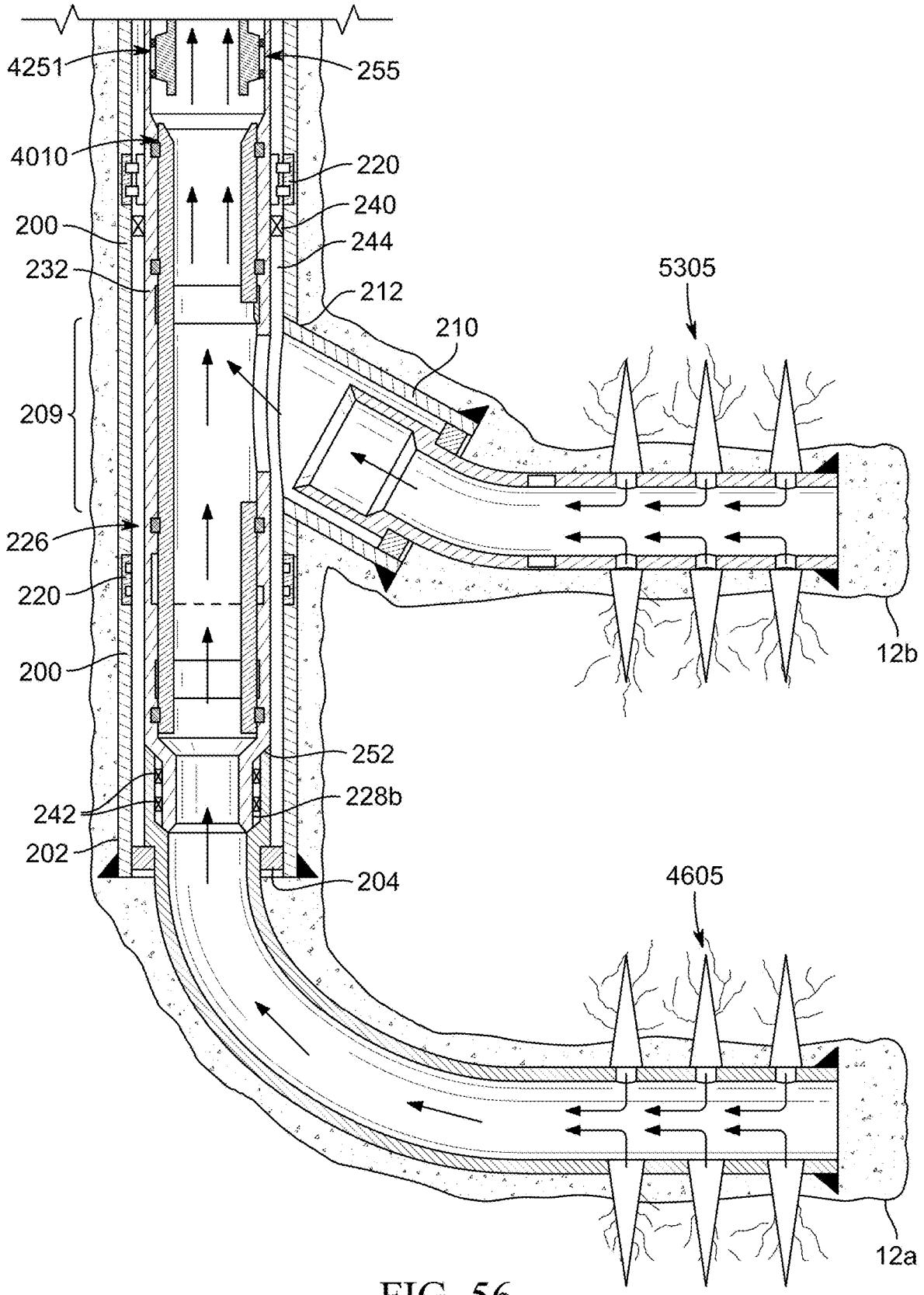

FIG. 56 illustrates the removal of the plug 4874. In the illustrated embodiment, the plug 4874 is removed through the low-pressure frac string 4251. In yet another embodiment, the plug 4874 is drilled out through the low-pressure frac string 4251. What results is commingled flow from the lower secondary wellbore 12*a* and the upper secondary wellbore 12*b*. In at least one embodiment, the commingled flow travels to the surface of the wellbore 12 through the frac window system 226 and the low-pressure frac string 4251. Accordingly, the low-pressure frac string 4251 may ultimately function as production tubing, for at least as long as it remains within the wellbore 12.

Figure 57:
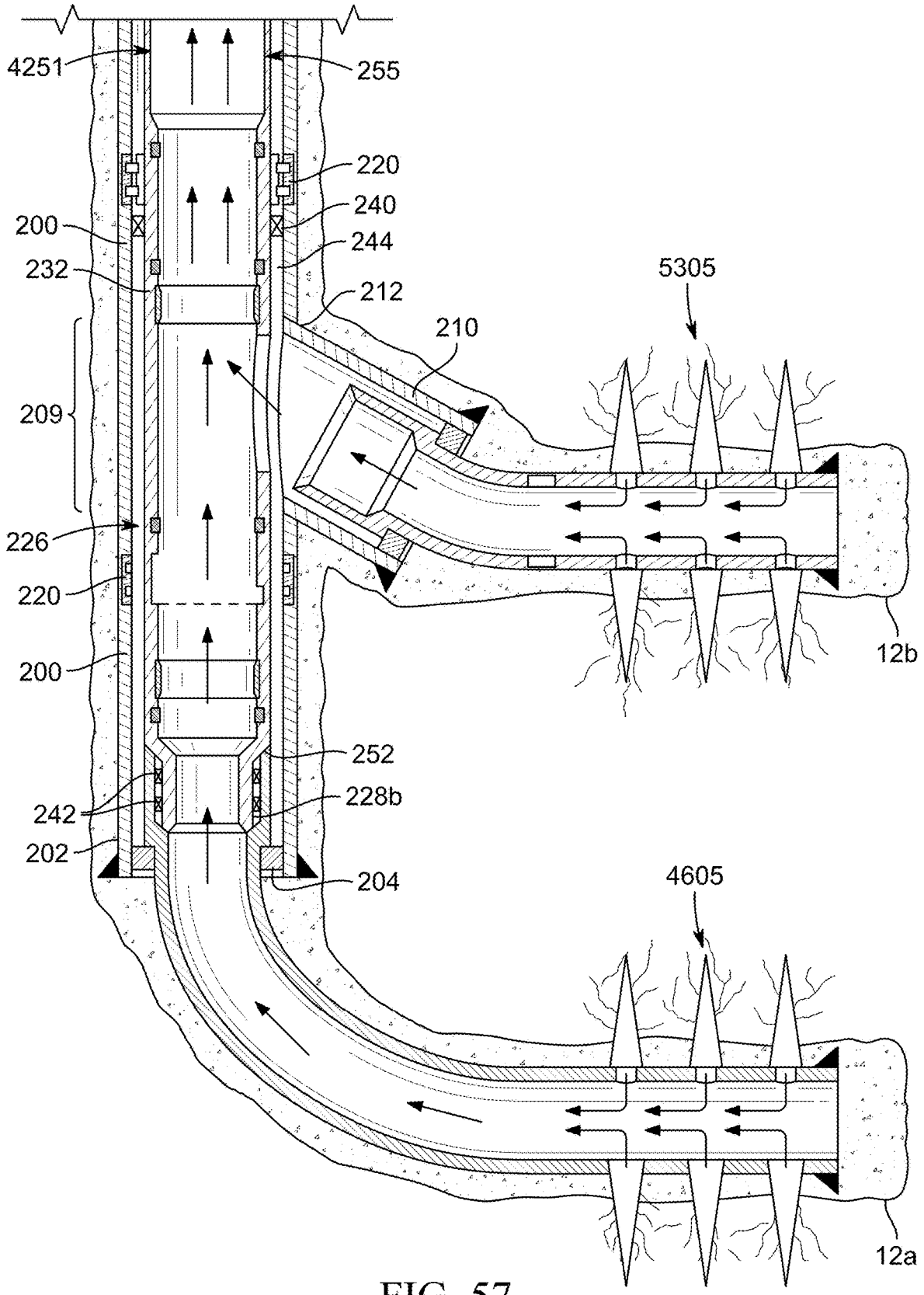

FIG. 57 illustrates the removal of the low-pressure frac string 4251 and the spacer window sleeve 4010. Those skilled in the art understand the processes that may be used to remove the low-pressure frac string 4251 and the spacer window sleeve 4010.

Aspects disclosed herein include:

A. A frac window system, the frac window system including: 1) an elongated tubular having a first end and a second end with an opening defined in a wall of the elongated tubular between the first end and the second end, the wall having an inner surface and an outer surface, wherein the opening in the wall is configured to align with a window of a wellbore casing; and 2) a polished bore receptacle coupled to the first end of the elongated tubular, the polished bore receptacle having an inside diameter ($ID_1$) sufficient to engage with a high-pressure frac string.

B. A well system, the well system including: 1) a first wellbore casing defining an interior annulus and having a window formed there along; 2) a secondary wellbore extending from the window of the first wellbore casing, the first wellbore casing and the secondary wellbore forming a junction; 3) a frac window system disposed within the first wellbore casing at the junction, the frac window system including: a) an elongated tubular having a first end and a second end with an opening defined in a wall of the elongated tubular between the first end and the second end, the wall having an inner surface and an outer surface, wherein the opening in the wall is aligned with the window of the first wellbore casing; and b) a polished bore receptacle coupled to the first end of the elongated tubular, the polished bore receptacle having an inside diameter ($ID_1$) sufficient to engage with a high-pressure frac string; and 4) a high-pressure frac string coupled to the polished bore receptacle.

C. A wellbore stimulation method, the method including: 1) positioning a frac window system in a first wellbore casing defining an interior annulus and having a window formed there along, the frac window system including: a) an elongated tubular having a first end and a second end with an opening defined in a wall of the elongated tubular between the first end and the second end, the wall having an inner surface and an outer surface; and b) a polished bore receptacle coupled to the first end of the elongated tubular, the polished bore receptacle having an inside diameter ($ID_1$) sufficient to engage with a high-pressure frac string; and 2) orientating the frac window system so that the opening in the elongated tubular aligns with a junction of a secondary wellbore extending from the cased portion of the first wellbore.

D. A sleeve for use with a frac window system, the sleeve including: 1) a tubular having a first tubular end and a second tubular end; and 2) one or more flow control orifices located in a sidewall of the tubular between the first tubular end and the second tubular end, the tubular configured to be placed within a frac window system at a junction between a first wellbore and a secondary wellbore such that the one or more flow control orifices restrict a flow of wellbore fluid from the secondary wellbore into the tubular.

E. A well system, the well system including: 1) a first wellbore casing defining an interior annulus and having a window formed there along; 2) a secondary wellbore extending from the window of the first wellbore casing, the first wellbore casing and the secondary wellbore forming a junction; 3) a frac window system disposed within the first wellbore casing at the junction, the frac window system including an elongated tubular having a first end and a second end with an opening defined in a wall of the elongated tubular between the first end and the second end, the wall having an inner surface and an outer surface, wherein the opening in the wall is aligned with the window of the first wellbore casing; and 4) a sleeve positioned within the frac window system, the sleeve including: a) a tubular having a first tubular end and a second tubular end; and b) one or more flow control orifices located in a sidewall of the tubular between the first tubular end and the second tubular end such that the flow control orifices restrict a flow of wellbore fluid from the secondary wellbore into the elongated tubular.

F. A method, the method including: 1) positioning a frac window system in a first wellbore casing defining an interior annulus and having a window formed there along, the frac window system including an elongated tubular having a first end and a second end with an opening defined in a wall of the elongated tubular between the first end and the second end, the wall having an inner surface and an outer surface; 2) orientating the frac window system so that the opening in the elongated tubular aligns with the window and a junction of a secondary wellbore extending from the cased portion of the first wellbore; and 3) positioning a sleeve within the frac window system, the sleeve including: a) a tubular having a first tubular end and a second tubular end; and b) one or more flow control orifices located in a sidewall of the tubular between the first tubular end and the second tubular end such that the flow control orifices restrict a flow of wellbore fluid from the secondary wellbore into the elongated tubular.

G. An isolation sleeve for use with a frac window system, the isolation sleeve including: 1) a tubular having a first tubular end and a second tubular end; and 2) a first high-expansion seal located at least partially along an outer surface of the tubular proximate the first tubular end and a second high-expansion seal located at least partially along the outer surface of the tubular proximate the second tubular end, the first and second high-expansion seals configured to move between a radially retracted state for running the isolation sleeve in hole and a radially expanded state for engaging an inner surface of a frac window system.

H. A well system, the well system including: 1) a first wellbore casing defining an interior annulus and having a window formed there along; 2) a secondary wellbore extending from the window of the first wellbore casing, the first wellbore casing and the secondary wellbore forming a junction; 3) a frac window system disposed within the first wellbore casing at the junction, the frac window system including an elongated tubular having a first end and a second end with an opening defined in a wall of the elongated tubular between the first end and the second end, the wall having an inner surface and an outer surface, wherein the opening in the wall is aligned with the window of the first wellbore casing; and 4) an isolation sleeve positioned within the frac window system, the isolation sleeve including: a) a tubular having a first tubular end and a second tubular end; and b) a first high-expansion seal located at least partially along an outer surface of the tubular proximate the first tubular end and a second high-expansion seal located at least partially along the outer surface of the tubular proximate the second tubular end, the first and second high-expansion seals configured to move between a radially retracted state for running the isolation sleeve in hole and a radially expanded state for engaging the inner surface of the frac window system.

I. A method, the method including: 1) positioning a frac window system in a first wellbore casing defining an interior annulus and having a window formed there along, the frac window system including an elongated tubular having a first end and a second end with an opening defined in a wall of the elongated tubular between the first end and the second end, the wall having an inner surface and an outer surface; 2) orientating the frac window system so that the opening in the elongated tubular aligns with the window and a junction of a secondary wellbore extending from the cased portion of the first wellbore; and 3) positioning an isolation sleeve within the frac window system, the isolation sleeve including: a) a tubular having a first tubular end and a second tubular end; and b) a first high-expansion seal located at least partially along an outer surface of the tubular proximate the first tubular end and a second high-expansion seal located at least partially along the outer surface of the tubular proximate the second tubular end, the first and second high-expansion seals configured to move between a radially retracted state for running the isolation sleeve in hole and a radially expanded state for engaging the inner surface of the frac window system; and 4) moving the first and second high-expansion seals from the radially retracted state to the radially expanded state to engage the inner surface of the frac window system.

J. A whipstock for use with a frac window system, the whipstock including: 1) a housing having a first whipstock end with a contoured surface and a second whipstock end; and 2) one or more high-expansion members located at least partially along an outer surface of the housing the one or more high-expansion members configured to move between a radially retracted state for running the whipstock in hole and a radially expanded state for engaging an inner surface of a frac window system.

K. A well system, the well system including: 1) a first wellbore casing defining an interior annulus and having a window formed there along; 2) a secondary wellbore extending from the window of the first wellbore casing, the first wellbore casing and the secondary wellbore forming a junction; 3) a frac window system disposed within the first wellbore casing at the junction, the frac window system including an elongated tubular having a first end and a second end with an opening defined in a wall of the elongated tubular between the first end and the second end, the wall having an inner surface and an outer surface, wherein the opening in the wall is aligned with the window of the first wellbore casing; and 4) a whipstock positioned within the frac window system, the whipstock including: a) a housing having a first whipstock end with a contoured surface and a second whipstock end; and b) one or more high-expansion members located at least partially along an outer surface of the housing the one or more high-expansion members configured to move between a radially retracted state for running the whipstock in hole and a radially expanded state for engaging an inner surface of a frac window system.

L. A method, the method including: 1) positioning a frac window system in a first wellbore casing defining an interior annulus and having a window formed there along, the frac window system including an elongated tubular having a first end and a second end with an opening defined in a wall of the elongated tubular between the first end and the second end, the wall having an inner surface and an outer surface; 2) orientating the frac window system so that the opening in the elongated tubular aligns with the window and a junction of a secondary wellbore extending from the cased portion of the first wellbore; and 3) positioning a whipstock within the frac window system, the whipstock including: a) a housing having a first whipstock end with a contoured surface and a second whipstock end; and b) one or more high-expansion members located at least partially along an outer surface of the housing the one or more high-expansion members configured to move between a radially retracted state for running the whipstock in hole and a radially expanded state for engaging an inner surface of a frac window system; and 4) moving the one or more high-expansion members from the radially retracted state to the radially expanded state to engage the inner surface of the frac window system.

M. A frac window system, the frac window system including: 1) an elongated tubular having a first end and a second end with an opening defined in a wall of the elongated tubular between the first end and the second end, the wall having an inner surface and an outer surface, wherein the opening in the wall is configured to align with a window of a first wellbore casing; and 2) a spacer window sleeve positioned within the elongated tubular, the spacer window sleeve including a tubular having a first tubular end and a second tubular end with a second opening defined in a second wall of the tubular between the first tubular end and the second tubular end, the second wall having a second inner surface and a second outer surface, wherein the second opening in the second wall is configured to at least partially align with the opening in the wall of the elongated tubular.

N. A well system, the well system including: 1) a first wellbore casing defining an interior annulus and having a window formed there along; 2) a secondary wellbore extending from the window of the first wellbore casing, the first wellbore casing and the secondary wellbore forming a junction; 3) a frac window system disposed within the first wellbore casing at the junction, the frac window system including: a) an elongated tubular having a first end and a second end with an opening defined in a wall of the elongated tubular between the first end and the second end, the wall having an inner surface and an outer surface, wherein the opening in the wall is configured to align with a window of a first wellbore casing; and b) a spacer window sleeve positioned within the elongated tubular, the spacer window sleeve including a tubular having a first tubular end and a second tubular end with a second opening defined in a second wall of the tubular between the first tubular end and the second tubular end, the second wall having a second inner surface and a second outer surface, wherein the second opening in the second wall is configured to at least partially align with the opening in the wall of the elongated tubular.

O. A wellbore stimulation method, the method including: positioning a frac window system in a first wellbore casing defining an interior annulus and having a window formed there along, the frac window system including: 1) an elongated tubular having a first end and a second end with an opening defined in a wall of the elongated tubular between the first end and the second end, the wall having an inner surface and an outer surface, wherein the opening in the wall is configured to align with a window of a first wellbore casing; and 2) a spacer window sleeve positioned within the elongated tubular, the spacer window sleeve including a tubular having a first tubular end and a second tubular end with a second opening defined in a second wall of the tubular between the first tubular end and the second tubular end, the second wall having a second inner surface and a second outer surface, wherein the second opening in the second wall is configured to at least partially align with the opening in the wall of the elongated tubular.

Aspects A, B, C, D, E, F, G, H, I, J, K, L, M, N, and O may have one or more of the following additional elements in combination: Element 1: wherein the elongated tubular has an inside diameter ($ID_3$), and further wherein the inside diameter ($ID_1$) of the polished bore receptacle is greater than the inside diameter ($ID_3$) of the elongated tubular. Element 2: wherein the inside diameter ($ID_1$) of the polished bore receptacle is at least 5½". Element 3: wherein the inside diameter ($ID_1$) of the polished bore receptacle is at least 7". Element 4: wherein the polished bore receptacle is capable of withstanding the stresses of stimulating at a pressure of above 5,000-psi. Element 5: wherein the polished bore receptacle is capable of withstanding the stresses of stimulating at a pressure of at least 10,000-psi. Element 6: wherein the polished bore receptacle is capable of withstanding the stresses of stimulating at a pressure of over 12,500-psi. Element 7: wherein the polished bore receptacle is capable of withstanding the stresses of stimulating at a pressure of 15,000-psi. Element 8: wherein a length ($L_1$) of the polished bore receptacle is at least two times the inside diameter ($ID_1$) of the polished bore receptacle. Element 9: wherein the polished bore receptacle comprises at least a 125-ksi grade material. Element 10: wherein the high-pressure frac string is an extremely high-pressure frac string. Element 11: wherein the high-pressure frac string is a super high-pressure frac string. Element 12: wherein the high-pressure frac string has an inside diameter ($ID_5$) of at least 5½". Element 13: further including a whipstock positioned within the frac window system proximate the junction. Element 14: further including a straddle stimulation tool extending through the window into the secondary wellbore. Element 15: further including one or more debris barrier layers located proximate an uphole surface of the straddle stimulation tool. Element 16: wherein the straddle stimulation tool has one or more sealing elements along its outer surface, and further including one or more protective sheaths at least partially covering the one or more sealing elements. Element 17: further including coupling a high-pressure frac string with the polished bore receptacle. Element 18: further including stimulating the secondary wellbore through the high-pressure frac string. Element 19: further including stimulating the first wellbore through the high-pressure frac string. Element 20: further including passing a wellbore device having an outside diameter (OD) of at least 5½" through the high-pressure frac string and into at least one of the first wellbore or the secondary wellbore. Element 21: wherein the wellbore device is a wellbore plug. Element 22: wherein the wellbore device is an isolation sleeve. Element 23: wherein the wellbore device is a whipstock. Element 24: wherein the wellbore device is a straddle stimulation tool. Element 25: wherein the wellbore device is a frac plug. Element 26: further including two or more flow control orifices located in the sidewall of the tubular between the first tubular end and the second tubular end. Element 27: further including an uphole seal located at least partially along an outer surface of the tubular proximate the first tubular end and a downhole seal located at least partially along the outer surface of the tubular proximate the second tubular end. Element 28: wherein the uphole seal is a first uphole seal and the downhole seal is a first downhole seal, and further including a second uphole seal located at least partially along the outer surface of the tubular proximate the first tubular end and a second downhole seal located at least partially along the outer surface of the tubular proximate the second tubular end. Element 29: further including a depth mechanism disposed at least partially along the outer surface of the tubular, the depth mechanism configured to engage a related depth mechanism disposed along an inner surface of a frac window system. Element 30: wherein the depth mechanism is positioned between the uphole seal and the first tubular end. Element 31: wherein an outside diameter ($OD_s$) of the tubular is at least 5.5". Element 32: wherein the one or more flow control orifices are located proximate the junction. Element 33: wherein the one or more flow control orifices are located between opposing edges of the window. Element 34: wherein positioning the sleeve includes positioning the sleeve such that the one or more flow control orifices are located proximate the junction. Element 35: wherein positioning the sleeve includes positioning the sleeve such that the one or more flow control orifices are located between opposing edges of the window. Element 36: further including removing the sleeve and positioning a second sleeve within the frac window system, the second sleeve having a different number or size of one or more second flow control orifices than the sleeve. Element 37: further including a depth mechanism disposed at least partially along the outer surface of the tubular, the depth mechanism configured to engage a related depth mechanism disposed along an inner surface of the frac window system. Element 38: wherein the depth mechanism is positioned between the first high-expansion seal and the first tubular end. Element 39: wherein the first high-expansion seal and the second high-expansion seal are spaced such that they span a junction between a first wellbore and a secondary wellbore that the frac window system is located. Element 40: wherein the first and second seals are located in the radially retracted state such that they do not engage the inner surface of the frac window system. Element 41: wherein the first and second seals are located in the radially expanded state such that they engage the inner surface of the frac window system. Element 42: wherein the first and second high-expansion seals can seal a frac pressure of at least 5,000-psi. Element 43: wherein the first and second high-expansion seals can seal a frac pressure of at least 10,000-psi. Element 44: wherein the first and second high-expansion seals can seal a frac pressure of at least 12,500-psi. Element 45: further including stimulating a first wellbore associated with the first wellbore casing through the isolation sleeve while the isolation sleeve isolates the secondary wellbore. Element 46: wherein stimulating includes stimulating with a frac pressure of at least 5,000-psi. Element 47: wherein stimulating includes stimulating with a frac pressure of at least 10,000-psi. Element 48: wherein stimulating includes stimulating with a frac pressure of at least 12,500-psi. Element 49: wherein the one or more high-expansion members are one or more scissor type high-expansion members. Element 50: wherein the one or more high-expansion members each have a plurality of teeth for engaging the inner surface of the frac window system.

Element 51: wherein the whipstock is a neckless whipstock. Element 52: wherein the whipstock is necked or extended necked whipstock. Element 53: further including a depth mechanism disposed at least partially along the outer surface of the housing, the depth mechanism configured to engage a related depth mechanism disposed along an inner surface of the frac window system. Element 54: wherein the depth mechanism is positioned between the one or more high-expansion members and the second whipstock end. Element 55: wherein the one or more high-expansion members are located in the radially retracted state such that they do not engage the inner surface of the frac window system. Element 56: wherein the one or more high-expansion members are located in the radially expanded state such that they engage the inner surface of the frac window system. Element 57: wherein the spacer window sleeve further includes an orientation device. Element 58: wherein the orientation device is a muleshoe. Element 59: wherein the muleshoe is located proximate the first tubular end. Element 60: wherein the muleshoe is located between the second opening and the second tubular end. Element 61: wherein the spacer window sleeve further includes an uphole seal located at least partially along an outer surface of the tubular proximate the first tubular end and a downhole seal located at least partially along the outer surface of the tubular proximate the second tubular end. Element 62: wherein the uphole seal is a first uphole seal and the downhole seal is a first downhole seal, and further including a second uphole seal located at least partially along the outer surface of the tubular proximate the first tubular end and a second downhole seal located at least partially along the outer surface of the tubular proximate the second tubular end. Element 63: further including an isolation sleeve positioned within the spacer window sleeve. Element 64: further including orientating the frac window system so that the opening in the elongated tubular aligns with a junction of a secondary wellbore extending from the cased portion of the first wellbore.

Those skilled in the art to which this application relates will appreciate that other and further additions, deletions, substitutions, and modifications may be made to the described embodiments.

What is claimed is:

1. A frac window system, comprising:

an elongated tubular having a first end and a second end with an opening defined in a wall of the elongated tubular between the first end and the second end, the wall having an inner surface and an outer surface, wherein the opening in the wall is configured to align with a window of a first wellbore casing, the elongated tubular having an elongated tubular engagement mechanism along an outer surface thereof, the elongated tubular engagement mechanism configured to engage with an engagement mechanism of the first wellbore casing proximate the window of the first wellbore casing; and a spacer window sleeve positioned within and removably coupled with the elongated tubular, the spacer window sleeve including a tubular having a first tubular end and a second tubular end with a second opening defined in a second wall of the tubular between the first tubular end and the second tubular end, the second wall having a second inner surface and a second outer surface, wherein the second opening in the second wall is configured to at least partially align with the opening in the wall of the elongated tubular.

2. The frac window system as recited in claim 1, wherein the spacer window sleeve further includes an orientation device.

3. The frac window system as recited in claim 2, wherein the orientation device is a muleshoe.

4. The frac window system as recited in claim 3, wherein the muleshoe is located proximate the first tubular end.

5. The frac window system as recited in claim 3, wherein the muleshoe is located between the second opening and the second tubular end.

6. The frac window system as recited in claim 1, wherein the spacer window sleeve further includes an uphole seal located at least partially along an outer surface of the tubular proximate the first tubular end and a downhole seal located at least partially along the outer surface of the tubular proximate the second tubular end.

7. The frac window system as recited in claim 6, wherein the uphole seal is a first uphole seal and the downhole seal is a first downhole seal, and further including a second uphole seal located at least partially along the outer surface of the tubular proximate the first tubular end and a second downhole seal located at least partially along the outer surface of the tubular proximate the second tubular end.

8. The frac window system as recited in claim 1, further including an isolation sleeve positioned within the spacer window sleeve.

9. A well system, comprising:

a first wellbore casing defining an interior annulus and having a window formed there along;

a secondary wellbore extending from the window of the first wellbore casing, the first wellbore casing and the secondary wellbore forming a junction;

a frac window system disposed within the first wellbore casing at the junction, the frac window system including:

an elongated tubular having a first end and a second end with an opening defined in a wall of the elongated tubular between the first end and the second end, the wall having an inner surface and an outer surface, wherein the opening in the wall is configured to align with a window of a first wellbore casing, the elongated tubular having an elongated tubular engagement mechanism along an outer surface thereof, the elongated tubular engagement mechanism configured to engage with an engagement mechanism of the first wellbore casing proximate the window of the first wellbore casing; and a spacer window sleeve positioned within and removably coupled with the elongated tubular, the spacer window sleeve including a tubular having a first tubular end and a second tubular end with a second opening defined in a second wall of the tubular between the first tubular end and the second tubular end, the second wall having a second inner surface and a second outer surface, wherein the second opening in the second wall is configured to at least partially align with the opening in the wall of the elongated tubular.

10. The well system as recited in claim 9, wherein the spacer window sleeve further includes an orientation device.

11. The well system as recited in claim 10, wherein the orientation device is a muleshoe.

12. The well system as recited in claim 11, wherein the muleshoe is located proximate the first tubular end.

13. The well system as recited in claim 11, wherein the muleshoe is located between the second opening and the second tubular end.

14. The well system as recited in claim 9, wherein the spacer window sleeve further includes an uphole seal located at least partially along an outer surface of the tubular proximate the first tubular end and a downhole seal located at least partially along the outer surface of the tubular proximate the second tubular end.

15. The well system as recited in claim 14, wherein the uphole seal is a first uphole seal and the downhole seal is a first downhole seal, and further including a second uphole seal located at least partially along the outer surface of the tubular proximate the first tubular end and a second downhole seal located at least partially along the outer surface of the tubular proximate the second tubular end.

16. The well system as recited in claim 9, further including an isolation sleeve positioned within the spacer window sleeve.

17. A wellbore stimulation method, comprising:

positioning a frac window system in a first wellbore casing defining an interior annulus and having a window formed there along, the frac window system including:

an elongated tubular having a first end and a second end with an opening defined in a wall of the elongated tubular between the first end and the second end, the wall having an inner surface and an outer surface, wherein the opening in the wall is configured to align with a window of a first wellbore casing, the elongated tubular having an elongated tubular engagement mechanism along an outer surface thereof, the elongated tubular engagement mechanism configured to engage with an engagement mechanism of the first wellbore casing proximate the window of the first wellbore casing; and a spacer window sleeve positioned within and removably coupled with the elongated tubular, the spacer window sleeve including a tubular having a first tubular end and a second tubular end with a second opening defined in a second wall of the tubular between the first tubular end and the second tubular end, the second wall having a second inner surface and a second outer surface, wherein the second opening in the second wall is configured to at least partially align with the opening in the wall of the elongated tubular.

18. The method as recited in claim 17, wherein the spacer window sleeve further includes an orientation device.

19. The method as recited in claim 18, wherein the orientation device is a muleshoe.

20. The method as recited in claim 19, wherein the muleshoe is located proximate the first tubular end.

21. The method as recited in claim 19, wherein the muleshoe is located between the second opening and the second tubular end.

22. The method as recited in claim 17, wherein the spacer window sleeve further includes an uphole seal located at least partially along an outer surface of the tubular proximate the first tubular end and a downhole seal located at least partially along the outer surface of the tubular proximate the second tubular end.

23. The method as recited in claim 22, wherein the uphole seal is a first uphole seal and the downhole seal is a first downhole seal, and further including a second uphole seal located at least partially along the outer surface of the tubular proximate the first tubular end and a second downhole seal located at least partially along the outer surface of the tubular proximate the second tubular end.

24. The method as recited in claim 17, further including positioning an isolation sleeve within the spacer window sleeve.

25. The method as recited in claim 17, further including orientating the frac window system so that the opening in the elongated tubular aligns with a junction of a secondary wellbore extending from the cased portion of the first wellbore.

* * * * *